US009752406B2

(12) United States Patent
Hardesty et al.

(10) Patent No.: US 9,752,406 B2
(45) Date of Patent: Sep. 5, 2017

(54) WELLBORE PLUG ISOLATION SYSTEM AND METHOD

(71) Applicant: GEODynamics, Inc., Millsap, TX (US)

(72) Inventors: John T. Hardesty, Weatherford, TX (US); Philip M. Snider, Tomball, TX (US); David S. Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 14/732,391

(22) Filed: Jun. 5, 2015

(65) Prior Publication Data

US 2016/0047199 A1 Feb. 18, 2016

Related U.S. Application Data

(63) Continuation-in-part of application No. 14/459,042, filed on Aug. 13, 2014, now Pat. No. 9,062,543.
(Continued)

(51) Int. Cl.
*E21B 33/12* (2006.01)
*E21B 43/14* (2006.01)
(Continued)

(52) U.S. Cl.
CPC ..... *E21B 33/1208* (2013.01); *E21B 33/12* (2013.01); *E21B 43/116* (2013.01);
(Continued)

(58) Field of Classification Search
CPC ..... E21B 43/26; E21B 43/116; E21B 33/13
See application file for complete search history.

(56) References Cited

U.S. PATENT DOCUMENTS 2,732,195 A * 1/1956 Ljungström ..... C10G 1/00 166/278
2,754,910 A 7/1956 Derrick et al.
(Continued)

FOREIGN PATENT DOCUMENTS

WO 2014062200 A1 4/2014
WO 2014098903 A1 6/2014

OTHER PUBLICATIONS

ISA/US, International Search Report and Written Opinion for PCT/US2015/031841 dated Aug. 5, 2015.
(Continued)

*Primary Examiner* — Zakiya W Bates
*Assistant Examiner* — Crystal J Miller
(74) *Attorney, Agent, or Firm* — David W. Carstens; Sudhakar V. Allada; Carstens & Cahoon, LLP

(57) ABSTRACT

A wellbore plug isolation system and method for positioning plugs to isolate fracture zones in a horizontal, vertical, or deviated wellbore is disclosed. The system/method includes a wellbore casing laterally drilled into a hydrocarbon formation, a wellbore setting tool (WST) that sets a large inner diameter (ID) restriction sleeve member (RSM), and a restriction plug element (RPE). The RPE includes a first composition and a second composition that changes phase or strength under wellbore conditions. After a stage is perforated, RPEs are deployed to isolate toe ward pressure communication. The second composition changes phase to create flow channels in the RPE during production. In an alternate system/method, the second composition changes phase or strength thereby deforming the RPE to reduce size and pass through the RSM's. The RPEs are removed or left behind prior to initiating well production without the need for a milling procedure.

29 Claims, 84 Drawing Sheets

Related U.S. Application Data

(60) Provisional application No. 62/081,399, filed on Nov. 18, 2014.

(51) Int. Cl.
*E21B 43/26* (2006.01)
*E21B 43/116* (2006.01)
*E21B 33/10* (2006.01)

(52) U.S. Cl.
CPC ..... *E21B 43/14* (2013.01); *E21B 43/26* (2013.01); *E21B 2033/105* (2013.01)

(56) References Cited

U.S. PATENT DOCUMENTS 2,780,450 A * 2/1957 Ljungstrom ..... E21B 43/2401 166/258
2,849,070 A 8/1958 Maly
2,906,123 A 9/1959 Vernet et al.
2,923,535 A * 2/1960 Ljungstrom ..... E21B 43/2401 166/245
3,072,189 A * 1/1963 MacSporran ..... E21B 36/02 166/250.15
3,103,973 A * 9/1963 Mullen ..... C09K 8/42 166/288
3,208,530 A * 9/1965 Allen ..... E21B 33/1204 166/123
3,832,243 A 8/1974 Donkersloot et al.
4,424,865 A 1/1984 Payton, Jr.
4,515,213 A 5/1985 Rogen et al.
4,681,159 A * 7/1987 Allwin ..... E21B 17/06 166/124
5,040,283 A 8/1991 Pelgrom
5,070,788 A 12/1991 Carisella et al.
5,159,145 A 10/1992 Carisella et al.
6,474,414 B1 * 11/2002 Gonzalez ..... E21B 33/14 166/192
6,828,531 B2 * 12/2004 Spencer ..... E21B 33/13 166/304
6,923,263 B2 * 8/2005 Eden ..... C09K 8/42 166/179
6,942,032 B2 * 9/2005 La Rovere ..... E21B 33/14 166/288
7,258,169 B2 * 8/2007 Fripp ..... E21B 41/0085 166/302
7,290,609 B2 * 11/2007 Wardlaw ..... E21B 36/008 166/192
7,350,582 B2 4/2008 McKeachnie et al.
7,625,846 B2 12/2009 Cooke, Jr.
7,647,964 B2 1/2010 Akbar et al.
7,735,567 B2 6/2010 O'Malley et al.
7,743,825 B2 * 6/2010 O'Malley ..... E21B 33/1208 166/179
7,886,825 B2 * 2/2011 Van Hal ..... E21B 36/008 166/300
8,025,104 B2 * 9/2011 Cooke, Jr. ..... C09K 8/508 166/317
8,178,476 B2 5/2012 Xie et al.
8,191,644 B2 6/2012 Rytlewski et al.
8,215,385 B2 * 7/2012 Cooke, Jr. ..... C09K 8/508 166/227
8,276,670 B2 10/2012 Patel
8,283,174 B2 * 10/2012 Van Hal ..... E21B 36/008 166/250.1
8,342,240 B2 1/2013 Richard et al.
8,439,108 B2 * 5/2013 Cooke, Jr. ..... C09K 8/508 166/227
8,485,265 B2 7/2013 Marya et al.
8,622,133 B2 * 1/2014 Kaminsky ..... E21B 36/04 166/302
8,726,991 B2 5/2014 Boney
8,905,147 B2 12/2014 Fripp et al.
9,062,543 B1 6/2015 Snider et al.
9,068,428 B2 6/2015 Mazyar et al.
9,080,098 B2 7/2015 Xu et al.
2002/0060071 A1 * 5/2002 Grundmann ..... E21B 43/267 166/288
2003/0132224 A1 * 7/2003 Spencer ..... E21B 33/13 219/635
2003/0164237 A1 9/2003 Butterfield, Jr.
2004/0149443 A1 * 8/2004 La Rovere ..... E21B 33/14 166/302
2004/0231845 A1 * 11/2004 Cooke, Jr. ..... C09K 8/508 166/279
2005/0109511 A1 * 5/2005 Spencer ..... E21B 33/13 166/302
2005/0211436 A1 * 9/2005 Fripp ..... E21B 41/0085 166/302
2006/0144591 A1 * 7/2006 Gonzalez ..... E21B 29/10 166/277
2007/0034267 A1 2/2007 Partridge
2007/0107908 A1 5/2007 Vaidya et al.
2007/0169935 A1 * 7/2007 Akbar ..... E21B 33/138 166/284
2007/0225175 A1 * 9/2007 Cooke ..... C09K 8/508 507/219
2007/0240885 A1 * 10/2007 O'Mally ..... E21B 33/1208 166/387
2008/0015120 A1 * 1/2008 Cooke ..... C09K 8/508 507/219
2008/0066904 A1 * 3/2008 Van Hal ..... E21B 36/008 166/250.1
2008/0115932 A1 * 5/2008 Cooke ..... C09K 8/508 166/250.01
2008/0149345 A1 * 6/2008 Marya ..... E21B 23/00 166/376
2008/0149351 A1 6/2008 Marya et al.
2008/0210423 A1 * 9/2008 Boney ..... C09K 8/68 166/281
2008/0230219 A1 * 9/2008 Kaminsky ..... E21B 36/04 166/248
2009/0101342 A1 4/2009 Gaudette et al.
2009/0255686 A1 * 10/2009 Richard ..... E21B 37/06 166/376
2010/0078173 A1 4/2010 Buytaert et al.
2010/0243242 A1 9/2010 Boney et al.
2010/0270031 A1 * 10/2010 Patel ..... E21B 33/1208 166/376
2010/0294507 A1 11/2010 Tanton
2010/0300675 A1 12/2010 Johnson et al.
2011/0036570 A1 * 2/2011 La Rovere ..... E21B 33/138 166/277
2011/0132609 A1 * 6/2011 Van Hal ..... E21B 49/10 166/300
2011/0132611 A1 6/2011 Rytlewski et al.
2011/0132621 A1 6/2011 Agrawal et al.
2011/0146985 A1 6/2011 Xie et al.
2011/0303423 A1 * 12/2011 Kaminsky ..... E21B 43/2401 166/400
2012/0181032 A1 7/2012 Naedler et al.
2012/0199349 A1 8/2012 Themig et al.
2012/0217021 A1 8/2012 Cravatte et al.
2012/0267101 A1 * 10/2012 Cooke, Jr. ..... C09K 8/508 166/278
2012/0276356 A1 11/2012 Xu et al.
2012/0318513 A1 12/2012 Mazyar et al.
2013/0032357 A1 2/2013 Mazyar et al.
2013/0087334 A1 * 4/2013 Buytaert ..... E21B 17/1014 166/288
2013/0087335 A1 * 4/2013 Carragher ..... E21B 23/00 166/288
2013/0133876 A1 5/2013 Naedler et al.
2013/0133897 A1 5/2013 Baihly et al.
2013/0146302 A1 6/2013 Gaudette et al.
2013/0206425 A1 * 8/2013 Mazyar ..... E21B 33/12 166/376
2013/0284425 A1 10/2013 Agrawal et al.
2013/0327540 A1 * 12/2013 Hamid ..... E21B 33/12 166/376

(56) References Cited

U.S. PATENT DOCUMENTS

| | | | | |
|---|---|---|---|---|
| 2013/0333890 | A1* | 12/2013 | Dagenais | E21B 29/00 166/302 |
| 2014/0027128 | A1* | 1/2014 | Johnson | B22F 1/02 166/376 |
| 2014/0060837 | A1* | 3/2014 | Love | E21B 43/26 166/297 |
| 2014/0069636 | A1* | 3/2014 | Kaminsky | E21B 36/04 166/248 |
| 2014/0069637 | A1* | 3/2014 | Kaminsky | E21B 36/04 166/248 |
| 2014/0190685 | A1 | 7/2014 | Frazier et al. | |
| 2015/0008003 | A1 | 1/2015 | Lafleur | |
| 2015/0060069 | A1 | 3/2015 | Potapenko et al. | |
| 2015/0159462 | A1 | 6/2015 | Cutler | |
| 2016/0258242 | A1 | 9/2016 | Hayter et al. | |

OTHER PUBLICATIONS

ISA/US, International Search Report and Written Opinion for PCT/US2015/043866 mailed Dec. 22, 2015.
ISA/US, International Search Report and Written Opinion for PCT/US2015/043876 dated Jan. 4, 2016.
ISA/US, International Search Report and Written Opinion for PCT/US2015/043871 dated Jan. 4, 2016.
ISA/US, International Search Report and Written Opinion for PCT/US2015/043880 dated Jan. 7, 2016.
ISA/US, International Search Report and Written Opinion for PCT/US2017/025987 dated May 1, 2017.

* cited by examiner

*Prior Art.*

3000

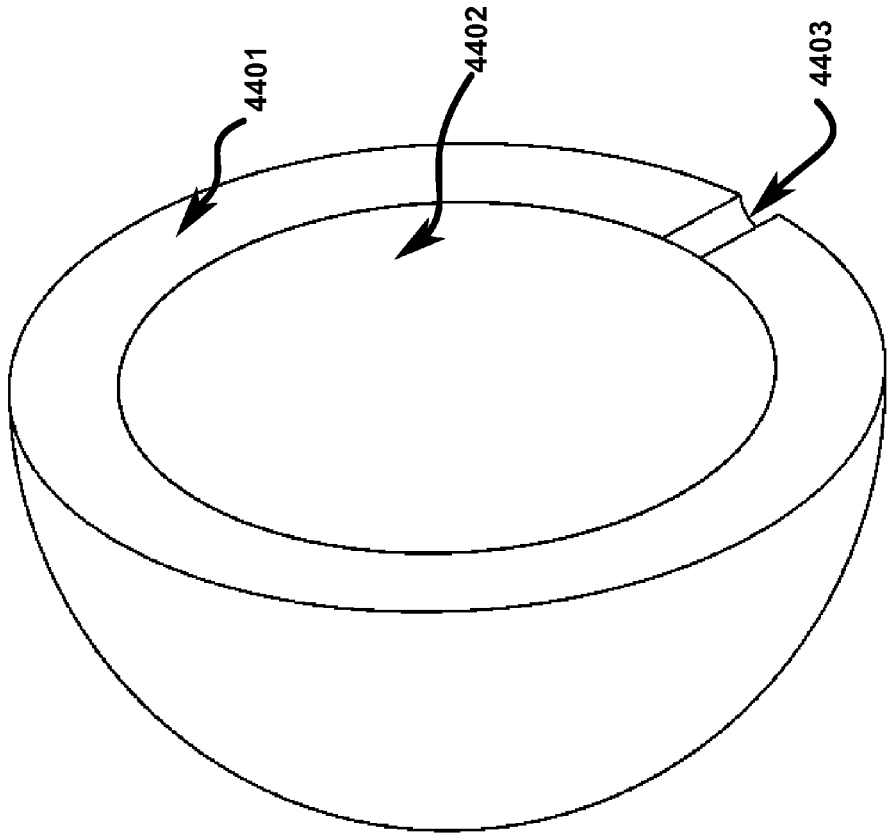
FIG. 45
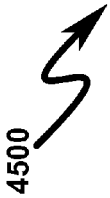

5700

WELLBORE PLUG ISOLATION SYSTEM AND METHOD

CROSS REFERENCE TO RELATED APPLICATIONS

This application claims the benefit of U.S. Provisional Application No. 62/081,399, filed Nov. 18, 2014, and also is a continuation-in-part of application Ser. No. 14/459,042, filed Aug. 13, 2014, now U.S. Pat. No. 9,062,543.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention generally relates to oil and gas extraction. Specifically, the invention attempts to isolate fracture zones through selectively positioning restriction elements within a wellbore casing. More specifically, it relates to restriction plug elements that are insoluble in well fluid but have properties such as phase or strength that vary with temperature so as to change shape to pass through restrictions during production.

PRIOR ART AND BACKGROUND OF THE INVENTION

Prior Art Background

The process of extracting oil and gas typically consists of operations that include preparation, drilling, completion, production and abandonment.

Preparing a drilling site involves ensuring that it can be properly accessed and that the area where the rig and other equipment will be placed has been properly graded. Drilling pads and roads must be built and maintained which includes the spreading of stone on an impermeable liner to prevent impacts from any spills but also to allow any rain to drain properly.

In the drilling of oil and gas wells, a wellbore is formed using a drill bit that is urged downwardly at a lower end of a drill string. After drilling the wellbore is lined with a string of casing. An annular area is thus formed between the string of casing and the wellbore. A cementing operation is then conducted in order to fill the annular area with cement. The combination of cement and casing strengthens the wellbore and facilitates the isolation of certain areas of the formation behind the casing for the production of hydrocarbons.

The first step in completing a well is to create a connection between the final casing and the rock which is holding the oil and gas. There are various operations in which it may become necessary to isolate particular zones within the well. This is typically accomplished by temporarily plugging off the well casing at a given point or points with a plug.

A special tool, called a perforating gun, is lowered to the rock layer. This perforating gun is then fired, creating holes through the casing and the cement and into the targeted rock. These perforated holes connect the rock holding the oil and gas and the wellbore.

Since these perforations are only a few inches long and are performed more than a mile underground, no activity is detectable on the surface. The perforation gun is then removed before the next step, hydraulic fracturing stimulation fluid, which is a mixture of over 90% water and sand, plus a few chemical additives, is pumped under controlled conditions into deep, underground reservoir formations. The chemicals are used for lubrication and to keep bacteria from forming and to carry the sand. These chemicals are typically non-hazardous and range in concentrations from 0.1% to 0.5% by volume and are needed to help improve the performance and efficiency of the hydraulic fracturing. This stimulation fluid is pumped at high pressure out through the perforations made by the perforating gun. This process creates fractures in the shale rock which contains the oil and natural gas.

In many instances a single wellbore may traverse multiple hydrocarbon formations that are otherwise isolated from one another within the earth. It is also frequently desired to treat such hydrocarbon bearing formations with pressurized treatment fluids prior to producing from those formations. In order to ensure that a proper treatment is performed on a desired formation, that formation is typically isolated during treatment from other formations traversed by the wellbore. To achieve sequential treatment of multiple formations, the casing adjacent to the toe of a horizontal, vertical, or deviated wellbore is first perforated while the other portions of the casing are left unperforated. The perforated zone is then treated by pumping fluid under pressure into that zone through perforations. Following treatment a plug is placed adjacent to the perforated zone. The process is repeated until all the zones are perforated. The plugs are particularly useful in accomplishing operations such as isolating perforations in one portion of a well from perforations in another portion or for isolating the bottom of a well from a wellhead. The purpose of the plug is to isolate some portion of the well from another portion of the well.

Conventional prior art frac balls are typically made of a non-metallic material, such as reinforced epoxies and phenolics, that may be removed by milling in the event the balls become stuck. Such conventional prior art frac balls are made of materials that are designed to remain intact when exposed to hydraulic fracturing temperatures and pressures and are not significantly dissolved or degraded by the hydrocarbons or other media present within the well. When one of these prior art balls does not return to the surface and prevents lower balls from purging, coiled tubing must be lowered into the wellbore to mill the stuck ball and remove it from the seat. In addition, smaller-sized prior art balls that are not stuck in their seats still might not return to the surface because the pressure differential across the ball due to the uprising current in the large diameter casing might not be significant enough to overcome gravity. Consequently, while such smaller-sized balls may not completely block a zone, they are still likely to impede production by partially blocking the wellbore.

Subsequently, production of hydrocarbons from these zones requires that the sequentially set plugs be removed from the well. In order to reestablish flow past the existing plugs an operator must remove and/or destroy the plugs by milling, drilling, or dissolving the plugs.

Prior Art System Overview (0100)

As generally seen in the system diagram of FIG. 1 (0100), prior art systems associated with oil and gas extraction may include a wellbore casing (0120) laterally drilled into a wellbore. A plurality of frac plugs (0110, 0111, 0112, 0113) may be set to isolate multiple hydraulic fracturing zones (0101, 0102, 0103). Each frac plug is positioned to isolate a hydraulic fracturing zone from the rest of the unperforated zones. The positions of frac plugs may be defined by preset sleeves in the wellbore casing. For example, frac plug (0111) is positioned such that hydraulic fracturing zone (0101) is isolated from downstream (injection or toe end) hydraulic fracturing zones (0102, 0103). Subsequently, the hydraulic fracturing zone (0101) is perforated using a perforation gun and fractured. Preset plug/sleeve positions in the casing, precludes change of fracture zone locations after a wellbore casing has been installed. Therefore, there is a need to position a plug at a desired location after a wellbore casing has been installed without depending on a predefined sleeve location integral to the wellbore casing to position the plug.

Furthermore, after well completions, sleeves used to set frac plugs may have a smaller inner diameter constricting fluid flow when well production is initiated. Therefore, there is a need for a relatively large inner diameter sleeves after well completion that allow for unrestricted well production fluid flow.

Additionally, frac plugs can be inadvertently set at undesired locations in the wellbore casing creating unwanted constrictions. The constrictions may latch wellbore tools that are run for future operations and cause unwanted removal process. Therefore, there is a need to prevent premature set conditions caused by conventional frac plugs.

Exemplary prior art covering degrading frac plugs includes the following:

U.S. Pat. No. 8,714,268, Method of making and using multi-component disappearing tripping ball; A method for making a tripping ball comprising configuring two or more parts to collectively make up a portion of a tripping ball; and assembling the two or more parts by adhering the two or more parts together with an adherent dissolvable material to form the tripping ball, the adherent dissolvable material operatively arranged to dissolve for enabling the two or more parts to separate from each other;

U.S. Pat. No. 8,231,947, Oilfield elements having controlled solubility and methods of use; Oilfield elements are described, one embodiment comprising a combination of a normally insoluble metal with an element selected from a second metal, a semi-metallic material, and non-metallic materials; and one or more solubility-modified high strength and/or high-toughness polymeric materials selected from polyamides, polyethers, and liquid crystal polymers;

U.S. Pat. No. 8,567,494, Well operating elements comprising a soluble component and methods of use; comprising a first component that is substantially non-dissolvable when exposed to a selected wellbore environment and a second component that is soluble in the selected wellbore environment and whose rate and/or location of dissolution is at least partially controlled by structure of the first component; A second embodiment includes the component that is soluble in the selected wellbore environment, and one or more exposure holes or passages in the soluble component to control its solubility;

US 20120181032, Disintegrating ball for sealing frac plug seat; A composition for a ball that disintegrates, dissolves, delaminates or otherwise experiences a significant degradation of its physical properties over time in the presence of hydrocarbons and formation heat;

U.S. Pat. No. 8,657,018, Circulating sub; teaches erodible hollow balls in the fluid flow and more particularly is adapted to be eroded to a certain extent and then collapse or implode due to the pressure of the external fluid being far higher than the internal pressure of the ball;

The aforementioned prior art teach frac balls that degrade, unlink, dissolve, and erode in the presence of wellbore fluids. However, they do not teach any methodology by which frac balls change shape by melting, phase change, strength, or elasticity to address a wide variety of system applications, including but not limited to wellbore plug isolation.

Prior Art Method Overview (0200)

As generally seen in the method of FIG. 2 (0200), prior art associated with oil and gas extraction includes site preparation and installation of a wellbore casing (0120) (0201). Preset sleeves may be installed as an integral part of the wellbore casing (0120) to position frac plugs for isolation. After setting a frac plug and isolating a hydraulic fracturing zone in step (0202), a perforating gun is positioned in the isolated zone in step (0203). Subsequently, the perforating gun detonates and perforates the wellbore casing and the cement into the hydrocarbon formation. The perforating gun is next moved to an adjacent position for further perforation until the hydraulic fracturing zone is completely perforated. In step (0204), hydraulic fracturing fluid is pumped into the perforations at high pressures. The steps comprising of setting up a plug (0202), isolating a hydraulic fracturing zone, perforating the hydraulic fracturing zone (0203) and pumping hydraulic fracturing fluids into the perforations (0204), are repeated until all hydraulic fracturing zones in the wellbore casing are processed. In step (0205), if all hydraulic fracturing zones are processed, the plugs are milled out with a milling tool and the resulting debris is pumped out or removed from the wellbore casing (0206). In step (0207) hydrocarbons are produced by pumping out from the hydraulic fracturing stages.

The step (0206) requires that removal/milling equipment be run into the well on a conveyance string which may typically be wire line, coiled tubing or jointed pipe. The process of perforating and plug setting steps represent a separate "trip" into and out of the wellbore with the required equipment. Each trip is time consuming and expensive. In addition, the process of drilling and milling the plugs creates debris that needs to be removed in another operation. Therefore, there is a need for isolating multiple hydraulic fracturing zones without the need for a milling operation. Furthermore, there is a need for positioning restrictive plug elements that could be removed in a feasible, economic, and timely manner before producing gas.

Deficiencies in the Prior Art

The prior art as detailed above suffers from the following deficiencies:

- Prior art systems do not provide for positioning a ball seat at a desired location after a wellbore casing has been installed, without depending on a predefined sleeve location integral to the wellbore casing to position the plug.
- Prior art systems do not provide for isolating multiple hydraulic fracturing zones without the need for a milling operation.
- Prior art systems do not provide for positioning restrictive elements that could be removed in a feasible, economic, and timely manner.
- Prior art systems do not provide for setting larger inner diameter sleeves to allow unrestricted well production fluid flow.
- Prior art systems cause undesired premature preset conditions preventing further wellbore operations.

While some of the prior art may teach some solutions to several of these problems, the core issue of isolating hydraulic fracturing zones without the need for a milling operation has not been addressed by prior art.

Deficiencies in the Prior Art for Restriction Plug Elements

While the use of degradable/dissolvable frac balls has been proven for many years, they have certain limitations. The prior art as detailed above suffers from the following deficiencies:

- Prior art systems do not provide for restriction plug elements (frac balls) comprising meltable eutectic alloys that change phase due to wellbore temperature.
- Prior art systems do not provide for restriction plug elements (frac balls) comprising compositions that change strength due to wellbore temperature.
- Prior art systems do not provide for restriction plug elements comprising meltable material that melts to create flow passages.
- Prior art systems do not provide for restriction plug elements held together by an un-bonded mechanical insert.
- Prior art systems do not provide for restriction plug elements with a cooling flow channel to keep the plug in solid state before liquefying.
- Prior art systems do not provide for restriction sleeve member with a cooling flow channel to retain a restriction plug element in solid state before liquefying in the presence of wellbore fluids.
- Prior art systems do not provide for restriction plug elements with dual chambers comprising a meltable eutectic alloy in one chamber that melts to deform and distort the plug element.
- Prior art methods do not provide for effectively reducing overall cycle time for stage fracturing.
- Prior art systems do not provide for cost effective restriction plug elements.
- Prior art systems require an acidic environment to degrade frac balls.
- Prior art systems that use PGA frac balls erode or pit wellbore casing.
- Prior art methods have no control on the amount of exposure of the frac balls to wellbore and frac fluids.

While some of the prior art may teach some solutions to several of these problems, the core issue of removing reduced size plugs after changing phase to pass through the restriction sleeve members (ball seats) without the need for milling operation has not been addressed by prior art.

OBJECTIVES OF THE INVENTION

Accordingly, the objectives of the present invention are (among others) to circumvent the deficiencies in the prior art and affect the following objectives:

- Provide for positioning a ball seat at a desired location after a wellbore casing has been installed, without depending on a predefined sleeve location integral to the wellbore casing to position the plug.
- Provide for isolating multiple hydraulic fracturing zones without the need for a milling operation.
- Provide for positioning restrictive elements that could be removed in a feasible, economic, and timely manner.
- Provide for setting larger inner diameter sleeves to allow unrestricted well production fluid flow.
- Provide for eliminating undesired premature preset conditions that prevent further wellbore operations.
- Provide for restriction plug elements (frac balls) comprising meltable eutectic alloys that change phase due to wellbore temperature.
- Provide for restriction plug elements (frac balls) comprising meltable eutectic alloys that change strength due to wellbore temperature.
- Provide for restriction plug elements comprising meltable material that melts to create flow passages or flow channels.
- Provide for restriction plug elements held together by an un-bonded mechanical insert.
- Provide for restriction plug elements with a cooling flow channel to keep the plug in solid state before liquefying.
- Provide for restriction sleeve member with a cooling flow channel to retain a restriction plug element in solid state before liquefying in the presence of wellbore fluids.
- Provide for restriction plug elements with dual chambers comprising a meltable eutectic alloy in one chamber that melts to deform and distort the plug element.
- Provide for effectively reducing overall cycle time for stage fracturing.
- Provide for a cost effective restriction plug elements
- Provide for restriction plug elements that do not require an acidic environment to degrade frac balls.
- Provide for restriction plug elements that do not erode or pit wellbore casing.
- Provide for controlling the amount of exposure of the frac balls to wellbore and frac fluids.
- Provide for restriction plug elements that are independent of the composition of the wellbore fluids Ph or chemical reactivity While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention in various embodiments addresses one or more of the above objectives in the following manner.

The present invention provides a system to isolate fracture zones in a horizontal, vertical, or deviated wellbore without the need for a milling operation. The system includes a wellbore casing laterally drilled into a hydrocarbon formation, a setting tool that sets a large inner diameter (ID) restriction sleeve member (RSM), and a restriction plug element (RPE). A setting tool deployed on a wireline or coil tubing into the wellbore casing sets and seals the RSM at a desired wellbore location. The setting tool forms a conforming seating surface (CSS) in the RSM. The CSS is shaped to engage/receive RPE deployed into the wellbore casing. The engaged/seated RPE isolates toe ward and heel ward fluid communication of the RSM to create a fracture zone. The RPEs are removed or pumped out or left behind without the need for a milling operation. A large ID RSM diminishes flow constriction during oil production.

Restriction Plug Element Integrated with a Heating Insert

Overview

A restriction plug element (RPE) for use in a wellbore casing comprising a first composition and a heating insert wherein the first composition is non-dissolvable at temperatures expected in said wellbore casing. The heating insert is configured with heating source that is configured to generate heat. When said heating source generates heat upon activation, the first composition changes physical property such that the restriction plug element changes shape to enable substantially unrestricted fluid flow fluid flow in the wellbore casing during production

Method Overview

The present invention system may be utilized in the context of an overall gas extraction method, wherein the wellbore plug isolation system described previously is controlled by a method having the following steps:

(1) installing the wellbore casing;
(2) deploying the WST along with the RSM and a perforating gun string assembly (GSA) to a desired wellbore location in the wellbore casing;
(3) setting the RSM at the desired wellbore location with the WST and forming a seal;
(4) perforating the hydrocarbon formation with the perforating GSA;
(5) removing the WST and perforating GSA from the wellbore casing;
(6) deploying the RPE into the wellbore casing to seat in the RSM and creating a hydraulic fracturing stage;
(7) fracturing the stage with fracturing fluids;
(8) checking if all hydraulic fracturing stages in the wellbore casing have been completed, if not so, proceeding to the step (2);
(9) enabling fluid flow in production direction; and
(10) commencing oil and gas production from the hydraulic fracturing stages.

Integration of this and other preferred exemplary embodiment methods in conjunction with a variety of preferred exemplary embodiment systems described herein in anticipation by the overall scope of the present invention.

Restriction Plug Element System Overview

The present invention in various embodiments addresses one or more of the above objectives in the following manner. The present invention provides a system to isolate fracture zones in a horizontal, vertical, or deviated wellbore without the need for a milling operation. The system includes a wellbore casing laterally drilled into a hydrocarbon formation, a wellbore setting tool (WST) that sets a large inner diameter (ID) restriction sleeve member (RSM), and a restriction plug element (RPE). The RPE includes a first composition and a second composition that changes phase or strength under wellbore conditions. After a stage is perforated, RPEs are deployed to isolate toe ward pressure communication. The second composition changes phase to create flow channels in the RPE during production. In an alternate system/method, the second composition changes phase or strength thereby deforming the RPE to reduce size and pass through the RSM's. The RPEs are removed or left behind prior to initiating well production without the need for a milling procedure.

Restriction Plug Element Method Overview

The present invention system may be utilized in the context of an overall gas extraction method, wherein the wellbore plug isolation system with a restriction plug element described previously is controlled by a method having the following steps:

(1) installing the wellbore casing;
(2) deploying the WST along with the RSM and a perforating gun string assembly (GSA) to a desired wellbore location in the wellbore casing;
(3) setting the RSM at the desired wellbore location with the WST and forming a seal;
(4) perforating the hydrocarbon formation with the perforating GSA;
(5) removing the WST and perforating GSA from the wellbore casing;
(6) deploying the RPE into the wellbore casing to seat in the RSM and creating a hydraulic fracturing stage;
(7) fracturing the stage with fracturing fluids;
(8) checking if all hydraulic fracturing stages in the wellbore casing have been completed, if not so, proceeding to the step (2);
(9) enabling fluid flow in production direction; and
(10) commencing oil and gas production from the hydraulic fracturing stages.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein:

FIG. 45 illustrates a perspective view of a restriction plug element with a first composition surrounding a second composition with a passage way according to a preferred exemplary system embodiment.

DESCRIPTION OF THE PRESENTLY PREFERRED EXEMPLARY EMBODIMENTS

Figure 1:
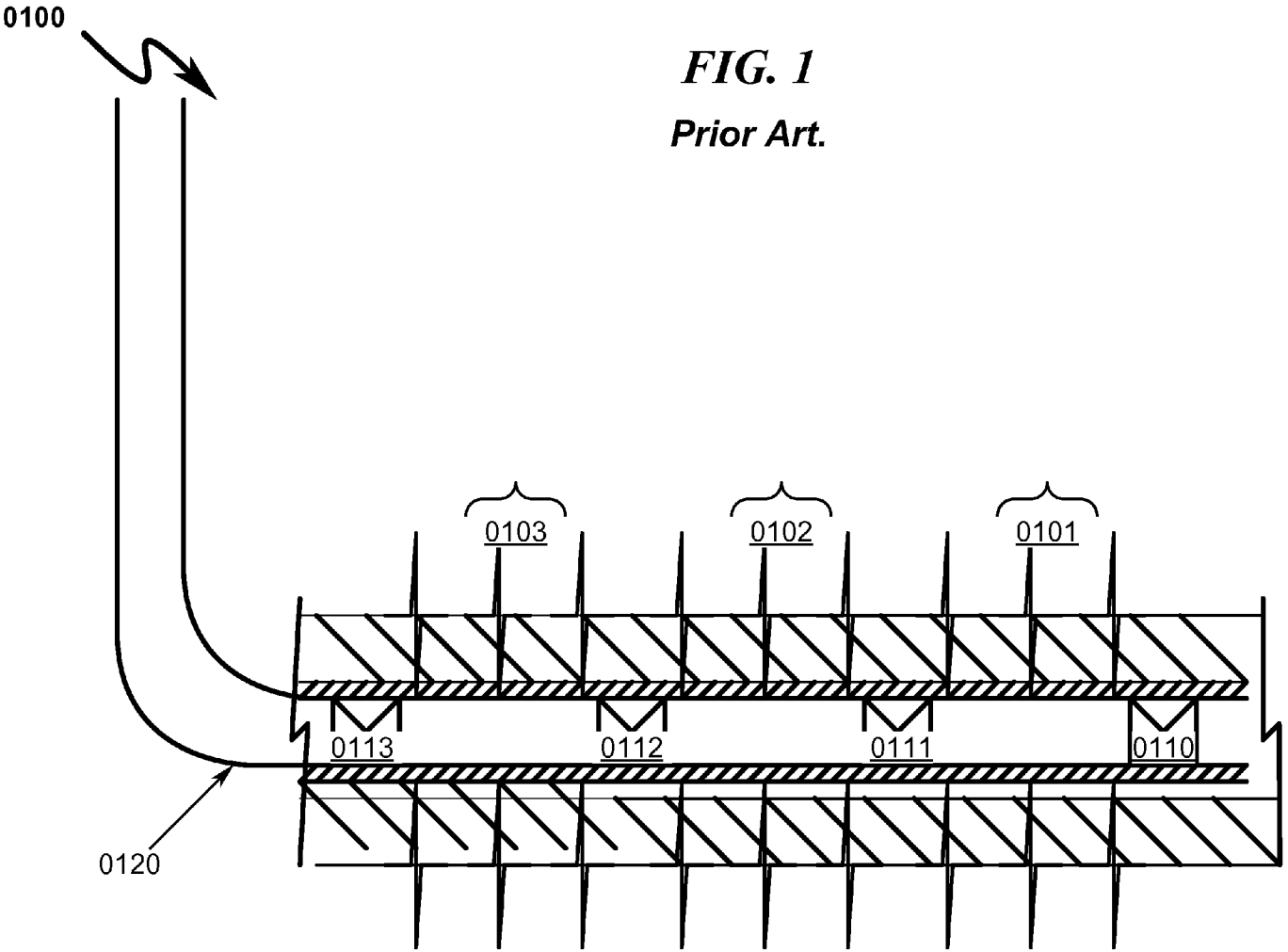
FIG. 1 Prior Art.
FIG. 1 illustrates a system block overview diagram describing how prior art systems use plugs to isolate hydraulic fracturing zones.
Figure 2:
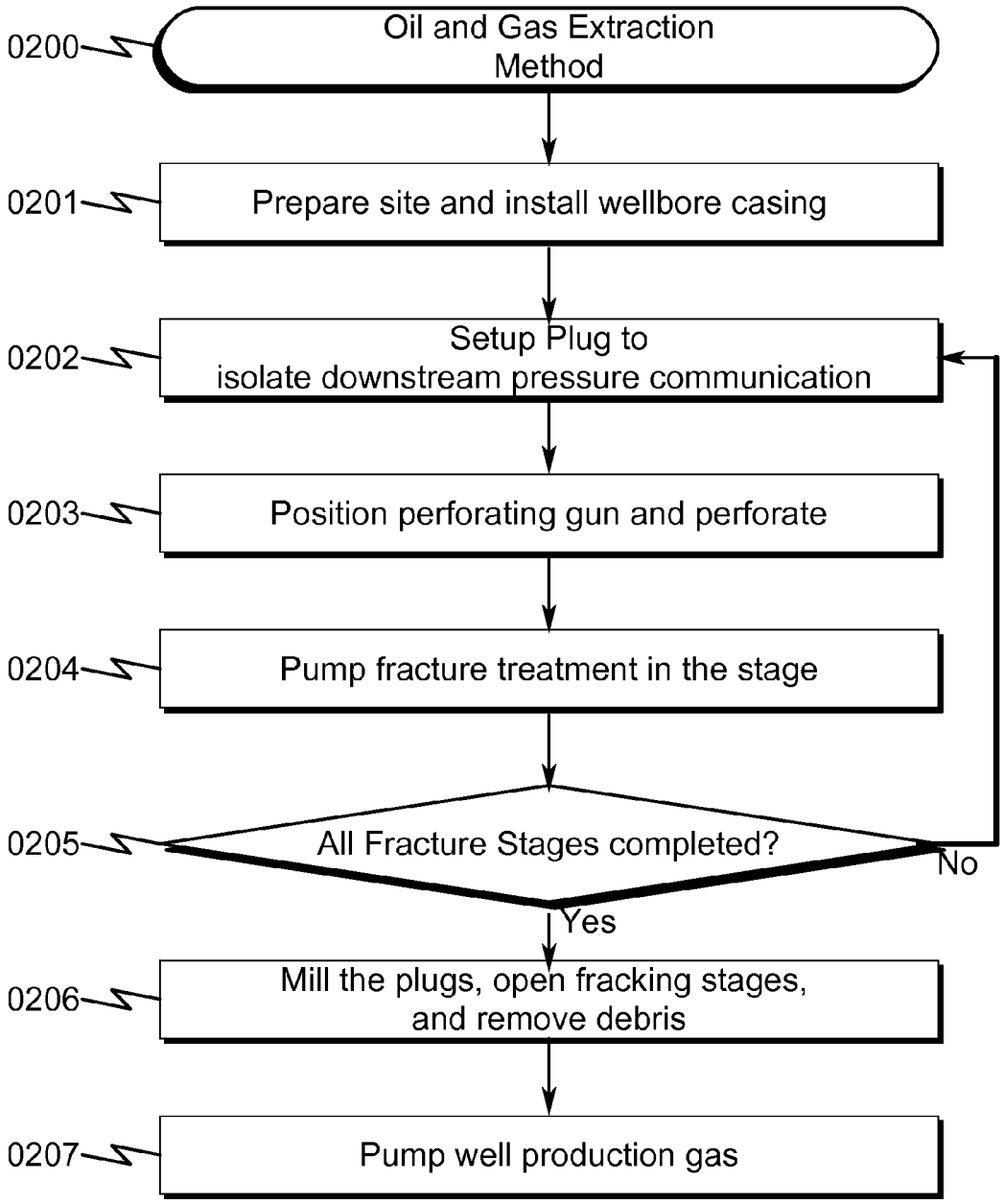
FIG. 2 illustrates a flowchart describing how prior art systems extract gas from hydrocarbon formations.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a wellbore plug isolation system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

GLOSSARY OF TERMS

RSM: Restriction Sleeve Member, a cylindrical member positioned at a selected wellbore location.

RPE: Restriction Plug Element, an element configured to isolate and block fluid communication.

CSS: Conforming Seating Surface, a seat formed within RSM.

ICD: Inner Casing Diameter, inner diameter of a wellbore casing.

ICS: Inner Casing Surface, inner surface of a wellbore casing.

ISD: Inner Sleeve Diameter, inner diameter of a RSM.

ISS: Inner Sleeve Surface, inner surface of a RSM.

WST: Wellbore Setting Tool, a tool that functions to set and seal RSMs.

GSA: Gun String Assembly, a cascaded string of perforating guns coupled to each other.

Preferred Embodiment System Block Diagram (0300, 0400)

Figure 3:
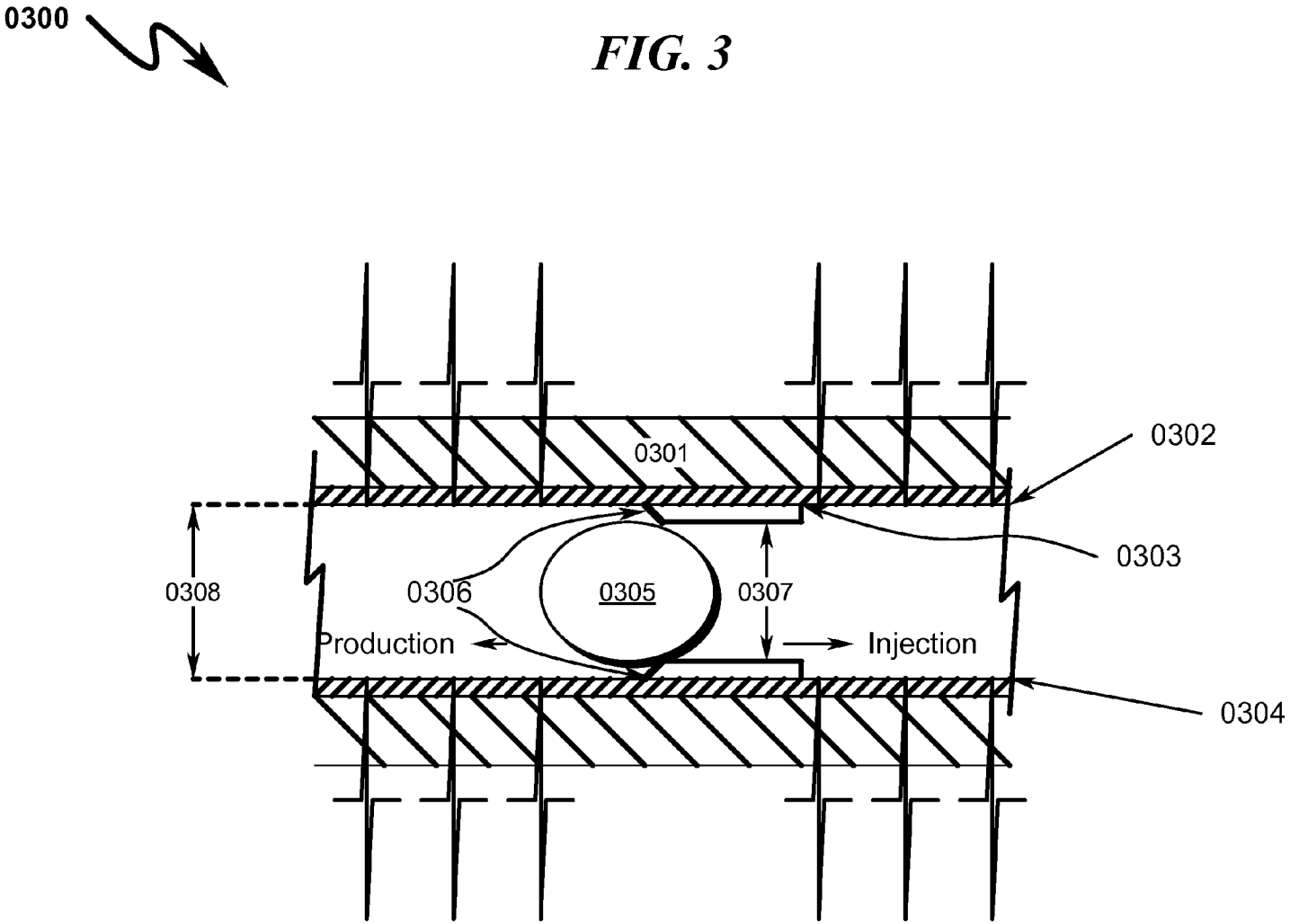
FIG. 3 illustrates an exemplary system side view of a spherical restriction plug element/restriction sleeve member overview depicting a presently preferred embodiment of the present invention.
Figure 3A:
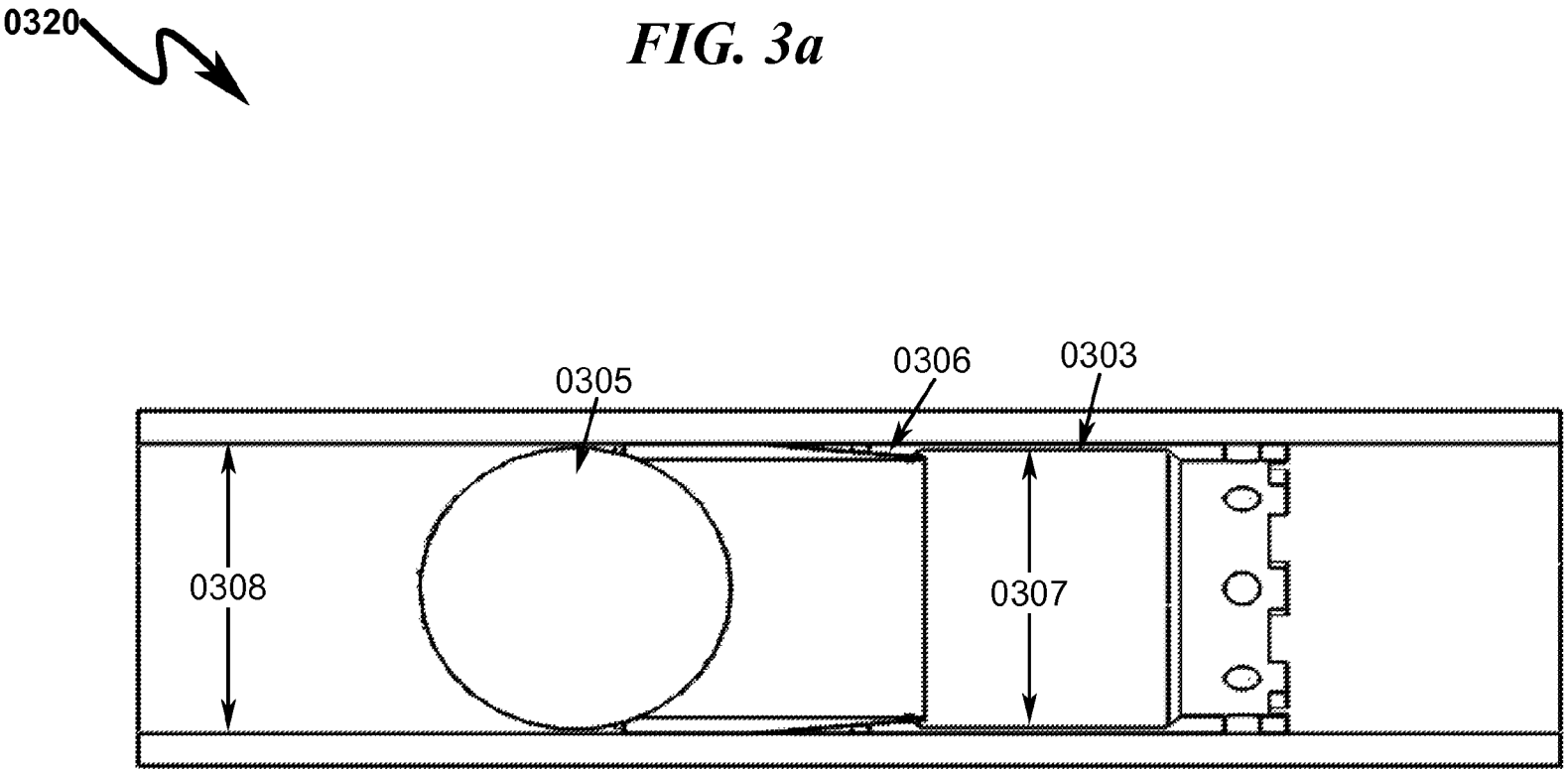
FIG. 3*a* illustrates an exemplary system side view of a spherical restriction plug element/restriction sleeve member overview depicting a presently preferred embodiment of the present invention.
Figure 4:
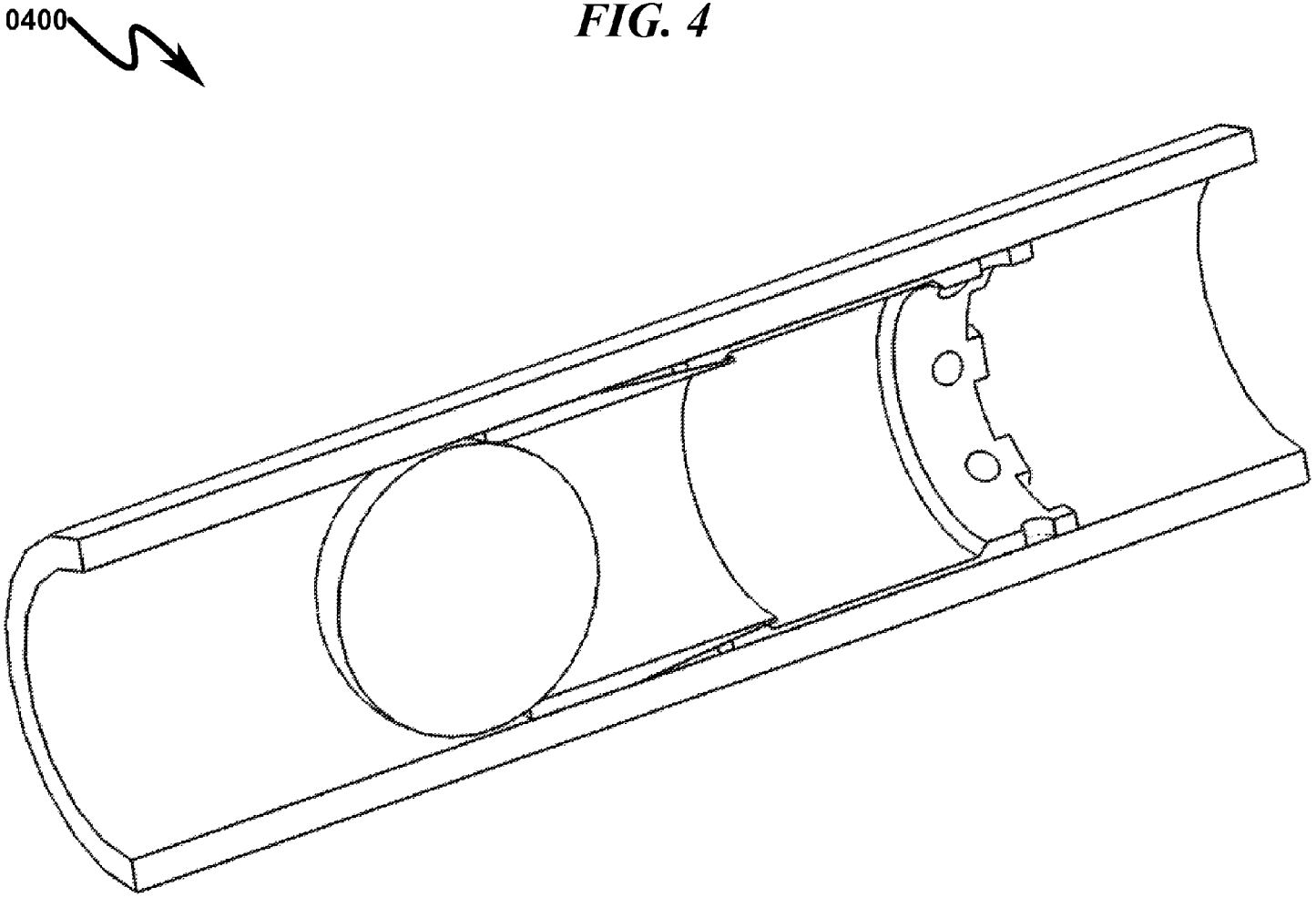
FIG. 4 illustrates a side perspective view of a spherical restriction plug element/restriction sleeve member depicting a preferred exemplary system embodiment.

The present invention may be seen in more detail as generally illustrated in FIG. 3 (0300) and FIG. 3*a* (0320), wherein a wellbore casing (0304) is installed inside a hydrocarbon formation (0302) and held in place by wellbore cement (0301). The wellbore casing (0304) may have an inside casing surface (ICS) associated with an inside casing diameter (ICD) (0308). For example, ICD (0308) may range from 2¾ inch to 12 inches. A restriction sleeve member (RSM) (0303) that fits inside of the wellbore casing is disposed therein by a wellbore setting tool (WST) to seal against the inside surface of the wellbore casing. The seal may be leaky or tight depending on the setting of RSM (0303). The RSM (0303) may be a hollow cylindrical member having an inner sleeve surface and an outer sleeve surface. The RSM (0303) may be concentric with the wellbore casing and coaxially fit within the ICS. In one preferred exemplary embodiment, the seal prevents RSM (0303) from substantial axially or longitudinally sliding along the inside surface of the wellbore casing. The RSM (0303) may be associated with an inner sleeve diameter (ISD) (0307) that is configured to fit within ICD (0308) of the wellbore casing (0304). In another preferred exemplary embodiment, ISD (0307) is large enough to enable unrestricted fluid movement through inside sleeve surface (ISS) during production. The ratio of ISD (0307) to ICD (0308) may range from 0.5 to 0.99. For example, ICD may be 4.8 inches and ISD may be 4.1 inches. In the foregoing example, the ratio of ISD (0307) and ICD (0308) is 0.85. The diameter of ISD (0307) may further degrade during production from wellbore fluids enabling fluid flow on almost the original diameter of the well casing. In a further preferred exemplary embodiment, RSM (0303) may be made from a material comprising of aluminum, iron, steel, titanium, tungsten, copper, bronze, brass, plastic, composite, natural fiber, and carbide. The RSM (0303) may be made of degradable material or a commercially available material.

In a preferred exemplary embodiment, the WST may set RSM (0303) to the ICS in compression mode to form an inner profile on the RSM (0303). The inner profile could form a tight or leaky seal preventing substantial axial movement of the RSM (0303). In another preferred exemplary embodiment, the WST may set RSM (0303) to the ICS in expansion mode providing more contact surface for sealing RSM (0303) against ICS. Further details of setting RSM (0303) through compression and expansion modes are further described below in FIG. 15.

In another preferred exemplary embodiment, the WST may set RSM (0303) using a gripping/sealing element disposed of therein with RSM (0303) to grip the outside surface of RSM (0303) to ICS. Further details of setting RSM (0303) through compression and expansion modes are described below in FIG. 11 (1100).

In another preferred exemplary embodiment, the WST may set RSM (0303) at any desired location within wellbore casing (0304). The desired location may be selected based on information such as the preferred hydrocarbon formation area, fraction stage, and wellbore conditions. The desired location may be chosen to create uneven hydraulic fracturing stages. For example, a shorter hydraulic fracturing stage may comprise a single perforating position so that the RSM locations are selected close to each other to accommodate the perforating position. Similarly, a longer hydraulic fracturing stage may comprise multiple perforating positions so that the RSM locations are selected as far to each other to accommodate the multiple perforating positions. Shorter and longer hydraulic fracturing positions may be determined based on the specific information of hydrocarbon formation (0302). A mudlog analyzes the mud during drilling operations for hydrocarbon information at locations in the wellbore. Prevailing mudlog conditions may be monitored to dynamically change the desired location of RSM (0303).

The WST may create a conforming seating surface (CSS) (0306) within RSM (0303). The WST may form a beveled edge on the production end (heel end) of the RSM (0303) by constricting the inner diameter region of RSM (0303) to create the CSS (0306). The inner surface of the CSS (0306) could be formed such that it seats and retains a restriction plug element (RPE) (0305). The diameter of the RPE (0305) is chosen such that it is less than the outer diameter and greater than the inner diameter of RSM (0303). The CSS (0306) and RPE (0305) may be complementary shaped such that RPE (0305) seats against CSS (0306). For example, RPE (0306) may be spherically shaped and the CSS (0306) may be beveled shaped to enable RPE (0305) to seat in CSS (0306) when a differential pressure is applied. The RPE (0305) may pressure lock against CSS (0306) when differential pressure is applied i.e., when the pressure upstream (production or heel end) of the RSM (0303) location is greater than the pressure downstream (injection or toe end) of the RSM (0303). The differential pressure established across the RSM (0303) locks RPE (0305) in place isolating downstream (injection or toe end) fluid communication. According to one preferred exemplary embodiment, RPE (0305) seated in CSS (0306) isolates a zone to enable hydraulic fracturing operations to be performed in the zone without affecting downstream (injection or toe end) hydraulic fracturing stages. The RPE (0305) may also be configured in other shapes such as a plug, dart or a cylinder. It should be noted that one skilled in the art would appreciate that any other shapes conforming to the seating surface may be used for RPEs to achieve similar isolation affect as described above.

According to another preferred exemplary embodiment, RPE (0305) may seat directly in RSM (0303) without the need for a CSS (0306). In this context, RPE (0305) may lock against the vertical edges of the RSM (0303) which may necessitate a larger diameter RPE (0305).

According to yet another preferred exemplary embodiment, RPE (0305) may degrade over time in the well fluids eliminating the need to be removed before production. The RPE (0305) degradation may also be accelerated by acidic components of hydraulic fracturing fluids or wellbore fluids, thereby reducing the diameter of RPE (0305) enabling it to flow out (pumped out) of the wellbore casing or flow back (pumped back) to the surface before production phase commences.

In another preferred exemplary embodiment, RPE (0305) may be made of a metallic material, non-metallic material, a carbide material, or any other commercially available material.

Preferred Embodiment Multistage System Diagram (0500)

Figure 5:
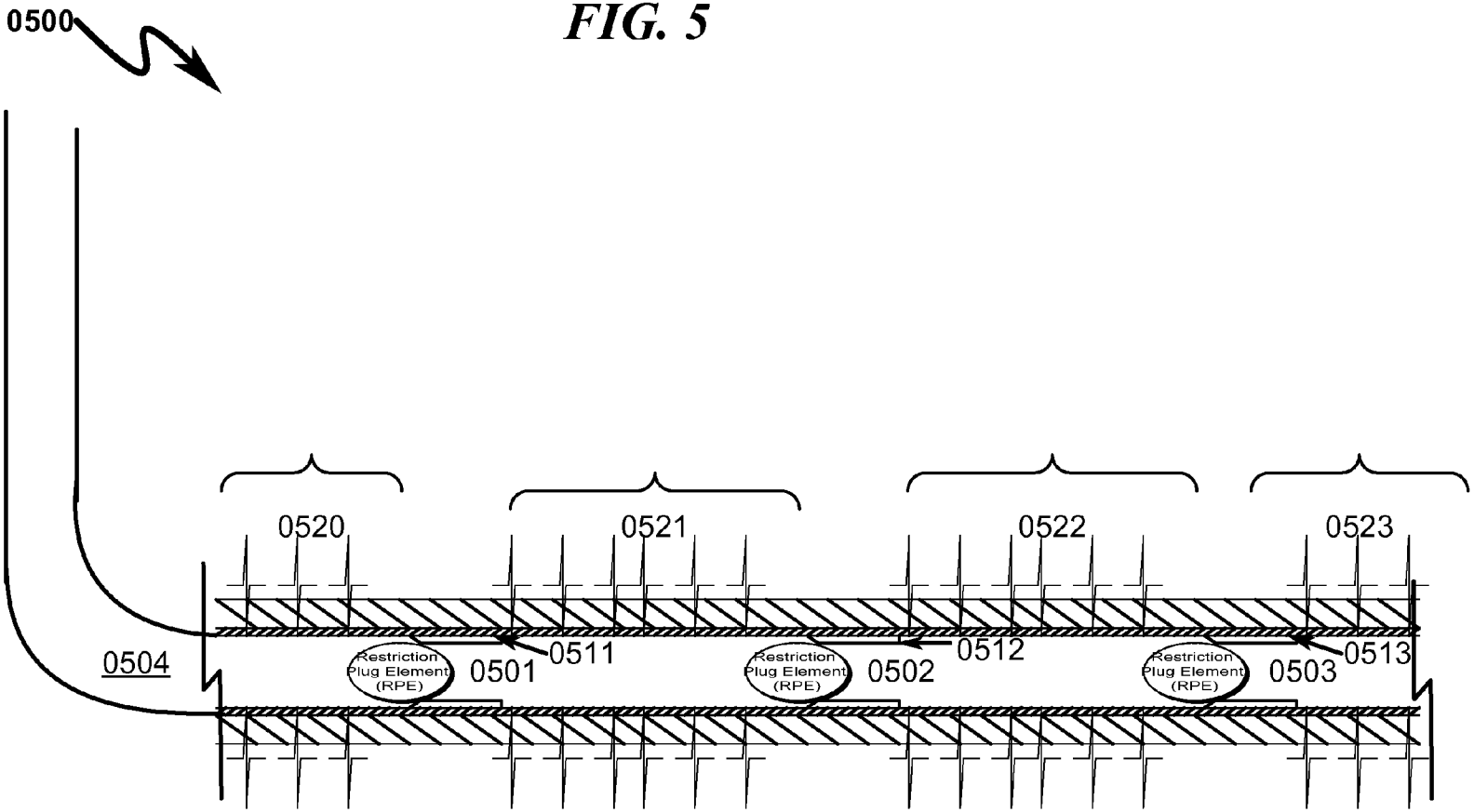
FIG. 5 illustrates an exemplary wellbore system overview depicting multiple stages of a preferred embodiment of the present invention.

The present invention may be seen in more detail as generally illustrated in FIG. 5 (0500), wherein a wellbore casing (0504) is shown after hydraulic fracturing is performed in multiple stages (fracture intervals) according to a method described herewith below in FIG. 6 (0600). A plurality of stages (0520, 0521, 0522, 0523) are created by setting RSMs (0511, 0512, 0513) at desired positions followed by isolating each stage successively with restriction plug elements RPEs (0501, 0502, 0503). A RSM (0513) may be set by a WST followed by positioning a perforating gun string assembly (GSA) in hydraulic fracturing zone (0522) and perforating the interval. Subsequently, RPE (0503) is deployed and the stage (0522) is hydraulically fractured. The WST and the perforating GSA are removed for further operations. Thereafter, RSM (0512) is set and sealed by WST followed by a perforation operation. Another RPE (0502) is deployed to seat in RSM (0512) to form hydraulic fracturing zone (0521). Thereafter the stage (0521) is hydraulically fracturing. Similarly, hydraulic fracturing zone (0520) is created and hydraulically fractured.

According to one aspect of a preferred exemplary embodiment, RSMs may be set by WST at desired locations to enable RPEs to create multiple hydraulic fracturing zones in the wellbore casing. The hydraulic fracturing zones may be equally spaced or unevenly spaced depending on wellbore conditions or hydrocarbon formation locations.

According to another preferred exemplary embodiment, RPEs are locked in place due to pressure differential established across RSMs. For example, RPE (0502) is locked in the seat of RSM (0512) due to a positive pressure differential established across RSM (0512) i.e., pressure upstream (hydraulic fracturing stages 0520, 0521 and stages towards heel of the wellbore casing) is greater than pressure downstream (hydraulic fracturing stages 0522, 0523 and stages towards toe of the wellbore casing).

According a further preferred exemplary embodiment, RPEs (0501, 0502, 0503) may degrade over time, flowed back by pumping, or flowed into the wellbore, after completion of all stages in the wellbore, eliminating the need for additional milling operations.

According a further preferred exemplary embodiment the RPE's may change shape or strength such that they may pass through a RSM in either the production (heel end) or injection direction (toe end). For example RPE (0512) may degrade and change shape such it may pass through RSM (0511) in the production direction or RSM (0513) in the injection direction. The RPEs may also be degraded such that they are in between the RSMs of current stage and a previous stage restricting fluid communication towards the injection end (toe end) but enabling fluid flow in the production direction (heel end). For example, RPE (0502) may degrade such it is seated against the injection end (toe end) of RSM (0511) that may have flow channels. Flow channels in the RSM are further described below in FIG. 32 (3200) and FIG. 34 (3400).

According to yet another preferred exemplary embodiment, inner diameters of RSMs (0511, 0512, 0513) may be the same and large enough to allow unrestricted fluid flow during well production operations. The RSMs (0511, 0512, 0513) may further degrade in well fluids to provide an even larger diameter comparable to the inner diameter of the well casing (0504) allowing enhanced fluid flow during well production. The degradation could be accelerated by acids in the hydraulic fracturing fluids.

Preferred Exemplary Restriction Plug Elements (RPE)

It should be noted that some of the material and designs of the RPE described below may not be limited and should not be construed as a limitation. This basic RPE design and materials may be augmented with a variety of ancillary embodiments, including but not limited to:

- Made of multi layered materials, where at least one layer of the material melts or deforms at temperature allowing the size or shape to change.
- May be a solid core with an outer layer of meltable material.

May or may not have another outer layer, such as a rubber coating.

May be a single material, non-degradable.

Outer layer may or may not have holes in it, such that an inner layer could melt and liquid may escape.

Passage ways through them which are filled with meltable, degradable, or dissolving materials.

Use of downhole temperature and pressure, which change during the stimulation and subsequent well warm up to change the shape of barriers with laminated multilayered materials.

Use of a solid core that is degradable or erodible.

Use of acid soluble alloy balls.

Use of water dissolvable polymer frac balls.

Use of poly glycolic acid balls.

Preferred Exemplary Wellbore Plug Isolation Flowchart Embodiment (0600)

Figure 6:
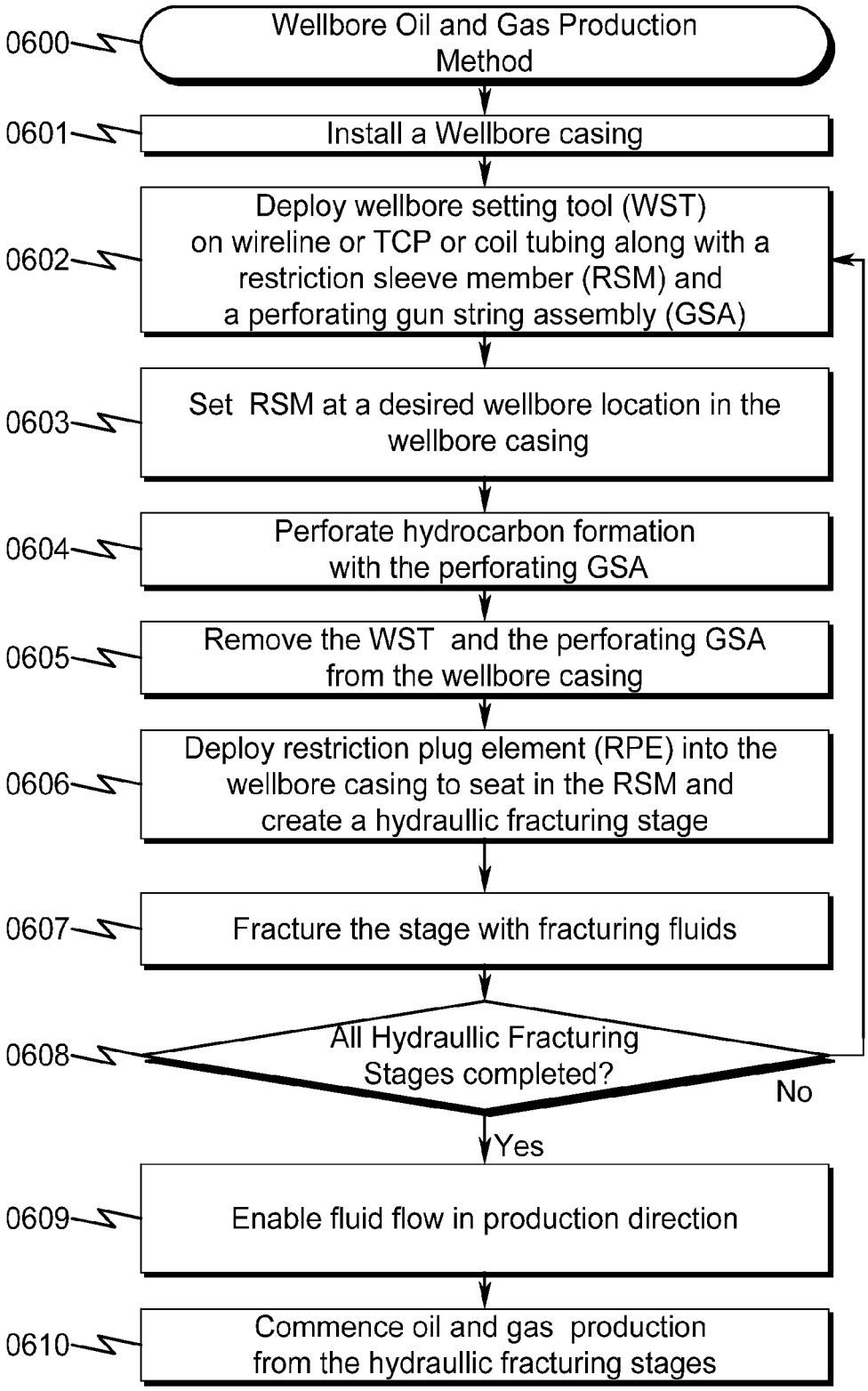
FIG. 6 illustrates a detailed flowchart of a preferred exemplary wellbore plug isolation method used in some preferred exemplary invention embodiments.

As generally seen in the flow chart of FIG. 6 (0600), a preferred exemplary wellbore plug isolation method may be generally described in terms of the following steps:

(1) installing the wellbore casing (0601);

(2) deploying the WST along with the RSM to a desired wellbore location in the wellbore casing along with a perforating gun string assembly (GSA); the WST could be deployed by wireline, coil tube, or tubing-conveyed perforating (TCP) (0602); the perforating GSA may comprise plural perforating guns;

(3) setting the RSM at the desired wellbore location with the WST; the WST could set RSM with a power charge or pressure (0603); The power charge generates pressure inside the setting tool that sets the RSM; the RSM may or may not have a conforming seating surface (CSS); the CSS may be machined or formed by the WST at the desired wellbore location;

(4) perforating hydrocarbon formation with the perforating GSA; the perforating GSA may perforate one interval at a time followed by pulling the GSA and perforating the next interval in the stage; the perforation operation is continued until all the intervals in the stage are completed;

(5) removing the WST and the perforating GSA from the wellbore casing; the WST could be removed by wireline, coil tube, or TCP (0605);

(6) deploying the RPE to seat in the RSM isolating fluid communication between upstream (heel or production end) of the RSM and downstream (toe or injection end) of the RSM and creating a hydraulic fracturing stage; RPE may be pumped from the surface, deployed by gravity, or set by a tool; If a CSS is present in the RSM, the RPE may be seated in the CSS; RPE and CSS complementary shapes enable RPE to seat into the CSS; positive differential pressure may enable RPE to be driven and locked into the CSS (0606);

(7) fracturing the hydraulic fracturing stage; by pumping hydraulic fracturing fluid at high pressure to create pathways in hydrocarbon formations (0607);

(8) checking if all hydraulic fracturing stages in the wellbore casing have been completed, if not so, proceeding to step (0602); prepare to deploy the WST to a different wellbore location towards the heel end of the already fractured stage; hydraulic fracturing stages may be determined by the length of the casing installed in the hydrocarbon formation; if all stages have been fractured proceed to step (0609), (0608);

(9) enabling fluid flow in the production (heel end) direction; fluid flow may been enabled through flow channels designed in the RSM while the RPEs are positioned in between the RSMs; fluid flow may also be been enabled through flow channels designed in the RPEs and RSMs; alternatively RPEs may also be removed from the wellbore casing or the RPEs could be flowed back to surface, pumped into the wellbore, or degraded in the presence of wellbore fluids or acid (0609); and

(10) commencing oil and gas production from all the hydraulically fractured stages (0610).

Preferred Embodiment Side View Cylindrical Restriction Plug System Block Diagram (0700, 0800)

Figure 7:
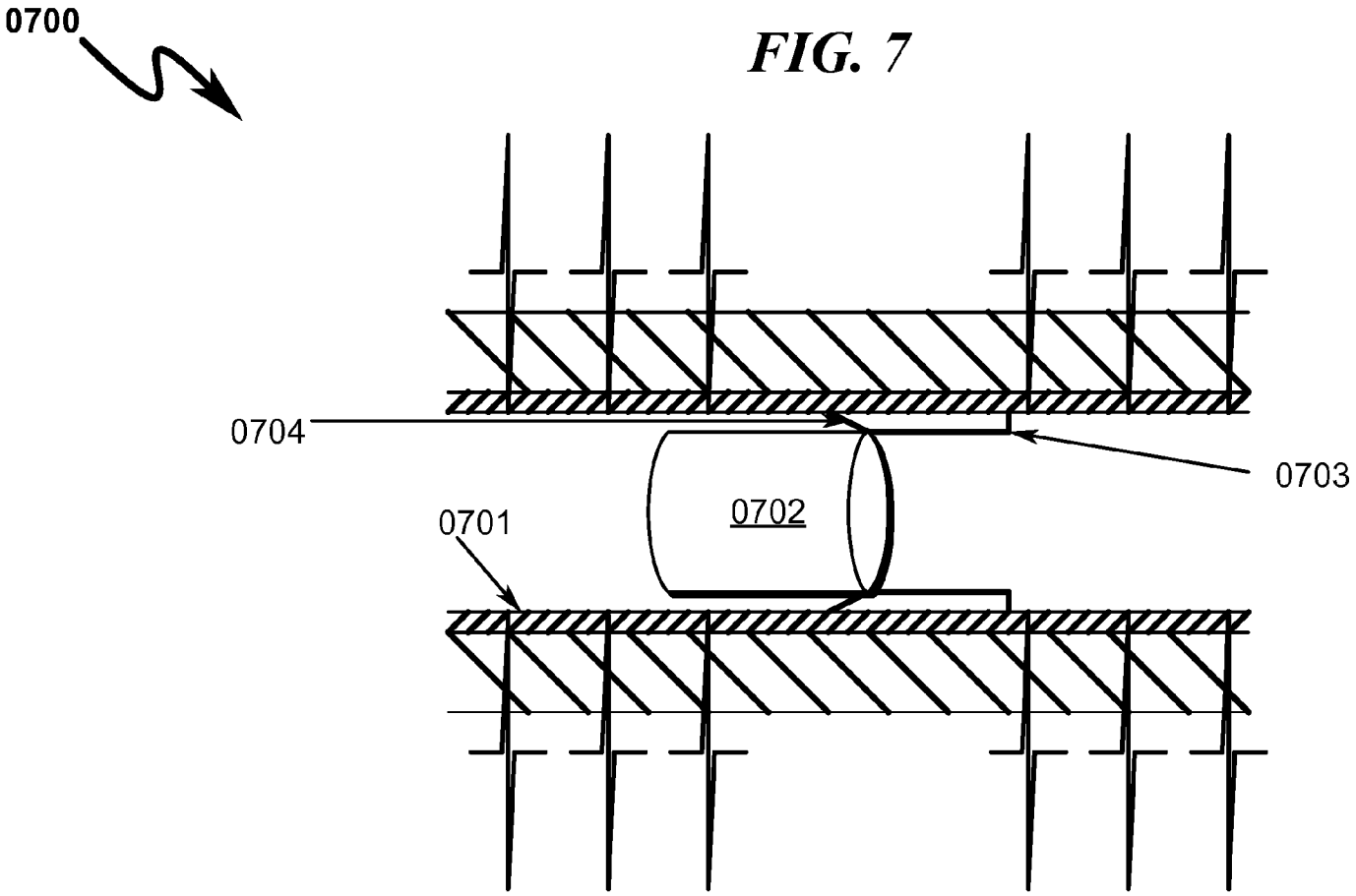
FIG. 7 illustrates a side view of a cylindrical restriction plug element seated in a restriction sleeve member depicting a preferred exemplary system embodiment.
Figure 8:
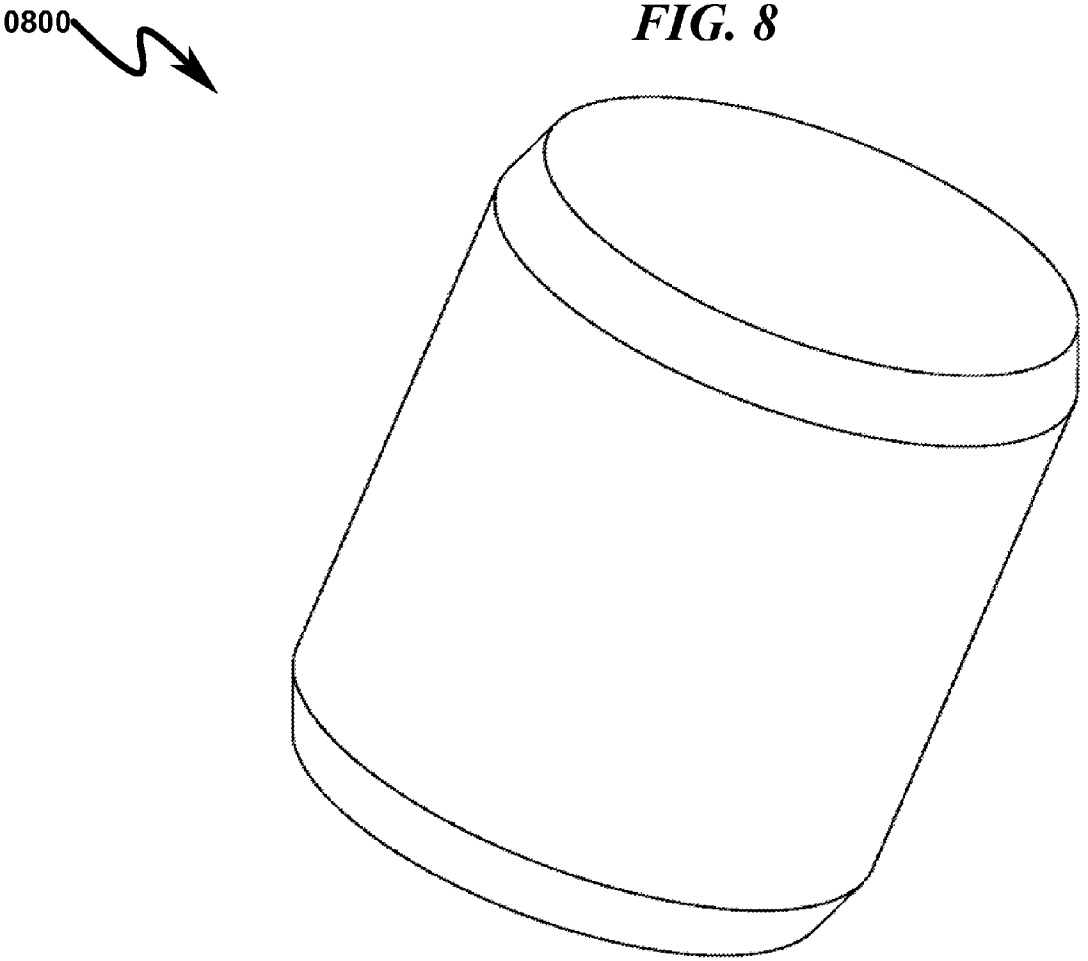
FIG. 8 illustrates a side perspective view of a cylindrical restriction plug element seated in a restriction sleeve member depicting a preferred exemplary system embodiment.

One preferred embodiment may be seen in more detail as generally illustrated in FIG. 7 (0700) and FIG. 8 (0800), wherein a cylindrical restrictive plug element (0702) is seated in CSS (0704) to provide downstream pressure isolation. A wellbore casing (0701) is installed in a hydrocarbon formation. A wellbore setting tool may set RSM (0703) at a desired location and seal it against the inside surface of the wellbore casing (0701). The WST may form a CSS (0704) in the RSM (0703) as described by foregoing method described in FIG. 6 (0600). According to one preferred exemplary embodiment, a cylindrical shaped restrictive plug element (RPE) (0702) may be deployed into the wellbore casing to seat in CSS (0704).

The diameter of the RPE (0702) is chosen such that it is less than the outer diameter and greater than the inner diameter of RSM (0703). The CSS (0704) and RPE (0702) may be complementary shaped such that RPE (0702) seats against CSS (0704). For example, RPE (0702) may be cylindrically shaped and CSS (0704) may be beveled shaped to enable RPE (0702) to seat in CSS (0704) when a differential pressure is applied. The RPE (0702) may pressure lock against CSS (0704) when differential pressure is applied.

It should be noted that, if a CSS is not present in the RSM (0703) or not formed by the WST, the cylindrical RPE (0702) may directly seat against the edges of the RSM (0703).

Preferred Embodiment Side View Dart Restriction Plug System Block Diagram (0900-1020)

Figure 9:
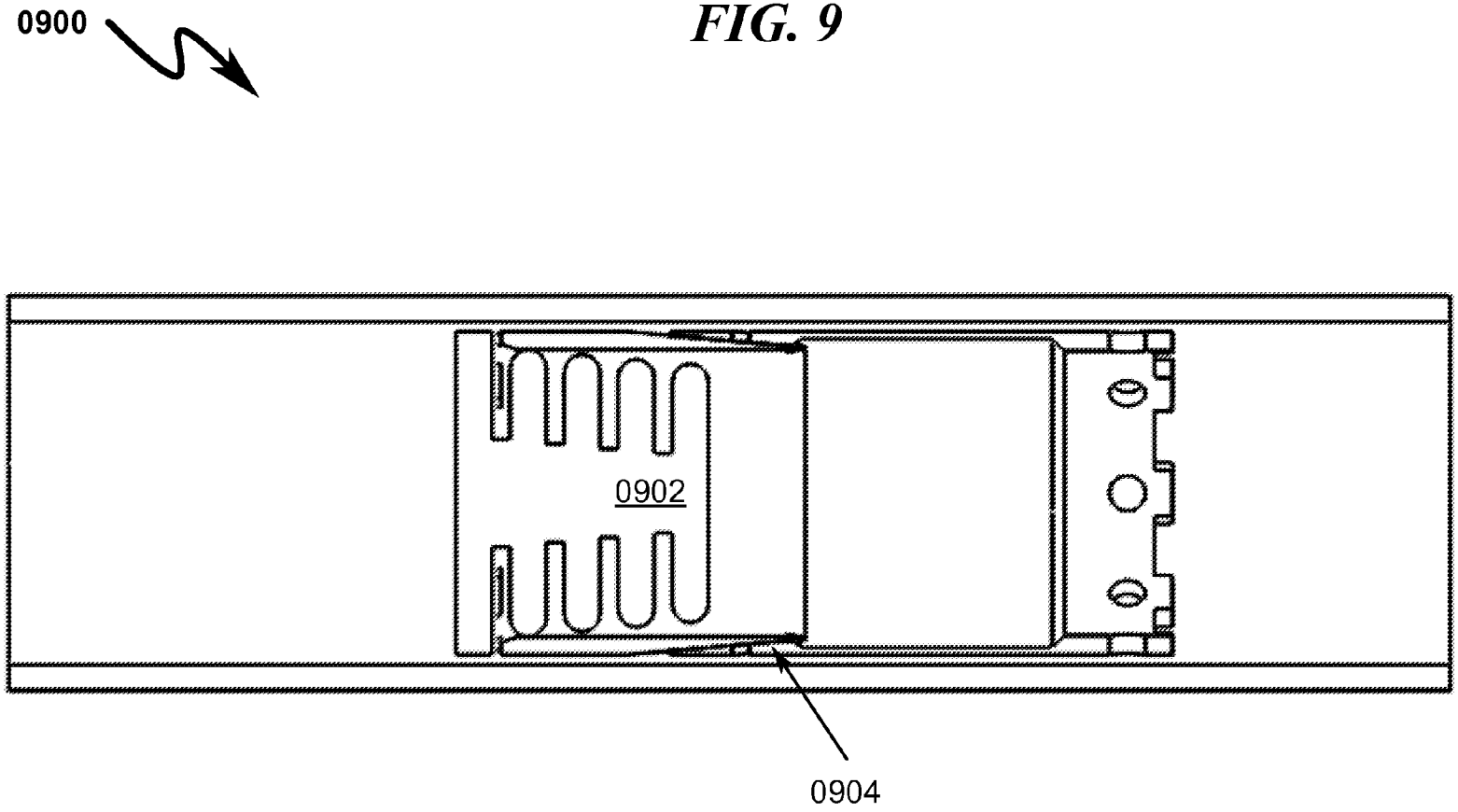
FIG. 9 illustrates a side view of a dart restriction plug element seated in a restriction sleeve member depicting a preferred exemplary system embodiment.
Figure 10:
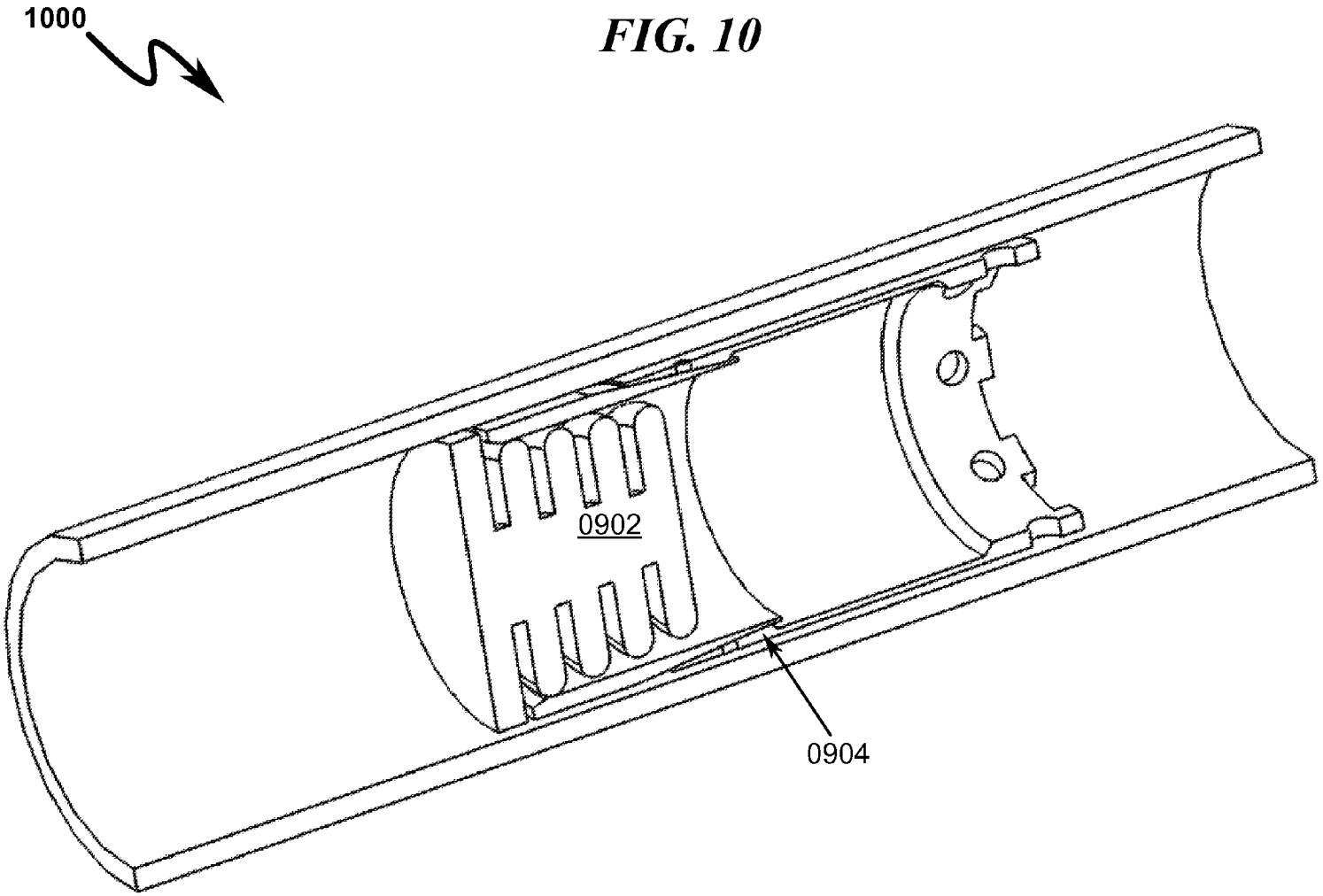
FIG. 10 illustrates a side perspective view of a dart restriction plug element seated in a restriction sleeve member depicting a preferred exemplary system embodiment.
Figure 10A:
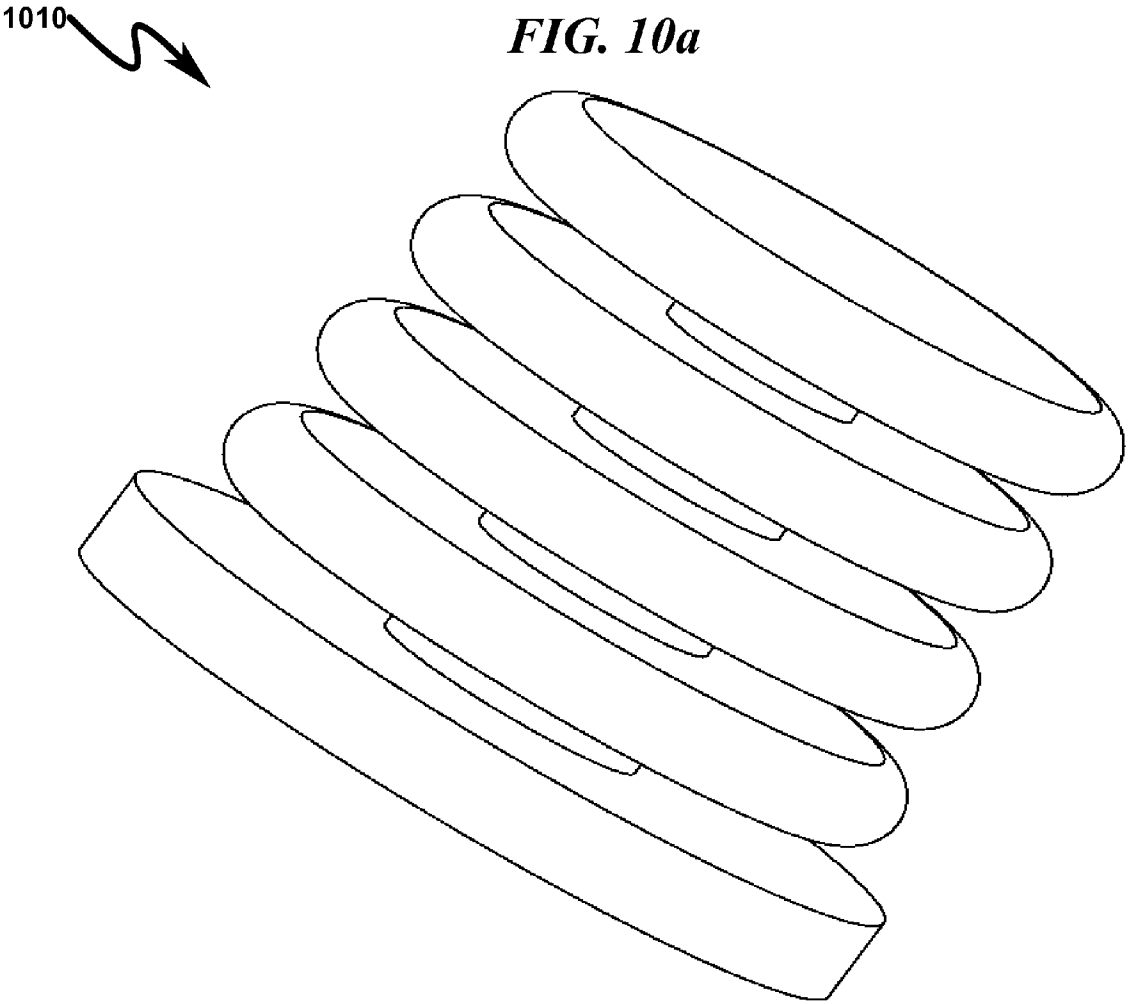
FIG. 10*a* illustrates a side perspective view of a dart restriction plug element depicting a preferred exemplary system embodiment.
Figure 10B:
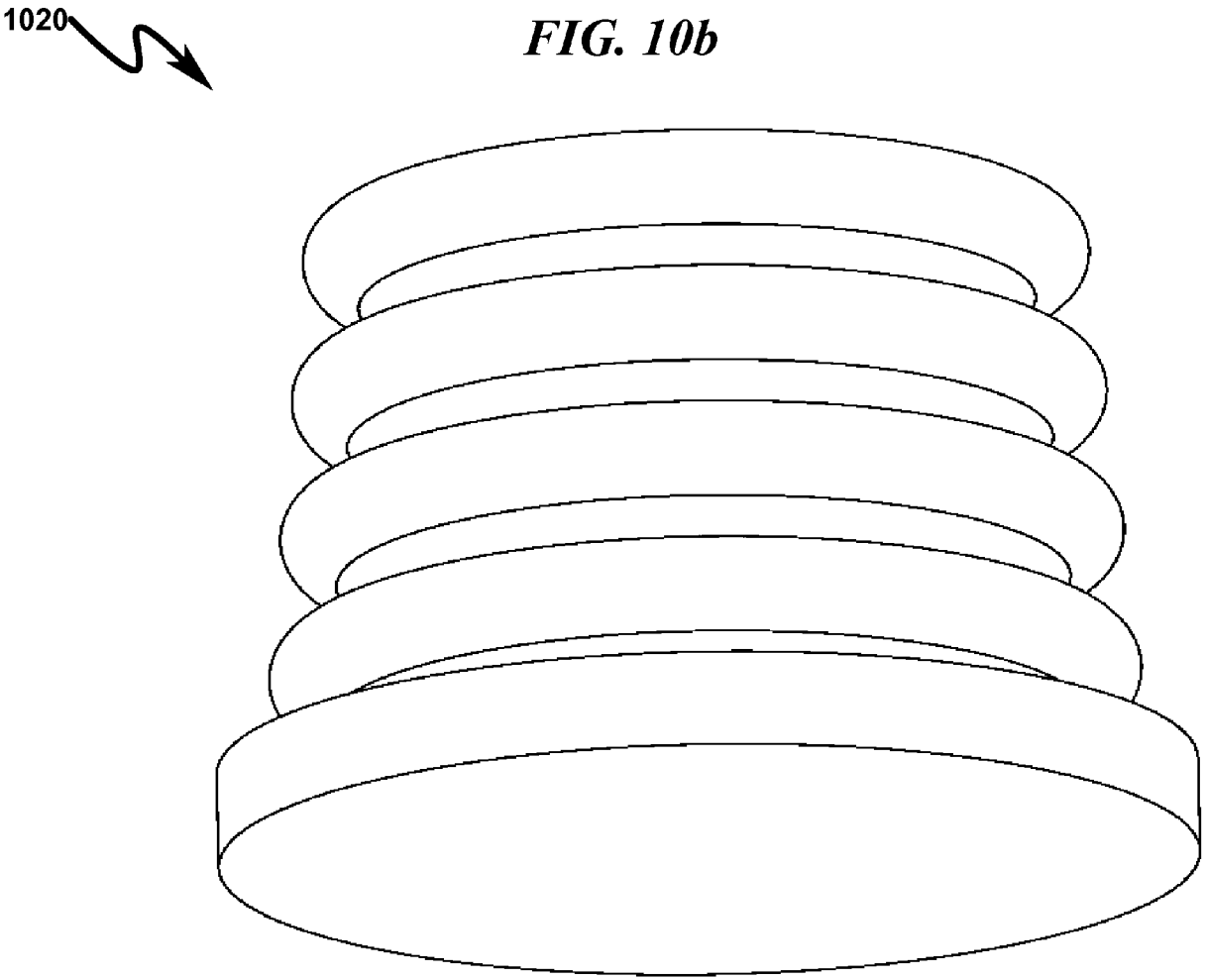
FIG. 10*b* illustrates another perspective view of a dart restriction plug element depicting a preferred exemplary system embodiment.

Yet another preferred embodiment may be seen in more detail as generally illustrated in FIG. 9 (0900), FIG. 10 (1000), FIG. 10*a* (1010), and FIG. 10*b* (1020) wherein a dart shaped restrictive plug element (0902) is seated in CSS (0904) to provide pressure isolation. According to a similar process described above in FIG. 7, RPE (0902) is used to isolate and create fracture zones to enable perforation and hydraulic fracturing operations in the fracture zones. As shown in the perspective views of the dart RPE in FIG. 10*a* (1010) and FIG. 10*b* (1020), the dart RPE is complementarily shaped to be seated in the RSM. The dart RPE (0902) is designed such that the fingers of the RPE (0902) are compressed during production enabling fluid flow in the production direction.

Preferred Embodiment Side Cross Section View of a Restriction Sleeve Member System Block Diagram (1100, 1200)

Figure 11:
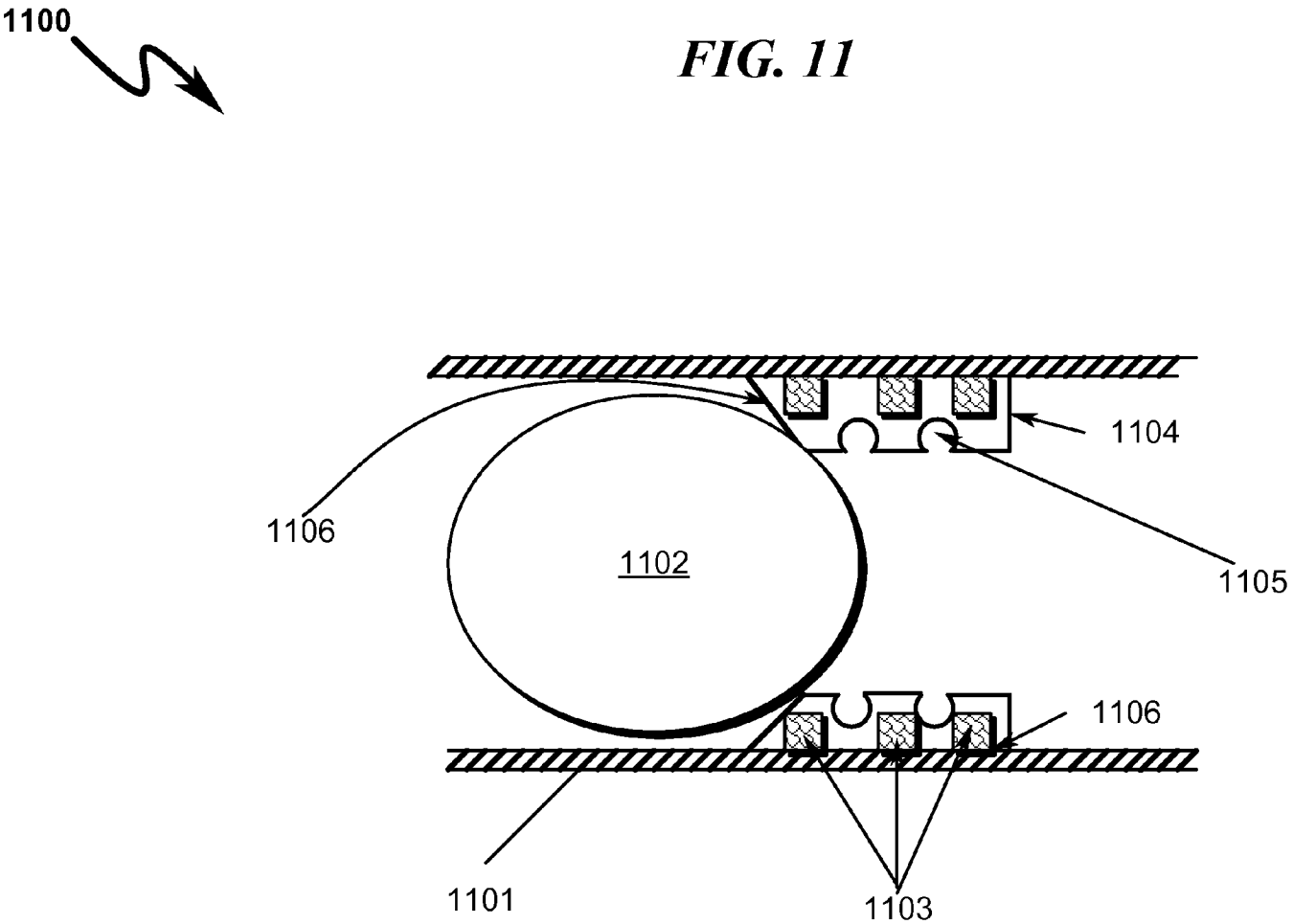
FIG. 11 illustrates a side view of a restriction sleeve member sealed with an elastomeric element depicting a preferred exemplary system embodiment.
Figure 12:
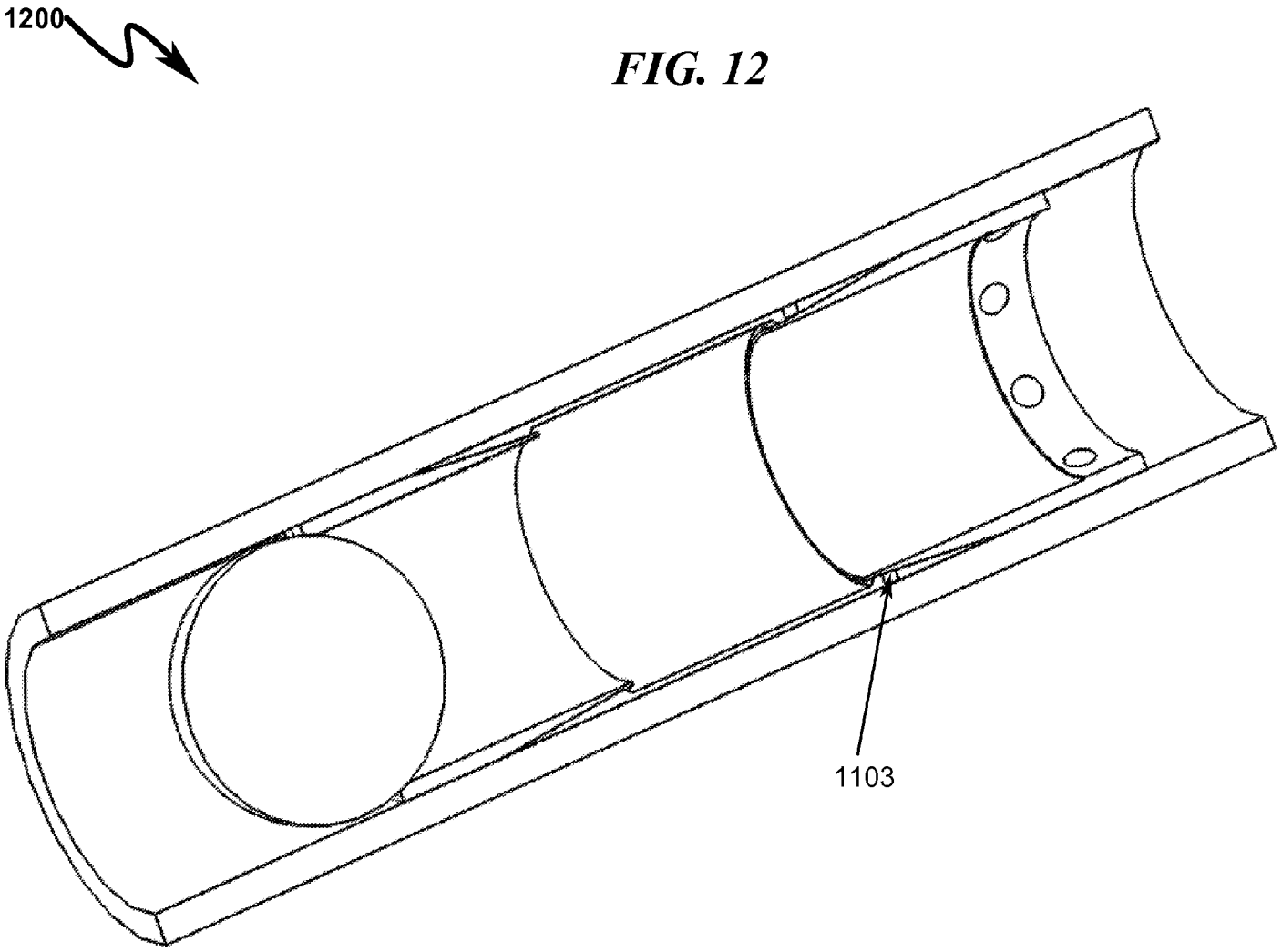
FIG. 12 illustrates a side perspective view of a restriction sleeve member sealed with gripping/sealing element depicting a preferred exemplary system embodiment.

One preferred embodiment may be seen in more detail as generally illustrated in FIG. 11 (1100) and FIG. 12 (1200), wherein a restrictive sleeve member RSM (1104) is sealed against the inner surface of a wellbore casing (1101) with a plurality of gripping/sealing elements (1103). Gripping elements may be elastomers, carbide buttons, or wicker forms. After a wellbore casing (1101) is installed, a wellbore setting tool may be deployed along with RSM (1104) to a desired wellbore location. The WST may then compress the RSM (1104) to form plural inner profiles (1105) on the inside surface of the RSM (1104) at the desired location. In one preferred exemplary embodiment, the inner profiles (1105) may be formed prior to deploying to the desired wellbore location. The compressive stress component in the inner profiles (1104) may aid in sealing the RSM (1104) to the inner surface of a wellbore casing (1101). A plurality of gripping/sealing elements (1103) may be used to further strengthen the seal (1106) to prevent substantial axial or longitudinal movement of RSM (1104). The gripping elements (1103) may be an elastomer, carbide buttons, or wicker forms that can tightly grip against the inner surface of the wellbore casing (1101). The seal (1106) may be formed by plural inner profiles (1104), plural gripping elements (1103), or a combination of inner profiles (1104) and gripping elements (1103). Subsequently, the WST may form a CSS (1106) and seat a RPE (1102) to create downstream isolation (toe end) as described by the foregoing method in FIG. 6 (0600).

Preferred Embodiment Side Cross Section View of Inner and Outer Profiles of a Restriction Sleeve Member System Block Diagram (1300-1700)

Figure 13:
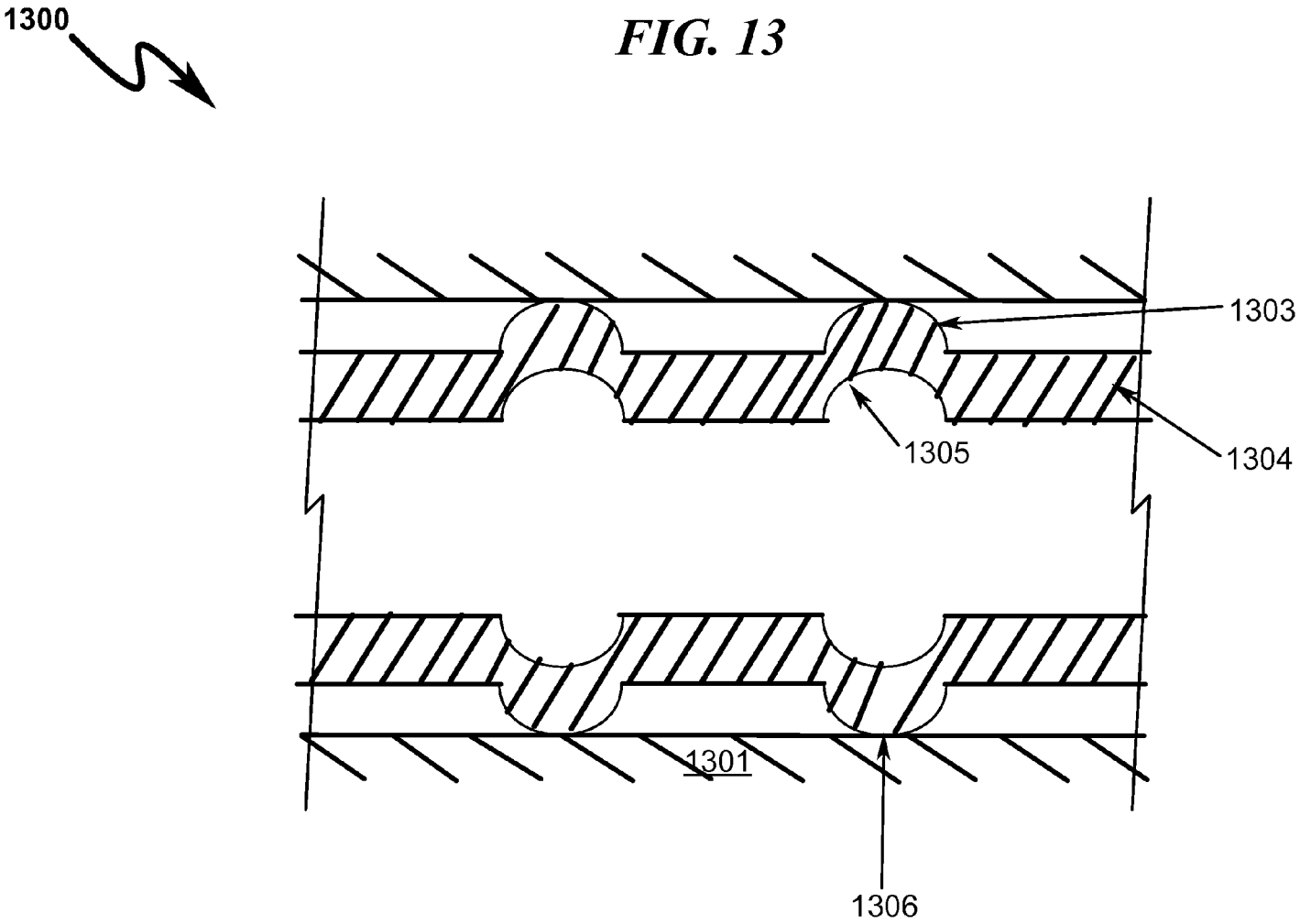
FIG. 13 illustrates side view of an inner profile of a restriction sleeve member sealed against an inner surface of a wellbore casing depicting a preferred exemplary system embodiment.
Figure 14:
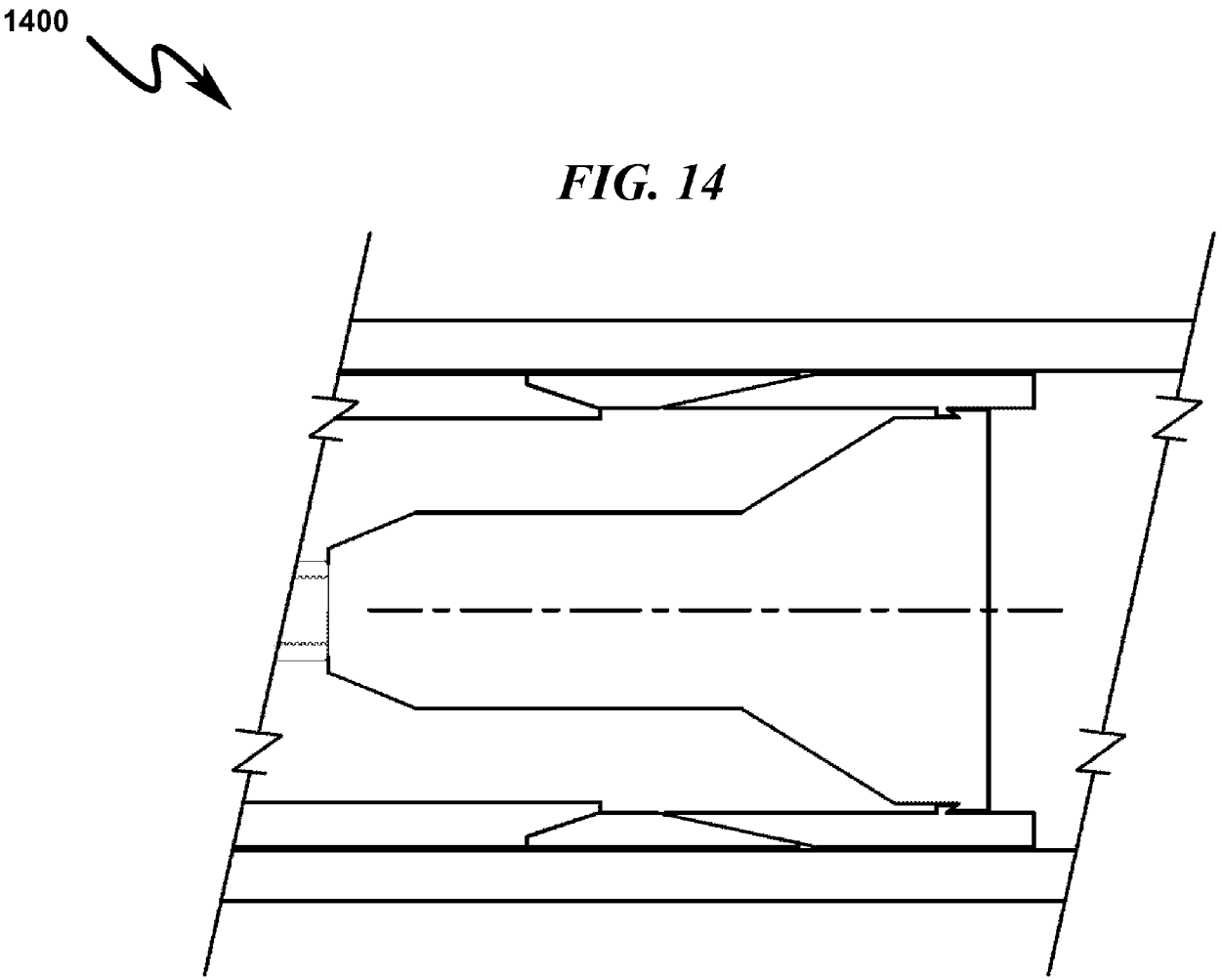
FIG. 14 illustrates a wellbore setting tool creating inner and outer profiles in the restriction sleeve member depicting a preferred exemplary system embodiment.

Yet another preferred embodiment may be seen in more detail as generally illustrated in FIG. 13 (1300), wherein a restrictive sleeve member RSM (1304) is sealed against the inner surface of a wellbore casing (1301). After a wellbore casing (1301) is installed, a wellbore setting tool may be deployed along with RSM (1304) to a desired wellbore location. The WST may then compress the RSM (1304) to form plural inner profiles (1305) on the inside surface of the RSM (1304) and plural outer profiles (1303) on the outside surface of the RSM (1304) at the desired location. In one preferred exemplary embodiment, the inner profiles (1305) and outer profiles (1303) may be formed prior to deploying to the desired wellbore location. The compressive stress component in the inner profiles (1304) and outer profiles (1303) may aid in sealing the RSM (1304) to the inner surface of a wellbore casing (1301). The outer profiles (1303) may directly contact the inner surface of the wellbore casing at plural points of the protruded profiles to provide a seal (1306) and prevent axial or longitudinal movement of the RSM (1304).

Figure 15:
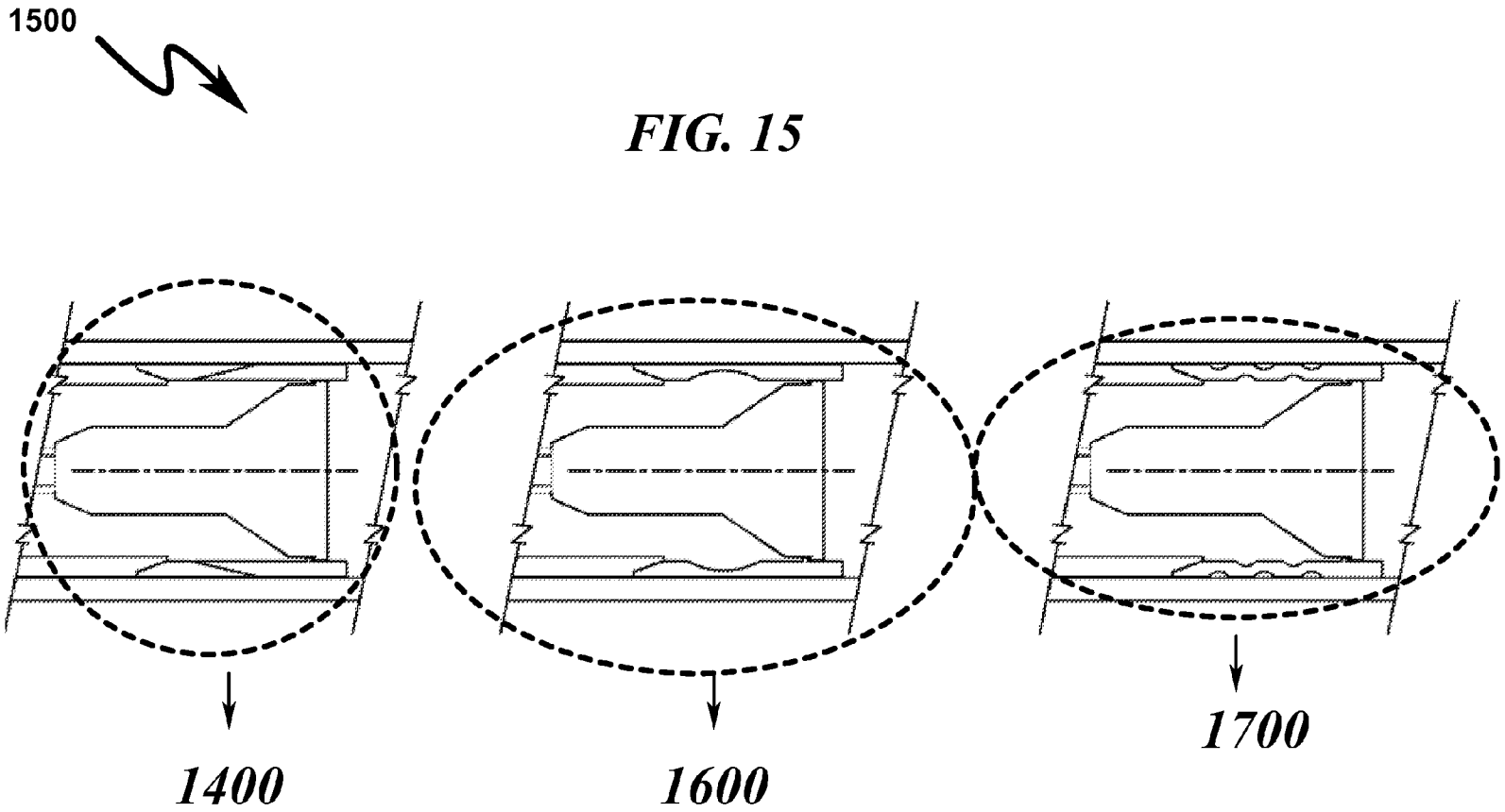
FIG. 15 illustrates a wellbore setting tool creating outer profiles in the restriction sleeve member depicting a preferred exemplary system embodiment.
Figure 16:
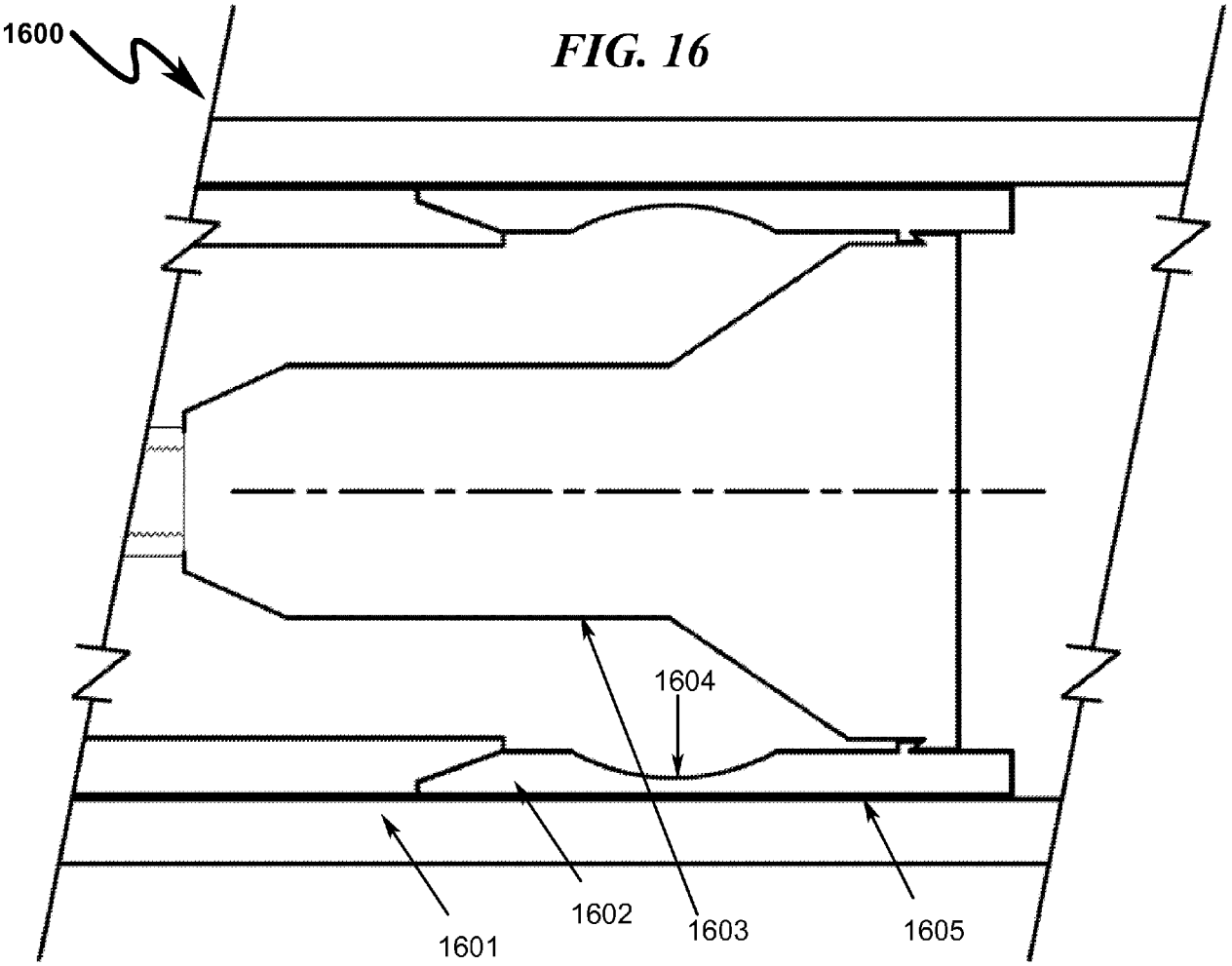
FIG. 16 illustrates a detailed cross section view of a wellbore setting tool creating inner profiles in the restriction sleeve member depicting a preferred exemplary system embodiment.
Figure 17:
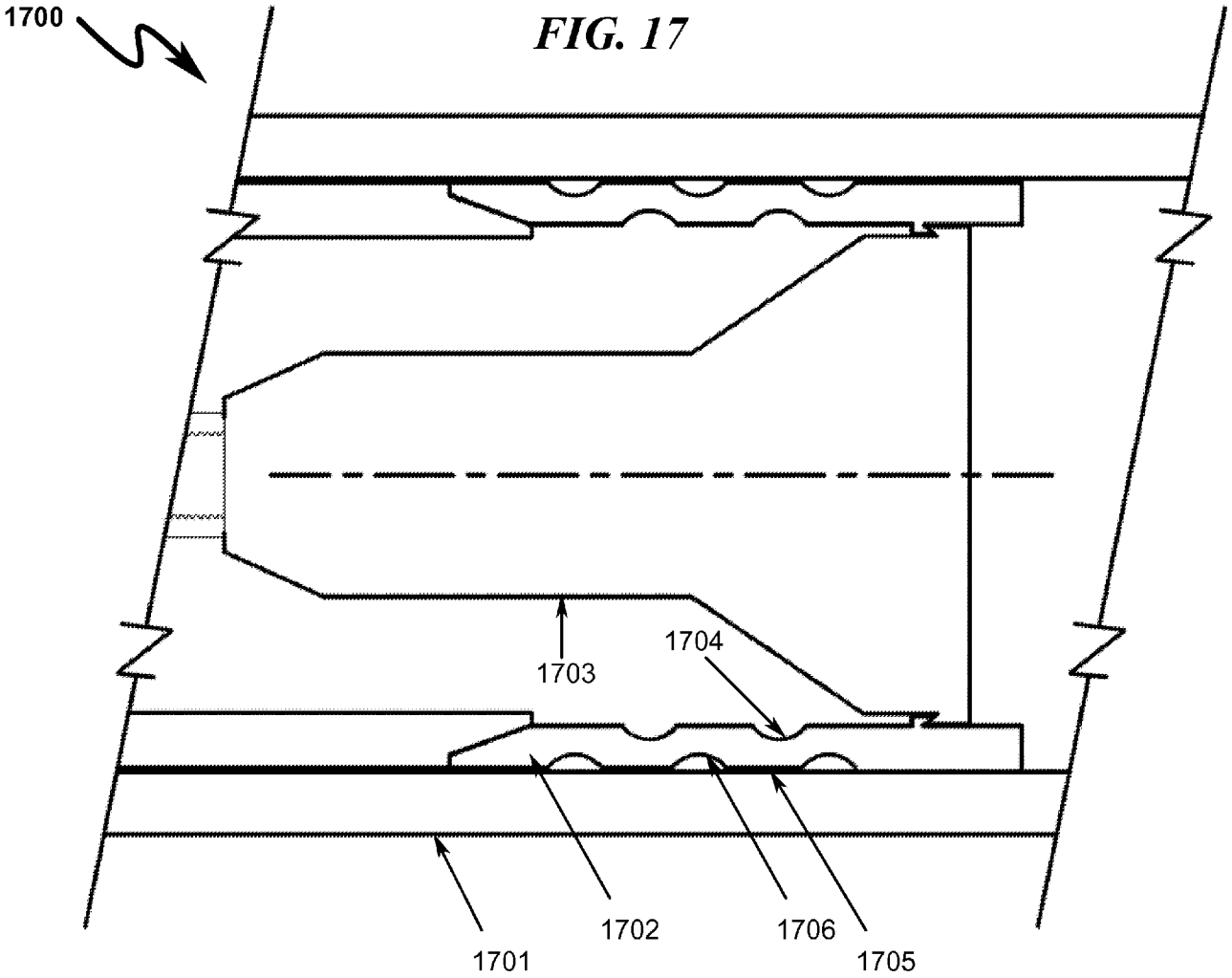
FIG. 17 illustrates a detailed cross section view of a wellbore setting tool creating inner profiles and outer profiles in the restriction sleeve member depicting a preferred exemplary system embodiment.

Similarly, FIG. 15 (1500) illustrates a wireline setting tool creating inner and outer profiles in restriction sleeve members for sealing against the inner surface of the wellbore casing. FIG. 16 illustrates a detailed cross section view of a WST (1603) that forms an inner profile (1604) in a RSM (1602) to form a seal (1605) against the inner surface of wellbore casing (1601). Likewise, FIG. 17 (1700) illustrates a detailed cross section view of a WST (1703) that forms an inner profile (1704) and an outer profile (1706) in a RSM (1702) to form a seal (1705) against the inner surface of wellbore casing (1701). According to a preferred exemplary embodiment, inner and outer profiles in a RSM forms a seal against an inner surface of the wellbore casing preventing substantial axial and longitudinal movement of the RSM during perforation and hydraulic fracturing process.

Preferred Embodiment Wellbore Setting Tool (WST) System Block Diagram (1800-2200)

Figure 18:
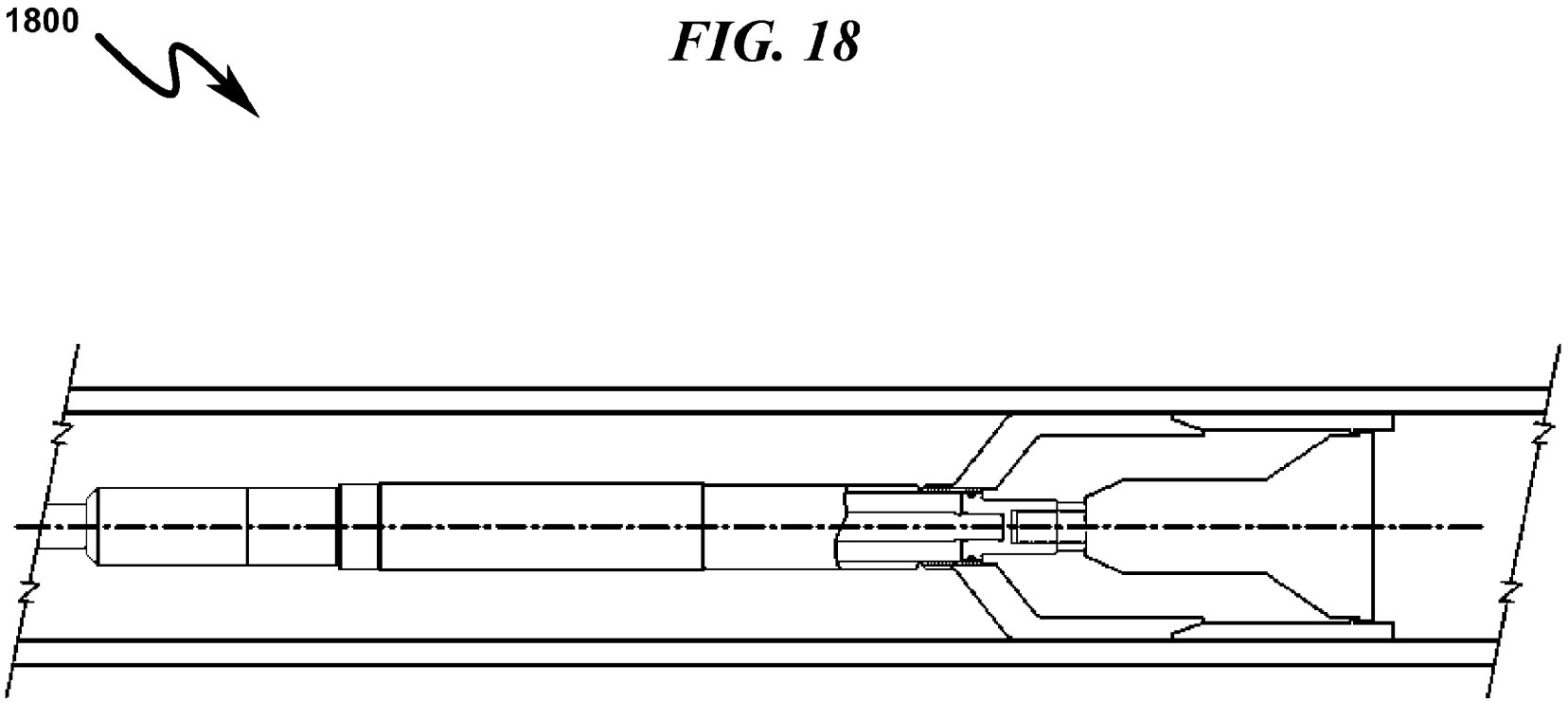
FIG. 18 illustrates a cross section view of a wellbore setting tool setting a restriction sleeve member depicting a preferred exemplary system embodiment.
Figure 19:
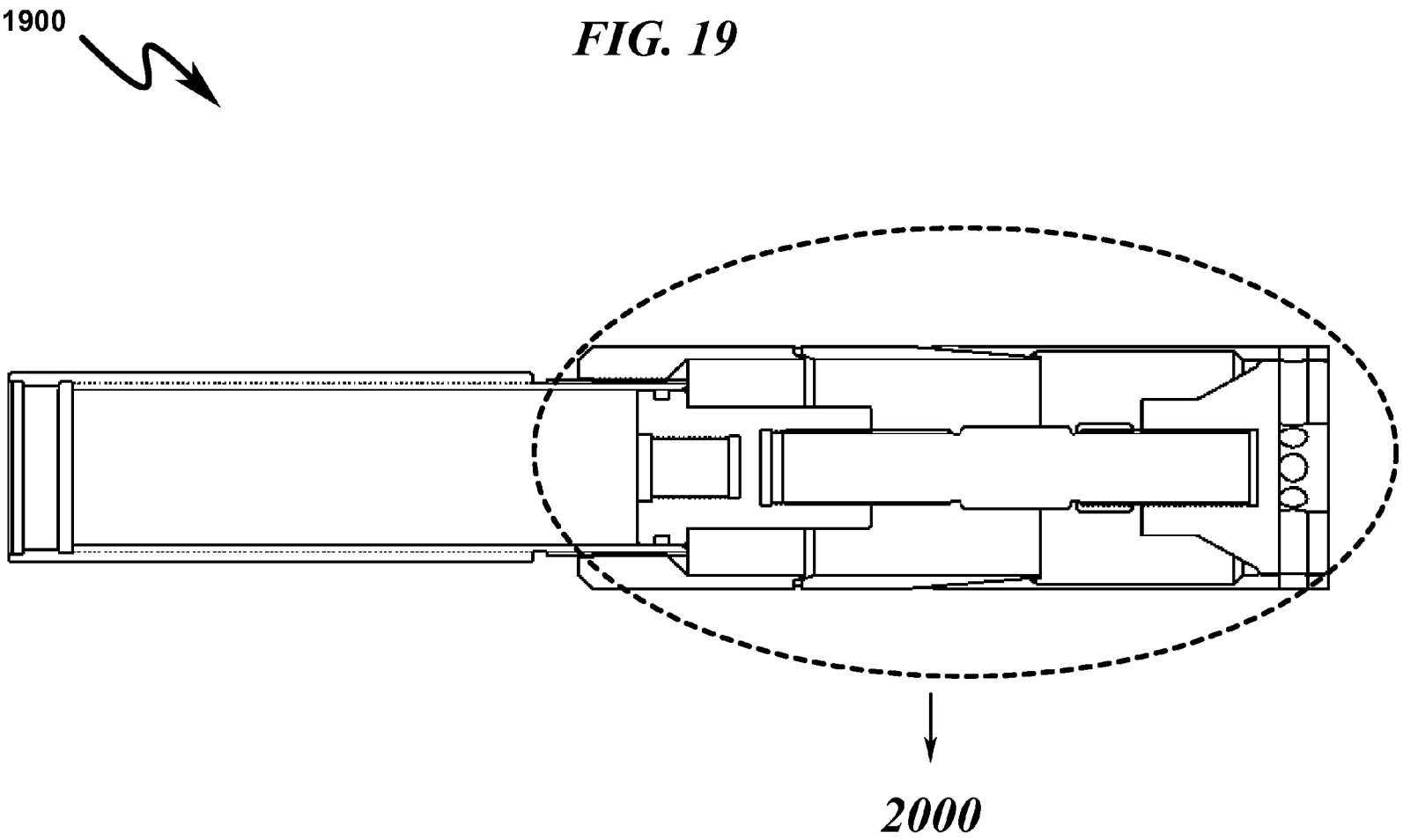
FIG. 19 illustrates a detailed cross section view of a wellbore setting tool setting a restriction sleeve member depicting a preferred exemplary system embodiment.
Figure 20:
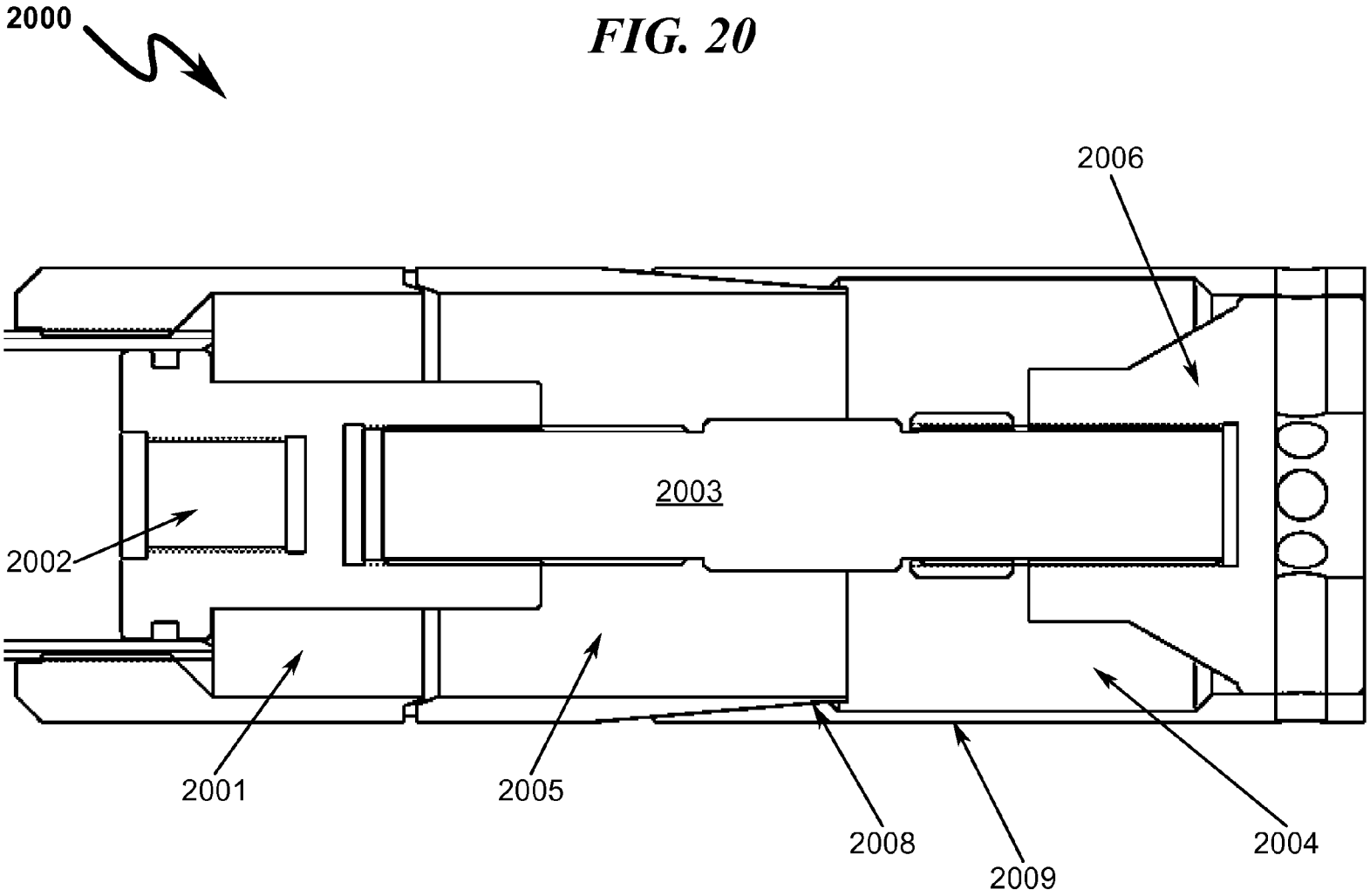
FIG. 20 illustrates a detailed side section view of a wellbore setting tool setting a restriction sleeve member depicting a preferred exemplary system embodiment.
Figure 21:
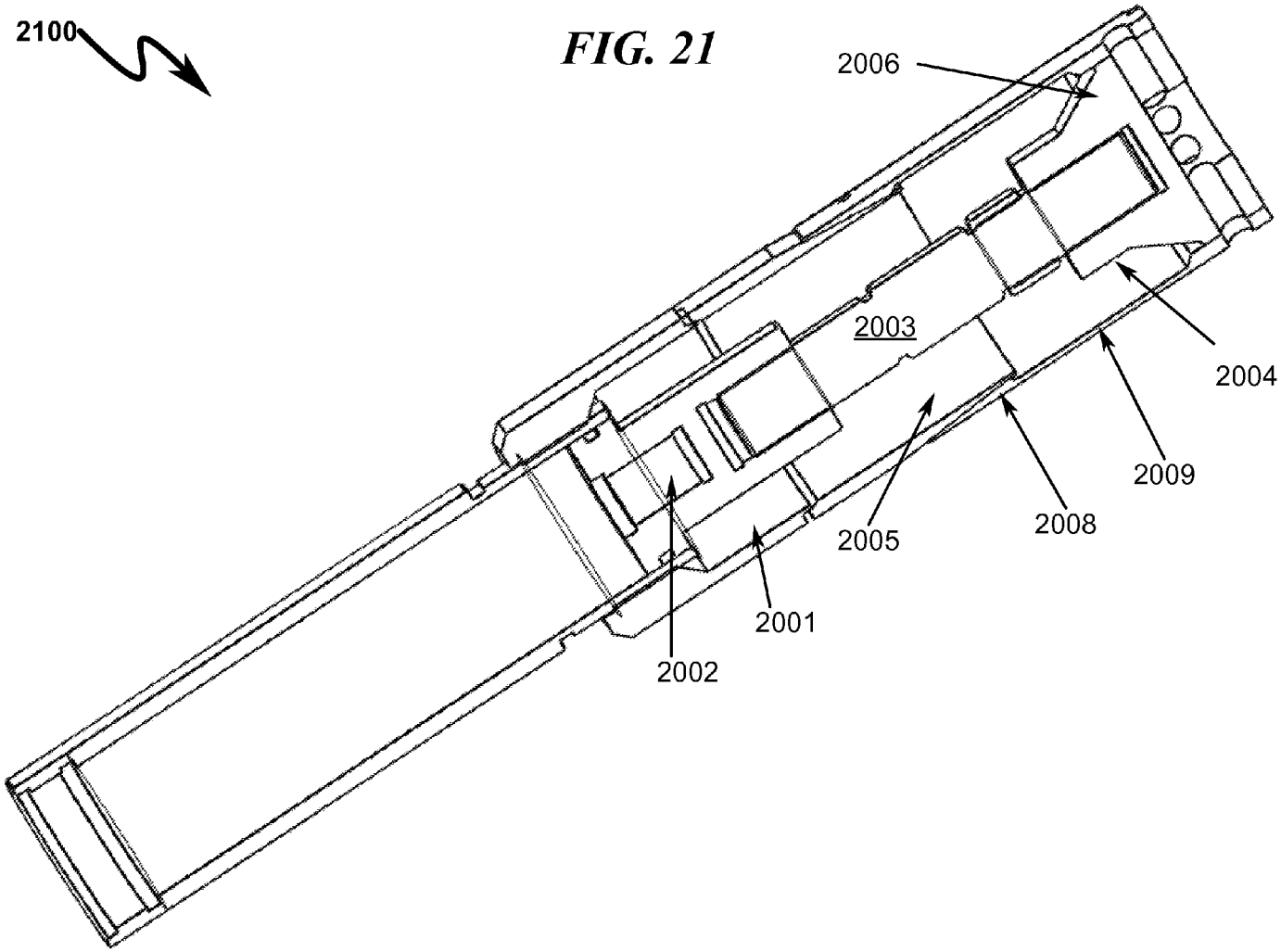
FIG. 21 illustrates a detailed perspective view of a wellbore setting tool setting a restriction sleeve member depicting a preferred exemplary system embodiment.
Figure 22:
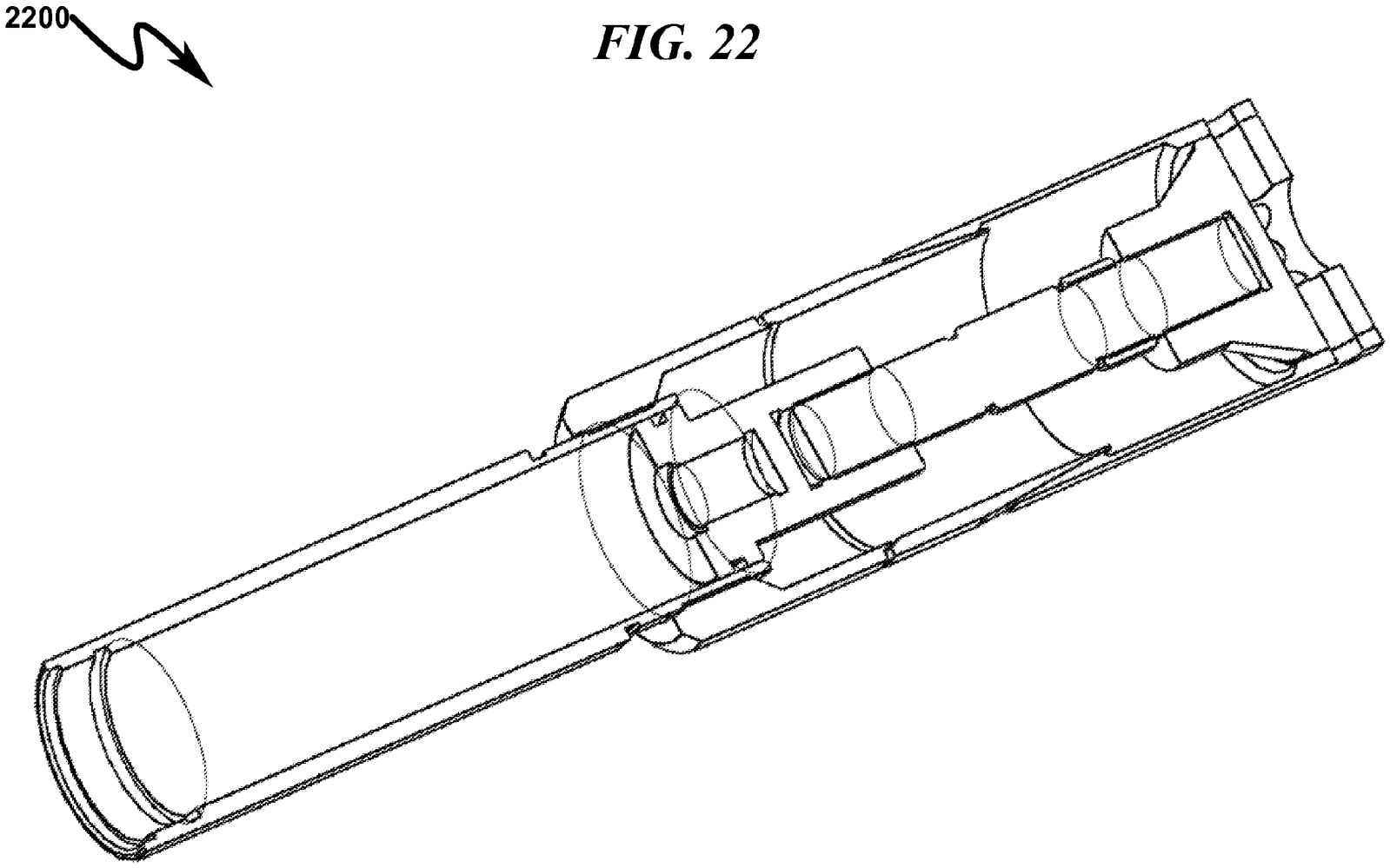
FIG. 22 illustrates another detailed perspective view of a wellbore setting tool setting a restriction sleeve member depicting a preferred exemplary system embodiment.

FIG. 18 (1800) and FIG. 19 (1900) show a front cross section view of a WST. According to a preferred exemplary embodiment, a wellbore setting tool (WST) may be seen in more detail as generally illustrated in FIG. 20 (2000). A WST-RSM sleeve adapter (2001) holds the RSM (2008) in place until it reaches the desired location down hole. After the RSM (2008) is at the desired location the WST-RSM sleeve adapter (2001) facilitates a reactionary force to engage the RSM (2008). When the WST (2002) is actuated, a RSM swaging member and plug seat (2005) provides the axial force to swage an expanding sleeve (2004) outward. A RSM-ICD expanding sleeve (2004) hoops outward to create a sealing surface between the RSM (2008) and inner casing diameter (ICD) (2009). After the WST (2002) actuation is complete, it may hold the RSM (2008) to the ICD (2009) by means of sealing force and potential use of other traction adding devices such as carbide buttons or wicker forms. The WST-RSM piston (2006) transmits the actuation force from the WST (2002) to the RSM (2008) by means of a shear set, which may be in the form of a machined ring or shear pins. The connecting rod (2003) holds the entire assembly together during the setting process. During activation, the connecting rod (2003) may transmit the setting force from the WST (2002) to the WST piston (2006). FIG. 21 (2100) and FIG. 22 (2200) show perspective views of the WST (2002) in more detail.

Preferred Embodiment Wellbore Plug Isolation System Block Diagram (2300-3100)

Figure 23:
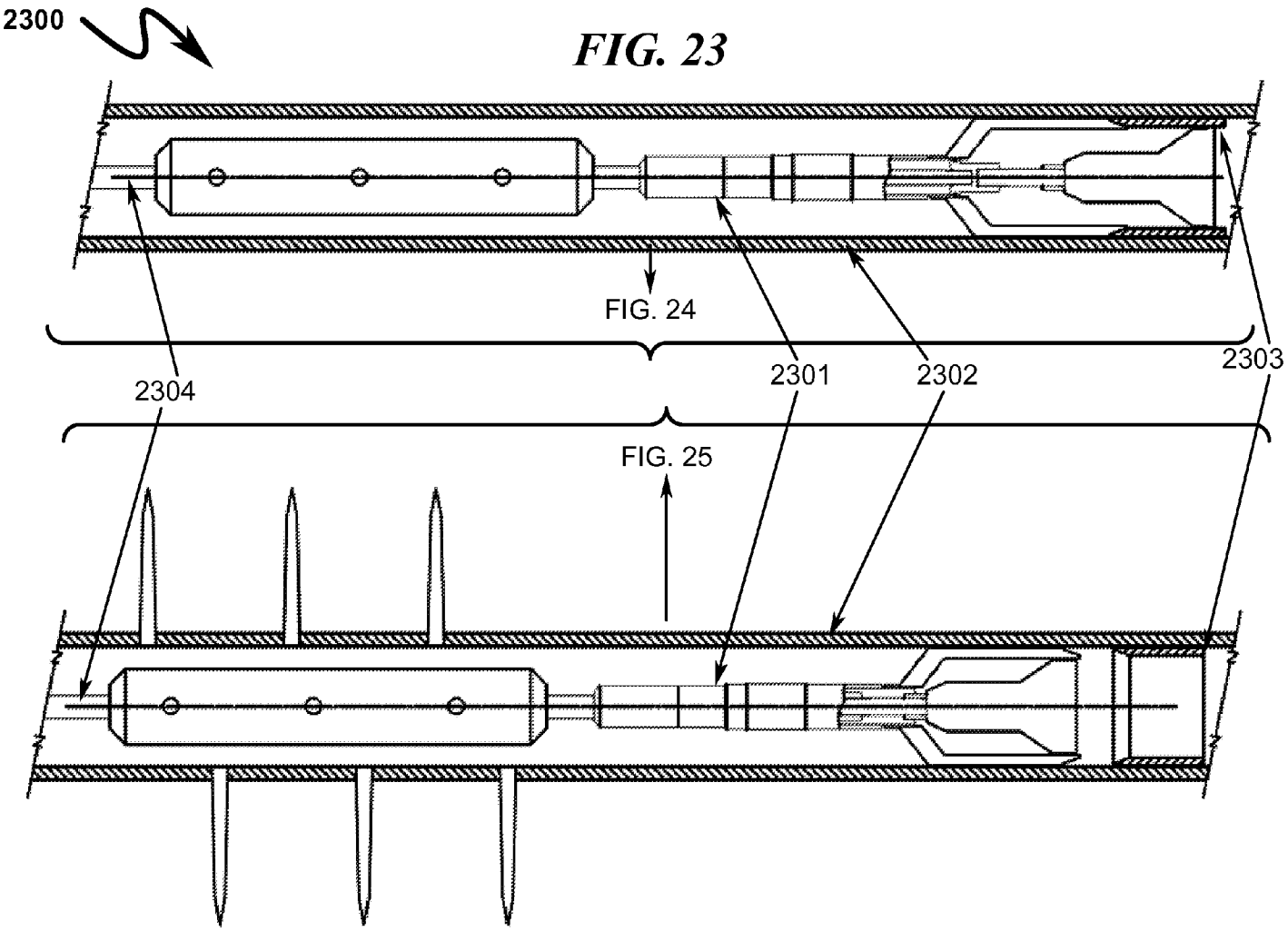
FIG. 23 illustrates a cross section view of a wellbore setting tool setting a restriction sleeve member and removing the tool depicting a preferred exemplary system embodiment.
Figure 31:
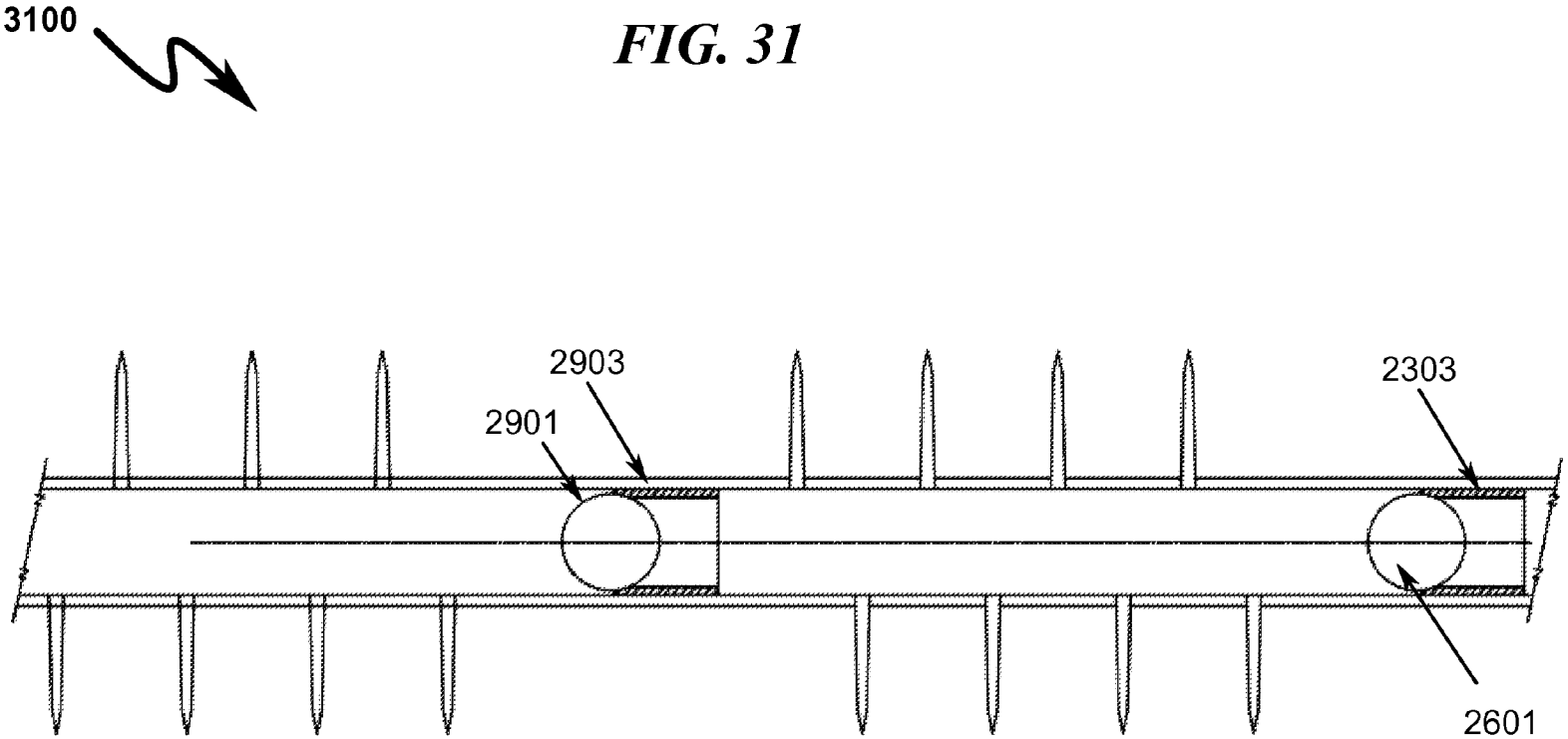
FIG. 31 illustrates a detailed cross section view of a spherical restriction plug element seated in a second restriction sleeve member depicting a preferred exemplary system embodiment.

As generally seen in the aforementioned flow chart of FIG. 6 (0600), the steps implemented for wellbore plug isolation are illustrated in FIG. 23 (2300)-FIG. 31 (3100).

Figure 24:
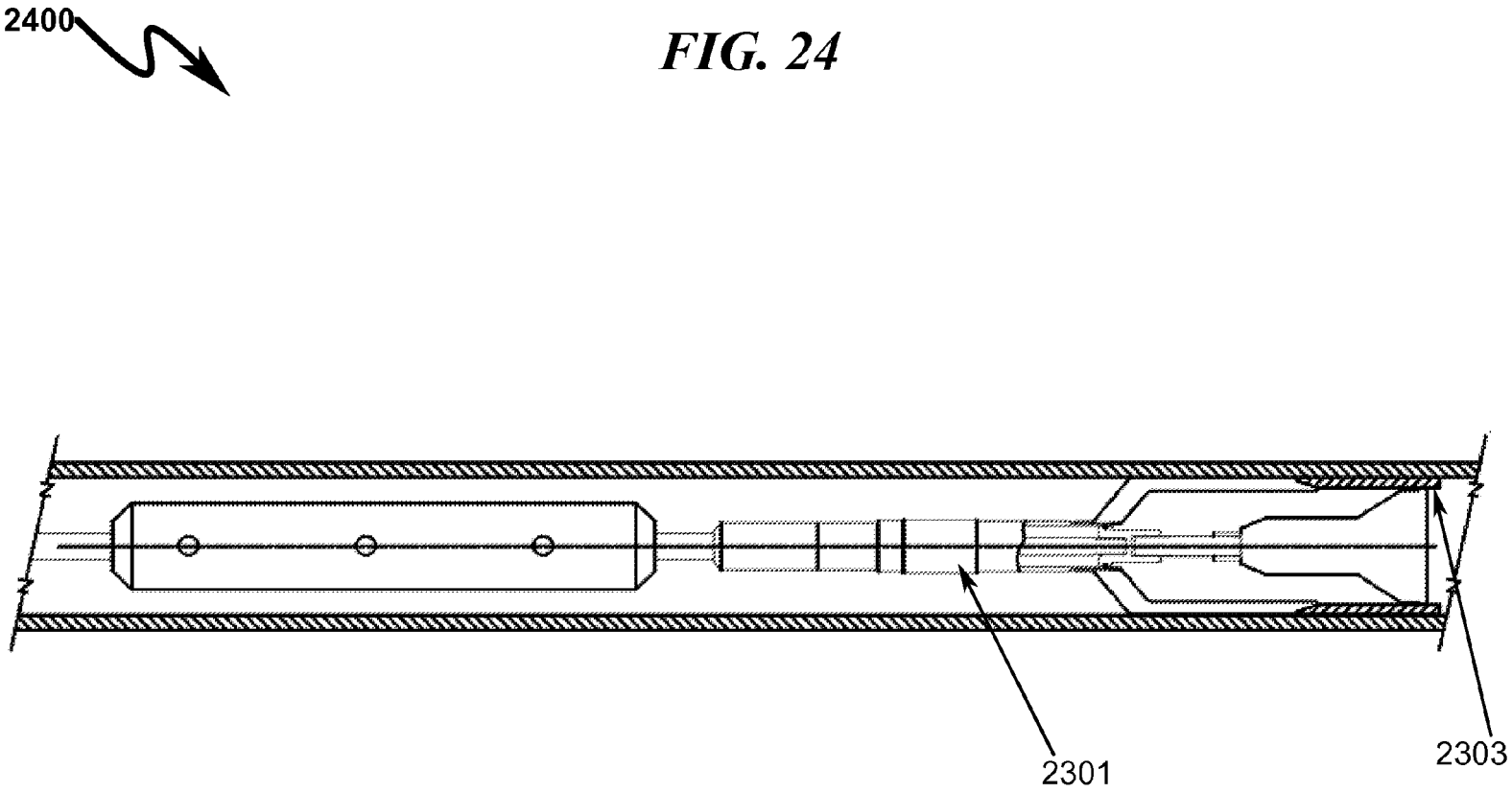
FIG. 24 illustrates a detailed cross section view of wellbore setting tool setting a restriction sleeve member depicting a preferred exemplary system embodiment.

As described above in steps (0601), (0602), and (0603) FIG. 23 (2300) shows a wellbore setting tool (WST) (2301) setting a restriction sleeve member (2303) on the inside surface of a wellbore casing (2302). The WST (2301) may create a conforming seating surface (CSS) in the RSM (2303) or the CSS may be pre-machined. A wireline (2304) or TCP may be used to pump WST (2301) to a desired location in the wellbore casing (2302). FIG. 24 (2400) shows a detailed view of setting the RSM (2303) at a desired location.

Figure 25:
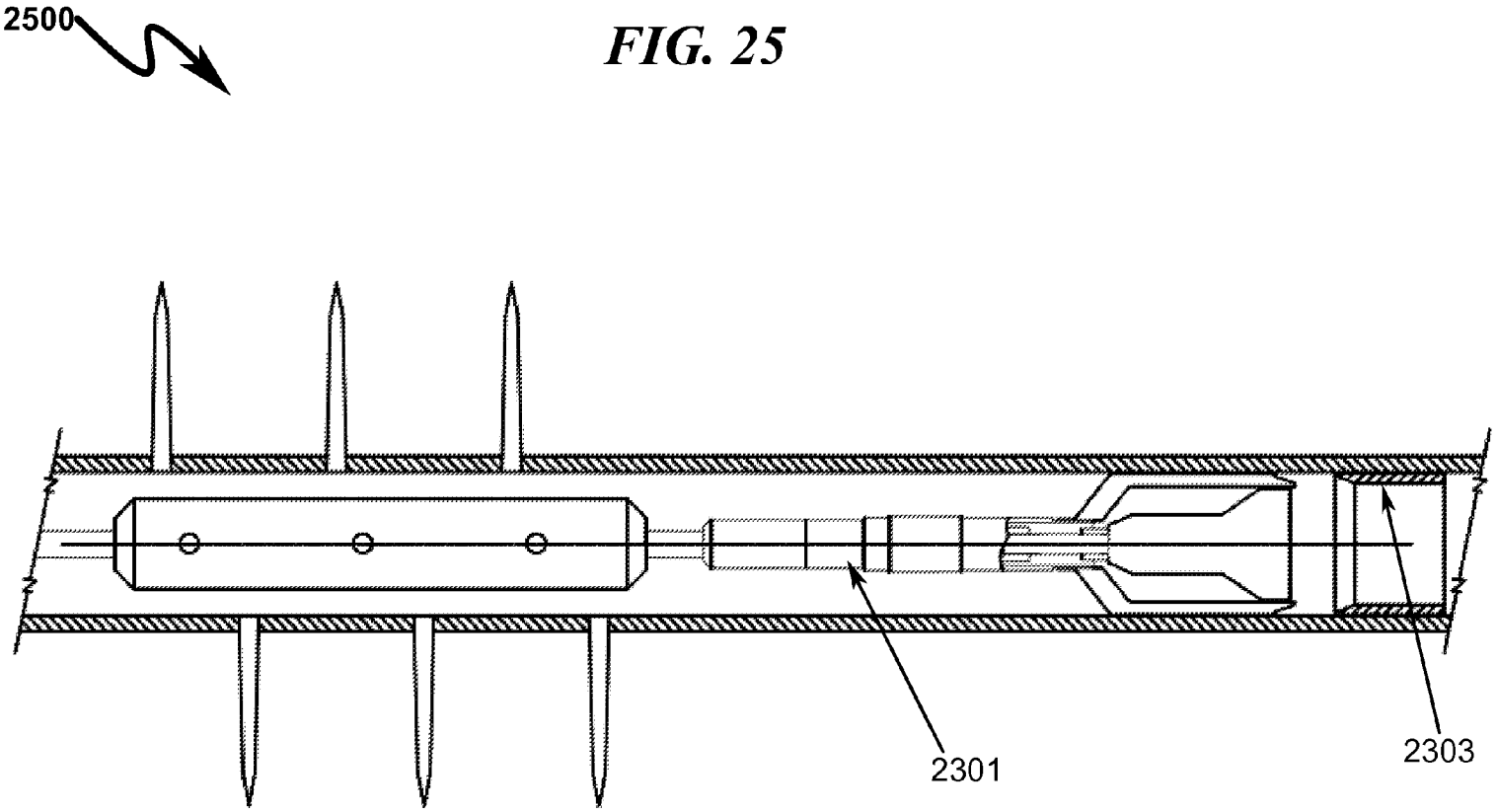
FIG. 25 illustrates a cross section view of wellbore setting tool removed from wellbore casing depicting a preferred exemplary system embodiment.

FIG. 25 (2500) illustrates the stage perforated with perforating guns after setting the RSM (2303) and removing WST (2301) as aforementioned in steps (0604) and (0605).

Figure 26:
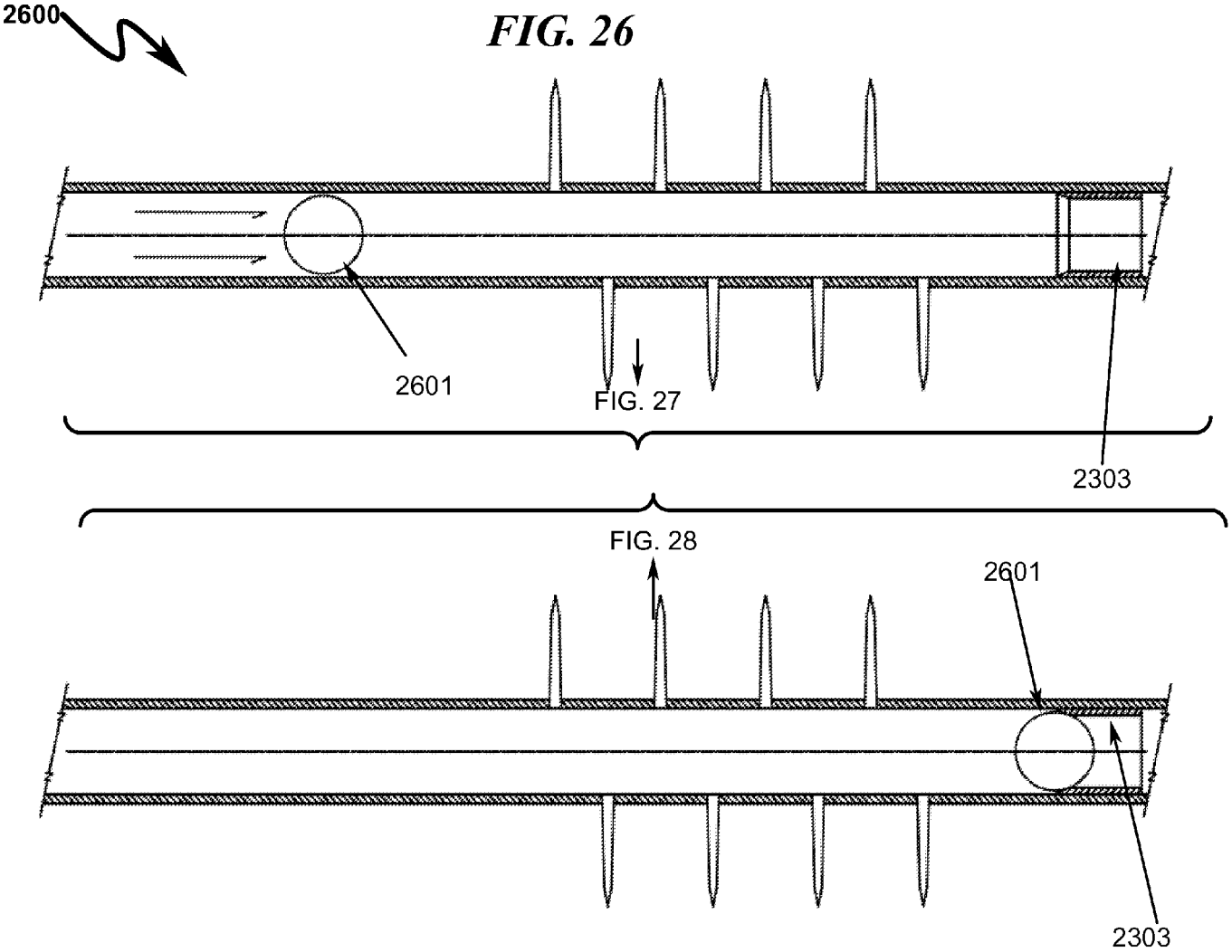
FIG. 26 illustrates a cross section view of a spherical restriction plug element deployed and seated into a restriction sleeve member depicting a preferred exemplary system embodiment.
Figure 27:
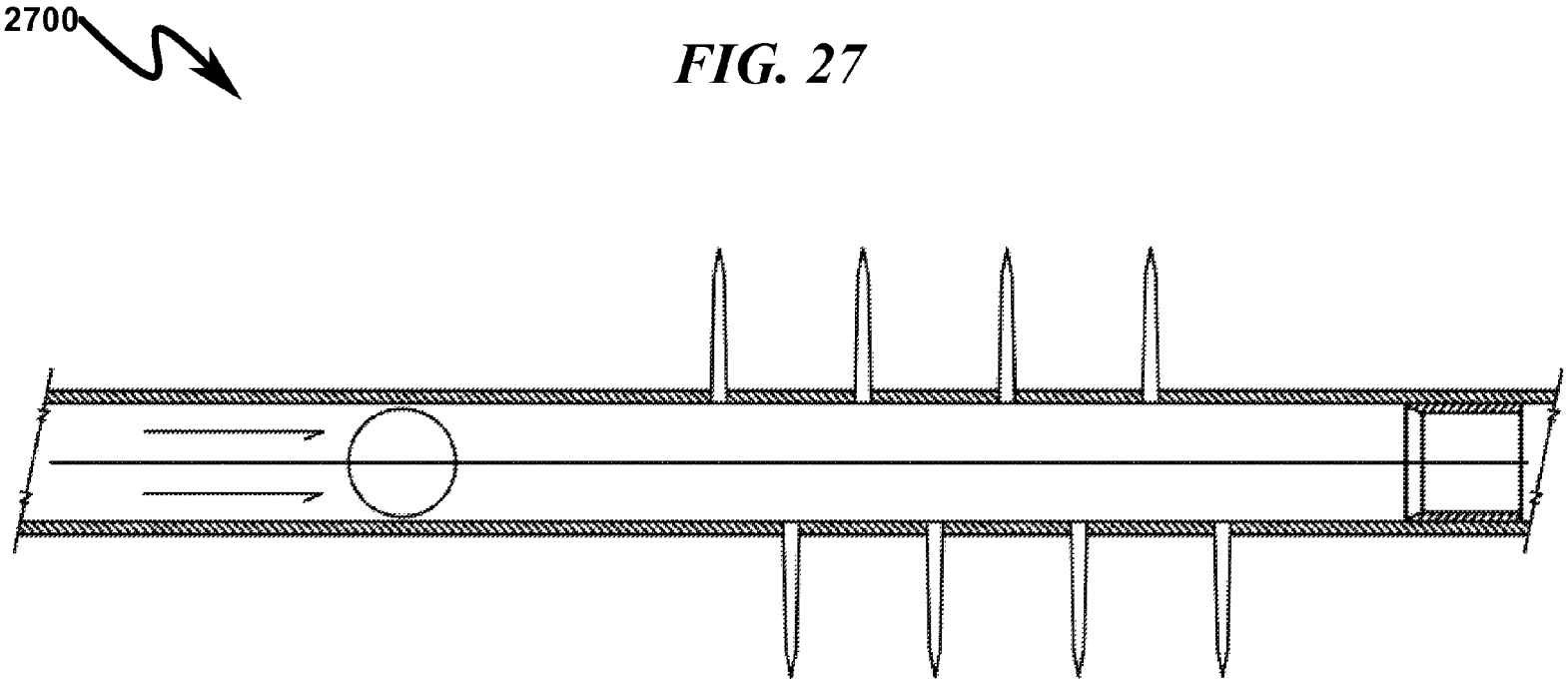
FIG. 27 illustrates a detailed cross section view of a spherical restriction plug element deployed into a restriction sleeve member depicting a preferred exemplary system embodiment.
Figure 28:
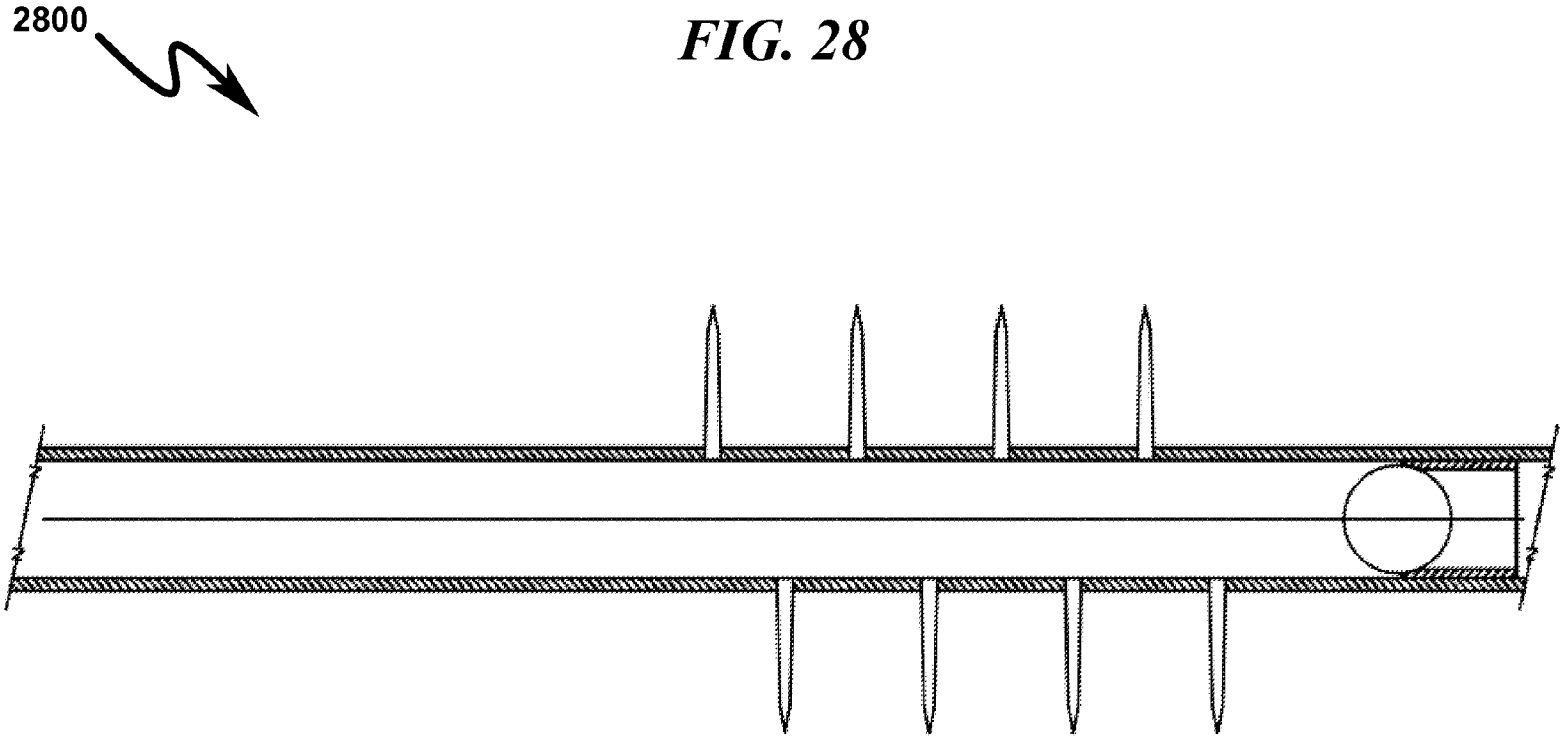
FIG. 28 illustrates a detailed cross section view of a spherical restriction plug element seated in a restriction sleeve member depicting a preferred exemplary system embodiment.

FIG. 26 (2600) illustrates a restriction plug element (RPE) (2601) deployed into the wellbore casing as described in step (0606). The RPE (2601) may seat in the conforming seating surface in RSM (2303) or directly in the RSM if the CSS is not present. After the RPE (2601) is seated, the stage is isolated from toe end pressure communication. The isolated stage is hydraulically fractured as described in step (0607). FIG. 27 (2700) shows details of RPE (2601) deployed into the wellbore casing. FIG. 28 (2800) shows details of RPE (2601) seated in RSM (2303).

Figure 29:
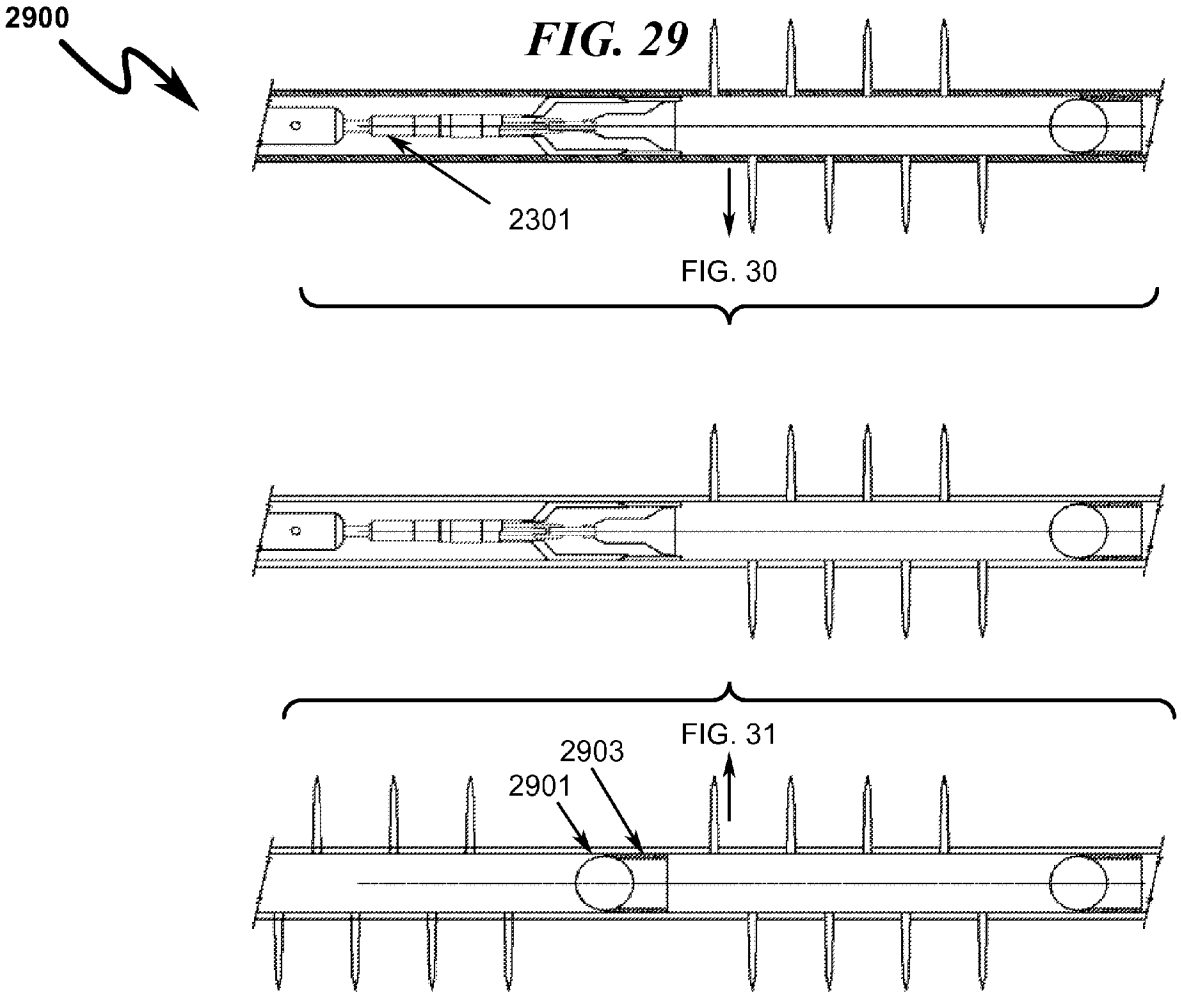
FIG. 29 illustrates a cross section view of wellbore setting tool setting a restriction sleeve member seating a second restriction plug element depicting a preferred exemplary system embodiment.
Figure 30:
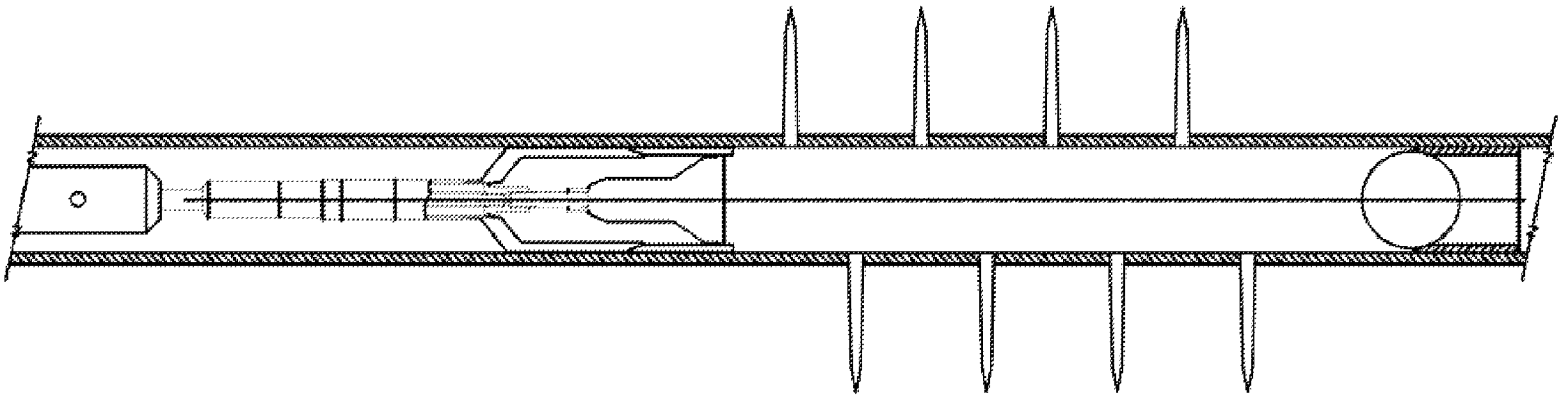
FIG. 30 illustrates a detailed cross section view of a wellbore setting tool setting a second restriction sleeve member depicting a preferred exemplary system embodiment.

FIG. 29 (2900) illustrates a WST (2301) setting another RSM (2903) at another desired location towards heel of the RSM (2303). Another RPE (2901) is deployed to seat in the RSM (2903). The RPE (2901) isolates another stage toe ward of the aforementioned isolated stage. The isolated stage is fractured with hydraulic fracturing fluids. FIG. 30 (3000) shows a detailed cross section view of WST (2301) setting RSM (2903) at a desired location. FIG. 31 (3100) shows a detailed cross section view of an RPE (2901) seated in RSM (2903). When all the stages are complete as described in (0608) the RPEs may remain in between the RSMs or flowed back or pumped into the wellbore (0609). According to a preferred exemplary embodiment, the RPE's and RSM's are degradable which enables larger inner diameter to efficiently pump oil and gas without restrictions and obstructions.

Preferred Embodiment Restriction Sleeve Member (RSM) with Flow Channels Block Diagram (3200-3400)

Figure 32:
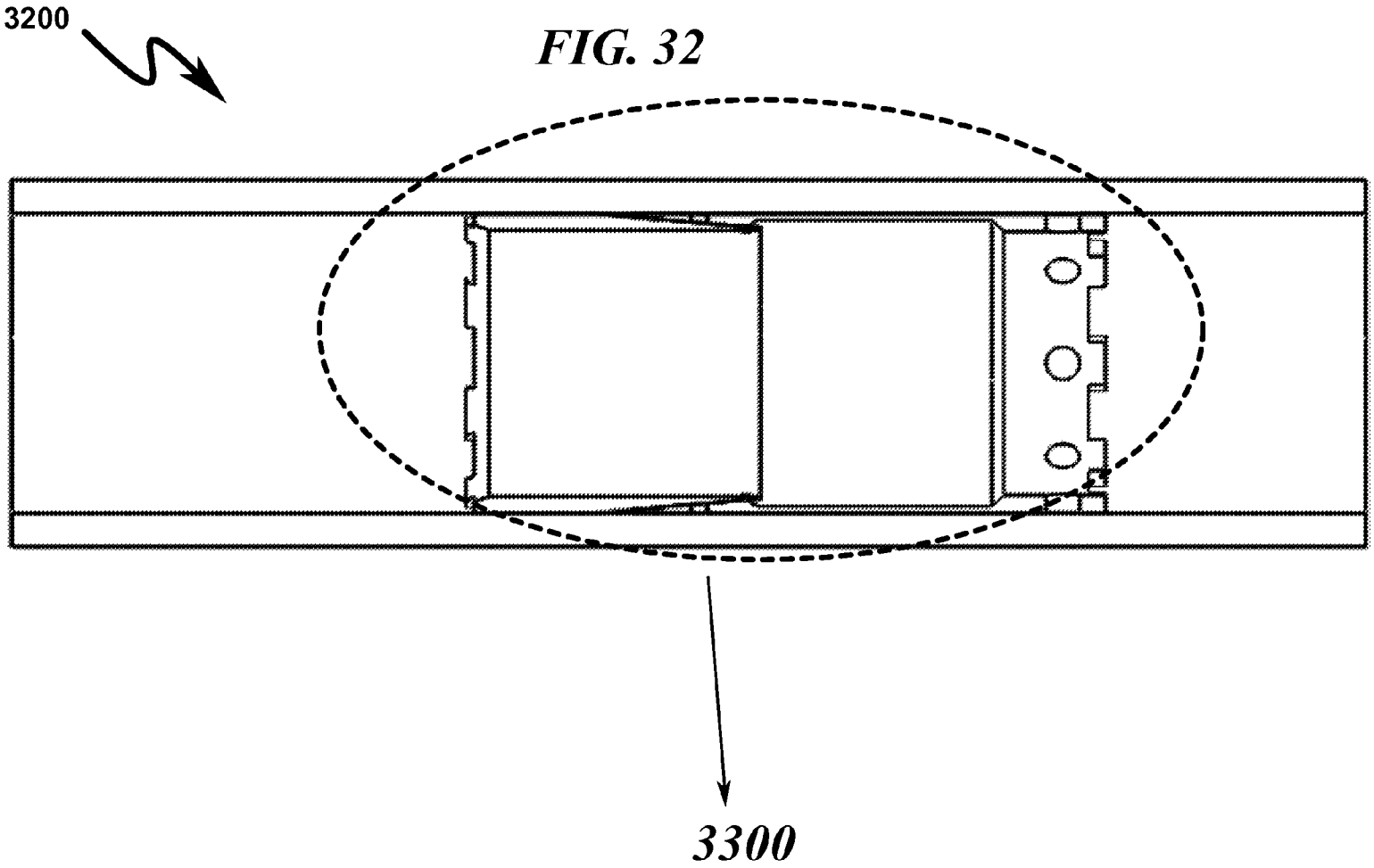
FIG. 32 illustrates a cross section view of a restriction sleeve member with flow channels according to a preferred exemplary system embodiment.
Figure 33:
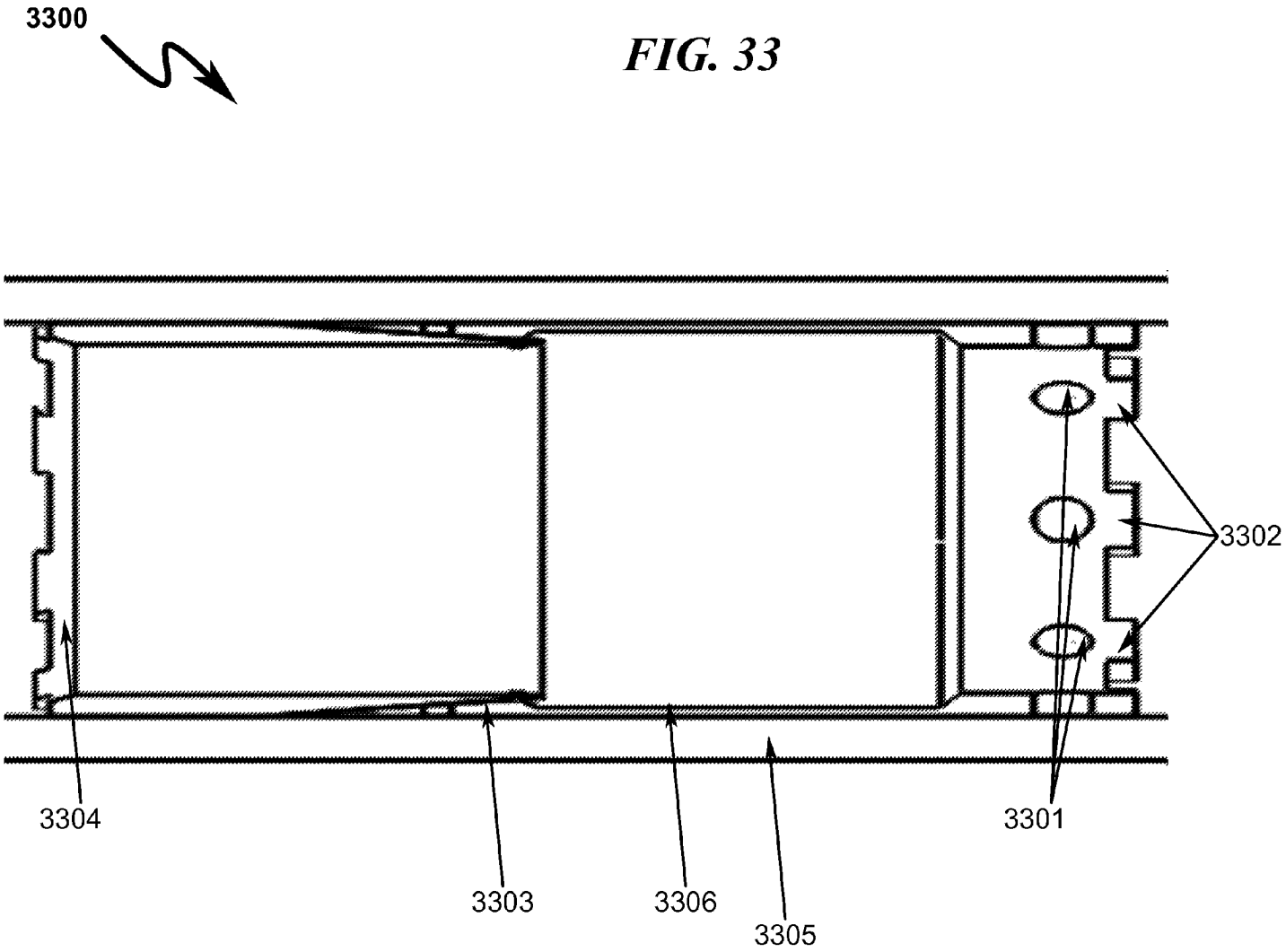
FIG. 33 illustrates a detailed cross section view of a restriction sleeve member with flow channels according to a preferred exemplary system embodiment.
Figure 34:
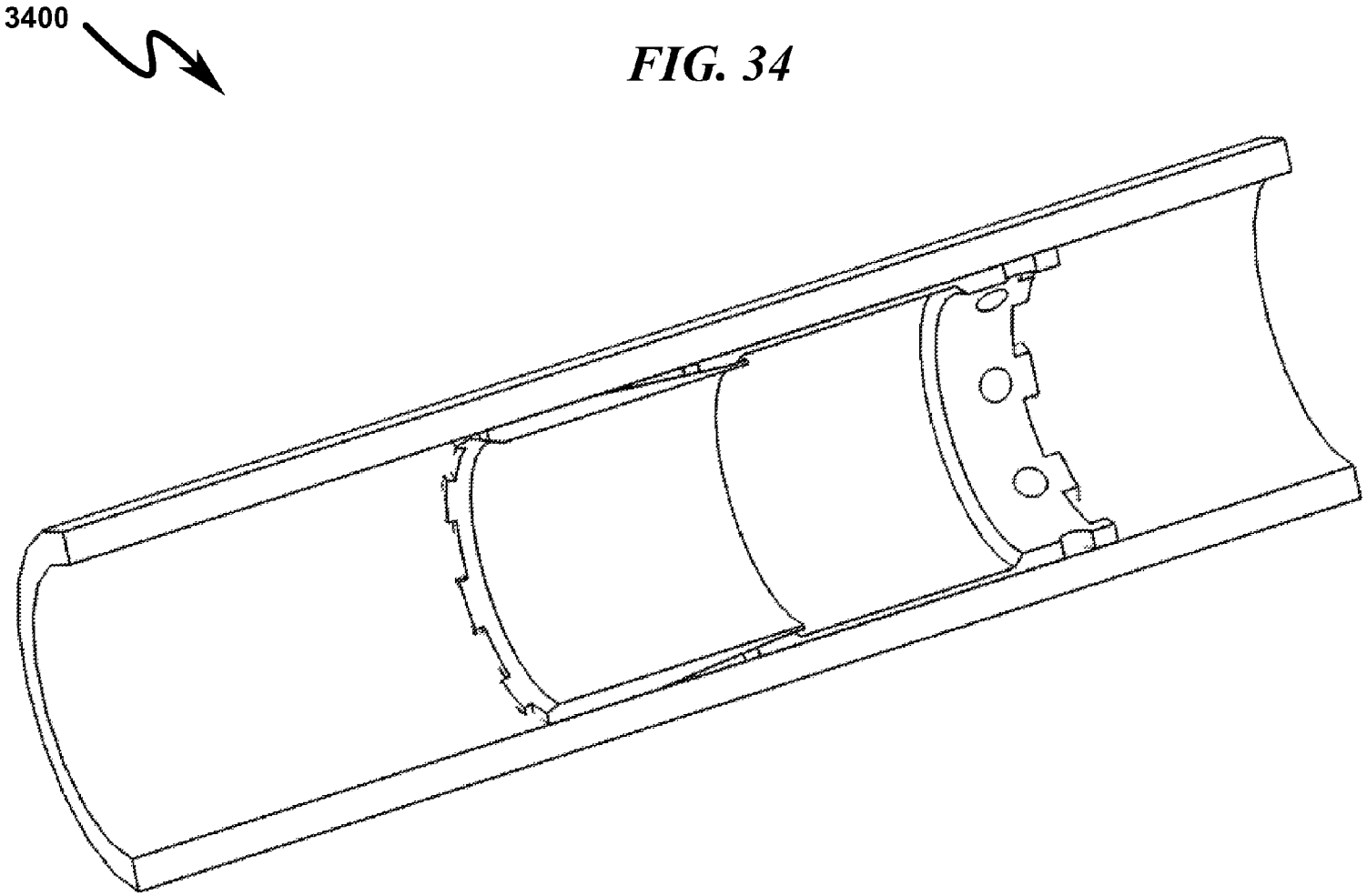
FIG. 34 illustrates a perspective view of a restriction sleeve member with flow channels according to a preferred exemplary system embodiment.

A further preferred embodiment may be seen in more detail as generally illustrated in FIG. 32 (3200), FIG. 33 (3300) and FIG. 34 (3400), wherein a restrictive sleeve member RSM (3306) comprising flow channels (3301) is set inside a wellbore casing (3305). A conforming seating surface (CSS) (3303) may be formed in the RSM (3306). The flow channels (3301) are designed in RSM (3306) to enable fluid flow during oil and gas production. The flow channels provide a fluid path in the production direction when restriction plug elements (RPE) degrade but are not removed after all stages are hydraulically fractured as aforementioned in FIG. 0600) step (0609). The channels (3301) are designed such that there is unrestricted fluid flow in the production direction (heel ward) while the RPEs block fluid communication in the injection direction (toe ward). Leaving the RPEs in place provides a distinct advantage over the prior art where a milling operation is required to mill out frac plugs that are positioned to isolate stages.

According to yet another preferred embodiment, the RSMs may be designed with fingers on either end to facilitate milling operation, if needed. Toe end fingers (3302) and heel end fingers (3304) may be designed on the toe end and heel end the RSM (3306) respectively. In the context of a milling operation, the toe end fingers may be pushed towards the heel end fingers of the next RSM (toe ward) such that the fingers are intertwined and interlocked. Subsequently, all the RSMs may be interlocked with each other finally eventually mill out in one operation as compared to the current method of milling each RSM separately.

Preferred Embodiment Wellbore Setting Tool (WST) System Double Set Block Diagram (3500-3700)

Figure 35:
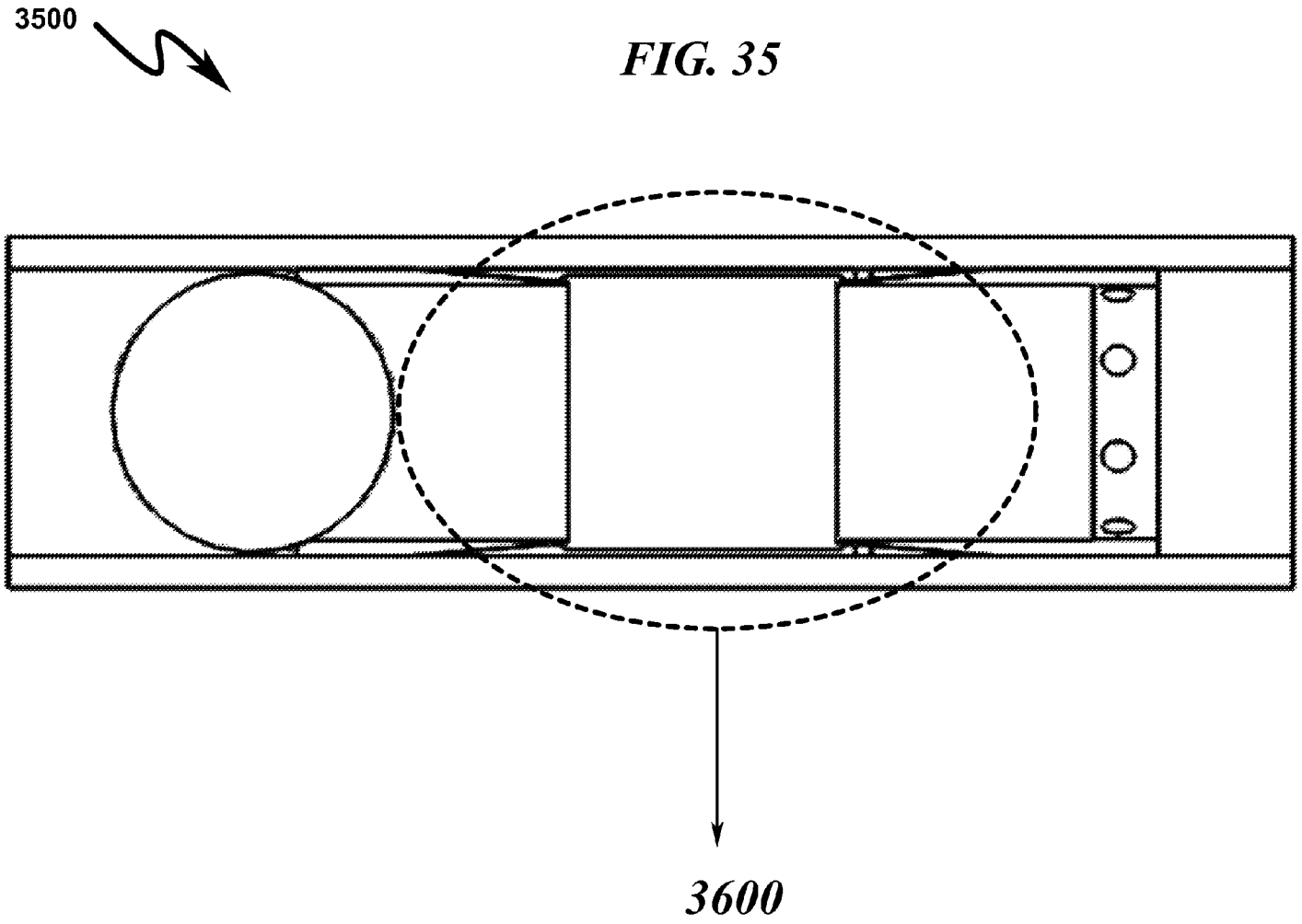
FIG. 35 illustrates a cross section view of a double set restriction sleeve member according to a preferred exemplary system embodiment.
Figure 36:
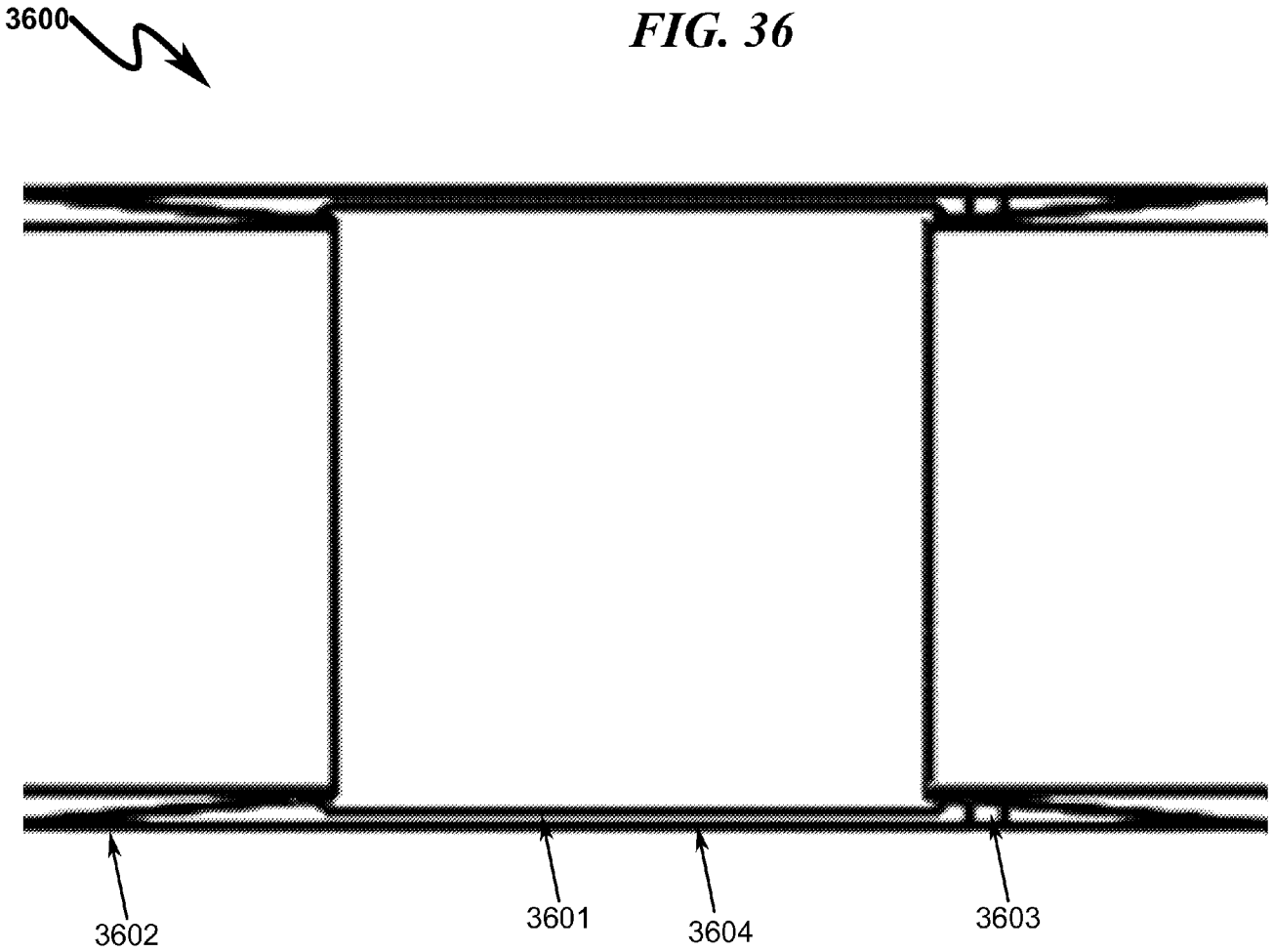
FIG. 36 illustrates a detailed cross section view of a double set restriction sleeve member according to a preferred exemplary system embodiment.
Figure 37:
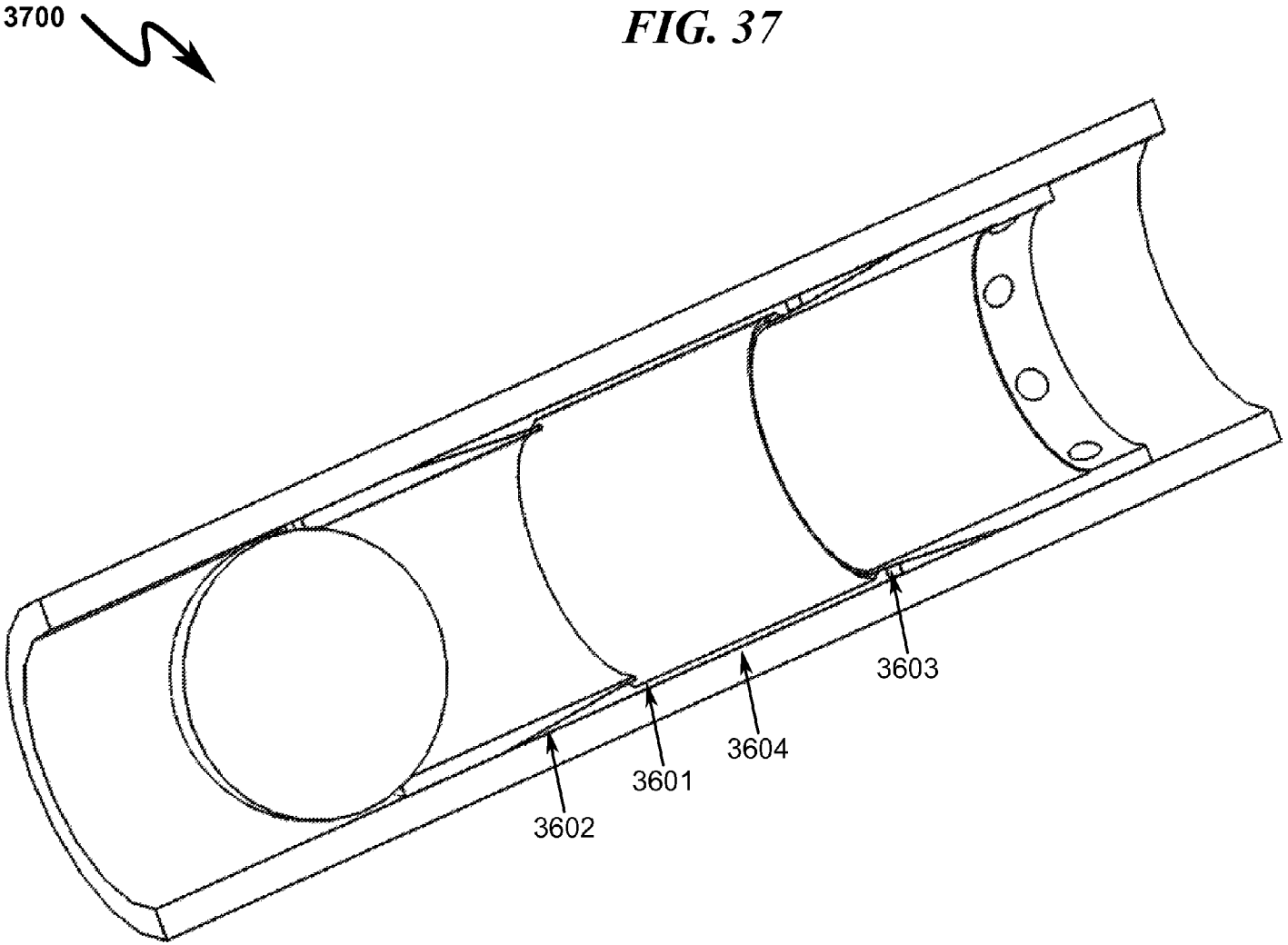
FIG. 37 illustrates a perspective view of a double set restriction sleeve member according to a preferred exemplary system embodiment.

As generally illustrated in FIG. 35 (3500), FIG. 36 (3600) and FIG. 37 (3700) a wellbore setting tool sets or seals on both sides of a restriction sleeve member (RSM) (3601) on the inner surface (3604) of a wellbore casing. In this context the WST swags the RSM on both sides (double set) and sets it to the inside surface of the wellbore casing. On one end of the RSM (3601), a RSM-ICD expanding sleeve in the WST may hoop outward to create a sealing surface between the RSM (3601) and inner casing diameter (ICS) (3604). On the other side of the RSM (3601), when WST actuation is complete, the WST may hold the RSM (3601) to the ICS (3604) by means of sealing force and potential use of other traction adding gripping devices (3603) such as elastomers, carbide buttons or wicker forms.

According to a preferred exemplary embodiment, a double set option is provided with a WST to seal one end of the RSM directly to the inner surface of the wellbore casing while the other end is sealed with a gripping element to prevent substantial axial and longitudinal movement.

Preferred Embodiment Wellbore Setting Tool (WST) System Multiple Set Block Diagram (3800-4100)

Figure 38:
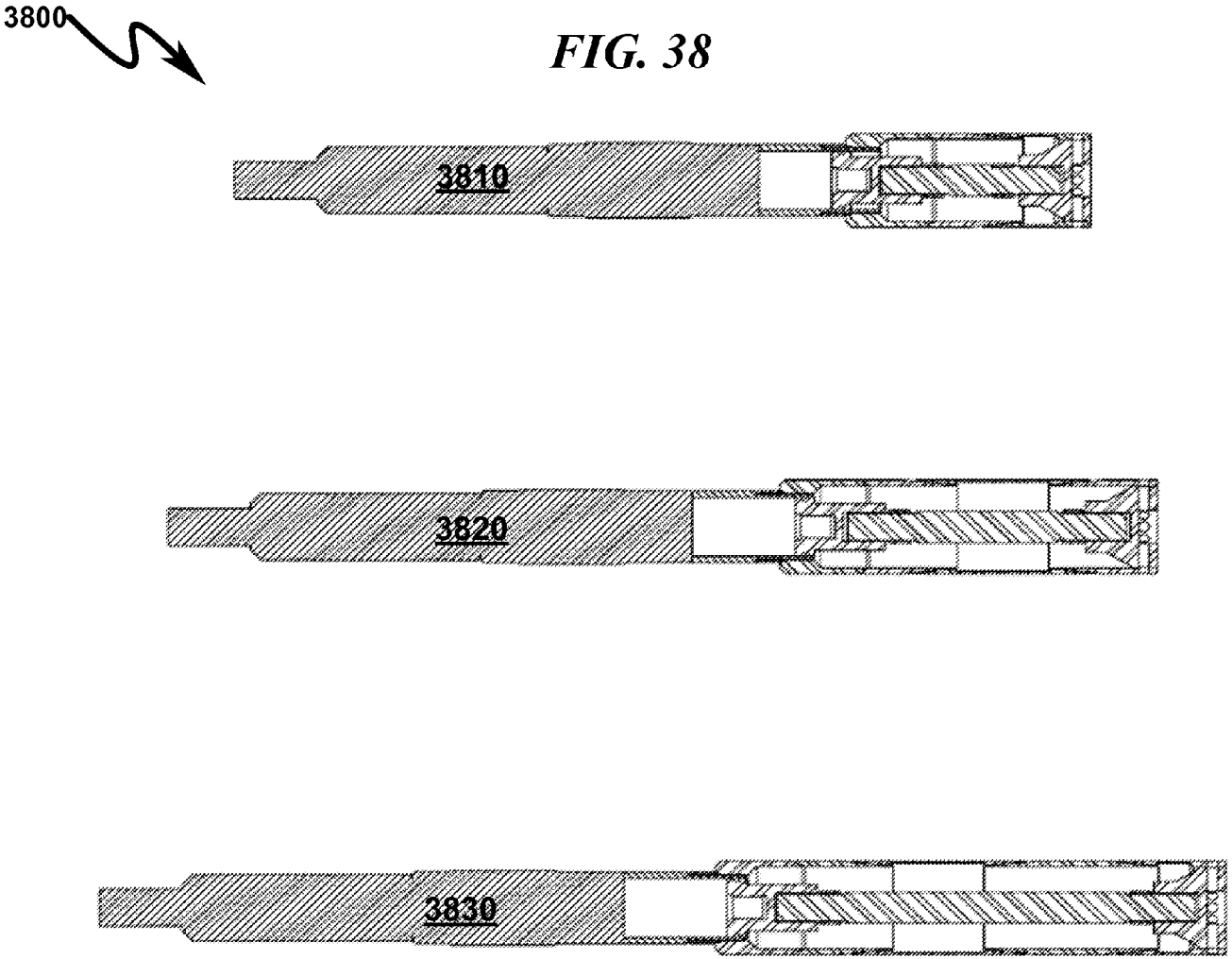
FIG. 38 illustrates a cross section view of a WST setting restriction sleeve member at single, double and triple locations according to a preferred exemplary system embodiment.
Figure 39:
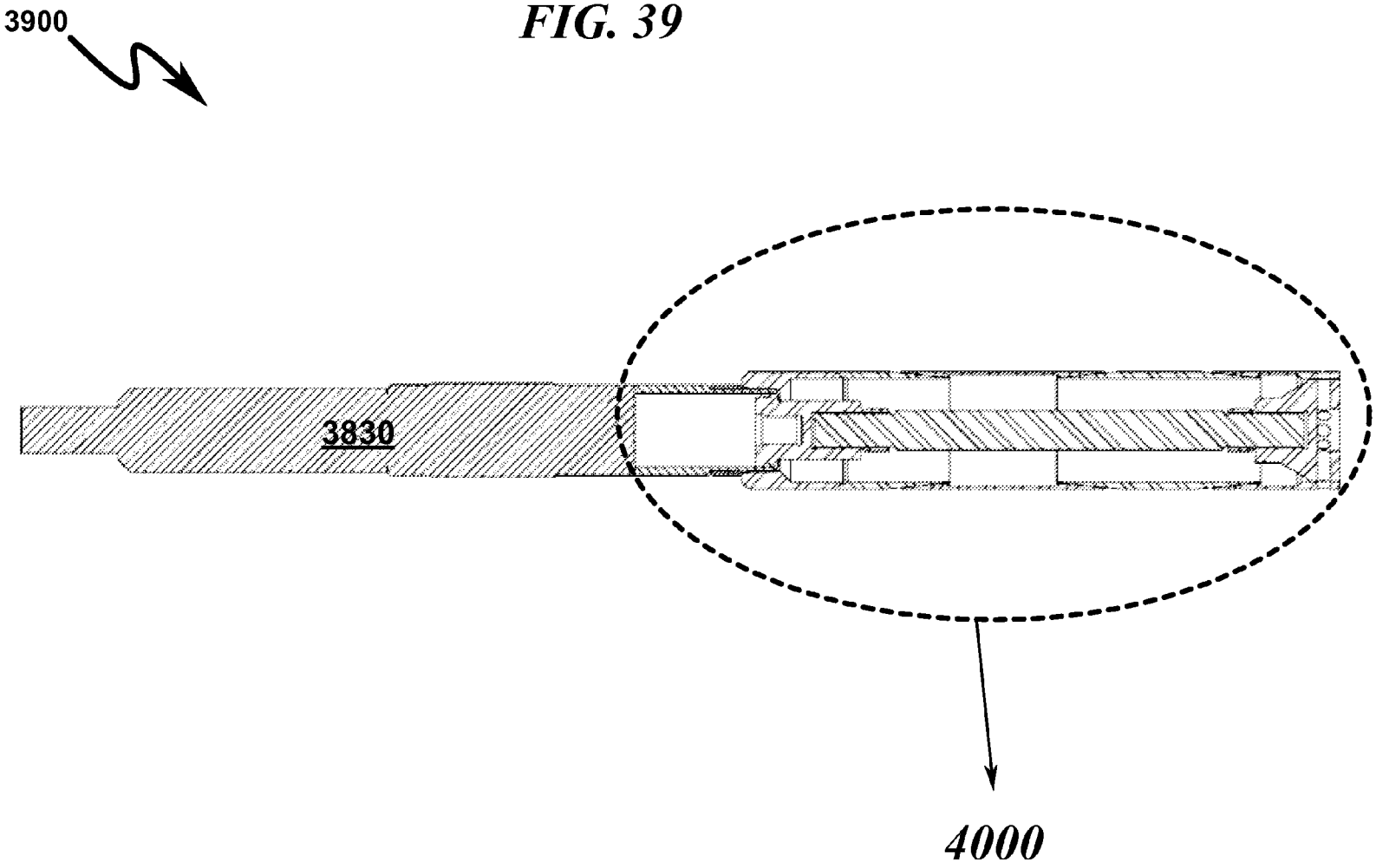
FIG. 39 illustrates a cross section view of a WST with triple set restriction sleeve member according to a preferred exemplary system embodiment.
Figure 40:
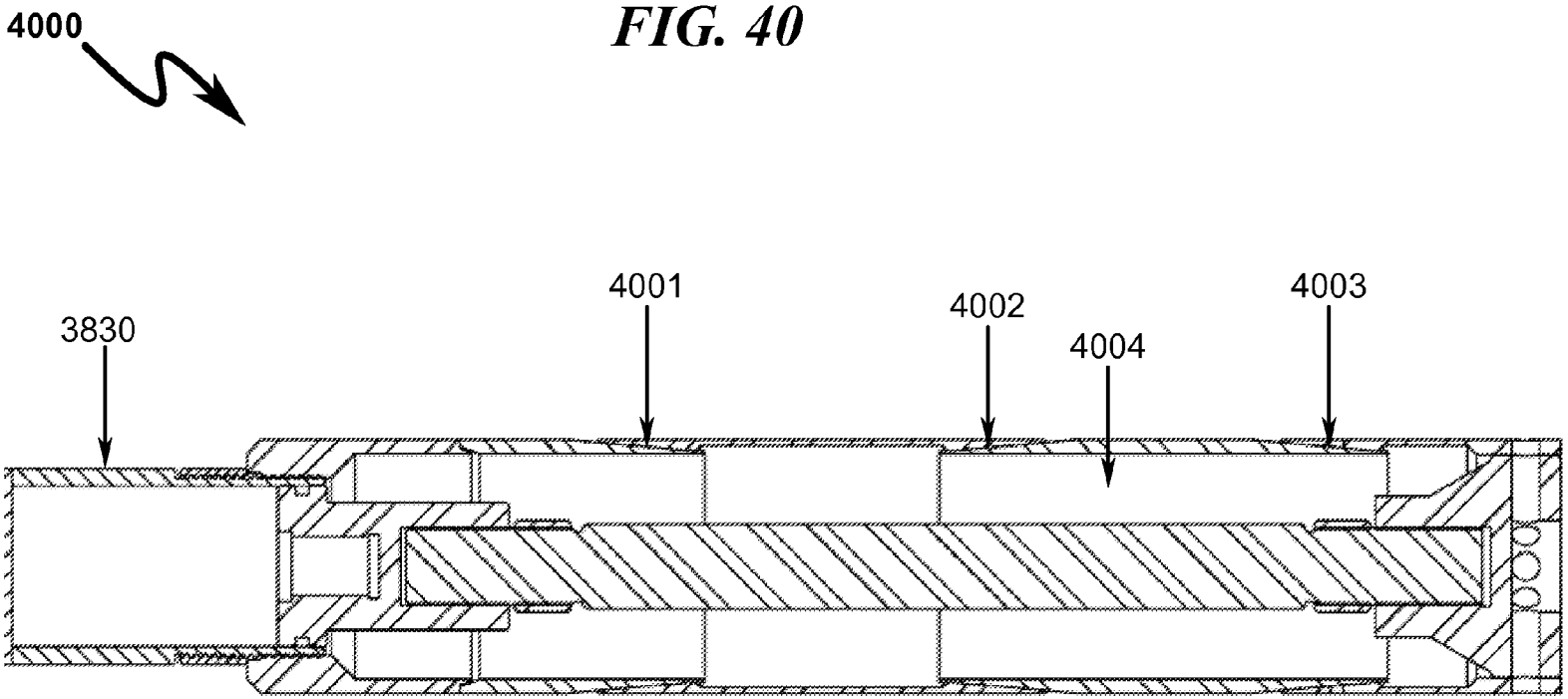
FIG. 40 illustrates a detailed cross section view of a triple set restriction sleeve member according to a preferred exemplary system embodiment.
Figure 41:
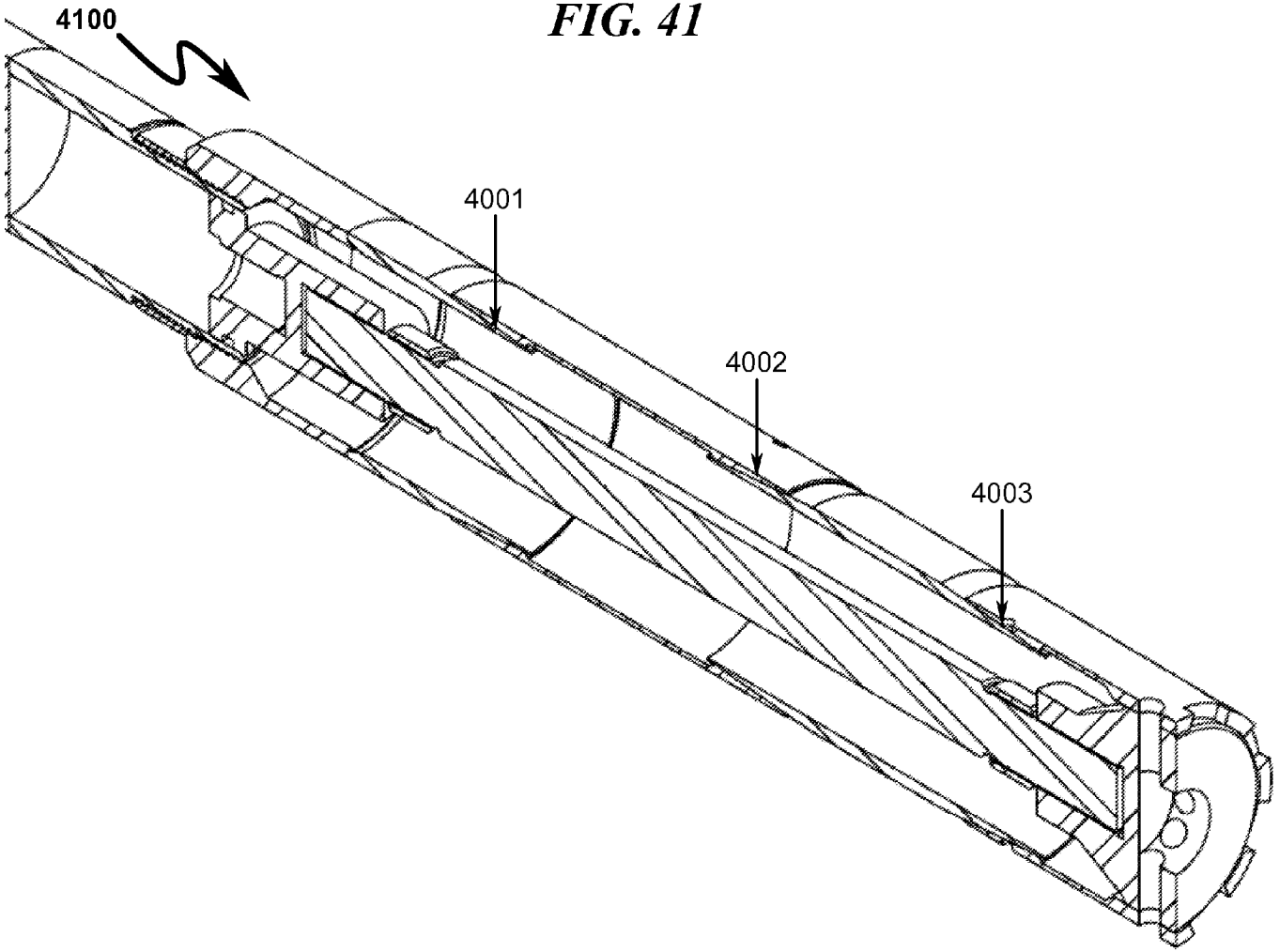
FIG. 41 illustrates a detailed perspective view of a triple set restriction sleeve member according to a preferred exemplary system embodiment.

As generally illustrated in FIG. 38 (3800), FIG. 39 (3900), FIG. 40 (4000), and FIG. 41 (4100) a wellbore setting tool sets or seals RSM at multiple locations. FIG. 38 (3800) shows a WST (3810) that may set or seal RSM at single location (single set), a WST (3820) that may set or seal RSM at double locations (double set), or a WST (3830) that may set or seal RSM 3 locations (triple set). A more detail illustration of WST (3830) may be seen in FIG. 40 (4000). The WST (3830) sets RSM (4004) at 3 locations (4001), (4002), and (4003). According to a preferred exemplary embodiment, WST sets or seals RSM at multiple locations to prevent substantial axial or longitudinal movement of the RSM. It should be noted that single, double and triple sets have been shown for illustrations purposes only and should not be construed as a limitation. The WST could set or seal RSM at multiple locations and not limited to single, double, or triple set as aforementioned. An isometric view of the triple set can be seen in FIG. 41 (4100).

Preferred Embodiment Restriction Sleeve Member Polished Bore Receptacle (PBR)

According to a preferred exemplary embodiment, the restricted sleeve member could still be configured with or without a CSS. The inner sleeve surface (ISS) of the RSM may be made of a polished bore receptacle (PBR). Instead of an independently pumped down RPE, however, a sealing device could be deployed on a wireline or as part of a tubular string. The sealing device could then seal with sealing elements within the restricted diameter of the internal sleeve surface (ISS), but not in the ICS surface. PBR surface within the ISS provides a distinct advantage of selectively sealing RSM at desired wellbore locations to perform treatment or re-treatment operations between the sealed locations, well production test, or test for casing integrity.

Preferred Embodiment Restriction Plug Element First Composition Materials

The RPEs of the present invention are designed for strength, rigidity and hardness sufficient to withstand the high pressure differentials required during well stimulation, which typically range from about 1,000 pounds per square inch (psi) to about 10,000 psi. According to certain embodiments, the RPE of the present invention is formed of a material or combination of materials having sufficient strength, rigidity and hardness at a temperature of from about 150° F. to about 350° F., from about 150° F. to about 220° F. or from about 150° F. to about 200° F. to seat in the RSM and then withstand deformation under the high pressure ranging from about 1,000 psi to about 10,000 psi associated with hydraulic fracturing processes. The materials selected for first composition deform enough to allow a second composition to exit through a passage when the second composition changes phase or loses strength upon exposure to wellbore temperature or fracturing fluids.

One class of useful materials for the first composition is elastomers. "Elastomer" as used herein is a generic term for substances emulating natural rubber in that they stretch under tension, have a high tensile strength, retract rapidly, and substantially recover their original dimensions. The term includes natural and man-made elastomers, and the elastomer may be a thermoplastic elastomer or a non-thermoplastic elastomer. The term includes blends (physical mixtures) of elastomers, as well as copolymers, terpolymers, and multi-polymers. Useful elastomers may also include one or more additives, fillers, plasticizers, and the like. Other materials may non-degradable group that includes G-10 (glass reinforced Epoxy Laminate), FR4, PEEK (Injection Molded), Nylon GF, Torlon, Steel, Aluminum, Stainless Steel, Nylon MF, Nylon GF, Magnesium Alloy (without HCL), Ceramic, Cast Iron, Thermoset Plastics, and Elastomers (rubber, nitrile, niton, silicone, etc.). The first composition may also include materials from a long term degradable group that includes PGA (polyglycolic acid) and Magnesium Alloy (with HCL).

Preferred Embodiment Restriction Plug Element Second Composition Materials

According to a preferred exemplary embodiment, the second composition may change phase, when exposed to the wellbore temperature conditions, in a controlled fashion. The second composition may comprise a solid, a liquid, or a gas. The second composition may melt to change phase from solid to liquid, may change phase from solid to gas, or may vaporize to change phase from liquid to gas. The second composition may also be selected from materials that change a physical property such as strength or elasticity upon exposure to wellbore fluids or fracturing fluids. Table 2.0 as generally illustrated below, shows a yield temperature for individual alloy that change strength above the yield temperature. The alloys in Table 2.0 are a combination of weight percentages as shown in individual columns. The first composition may control the rate of phase change in the second composition. The second composition in the RPE may be tailored to the temperature profile of the wellbore conditions. The second composition may comprise a eutectic alloy, a metal, a non-metal, and combinations thereof. Eutectic alloys have two or more materials and have a eutectic composition. When a well-mixed, eutectic alloy melts (changes phase), it does so at a single, sharp temperature. The eutectic alloys may be selected from the list shown in Table 1.0. As generally shown in Table 1.0, the eutectic alloys may have a melting point (The temperature at which a solid changes state from solid to liquid at atmospheric pressure) range from 150° F. to 350° F. Eutectic or Non-Eutectic metals with designed melting points may be combinations of Bismuth, Lead, Tin, Cadmium, Thallium, Gallium, Antimony, also fusible alloys as shown below in Table 1.0 and Table 2.0.

Thermoplastics with low melting points such as Acrylic, Nylon, Polybenzimidazole, Polyethylene, Polypropylene, Polystyrene, Polyvinyl Chloride, Teflon may also function as a second composition material that change phase or change physical property such as strength or elasticity. These thermoplastics, when reinforced with glass or carbon fiber may initially create stronger materials that change physical property such as strength or elasticity upon exposure to temperatures in the wellbore or fracturing fluids.

TABLE 2.0

(Alloys Composition in weight %)

| CS Alloys Name | Bi | Pb | Sn | Cd | In | Melting Range (F.) | Yield Temperature (F.) |
|---|---|---|---|---|---|---|---|
| Low 117 | 44.7 | 22.6 | 8.3 | 5.3 | 19.1 | 117-117 | 117 |
| Low 136 | 49 | 18 | 12 | | 21 | 136-136 | 136 |
| Low 140 | 47.5 | 25.4 | 12.6 | 9.5 | 5 | 134-144 | 140 |
| Low 147 | 48 | 25.63 | 12.77 | 9.6 | 4 | 142-149 | 147 |
| Bend 158 | 50 | 26.7 | 13.3 | 10 | — | 158-158 | 158 |
| Safe 165 | 42.5 | 37.7 | 11.3 | 8.5 | — | 160-190 | 165 |
| Low 174 | 57 | — | 17 | — | 26 | 174-174 | 174 |
| Shield 203 | 52.5 | 32 | 15.5 | — | — | 203-203 | 203 |
| Base 255 | 55.5 | 44.5 | — | — | — | 255-255 | 255 |
| Tru 281 | 58 | — | 42 | — | — | 281-281 | 281 |
| Cast 302 | 40 | — | 60 | — | — | 281-338 | 302 |

Materials which transform from solid to gas (sublimation), or are solid only at high pressures and low temperatures may also be selected as shown below in Table 3.0. For example, balls of Dry Ice (Solid Carbon Dioxide) would need to be kept at temperature below the specified melting point prior to use as a second composition material.

TABLE 3.0

| Composition in Weight % | Melting Point | Eutectic |
|---|---|---|
| Cs 73.71, K 22.14, Na 4.14[2] | −78.2 | yes |
| Hg 91.5, Tl 8.5 | −58 | yes |
| Hg 100 | −38.8 | (yes) |
| Cs 77.0, K 23.0 | −37.5 | |
| Ga 68.5, In 21.5, Sn 10 | −19 | no |
| K 76.7, Na 23.3 | −12.7 | yes |
| K 78.0, Na 22.0 | −11 | no |
| Ga 61, In 25, Sn 13, Zn 1 | 8.5 | yes |
| Ga 62.5, In 21.5, Sn 16.0 | 10.7 | yes |
| Ga 69.8, In 17.6, Sn 12.5 | 10.8 | no |
| Ga 75.5, In 24.5 | 15.7 | yes |

TABLE 1.0

(Alloys Composition in weight %)

| Alloy | Melting point | Eutectic | Bi | Pb | Sn | In | Cd | Tl | Ga | Sb |
|---|---|---|---|---|---|---|---|---|---|---|
| Rose's metal | 98° C. (208° F.) | no | 50 | 25 | 25 | — | — | — | — | — |
| Cerrosafe | 74° C. (165° F.) | no | 42.5 | 37.7 | 11.3 | — | 8.5 | — | — | — |
| Wood's metal | 70° C. (158° F.) | yes | 50 | 26.7 | 13.3 | — | 10 | — | — | — |
| Field's metal | 62° C. (144° F.) | yes | 32.5 | — | 16.5 | 51 | — | — | — | — |
| Cerrolow 136 | 58° C. (136° F.) | yes | 49 | 18 | 12 | 21 | — | — | — | — |
| Cerrolow 117 | 47.2° C. (117° F.) | yes | 44.7 | 22.6 | 8.3 | 19.1 | 5.3 | — | — | — |
| Bi—Pb—Sn—Cd—In—Tl | 41.5° C. (107° F.) | yes | 40.3 | 22.2 | 10.7 | 17.7 | 8.1 | 0.01 | — | — |
| Galinstan | −19° C. (−2° F.) | yes | <1.5 | — | 9.5-10.5 | 21-22 | — | — | 68-69 | <1.5 |

Preferred Embodiment Restriction Plug Element with a First Composition Surrounding Second Composition (4200-4300)

Figure 42:
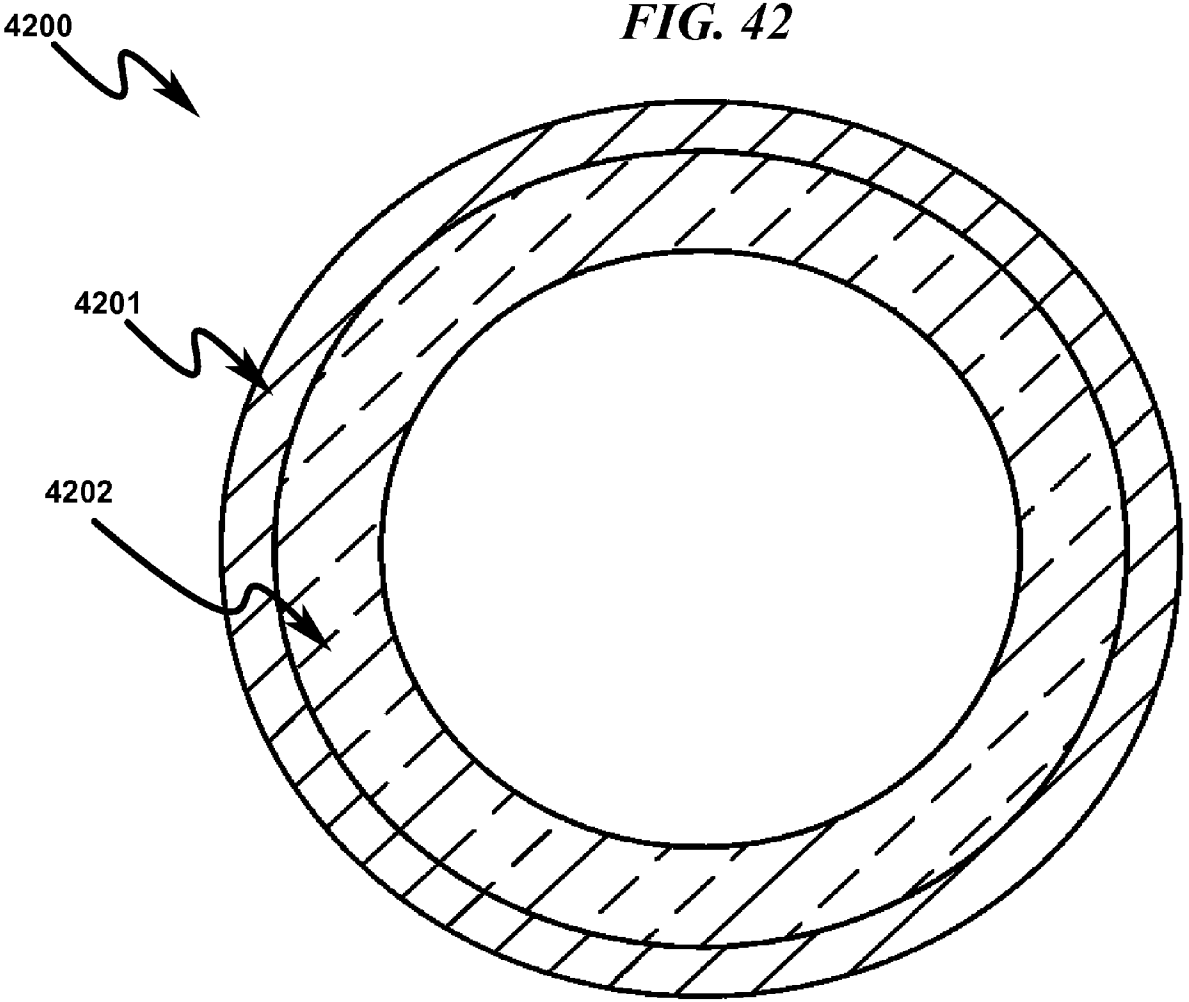
FIG. 42 illustrates a cross section view of a restriction plug element with a first composition surrounding a hollow second composition according to a preferred exemplary system embodiment.
Figure 43:
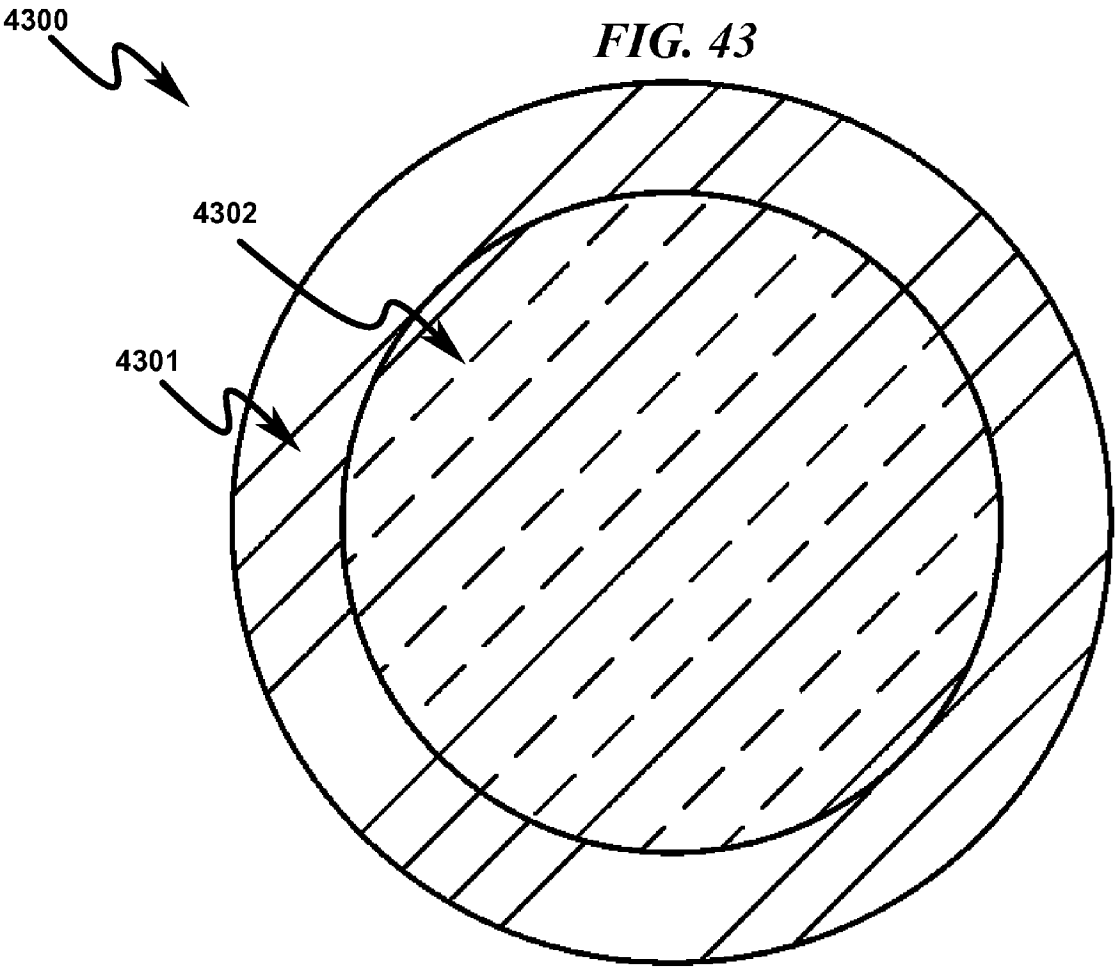
FIG. 43 illustrates a cross section view of a restriction plug element with a first composition surrounding a solid second composition according to a preferred exemplary system embodiment.

A cross section of the present invention may be seen in more detail as generally illustrated in FIG. 42 (4200), wherein a restriction plug element (RPE) comprises a first composition (4201) that is in direct contact with a second composition (4202). The first composition (4201) surrounds a hollow second composition (4202). According to a preferred exemplary embodiment, the second composition changes phase, strength, or elasticity to deform the RPE, thereby shrinking its size. A reduced size RPE enables it to pass through a restriction sleeve member (RSM) when flowed or pumped back to the surface. The first composition (4201) and the second composition (4202) may be selected from a group of materials as aforementioned. The thickness of the hollow second composition is designed such that the RPE has the strength, shape and integrity to sustain high pressure conditions for the time period required to fracture its assigned zone. In one embodiment, this time period is approximately 10 to 12 hours. The thickness may also be selected such that volume shrinkage created by a phase, strength, or elasticity change in the second composition (4202) is compensated by the hollow space in the second composition (4202).

According to another preferred exemplary embodiment, the second composition (4202) may change phase, strength, or elasticity when exposed to the wellbore temperature conditions, in a controlled fashion. The first composition (4201) may control the rate of phase, strength, or elasticity change in the second composition (4202). In one preferred exemplary embodiment, the first composition may be an insulator such as ceramic, elastomer or plastic that surrounds the second composition and slows the rate at which the second composition changes phase. In another preferred exemplary embodiment, the first composition may be a conductor such as steel, stainless steel, aluminum, and copper that accelerates the rate of phase, strength, or elasticity change. The selection of second composition may depend on the temperature profile of the well.

In some wells that may be under higher temperature conditions than others, a higher melting point eutectic alloy may be used as a second composition in the RPE. According to another preferred exemplary embodiment, the second composition (4202) in the RPE may be tailored to adapt to the temperature profile of the wellbore conditions. Furthermore, the RPEs comprising second composition (4202) with different melting point temperature materials may be used in higher or lower temperature fracturing stages of the wellbore accordingly. For example, an RPE comprising a second composition with a melting point greater than 150° F. may be used in fracturing stage that has a wellbore temperature of 150° F. Similarly, an RPE comprising a second composition with a melting point of greater than 250° F. may be used in fracturing stage that has a wellbore temperature of 250° F.

According to another preferred exemplary embodiment, the RPE is shaped as a sphere, a cylinder or a dart. The first composition (4201) is shaped in the form of a sphere surrounding a hollow spherical shaped second composition (4202). Likewise, the first composition (4201) may be shaped in the form of a cylinder surrounding a hollow cylindrical shaped second composition (4202). Similarly, the RPE may be shaped in the form of a dart. The dart may have a property (Phase, strength, elasticity) changeable first composition fins (7401) attached to a hollow/solid dart shaped second composition (7402). The hollow/solid dart shaped second composition (7402) may change phase, strength or elasticity, thereby deforming/collapsing the dart RPE.

According to yet another preferred exemplary embodiment, the RPE is shaped as a sphere, a cylinder or a dart. The first composition (4301) is shaped in the form of a sphere surrounding a solid core spherical shaped second composition (4302). Likewise, the first composition (4301) may be shaped in the form of a cylinder surrounding a solid core cylindrical shaped second composition (4302).

Preferred Embodiment Restriction Plug Element with a First Composition Surrounding Second Composition with a Passage Way (4400-4600)

Figure 44:
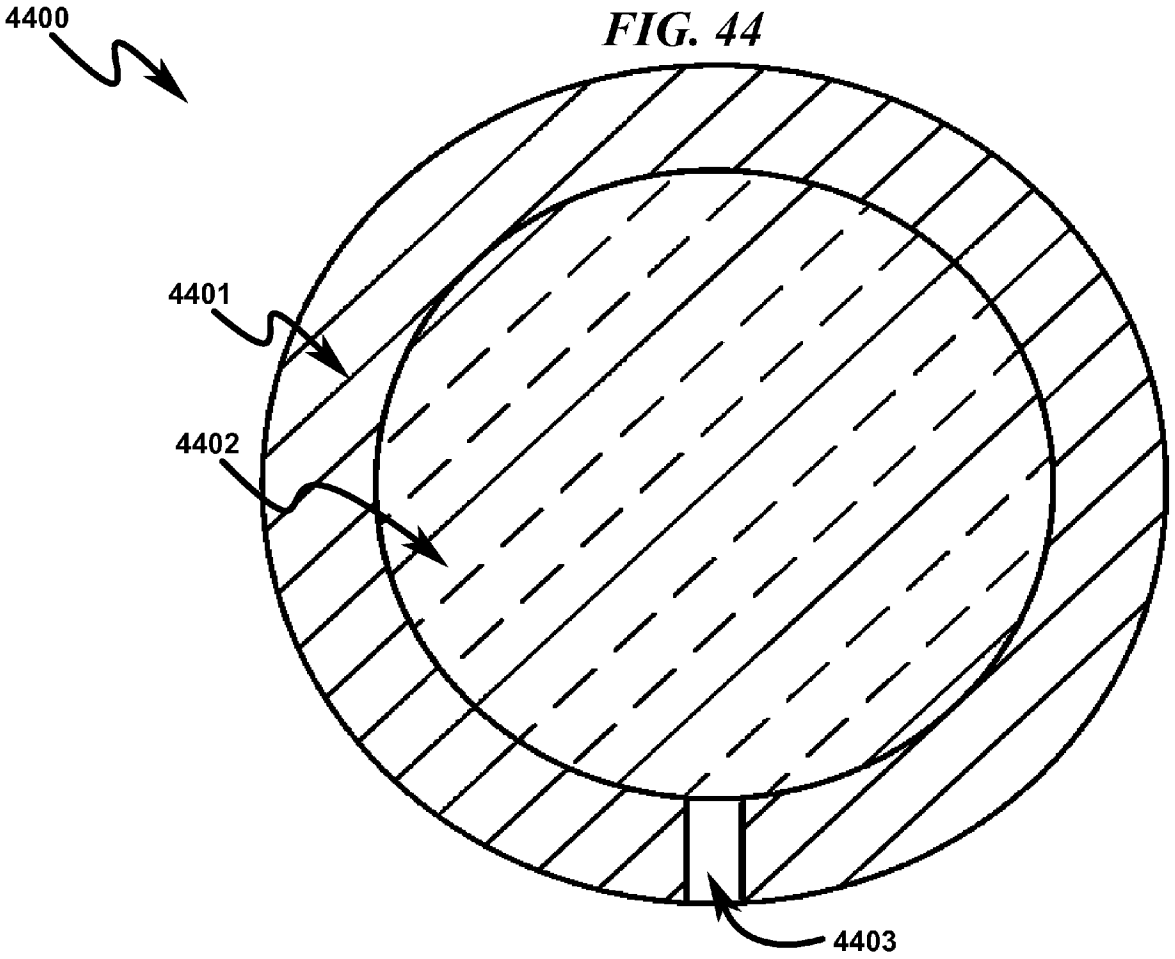
FIG. 44 illustrates a cross section view of a restriction plug element with a first composition surrounding a second composition with a passage way according to a preferred exemplary system embodiment.

A cross section of the present invention may be seen in more detail as generally illustrated in FIG. 44 (4400), wherein a restriction plug element (RPE) comprises a first composition (4401) that is in direct contact with a second composition (4402). The first composition (4401) surrounds a hollow second composition (4402). According to a preferred exemplary embodiment, the second composition changes phase to deform the RPE thereby shrinking its size. The RPE further comprises a passage way (4403) to provide a path for the second composition to change phase, strength, and/or elasticity and exit the RPE. The passage way (4403) could be designed such that it orients downwards facing the inner surface of the wellbore casing. The downward orientation may enable the second composition (4402) to exit the RPE by means of gravity upon phase change. The second composition may stay at the bottom of the wellbore casing during production without impeding production flow. Alternatively, the debris created by the second composition (4402) may be flowed back. A perspective view of the RPE is illustrated in FIG. 45 (4500).

Figure 46A:
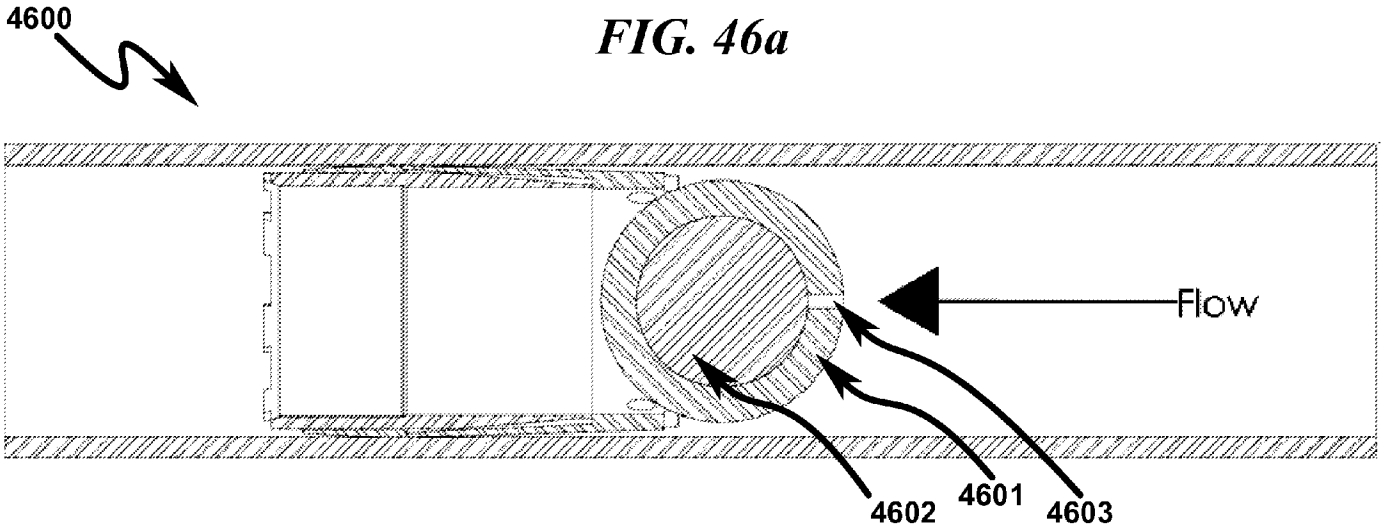
FIG. 46*a* illustrates a cross section view of a restriction plug element with a first composition surrounding a second composition with a passage way and the restriction plug element positioned in a restriction sleeve member during production according to a preferred exemplary system embodiment.
Figure 46B:
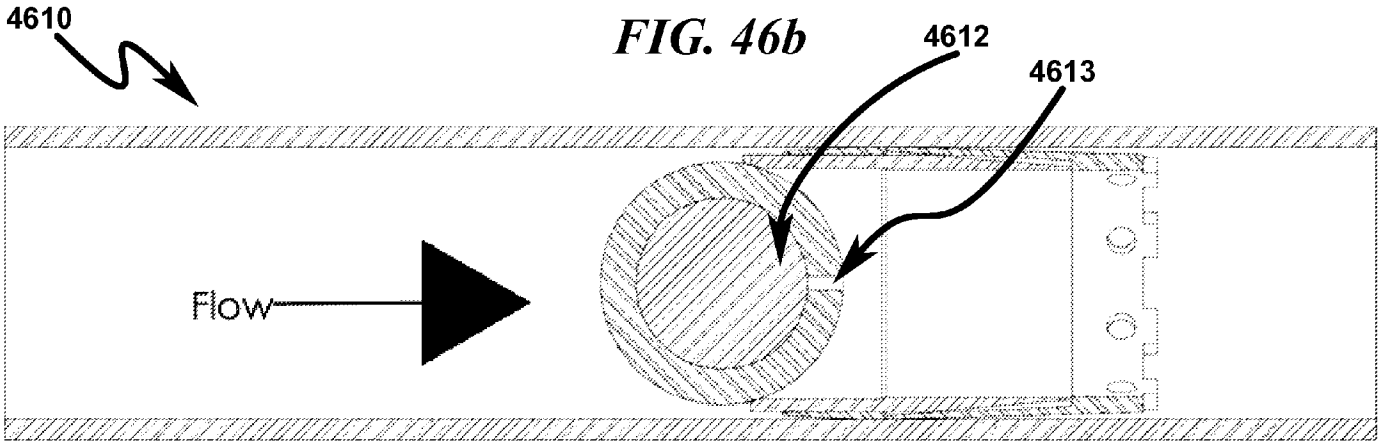
FIG. 46*b* illustrates a cross section view of a restriction plug element with a first composition surrounding a second composition with a passage way and the restriction plug element positioned in a restriction sleeve member during fracturing according to a preferred exemplary system embodiment.

Alternately, the second composition may exit the RPE by stress or pressure as illustrated in FIG. 46*a* (4600). During production, pressure acts in the direction of production pushing the RPE towards the RSM in the production direction. The second composition (4602) exits or squeezes out of the RPE through the passage (4603), thereby deforming the RPE. This enables an increase in hydrocarbon fluid flow in the production direction. Similarly, during fracturing operation, pressure acts in the direction of injection on the RPE that is seated in the RSM. The second composition (4612) exits or squeezes out of the RPE through the passage (4613), thereby deforming the RPE.

Preferred Embodiment Restriction Plug Element with a Second Composition Surrounding First Composition (4700-4800)

Figure 47:
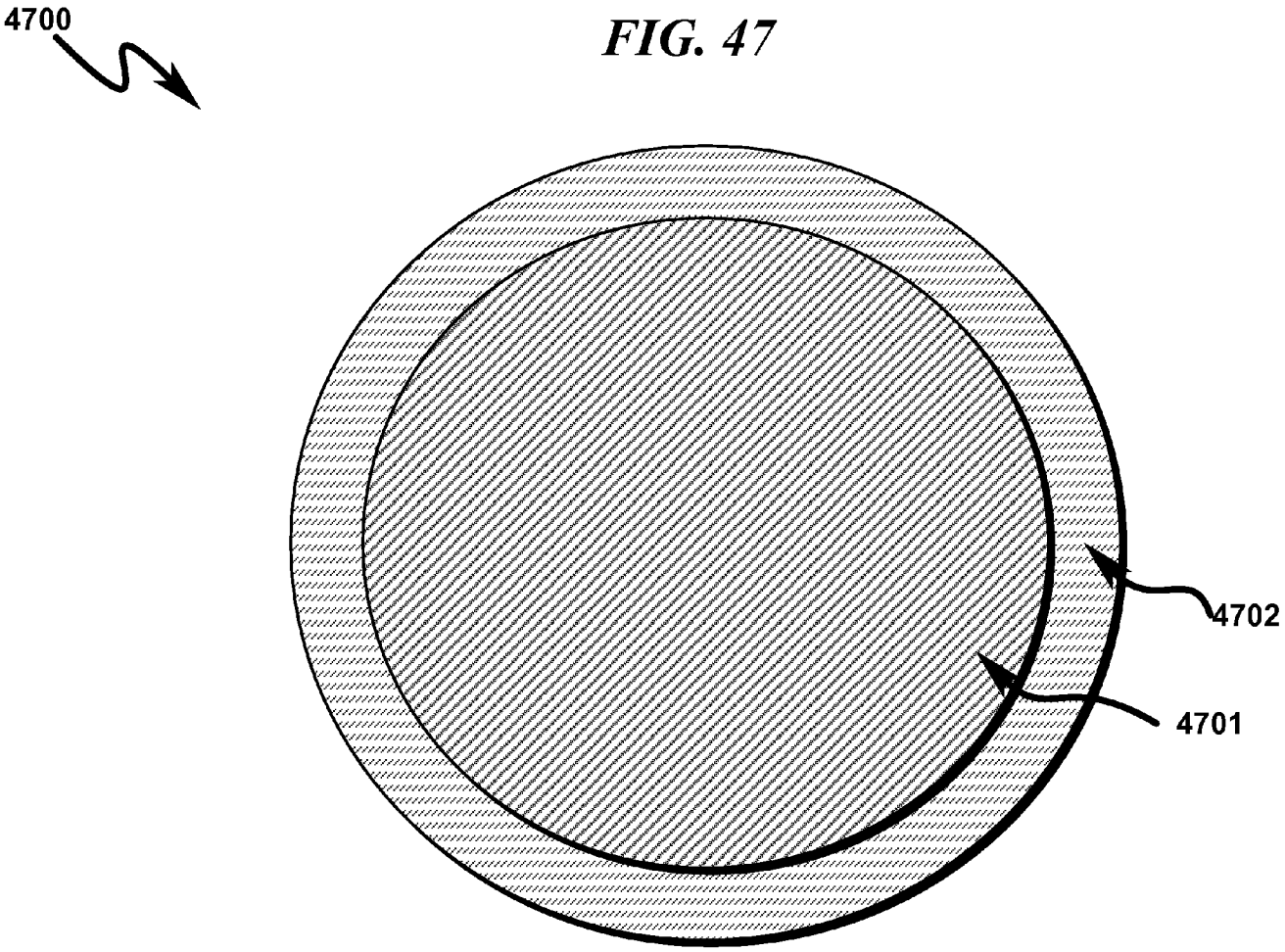
FIG. 47 illustrates a cross section view of a restriction plug element with a second composition surrounding a solid first composition according to a preferred exemplary system embodiment.
Figure 48:
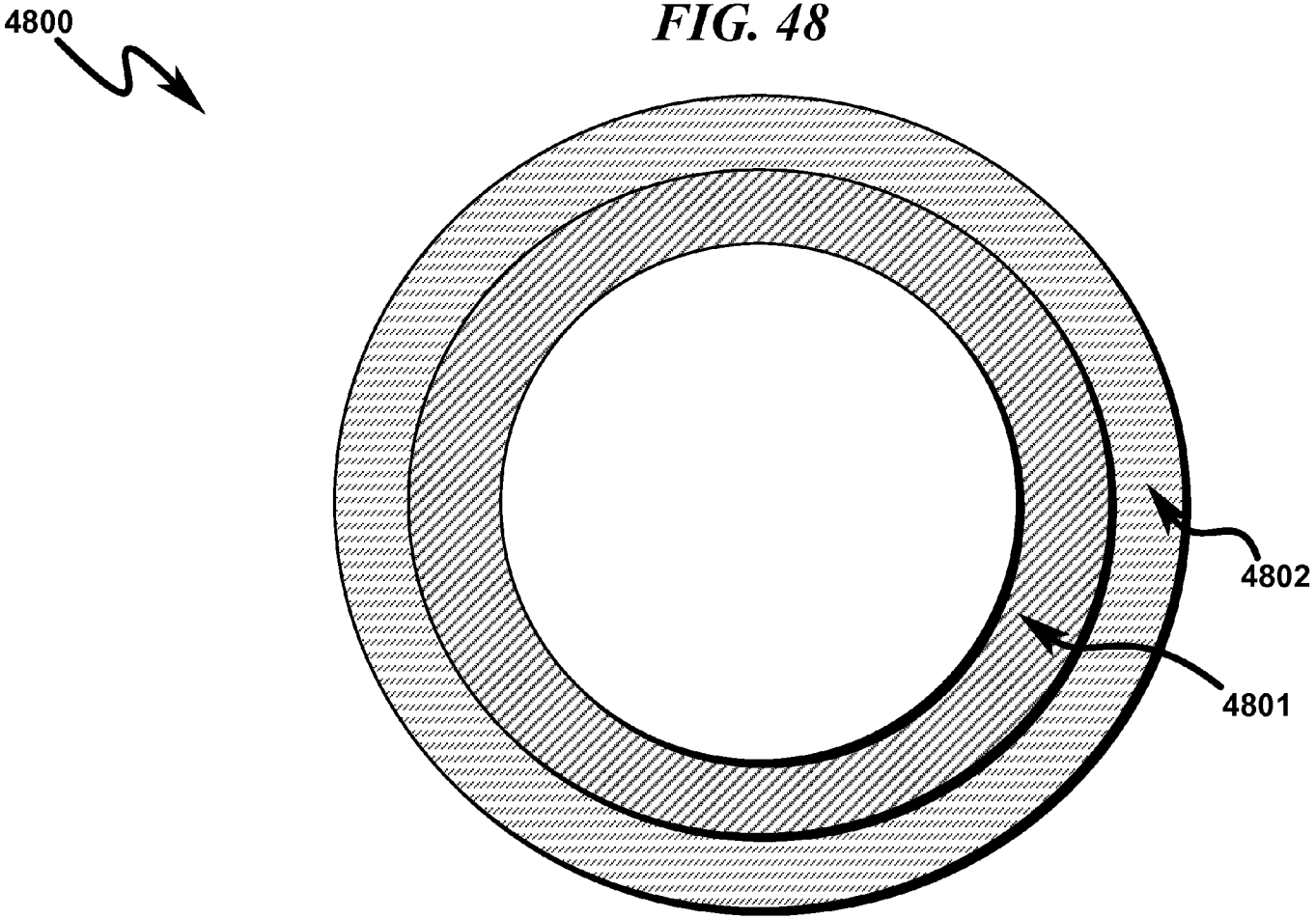
FIG. 48 illustrates a cross section view of a restriction plug element with a second composition surrounding a hollow first composition according to a preferred exemplary system embodiment.

A cross section of the present invention may be seen in more detail as generally illustrated in FIG. 47 (4700), wherein a restriction plug element (RPE) comprises a second composition (4702) in direct contact with a first composition (4701). The second composition (4702) surrounds a hollow first composition (4701). According to a preferred exemplary embodiment, the second composition may change phase (melt/vaporize) to exit the RPE thereby reducing the size of the RPE. For example, if the RPE is shaped as a sphere, the outer diameter of the RPE is reduced by the amount of the thickness of the second composition (4702). The thickness of the second composition (4702) may be reduced to quickly change phase and exit, for example for RPEs toward the heel end or for quicker screen outs. The thickness of the second composition (4702) is designed such that the overall strength, rigidity and integrity of the RPE along with the first composition (4701) can withstand the high pressure differential during fracturing treatment. The overall size of the RPE may be selected to adapt to the size of the RSM. For example, if the inner sleeve diameter (ISD) is 4.1 inches, overall RPE diameter could be made 4.2 inches, first composition diameter could be 3.5 inches and the thickness of the second composition could be 0.35 inches. Materials for the first composition (4701) and the second composition (4702) may be selected from the list of materials as aforementioned.

According to another preferred exemplary embodiment, the RPE is shaped as a sphere or a cylinder. The second composition (4702) is shaped in the form of a sphere surrounding a solid core spherical shaped first composition (4701). Likewise, the second composition (4702) may be shaped in the form of a cylinder surrounding a solid cylindrical shaped first composition (4701).

According to yet another preferred exemplary embodiment, the RPE is shaped as a sphere or a cylinder. The second composition (4801) is shaped in the form of a sphere surrounding a hollow spherical shaped first composition (4801). Likewise, the second composition (4802) may be shaped in the form of a cylinder surrounding a hollow cylindrical shaped first composition (4801).

Figure 73:
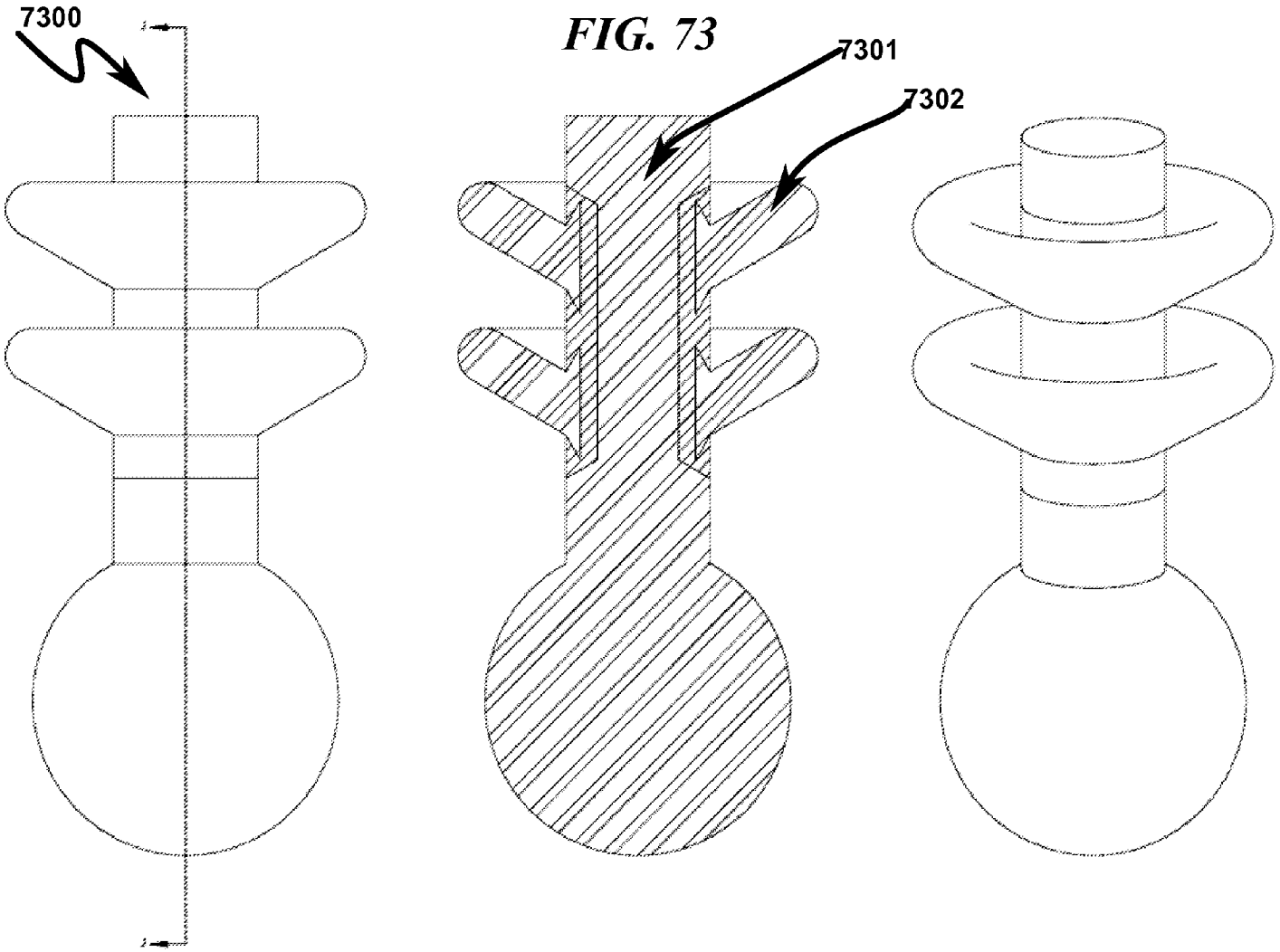
FIG. 73 illustrates a dart shaped restriction plug element with a second composition fins attached to a central first composition according to a preferred exemplary system embodiment.
Figure 74:
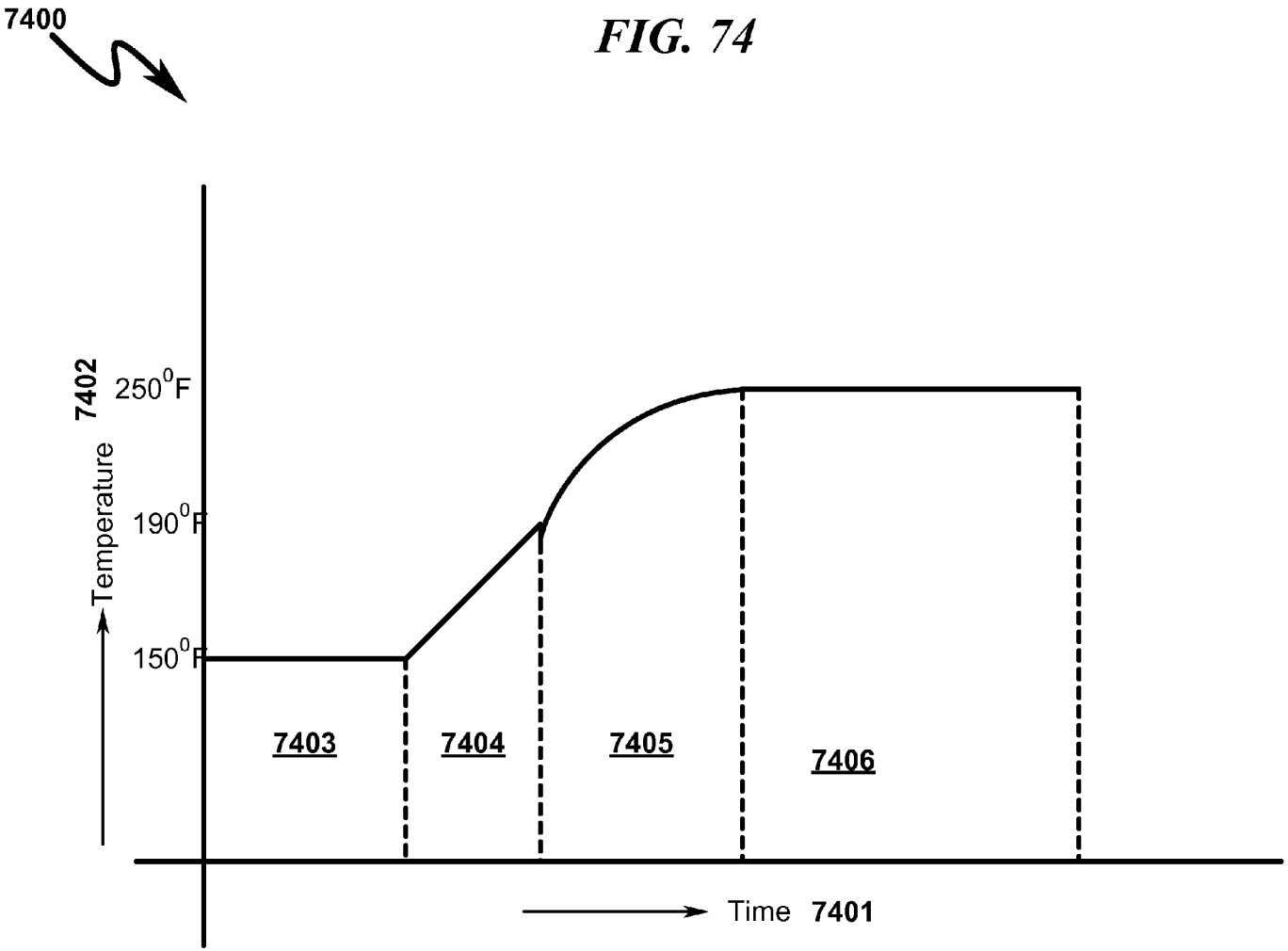
FIG. 74 shows a plot of temperature versus time in a wellbore.

Similarly, the RPE may be shaped in the form of a dart as shown in FIG. 73 (7300). The dart may have a property (Phase, strength, elasticity) changeable second composition fins (7302) attached to hollow/solid dart shaped first composition (7301). The fins (7302) may change phase, strength or elasticity, leaving the RPE with the solid/hollow first composition central dart core. The reduced size "finless" dart may then be flown back through the RSM's to the surface or pumped into the hydrocarbon formation enabling unrestricted production fluid flow.

Figure 72:
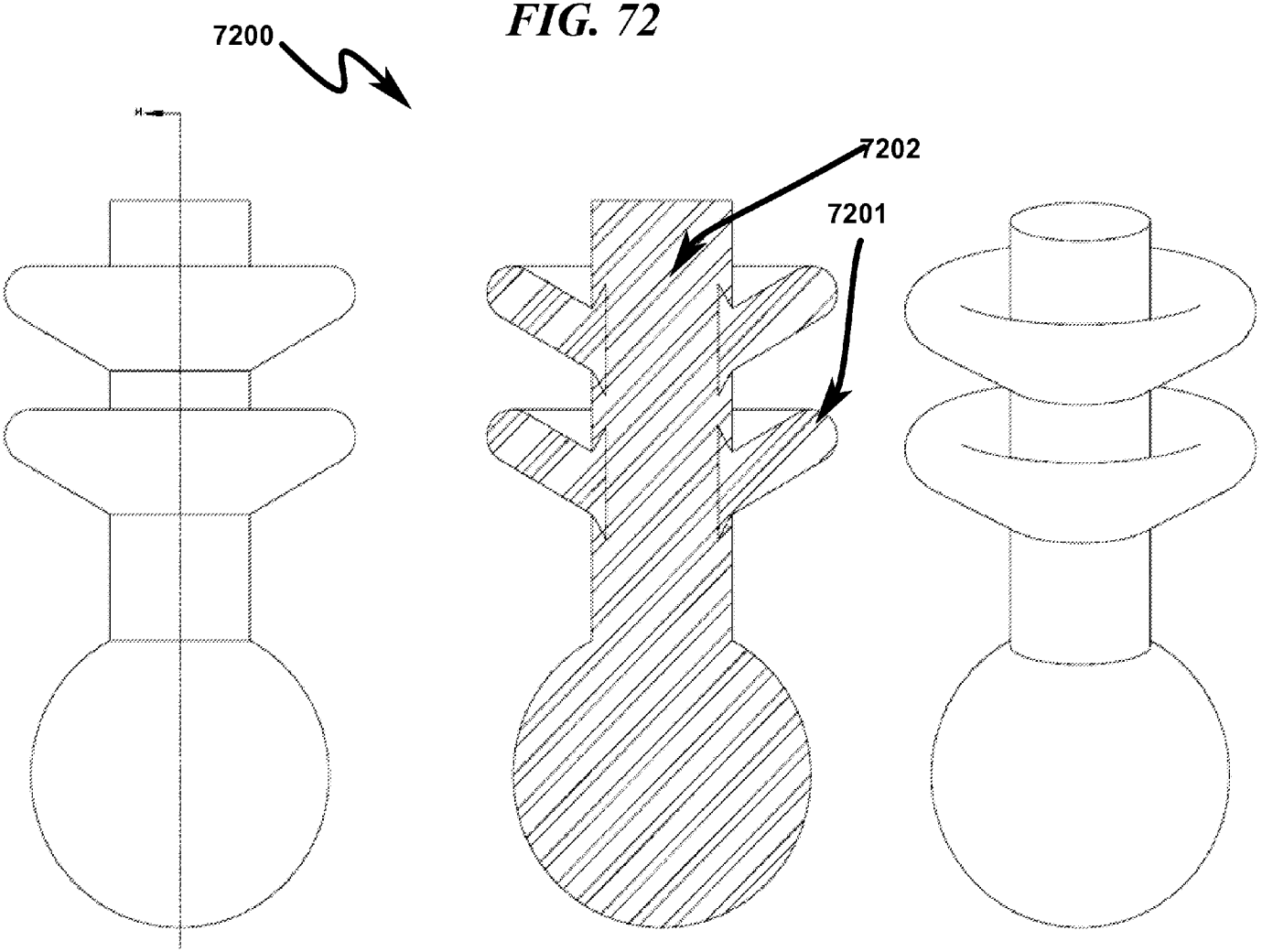
FIG. 72 illustrates a dart shaped restriction plug element with a first composition fins attached to a central second composition according to a preferred exemplary system embodiment.

As shown in FIG. 72 (7200) the fins (7201) of the dart shaped RPE may comprise a first composition similar to the dart core (7202). The RPE (7200) may change physical property such as phase, strength, elasticity due to conditions encountered in a wellbore. The changed RPE due to phase, strength or elasticity may then exit the wellbore in a toe ward direction or may be pumped back to the surface in a production direction.

Preferred Embodiment Restriction Plug Element with a First Composition, a Second Composition, and a Third Composition (4900)

Figure 49:
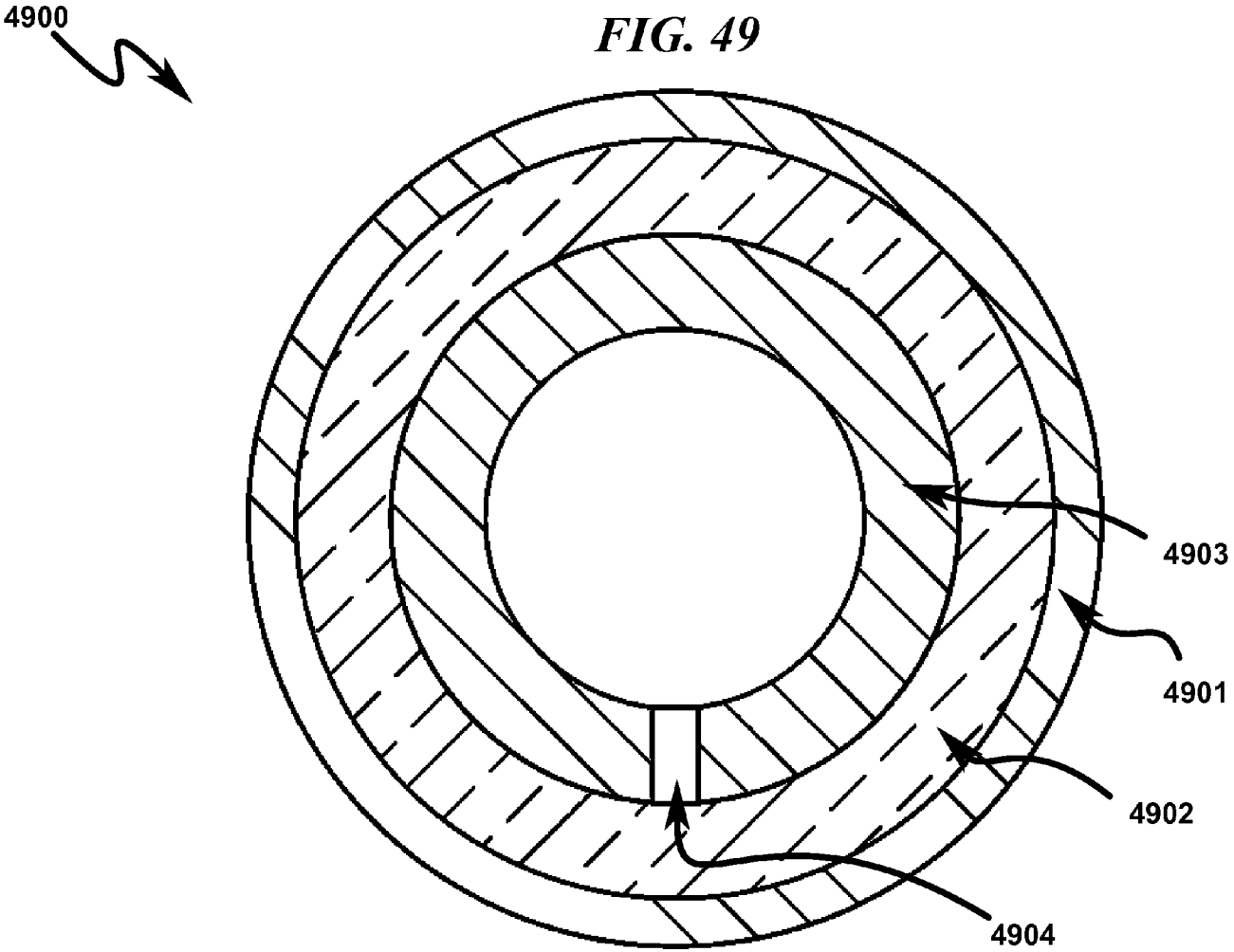
FIG. 49 illustrates a perspective view of a restriction plug element with a first composition with a passage way surrounding a second composition that surrounds a third composition according to a preferred exemplary system embodiment.

As generally illustrated in the cross section of FIG. 49 (4900), a restriction plug element comprises a first composition (4901) in direct contact with a second composition (4902) that is in direct contact with a third composition (4903). The first composition (4901) surrounds the second composition (4902) which in turn surrounds the third composition (4903). A passage way (4904) may be designed to facilitate the exit for the second composition (4902) upon a phase change. Phase change in the second composition (4902) may be triggered by a change in the temperature of the wellbore or the RSM. According to a preferred exemplary embodiment, the RPE shrinks and reduces size so as to pass through a restriction sleeve member (RSM) during flow back or during production. The thickness of the first, second and third compositions may be designed to withstand the high pressure conditions during fracturing treatment. Materials for the first composition (4901) and the second composition (4902) may be selected from the list of materials as aforementioned. Material for the third composition may be for example Al or Mg or any other high strength metal or non-metal.

It should be noted that even though the RPE illustrated in FIG. 49 (4900) comprises 3 layers, multiple layers arranged in any combination may be used. For example, an RPE may be made with 2 layers of second composition alternately between 2 layers of first composition or a combination of first and third composition. It should be noted that the RPE in FIG. 49 (4900) is for illustration purposes only and should be construed as a limitation of the number of compositions and layers comprising the RPE.

Preferred Embodiment Restriction Plug Element with Axial Flow Channels (5000-5100)

Figure 50:
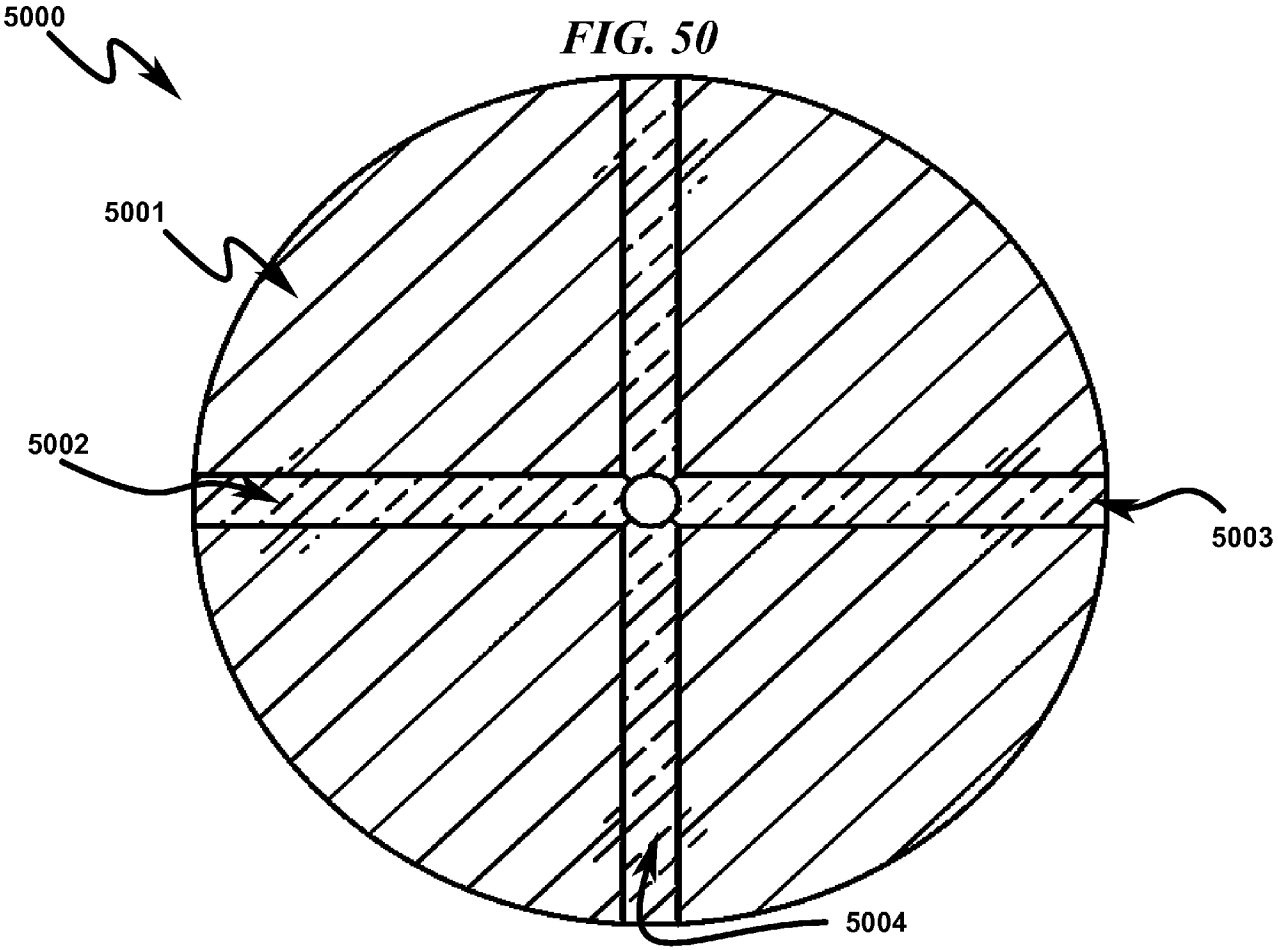
FIG. 50 illustrates a cross section view of a restriction plug element with a first composition surrounding a second composition in flow channels according to a preferred exemplary system embodiment.

As generally illustrated in the cross section of FIG. 50 (5000), a restriction plug element comprises a first composition (5001) in direct contact with a second composition (5002). The RPE is facilitated with flow channels in the first composition (5001). The RPE may be shaped in the shape of a sphere or cylinder. According to a preferred exemplary embodiment, the flow channels are filled with the second composition (5002). The flow channels may be cut and machined in an axial manner. The flow channels may take the shape of a cylinder, a tube, or an elongated wedge shape or combination thereof. For example, a horizontal flow channel (5003) may be cut in the x-axis direction and a vertical flow channel (5004) may be cut in the y-axis direction. It should be noted that the axes shown in FIG. 50 are for illustration purposes only and may not be construed as a limitation. Multiple axes may be cut in the RPE and filled with the second composition (5002) to provide multiple channels for production fluids to flow through during production. The axes may or may not be orthogonal to each other. In addition, the axes may or may not be aligned to each other.

Figure 51:
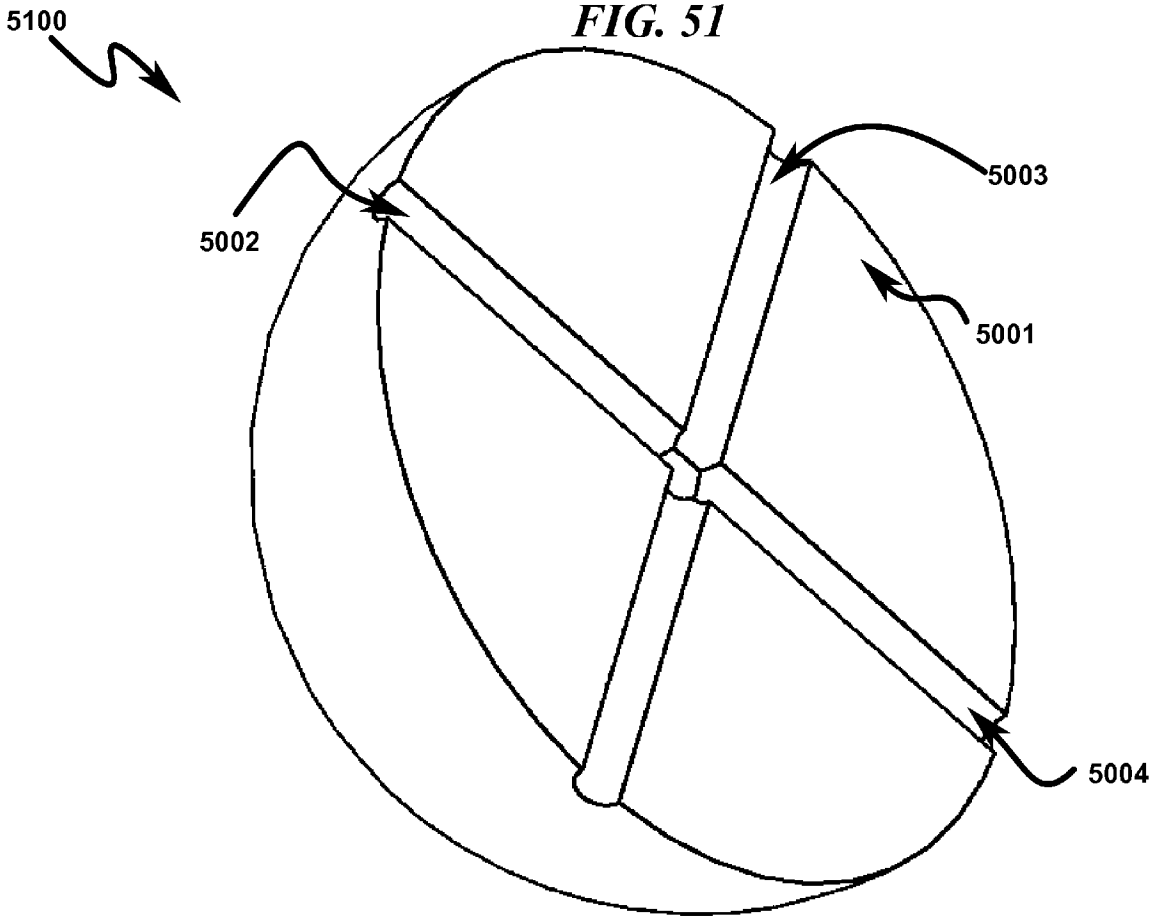
FIG. 51 illustrates a perspective view of a restriction plug element with a first composition surrounding a second composition in flow channels according to a preferred exemplary system embodiment.

According to a presently preferred exemplary embodiment, upon exposure to temperatures in a wellbore higher than the phase/strength/elasticity change temperature, the second composition in the flow channel changes phase (melt/vaporize) or weakens in strength, thereby exiting the RPE and creating vacant flow channels in the RPE. The first composition (5001) may maintain its shape and structure while the second composition (5002) exits. After a fracturing treatment and exodus of the second composition (5002), the RPE may disengage from a restriction sleeve member and position itself between RSMs. The RPE may also stay engaged in the RSM. During production, the vacated flow channels may facilitate production fluids to flow in the production direction. Additionally, the flow channels in the RSM may be used in conjunction with the flow channels in the RPE to provide substantially unobstructed production flow. It should be noted that fluids may take any path that is least resistant in the flow channels during production and are not limited to a specific flow channel, axis, or alignment. For example, horizontal flow channel (5003) may be an ingress path and vertical flow channel (5004) may be an egress path for fluids to flow through. Similarly, horizontal flow channel (5003) may be used as both an ingress and egress for fluid flow. A perspective view of the RPE is illustrated in more detail in FIG. 51 (5100).

Preferred Exemplary Wellbore Plug Isolation with Exemplary Restriction Plug Element Flowchart Embodiment (5200)

Figure 52:
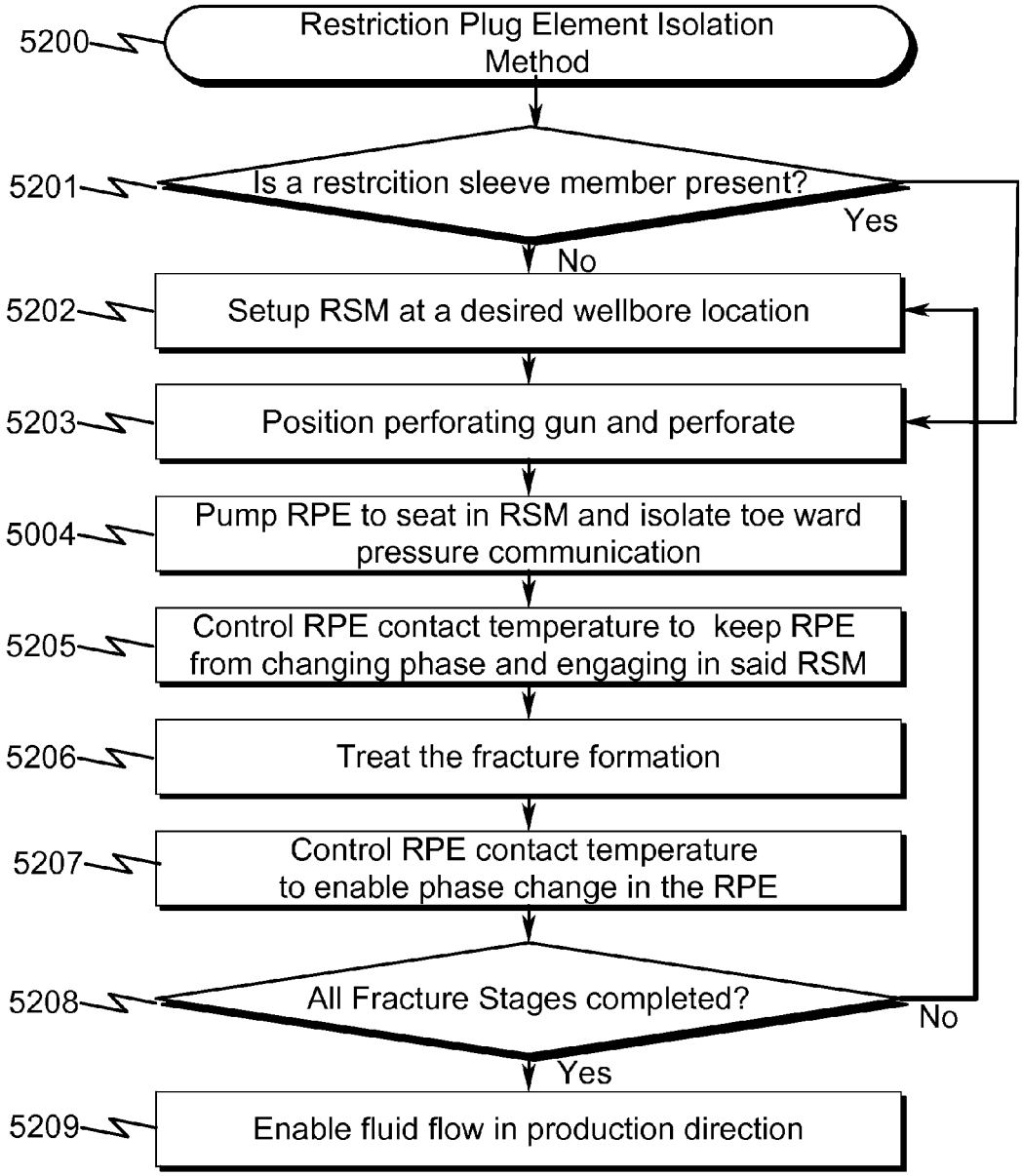
FIG. 52 illustrates a detailed flowchart of a preferred exemplary wellbore plug isolation method with a restriction plug element (RPE) used in some preferred exemplary invention embodiments.

As generally seen in the flow chart of FIG. 52 (5200), preferred exemplary wellbore plug isolation with exemplary restriction plug element method may be generally described in terms of the following steps:

(1) checking if a restriction sleeve member (RSM) is already integral to the casing, if so, proceeding to step (5203) (5201);

A temperature profile may be taken determine wellbore temperature. The temperature profile may include wellbore temperature after casing installation, before a RPE is pumped, during a fracturing treatment and after a fracturing treatment. A more specific profile could also be measured in individual fracturing zones.

(2) setting a RSM at the desired wellbore location with a WST (5202);

The WST could set the RSM with a power charge or pressure.

(3) perforating hydrocarbon formation with a perforating GSA (5203);

The perforating GSA may perforate one interval at a time followed by pulling the GSA and perforating the next interval in the stage. The perforation operation is continued until all the intervals in the stage are completed.

(4) deploying an RPE to seat in the RSM isolating fluid communication between upstream (heel or production end) of the RSM and downstream (toe or injection end) of the RSM and creating a hydraulic fracturing stage (5204);

RPE may be pumped from the surface, deployed by gravity, or set by a tool. If a conforming seating surface (CSS) is present in the RSM, the RPE may be seated in the CSS. A Positive differential pressure may enable RPE to be driven and locked into the RSM. The RPE may be at the temperature of the RSM when it lands on the RSM. The temperature of the RSM may be controlled using a fluid pumped from the surface or with a cooling fluid channel integrated into the RSM.

The RPE comprising a first composition and a second composition with a specific melting point range may be selected, so that the melting point selected is greater than the temperature of the fracture zone and wellbore temperature. A higher phase change temperature second composition may be deployed for higher temperature fracturing zones. For example, an RPE comprising a second composition with a melting point greater than 150° F. may be used in fracturing stage that has a wellbore temperature of 150° F. Similarly, an RPE comprising a second composition with a melting point of greater than 250° F. may be used in fracturing stage that has a wellbore temperature of 250° F.

(5) maintaining RPE contact temperature to keep it from changing phase (5205);

Fracturing fluids may be pumped along with the RPE or after the RPE is pumped. The RPE may be at the same temperature as the fracturing fluid. The temperature of the fracturing fluids is controlled to maintain the RPE at a temperature below the phase change temperature (melting point or boiling point or sublimation point). The temperature and volume of the fracturing fluids may be adjusted based on the temperature profile of the wellbore. For example, a greater volume of fracturing fluids may be required to displace and exchange heat convectively with a greater amount of hydrocarbon formations fluids already present in the wellbore casing.

(6) fracturing the hydraulic fracturing stage (5205);

Hydraulic fracturing fluids are pumped at high pressure to create pathways in hydrocarbon formations. During the hydraulic fracturing process, the convective fracturing fluid from the surface pumped to fracture the zone may also serve as a coolant for the RPE relative to latent high temperatures. Latent heat from the hydrocarbon formation may be transferred by convection to the RPE and is in turn transferred and removed from the RPE by convection to the fracturing fluid. In addition, the fracturing fluid displaces hydrocarbons within the well minimizing hydrocarbon contact with the RPE, thereby inhibiting phase change of the RPE during the hydraulic fracturing process.

(7) controlling RPE contact temperature to enable it to change phase (5206);

Once the fracturing zone is complete, hotter fluids may be pumped into the stage to effectively expose the portion of the RPE to higher pre-determined temperatures, greater than the phase change temperature of the second composition of the RPE, thereby initiating the phase change of the RPE.

(8) checking if all hydraulic fracturing stages in the wellbore casing have been completed, if not so, repeating steps (5201) to (5207) (5208); and After fracturing a stage another RPE is deployed or pumped to seat into a stage towards the heel end, and hydraulic fracturing procedures in the respective zone are initiated. The RPEs in the already fractured zones may be changing phase to shrink/reduce size or open up flow channels. The newly seated RPE functions to block fracturing fluid flow from reaching the now phase changing lower RPE. Thus, the RPEs of the already fractured stages towards the toe end of the wellbore continue to phase change while the zones above it are fractured. Without the relatively cool fracturing fluid reaching the lower RPE, the lower RPEs temperature will climb to the latent temperature in the wellbore. The latent temperature in the wellbore can reach, for example, in excess of 200° F., in excess of 220° F., or in excess of 350° F. The latent formation heat and pressure and hydrocarbons from the formation function to accelerate the phase change (melt/vaporize) the RPE and disengage the RPE from the RSM.

Since the toe end fracturing stages with RPE's are exposed to latent heat of the wellbore for longer periods of time as compared to the RPE's towards the heel end fracturing stages, a lower melting point RPE may be pumped into the heel end fracturing stage and a higher melting point RPE may be deployed towards the toe end facilitating a faster phase change towards the heel end. According to a present preferred exemplary embodiment, RPEs may be selected from a range of melting points (phase change temperatures) for fracturing stages in the toe end, middle and heel end such that the overall cycle time is reduced for screen out and flow back.

(9) enabling fluid flow in the production (heel end) direction (5209);

The fluid flow in the production direction (heel end) may be enabled through flow channels designed in the RSM while the RPEs are positioned in between the RSMs; fluid flow may also be enabled through flow channels designed in the RPEs. A combination of flow channels in the RPE and RSM may enable substantially unobstructed oil and gas flow. Alternatively RPEs may also be removed from the wellbore casing or the RPEs could be flowed back to surface, pumped into the wellbore, or shrink in the presence of wellbore fluids or acid. No intervention is needed to remove the RPE after its useful life of isolating the pressure communication is completed. Alternatively, the remainder of the RPE may be pumped to the surface.

Preferred Embodiment Mechanical Toroid Restriction Plug Element with (5300-5700)

Figure 56:
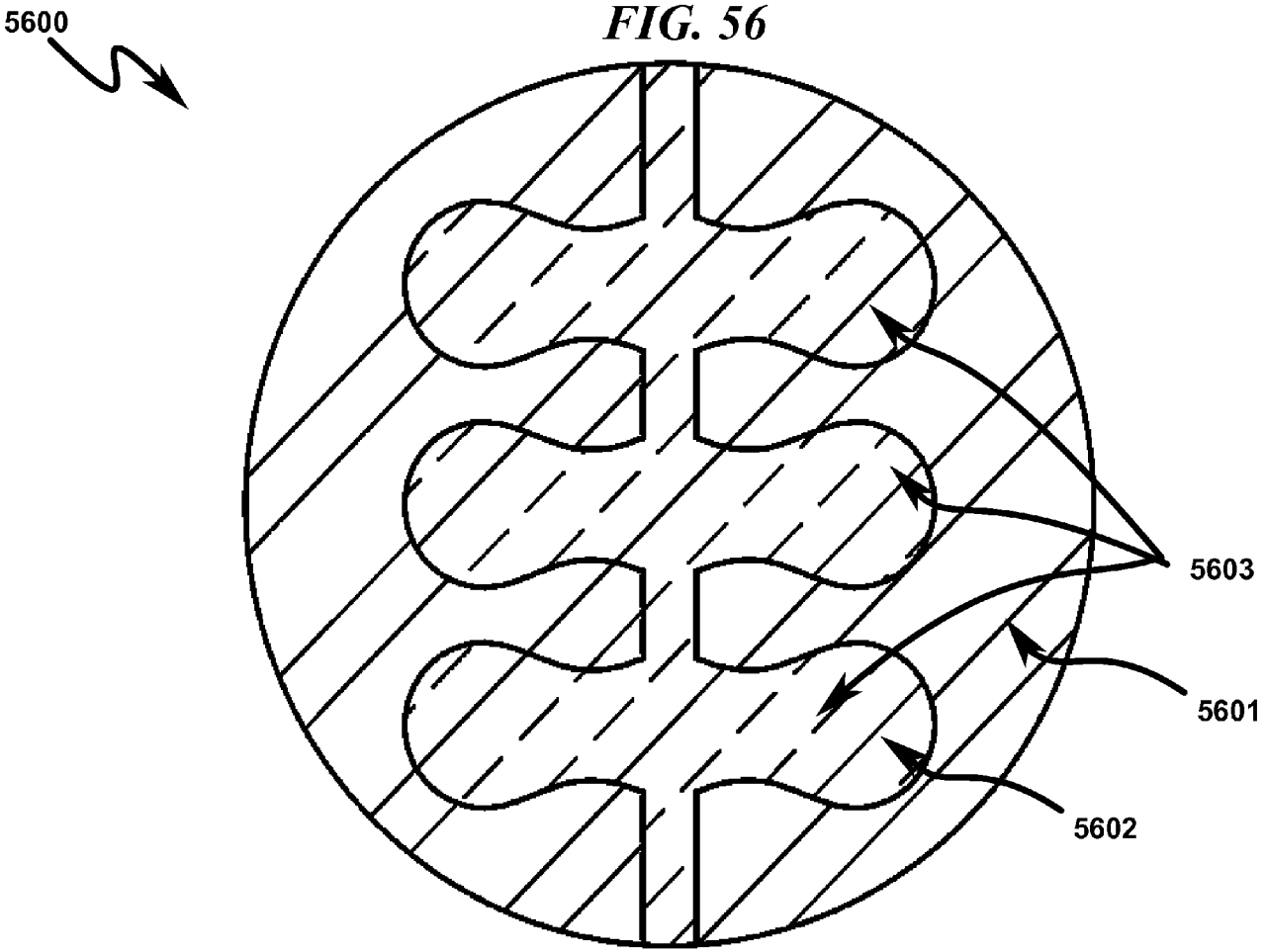
FIG. 56 illustrates a side perspective view of a spherical restriction plug element with a first composition mechanically held together by a toroid mechanical second composition according to a preferred exemplary system embodiment.

As generally illustrated in the cross section of FIG. 56 (5600), a restriction plug element comprises a first composition (5601) in direct contact with a second composition (5602). The first composition in the RPE may comprise multiple parts/segments that are held together by a toroid shaped un-bonded mechanical insert (5603). The RPE may be shaped as a sphere, cylinder, or ovoid. According to a preferred exemplary embodiment, the mechanical insert may be cast or die cast from second composition (5602). The toroid (5603) mechanical insert holds the RPE together during fracturing treatment. The mechanical insert may be designed such that the structure provides rigidity and strength to the RPE.

Figure 57:
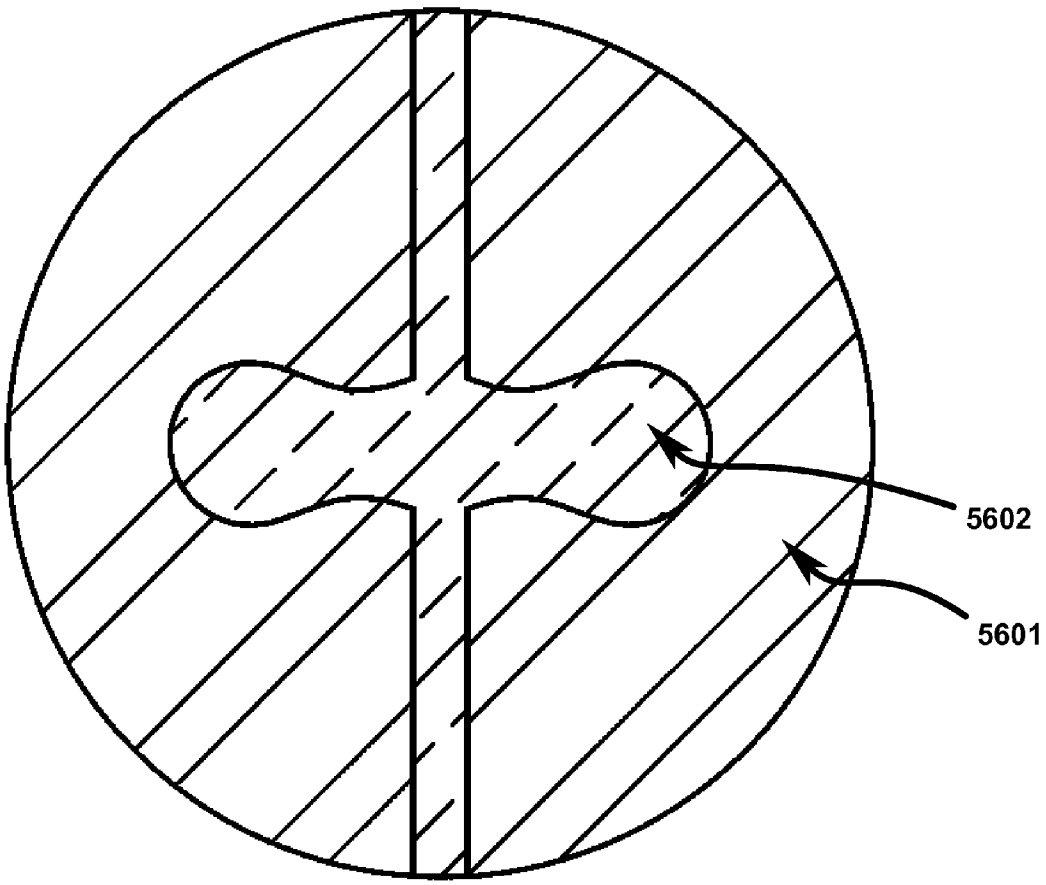
FIG. 57 illustrates a front cross section view of a spherical restriction plug element with a first composition mechanically held together by a toroid mechanical second composition according to a preferred exemplary system embodiment.

According to a preferred exemplary embodiment, the toroid mechanical insert may change phase (melt/vaporize) or loose strength or elasticity after a fracture treatment upon contact with wellbore formations or fluids pumped from the surface. The un-bonded mechanical linkage progressively weakens at well temperatures, allowing the ball to change shape in one or more coordinate directions, or to separate into multiple parts, whether or not the ball was in multiple parts before mechanically linked. The second composition may melt/vaporize and crumble the RPE into individual small segments like orange segments. The protrusions shown in FIG. 56 (5600) for toroid mechanical inserts are for illustration purposes only and may not be construed as a limitation. Multiple protrusions for the toroid insert may be created. Tradeoffs between number of protrusions, mechanical integrity and cost may be evaluated to determine an optimal structure. A cross section of a RPE with one protrusion in the toroid shape is illustrated in FIG. 57 (5700).

Figure 53:
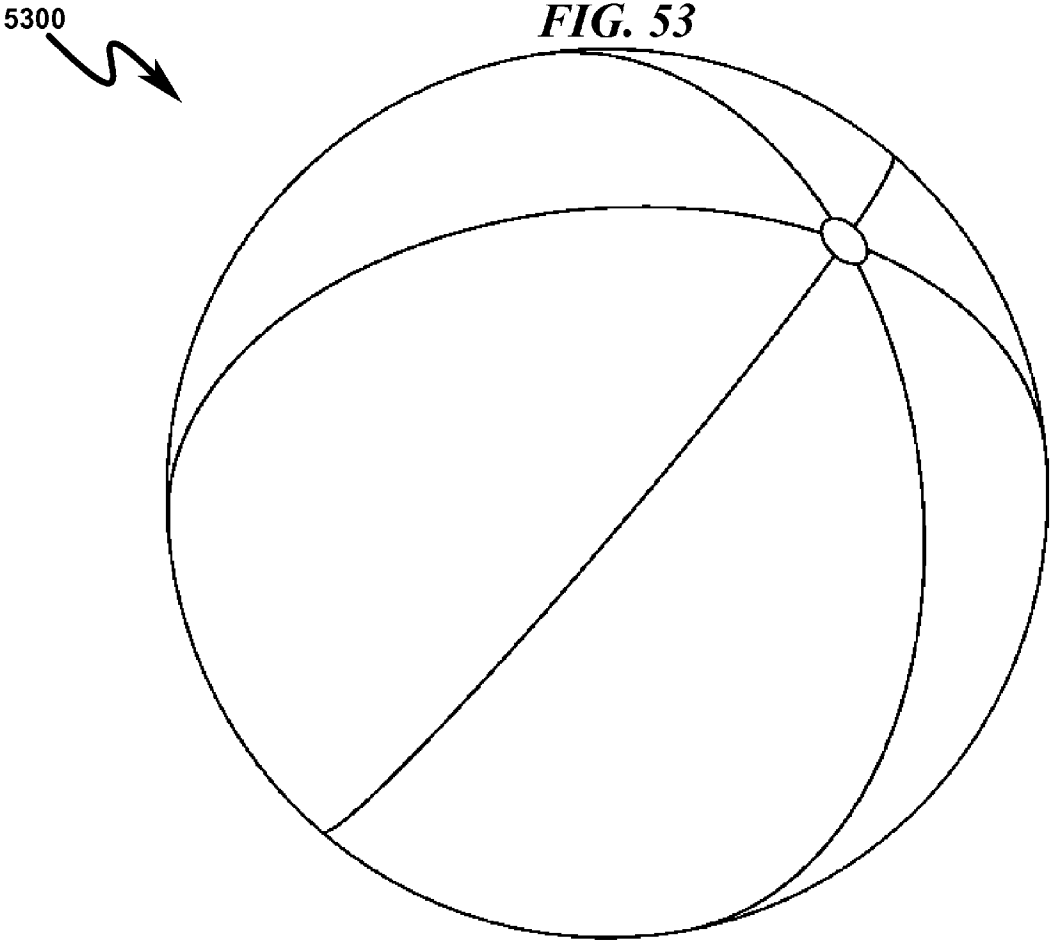
FIG. 53 illustrates a spherical restriction plug element with a first composition mechanically held together by a toroid mechanical second composition according to a preferred exemplary system embodiment.
Figure 54:
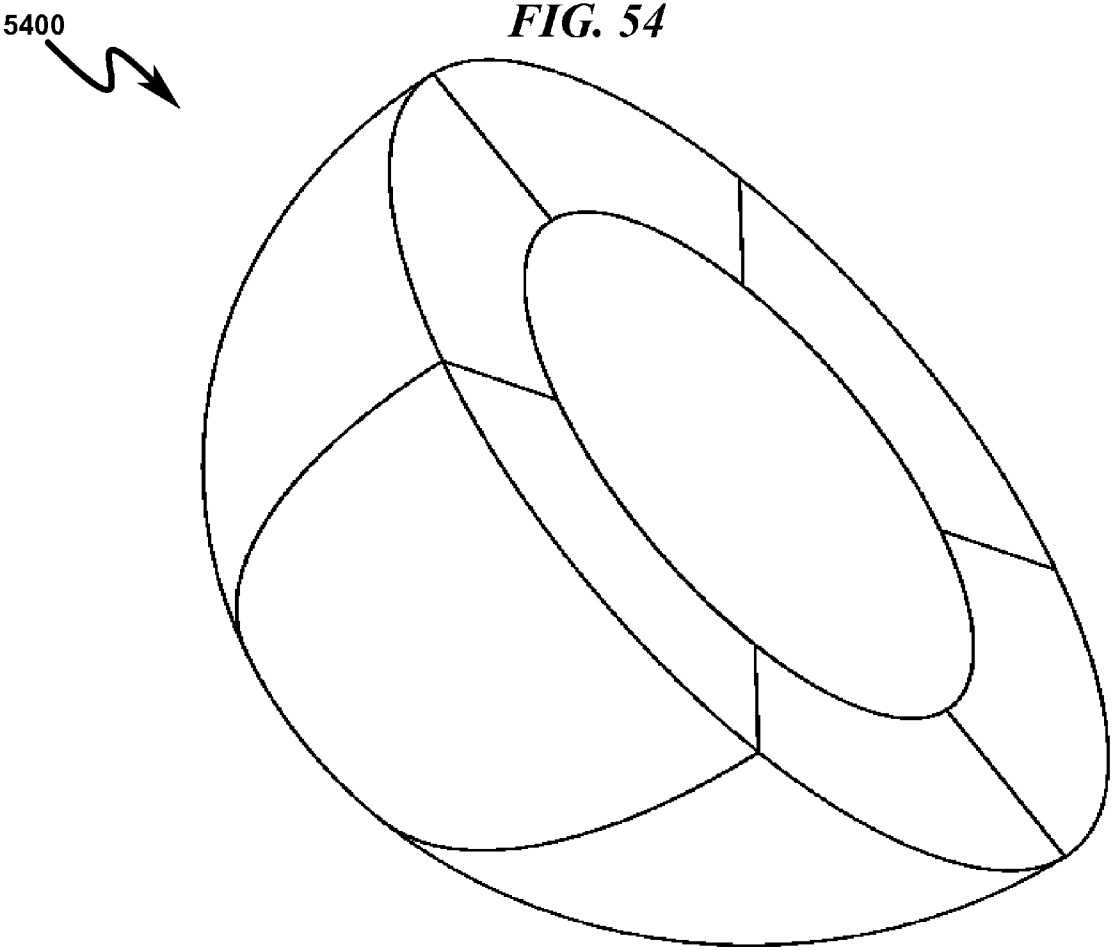
FIG. 54 illustrates a cross section view of a spherical restriction plug element with a first composition mechanically held together by a toroid mechanical second composition according to a preferred exemplary system embodiment.
Figure 55:
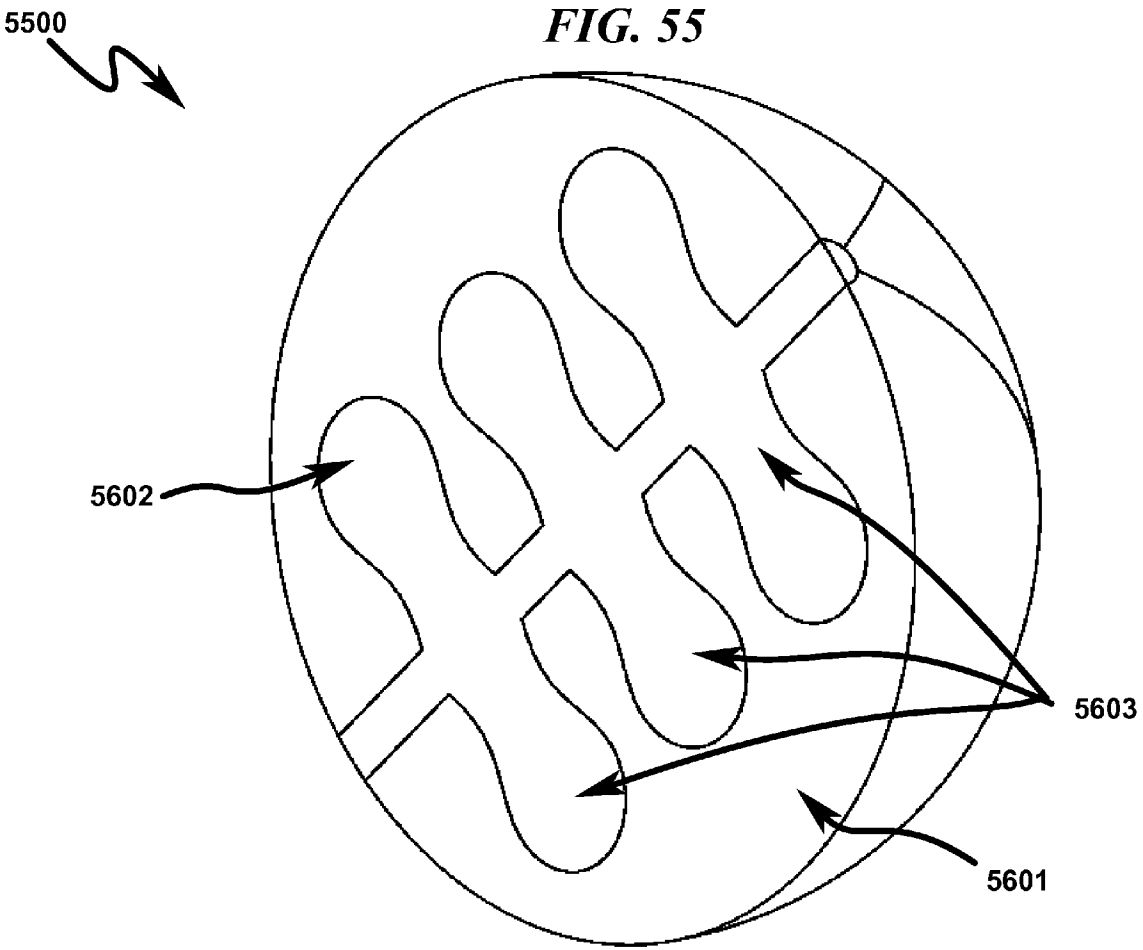
FIG. 55 illustrates a top perspective view of a spherical restriction plug element with a first composition mechanically held together by a toroid mechanical second composition according to a preferred exemplary system embodiment.
Figure 57A:
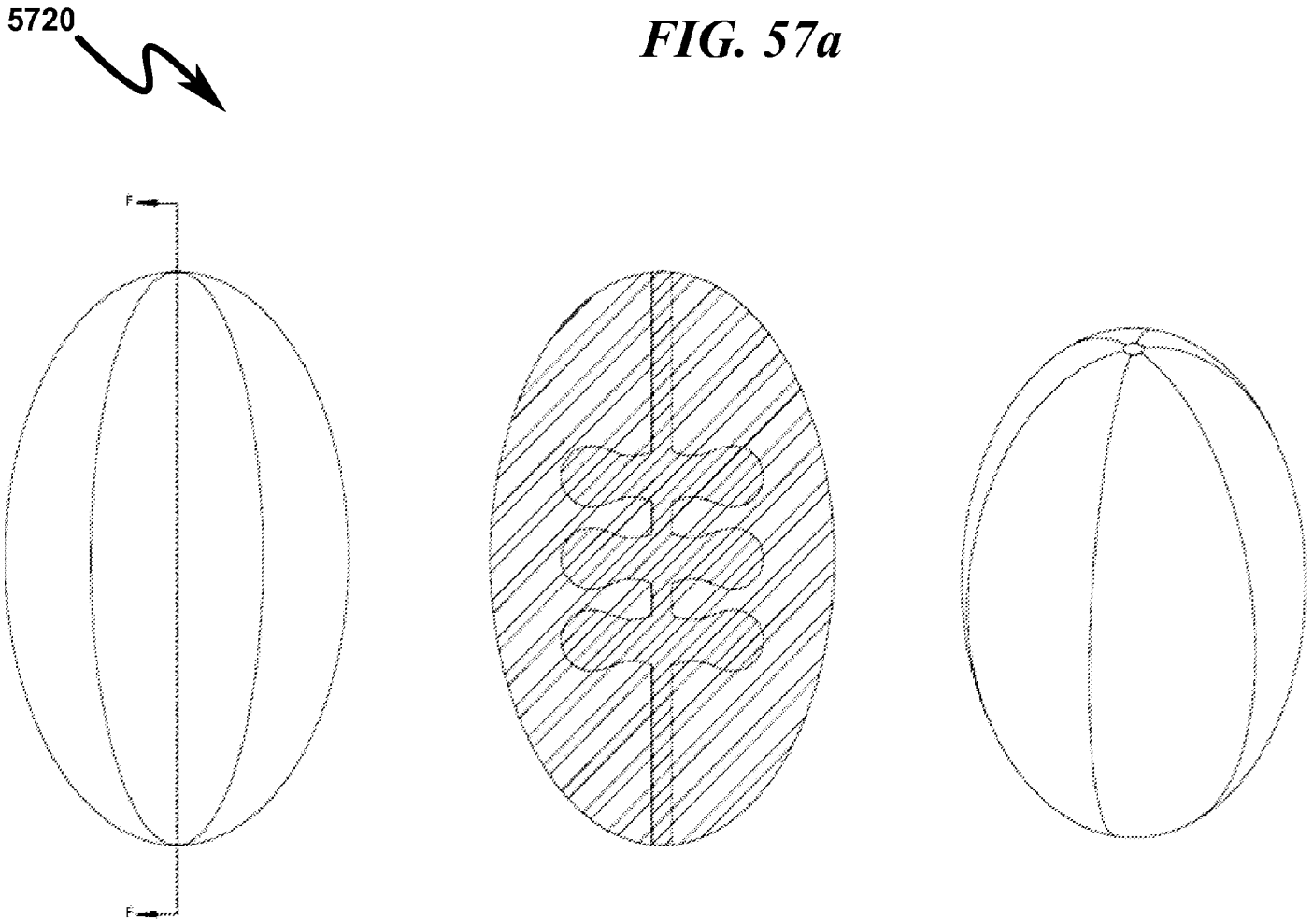
FIG. 57*a* illustrates an ovoid restriction plug element with a first composition mechanically held together by a toroid mechanical second composition according to a preferred exemplary system embodiment.

A perspective view of the restriction plug element with toroid mechanical insert is illustrated further in FIG. 53 (5300). A top and side perspective view of the restriction plug element with mechanical insert is illustrated in more detail in FIG. 54 (5400) and FIG. 55 (5500) respectively. Similarly, an exemplary embodiment oval shaped RPE with a toroid mechanical insert is illustrated in FIG. 57*a* (5720).

Preferred Embodiment Sliding Piston Restriction Plug Element (5800-6200)

Figure 60:
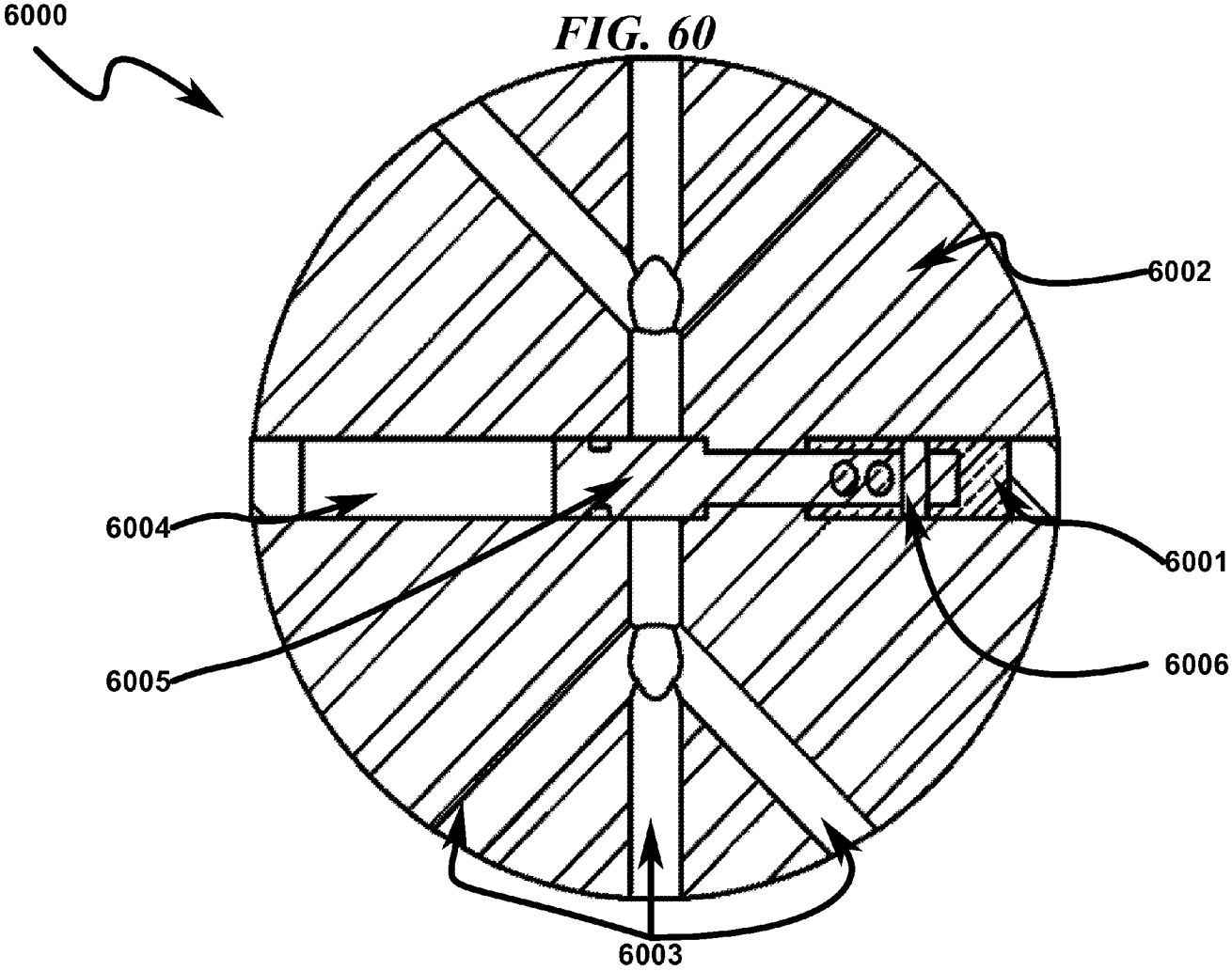
FIG. 60 illustrates a cross section view of a spherical restriction plug element with a first composition surrounding a second composition with a movable piston according to a preferred exemplary system embodiment.

As generally illustrated in the cross section of FIG. 60 (6000), a restriction plug element comprises a first composition (6001) in contact with a second composition (6002). The RPE is facilitated with flow channels in the first composition (6001). The RPE may be shaped as a sphere or a cylinder. Flow channels (6003) may be cut in the RPE. The flow channels (6003) may be hollow tubular, cylindrical, wedge shaped, or combinations thereof. The RPE may further comprise a sliding piston (6005) that slides from a first position to a second position. The second composition (6002) may clamp the piston in first position. Upon a phase change in the second composition (6002), the piston (6005) may slide from the first position to a second position in an annular space (6004). The second composition (6002) may melt/vaporize (change phase) on reaching its phase change temperature upon contact with wellbore fluids or fluids pumped from the surface. Pursuant to phase change in the second composition (6002), the piston (6005) loses hold and may slide to the second position. According to a preferred exemplary embodiment, in the second position the piston may align an aperture (6006) with the flow channels (6003) to enable fluid communication with the hydrocarbon formation during production. According to another exemplary embodiment, the piston (6005) in the first position holds in place while blocking fluid communication with toe end fracturing zones. In yet another exemplary embodiment, the piston may be made of the second composition (6002) and completely melt/vaporize subsequent to fracturing treatment creating flow channels in the RPE.

Figure 58:
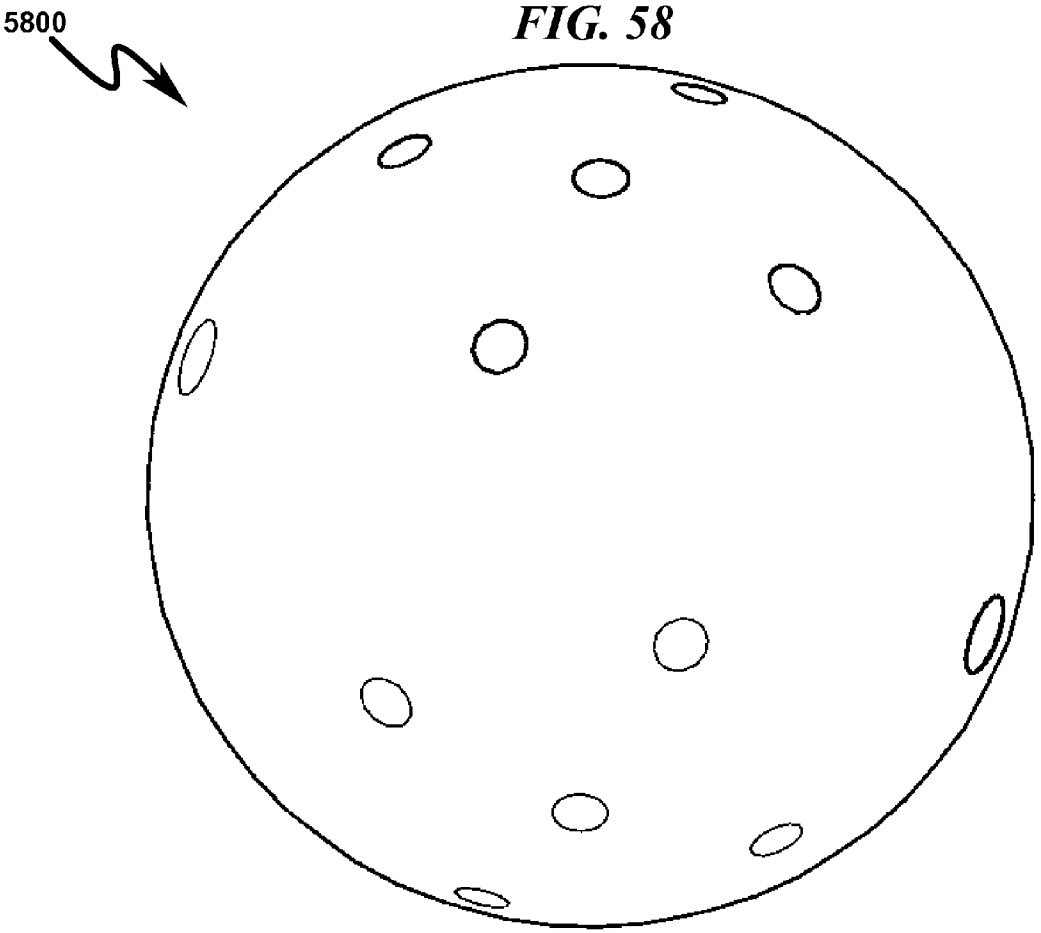
FIG. 58 illustrates a spherical restriction plug element with a first composition surrounding a second composition with a movable piston according to a preferred exemplary system embodiment.
Figure 59:
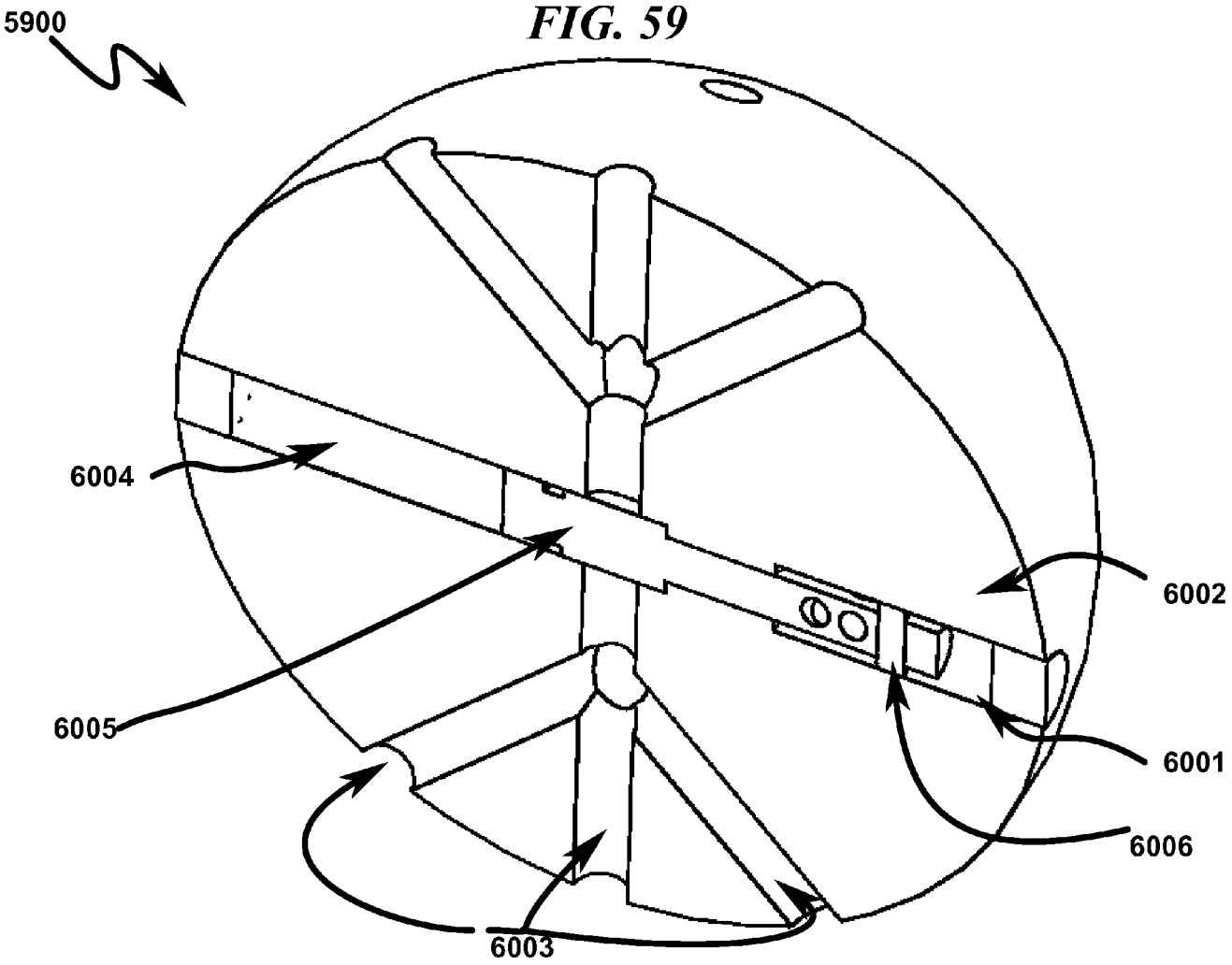
FIG. 59 illustrates a perspective view of a spherical restriction plug element with a first composition surrounding a second composition with a movable piston according to a preferred exemplary system embodiment.
Figure 61:
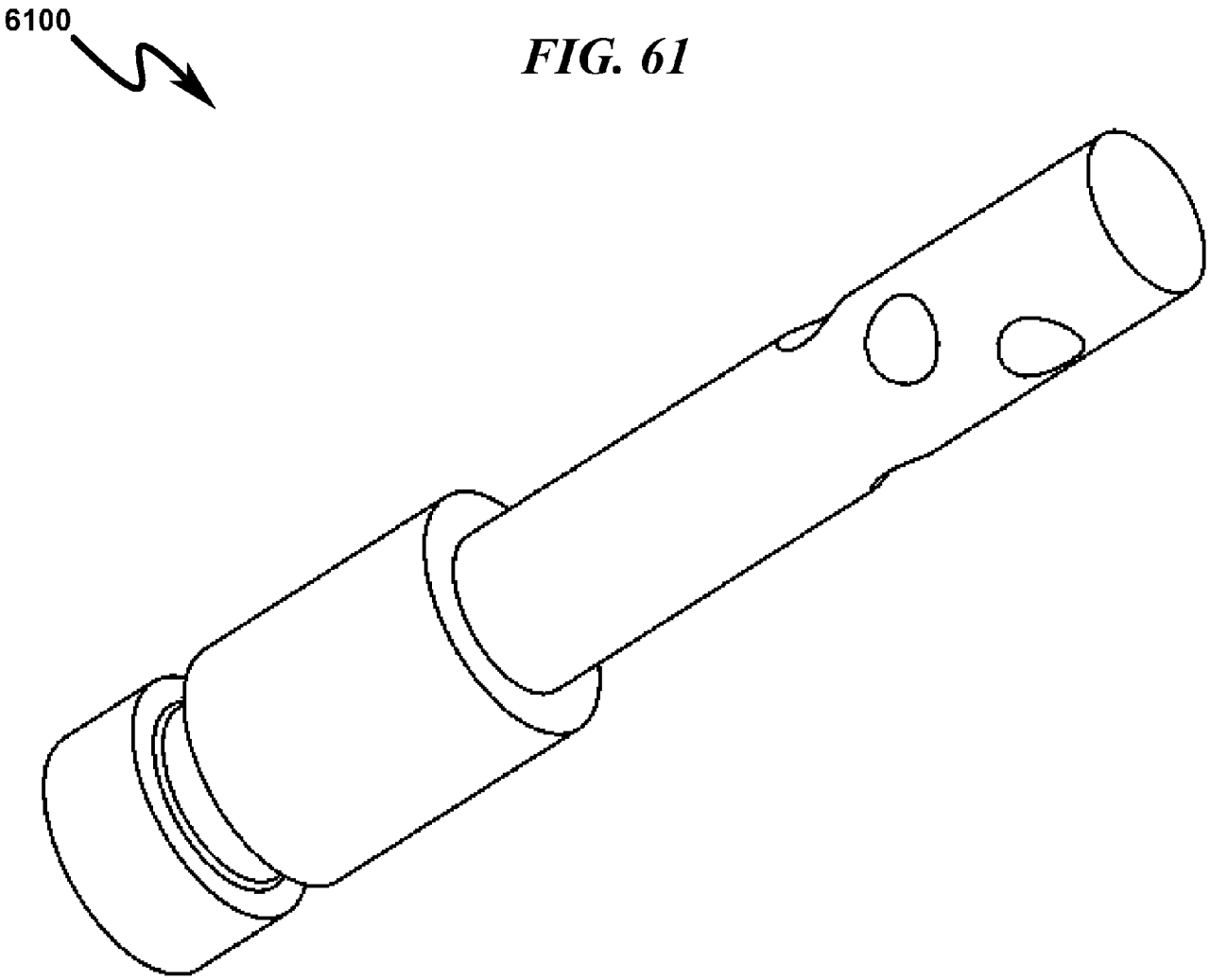
FIG. 61 illustrates a perspective view of a sliding piston within a spherical restriction plug element according to a preferred exemplary system embodiment.
Figure 62:
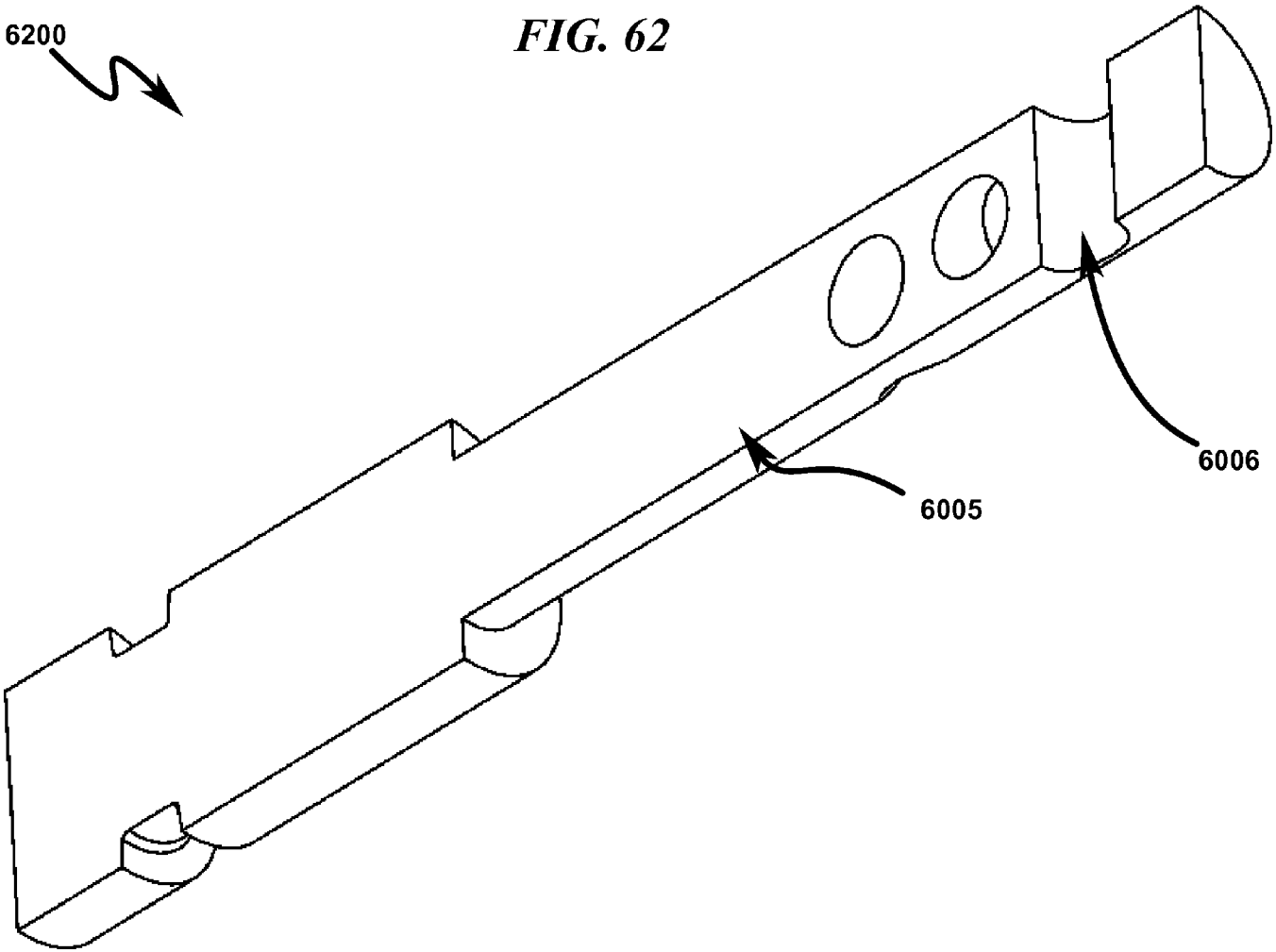
FIG. 62 illustrates a cross section view of a sliding piston within a spherical restriction plug element according to a preferred exemplary system embodiment.

A perspective view of the restriction plug element with a sliding piston is illustrated further in FIG. 58 (5800). A side perspective view of the restriction plug element with a sliding piston is illustrated in more detail in FIG. 59 (5900). A perspective view of the piston (6005) is illustrated in more detail in FIG. 61 (6100) and FIG. 62 (6200).

Preferred Embodiment Restriction Plug Element with Internal Flow Channels (6400, 6700, 7000)

Figure 64:
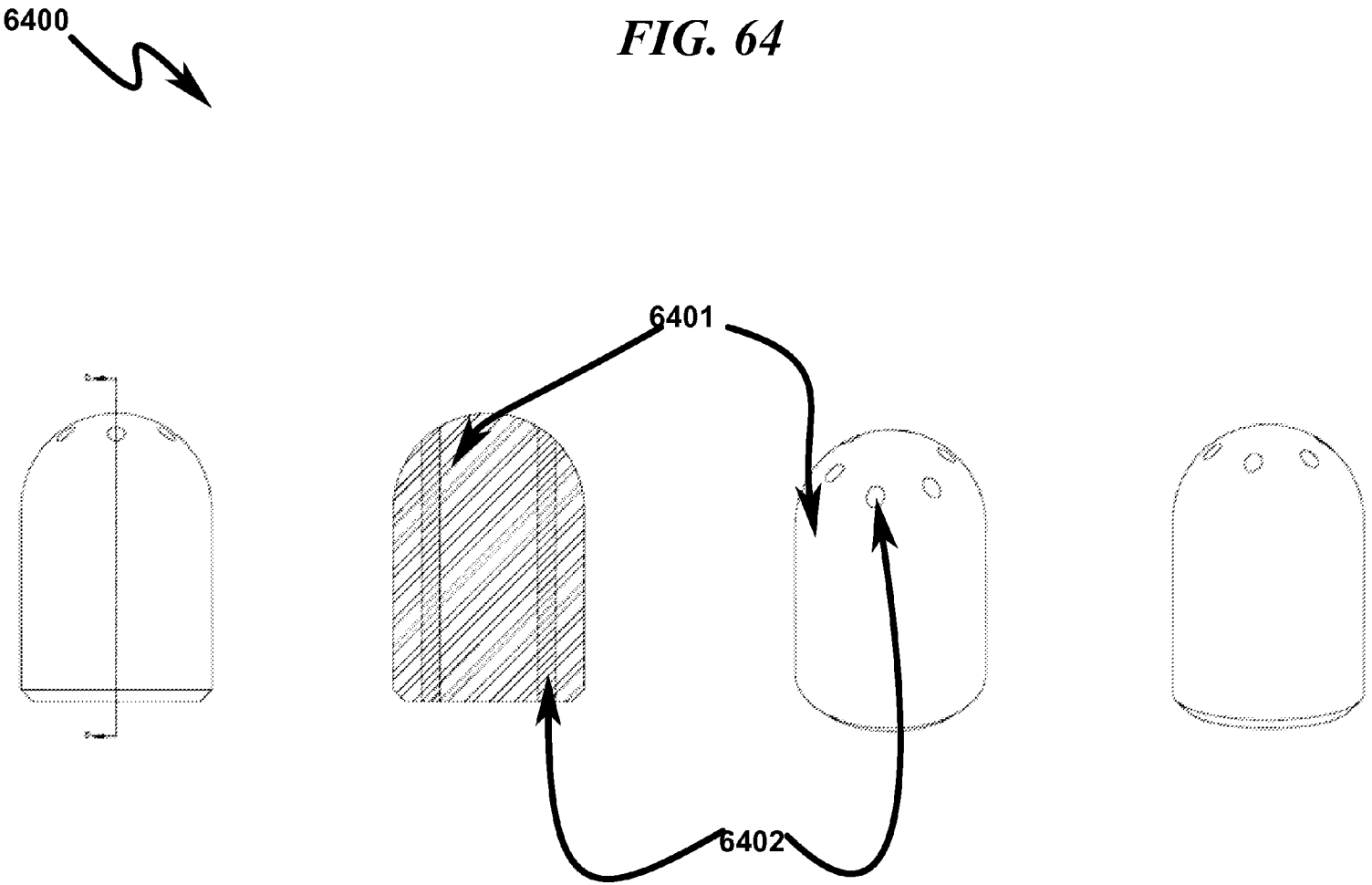
FIG. 64 illustrates a cylindrical restriction plug element with internal flow channels according to a preferred exemplary system embodiment.

As generally illustrated in FIG. 64 (6400), a cylindrical restriction plug element comprises a first composition (6401) in direct contact with a second composition (6402). The RPE is facilitated with flow channels in the first composition (6401). The RPE may be shaped as a sphere, cylinder, ovoid or dart. According to a preferred exemplary embodiment, the flow channels are filled with the second composition (6402). The flow channels may be cut through the first composition. The flow channels may take the shape of a cylinder, a tube, or an elongated wedge shape or combination thereof.

According to a presently preferred exemplary embodiment, upon exposure to temperatures in a wellbore higher than the phase/strength/elasticity change temperature, the second composition in the flow channel changes phase (melt/vaporize) or weakens in strength/elasticity, thereby exiting the RPE and creating vacant flow channels in the RPE. The first composition (6401) may maintain its shape and structure while the second composition (6402) exits. After a fracturing treatment and exodus of the second composition (6402), the RPE may disengage from a restriction sleeve member and position itself between RSMs. The RPE may also stay engaged in the RSM. During production, the vacated flow channels may facilitate production fluids to flow in the production direction. Additionally, the flow channels in the RSM may be used in conjunction with the flow channels in the RPE to provide substantially unobstructed production flow. It should be noted that fluids may take any path that is least resistant in the flow channels during production and are not limited to a specific flow channel, axis, or alignment.

Figure 67:
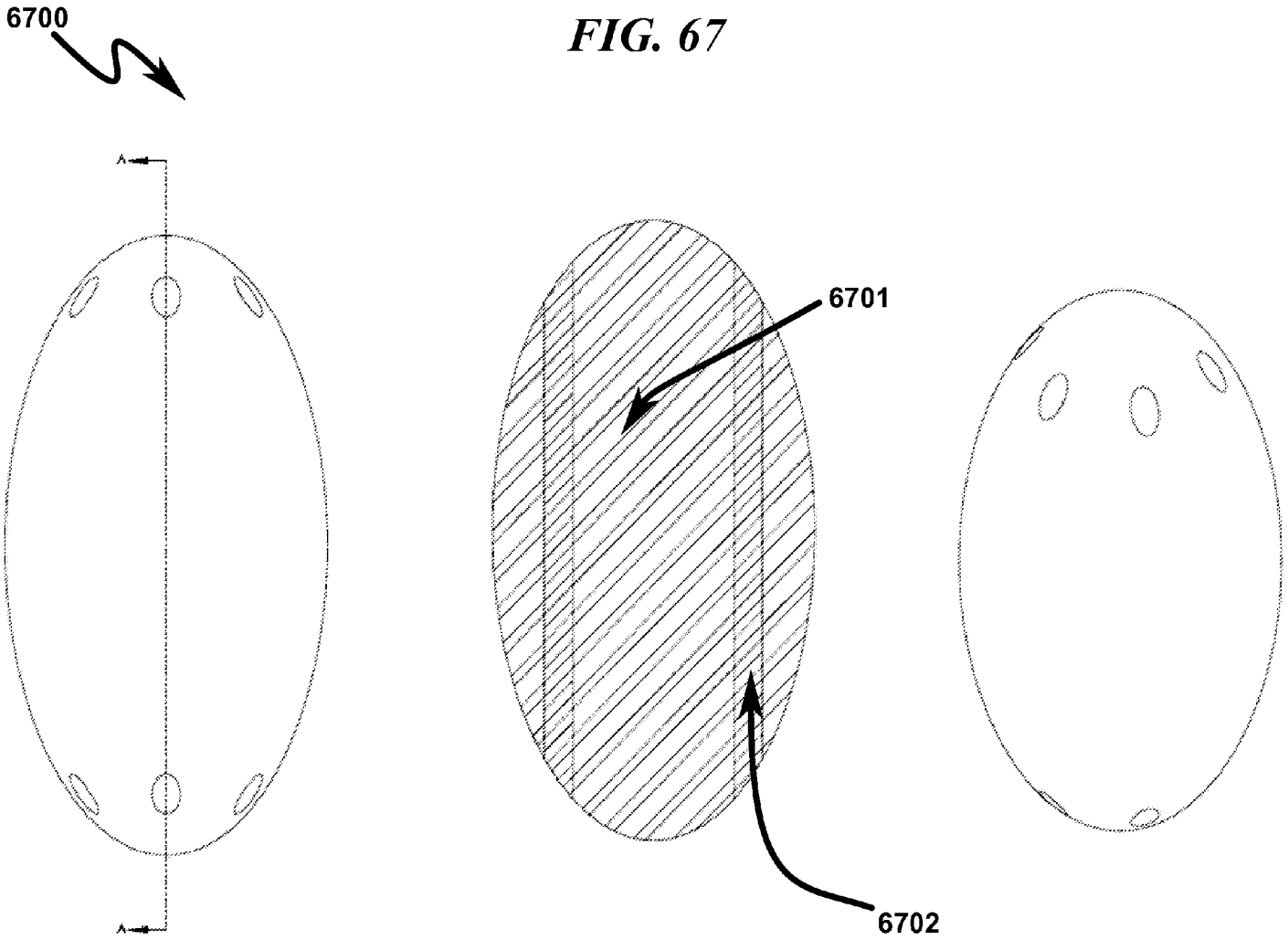
FIG. 67 illustrates an ovoid restriction plug element with internal flow channels according to a preferred exemplary system embodiment.
Figure 70:
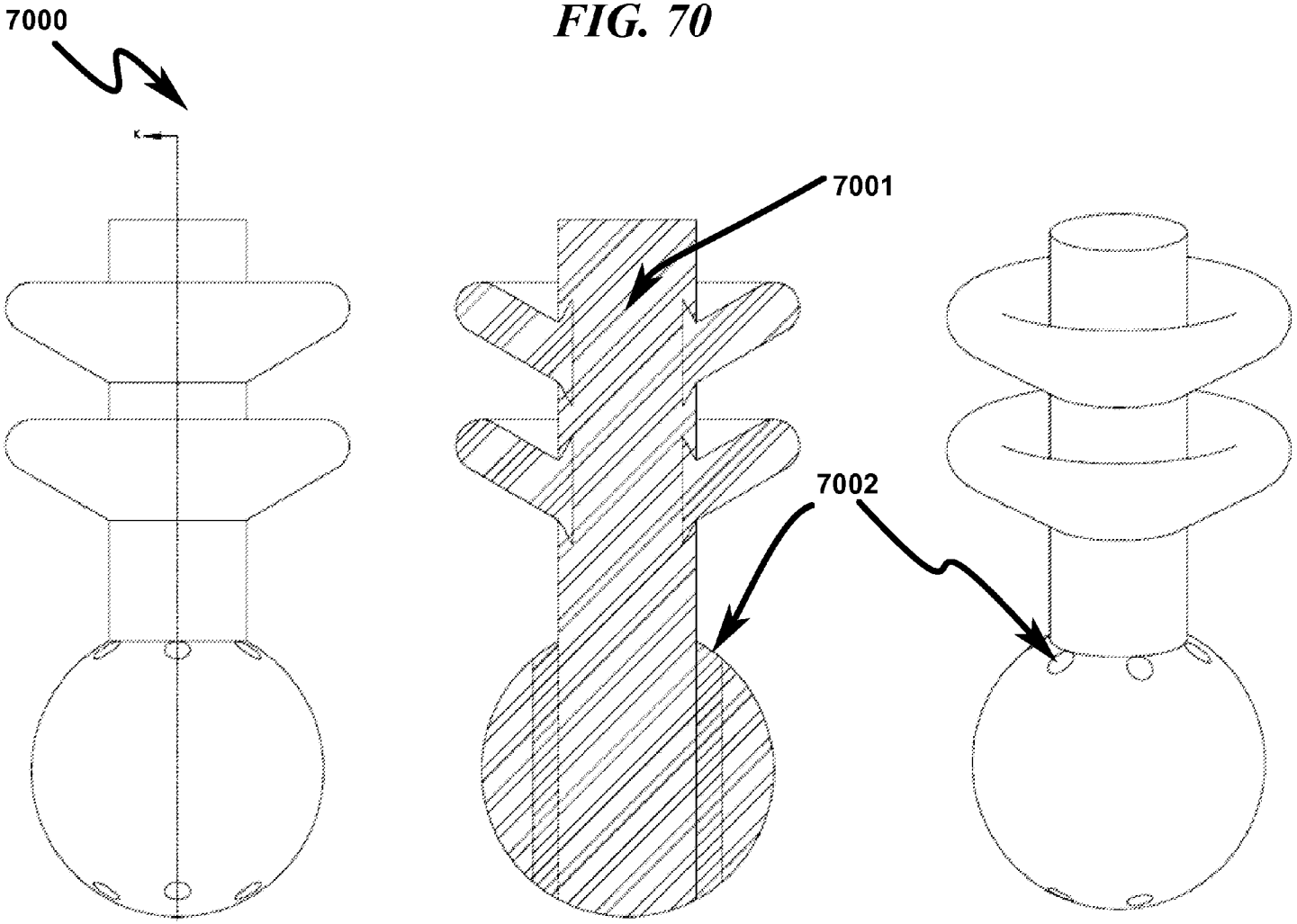
FIG. 70 illustrates a dart restriction plug element with internal flow channels according to a preferred exemplary system embodiment.

Similarly, an exemplary embodiment ovoid RPE is illustrated in FIG. 67 (6700) comprises a first composition (6701) in direct contact with a second composition (6702). Likewise, an exemplary embodiment dart RPE is illustrated in FIG. 70 (7000) comprises a first composition (7001) in direct contact with a second composition (7002).

According to an exemplary embodiment, the first composition and second composition may be reversed. For example, the internal flow channels may be filled with first composition surrounded by a second composition. In this case, the overall size of the RPE diminishes as the second compositions changes property (phase/strength/elasticity) enabling substantially larger fluid flow during production.

Preferred Embodiment Restriction Plug Element with External Flow Channels (6300, 6600, 6900)

Figure 63:
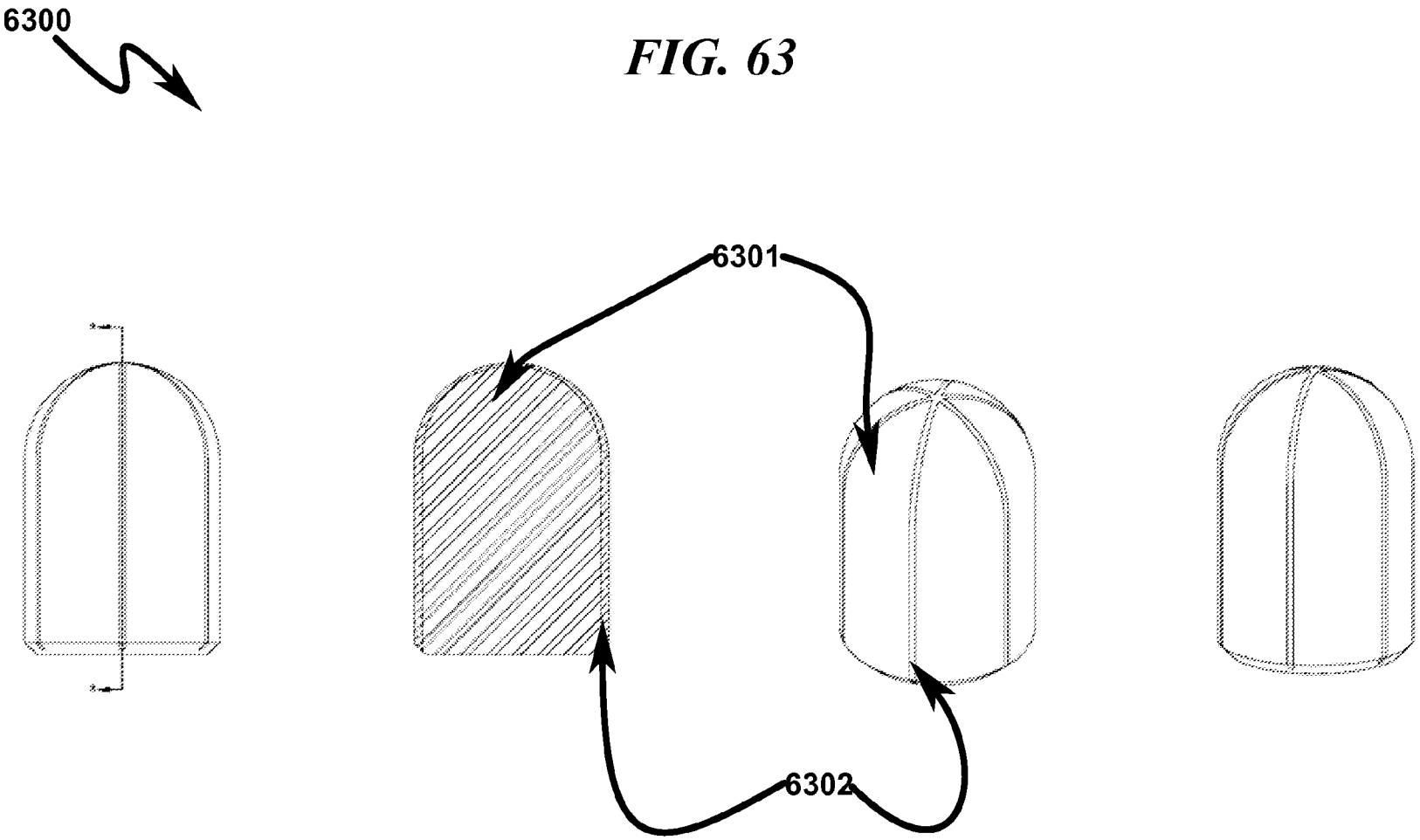
FIG. 63 illustrates a cylindrical restriction plug element with external flow channels according to a preferred exemplary system embodiment.

According to another exemplary embodiment, the flow channels may be exterior to the RPE. As generally illustrated in FIG. 63 (6300), a cylindrical restriction plug element comprises a first composition (6301) in direct contact with a second composition (6302). The RPE is facilitated with outer flow channels in the first composition (6301). The RPE may be shaped as a sphere, cylinder, ovoid or dart. According to a preferred exemplary embodiment, the flow channels may or may not be filled with a second composition (6302). The flow channels may be cut through the first composition. The flow channels may take the shape of a cylinder, a tube, or an elongated wedge shape or combination thereof.

According to a presently preferred exemplary embodiment, upon exposure to temperatures in a wellbore higher than the phase/strength/elasticity change temperature, the second composition in the flow channel changes phase (melt/vaporize) or weakens in strength, thereby exiting the RPE and creating vacant flow channels in the RPE. The first composition (6301) may maintain its shape and structure while the second composition (6302) exits.

Figure 66:
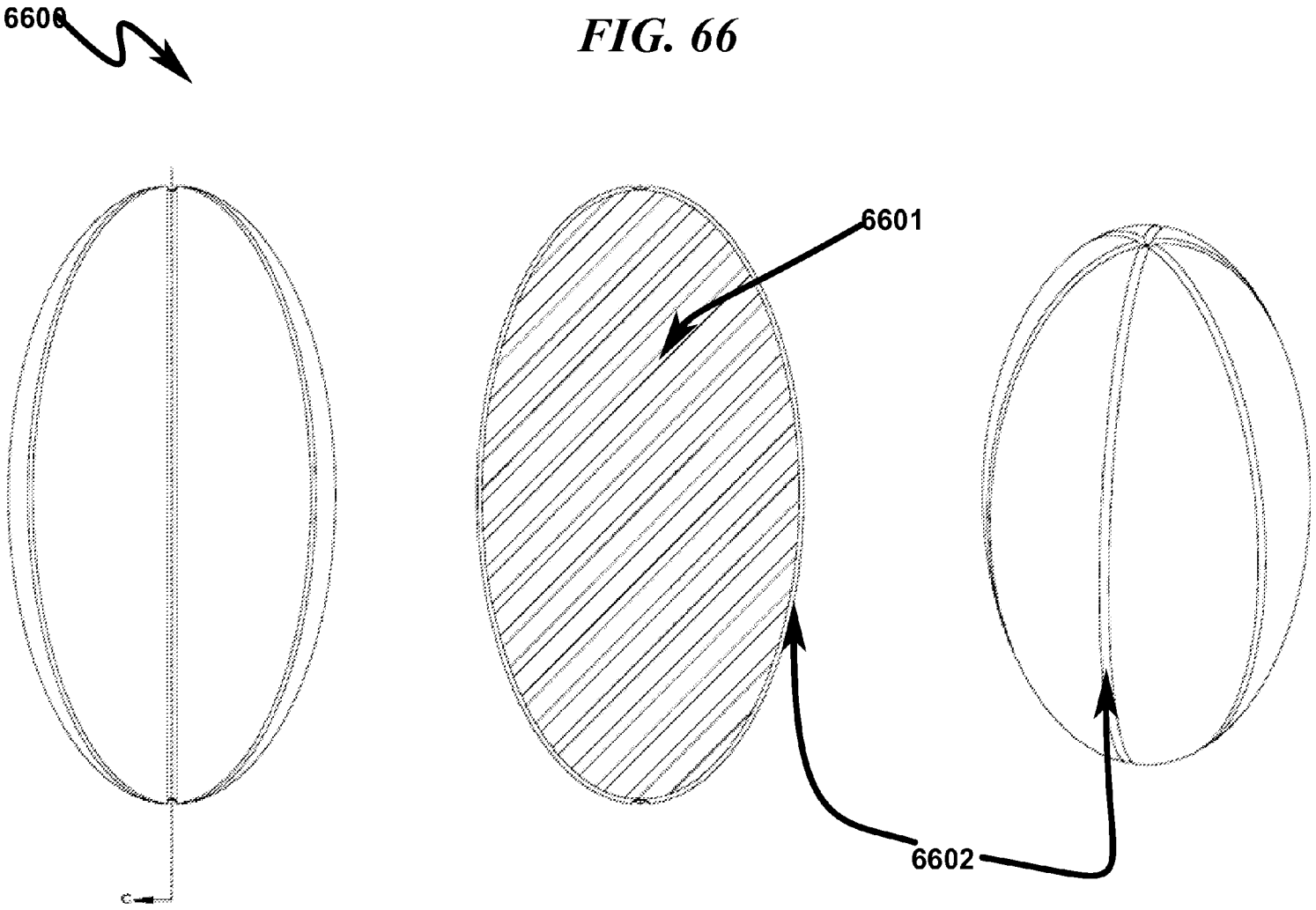
FIG. 66 illustrates an ovoid restriction plug element with external flow channels according to a preferred exemplary system embodiment.
Figure 69:
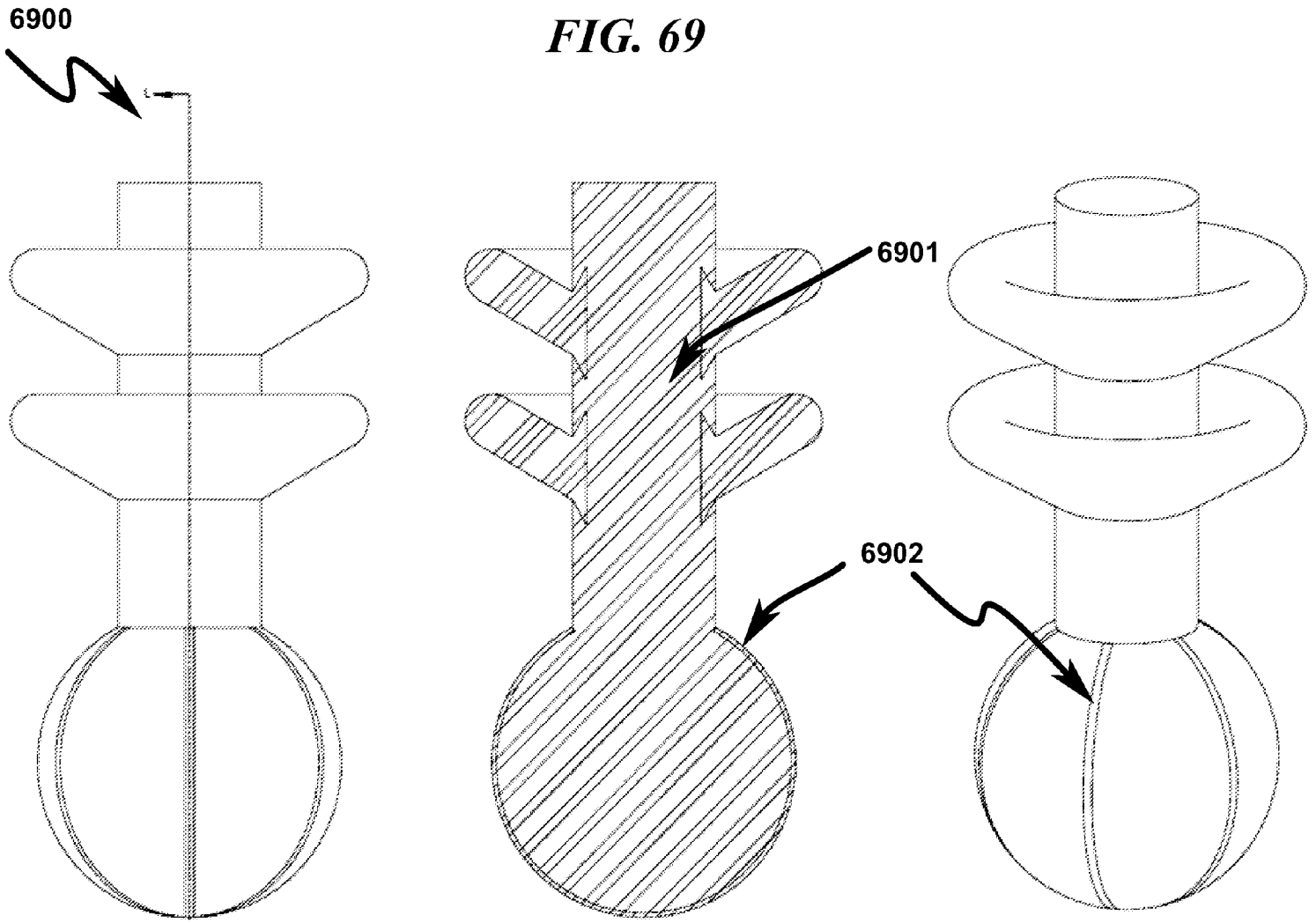
FIG. 69 illustrates a dart restriction plug element with external flow channels according to a preferred exemplary system embodiment.

Similarly, an exemplary embodiment ovoid RPE is illustrated in FIG. 66 (6600) that comprises a first composition (6601) in direct contact with a second composition (6602). Likewise, an exemplary embodiment dart RPE is illustrated in FIG. 69 (6900) that comprises a first composition (6901) in direct contact with a second composition (6902).

According to an exemplary embodiment, the first composition and second composition may be reversed. For example, the internal flow channels may be filled with first composition surrounded by a second composition. In this case, the overall size of the RPE diminishes as the second compositions changes property (phase/strength/elasticity) enabling substantially larger fluid flow during production.

Preferred Embodiment Restriction Plug Element with Banded Flow Channels (6500, 6800, 7100)

Figure 65:
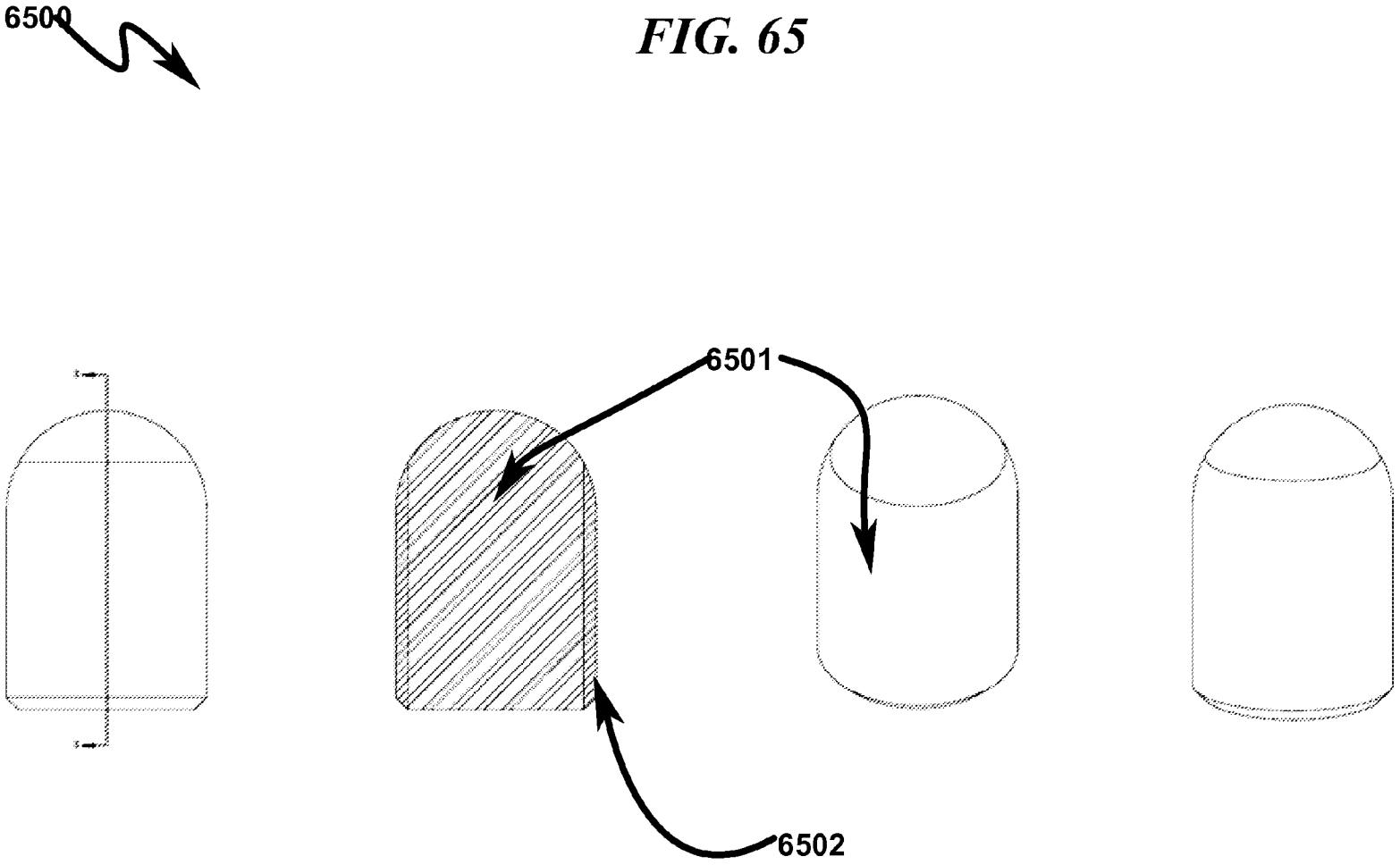
FIG. 65 illustrates a banded cylindrical restriction plug element according to a preferred exemplary system embodiment.

According to another exemplary embodiment, the flow channels may be banded in the RPE. As generally illustrated in FIG. 65 (6500), a cylindrical restriction plug element comprises a first composition (6501) in direct contact with a second composition (6502). The RPE is facilitated with banded flow channels in the first composition (6501). The RPE may be shaped in the shape of a sphere, cylinder, ovoid or dart. According to a preferred exemplary embodiment, the flow channels may or may not be filled with a second composition (6502). The flow channels may be cut through the first composition. The flow channels may take the shape of a cylinder, a tube, or an elongated wedge shape or combination thereof.

According to a presently preferred exemplary embodiment, upon exposure to temperatures in a wellbore higher than the phase/strength/elasticity change temperature, the second composition in the flow channel changes phase (melt/vaporize) or weakens in strength, thereby exiting the RPE and creating vacant flow channels in the RPE. The first composition (6501) may maintain its shape and structure while the second composition (6502) exits.

Figure 68:
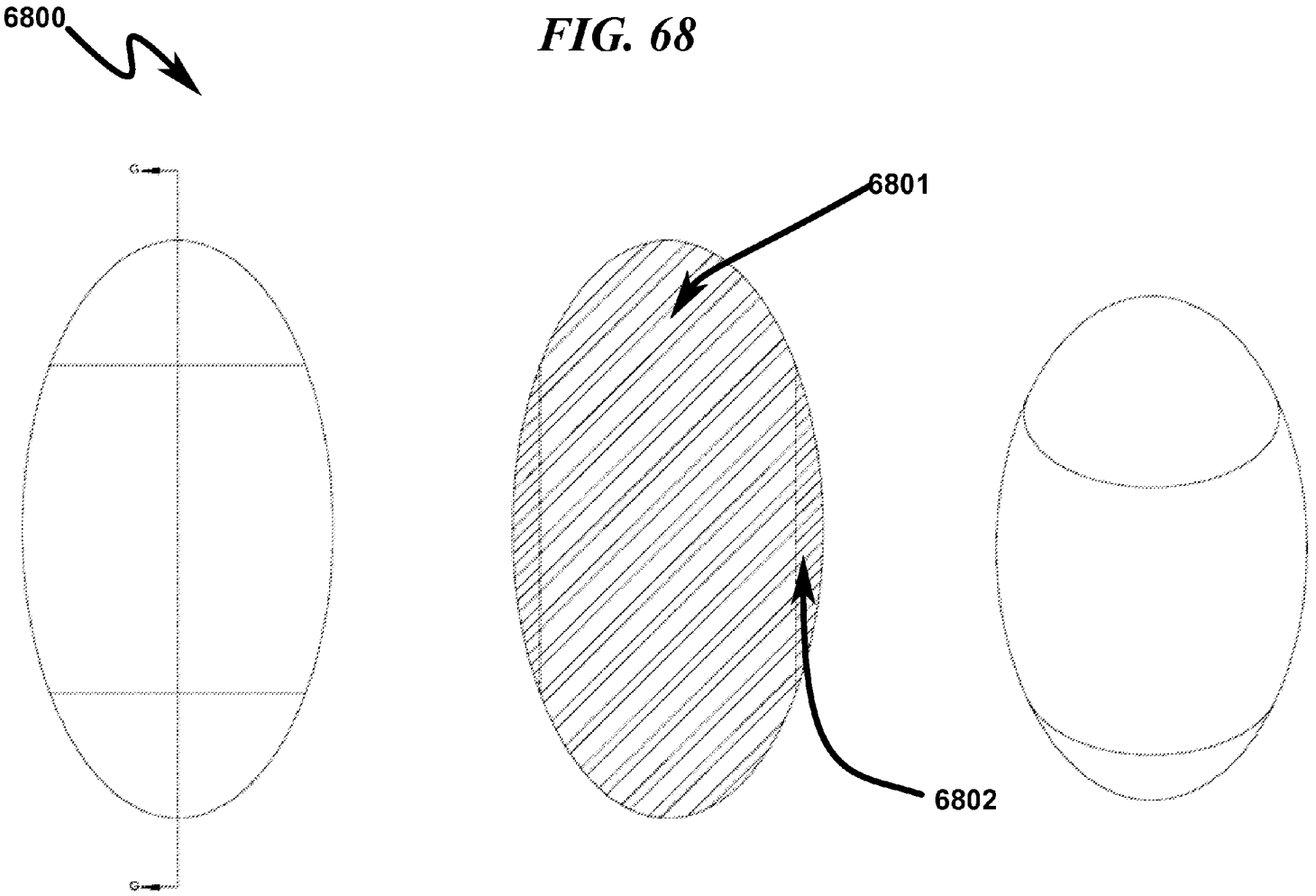
FIG. 68 illustrates a banded ovoid restriction plug element according to a preferred exemplary system embodiment.
Figure 71:
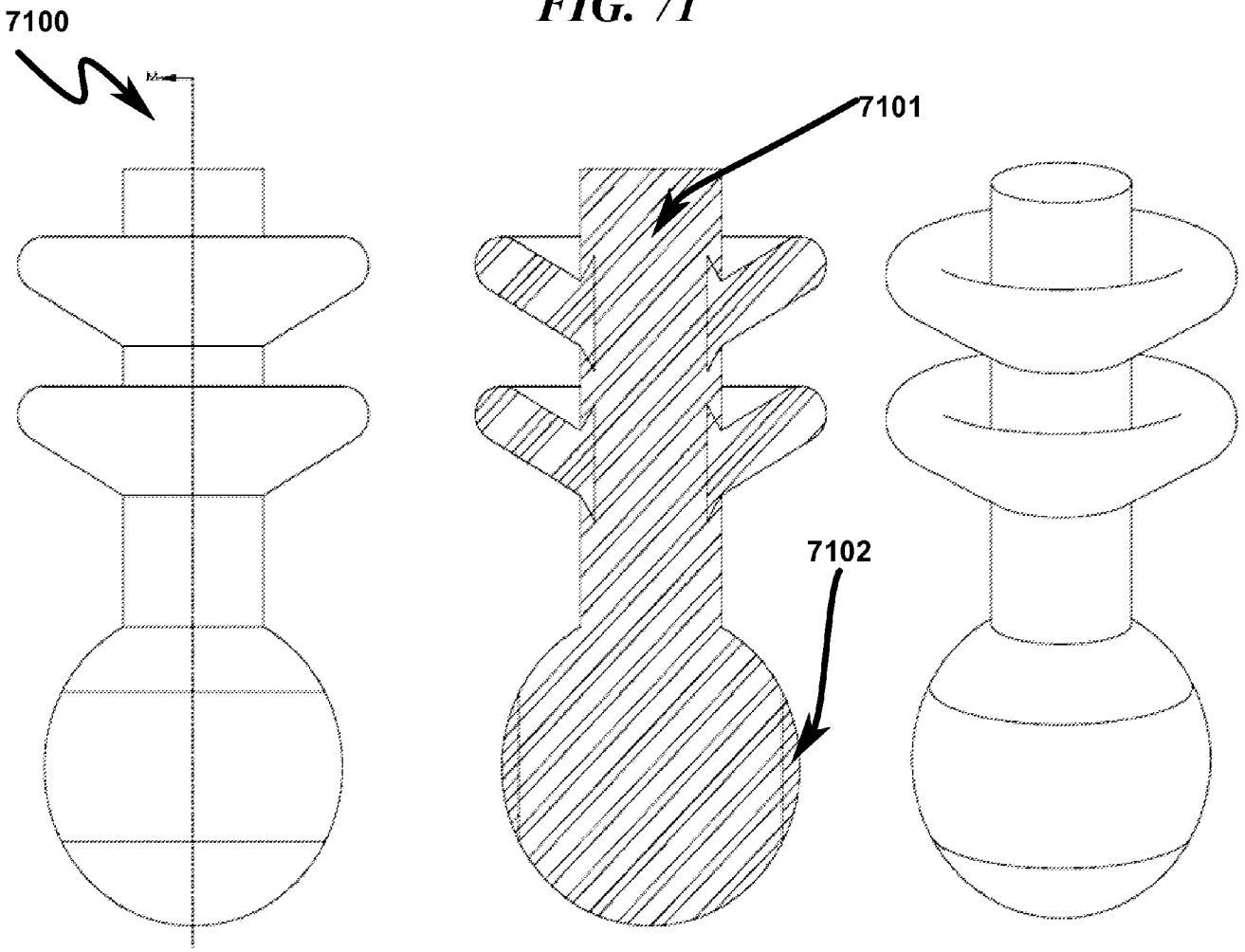
FIG. 71 illustrates a banded dart restriction plug element according to a preferred exemplary system embodiment.

Similarly, an exemplary embodiment ovoid RPE is illustrated in FIG. 68 (6800) that comprises a first composition (6801) in direct contact with a second composition (6802). Likewise, an exemplary embodiment dart RPE is illustrated in FIG. 71 (7100) that comprises a first composition (7101) in direct contact with a second composition (7102).

According to an exemplary embodiment, the first composition and second composition may be reversed. For example, the internal flow channels may be filled with first composition surrounded by a second composition. In this case, the overall size of the RPE diminishes as the second compositions changes property (phase/strength/elasticity) enabling substantially larger fluid flow during production.

Temperature Profile in a Wellbore (7400)

A typical temperature profile in a wellbore is shown in the plot (7400). The plot shows a time (x-axis) (7401) plotted against a temperature (y-axis) (7402) in the wellbore. The temperature of the RSM may be at constant temperature (for example 150° F.) before fracturing treatment (7403) in a zone. The temperature may rise to 190° F. during fracturing operation (7404) and further increase to 250° F. after fracturing treatment (7405) and stay at the temperature during production (7406). The temperature profile may be used to select RPEs with a specific melting point, strength, or phase changing temperature.

Exemplary Restriction Plug Element with an Integrated Resistive Heater (7500-7600)

Figure 75:
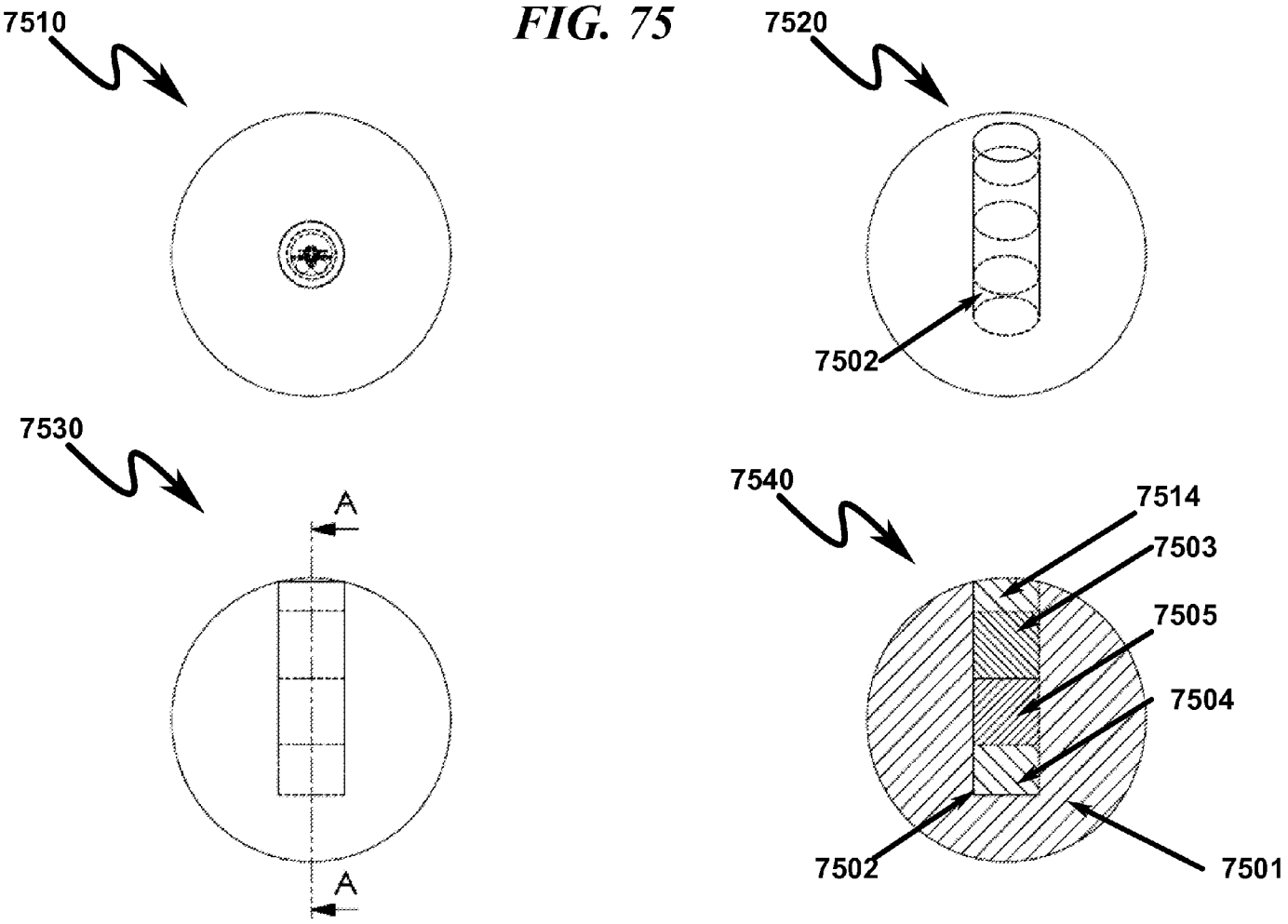
FIG. 75 illustrates a restrictive plug element with an integrated resistive heater according to a preferred exemplary system embodiment.
Figure 76:
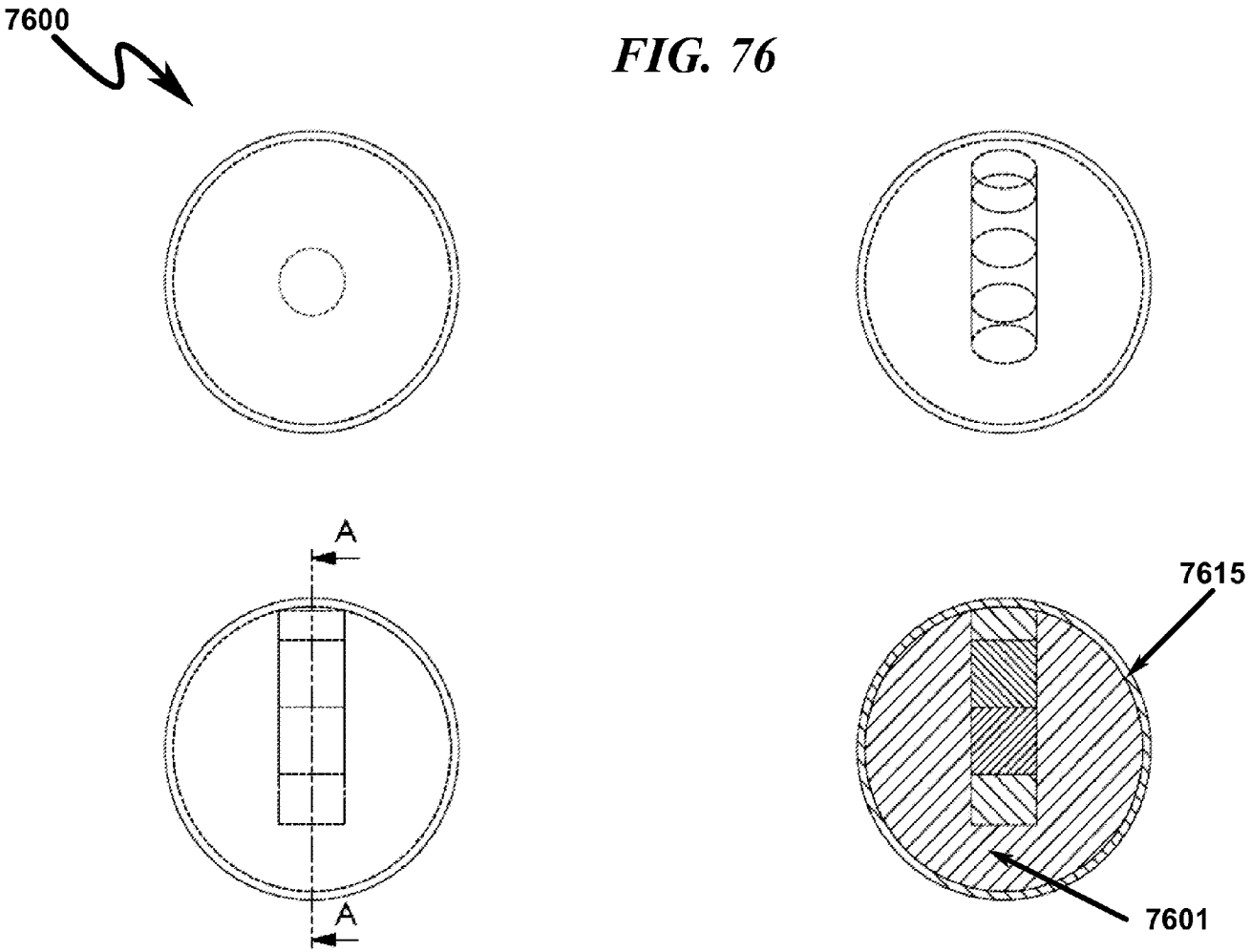
FIG. 76 illustrates a restrictive plug element surrounded by an insulating layer and integrated with a resistive heater according to a preferred exemplary system embodiment.

An exemplary restrictive plug element with an integrated resistive heater may be generally illustrated in more detail in FIG. 75, wherein a restriction plug element (RPE) comprises a first composition (7501) that is in direct contact with a resistive heating insert (7502). The RPE may be deployed into a wellbore casing for isolating pressure communication to toe end stages. A front view (7530), an end view (7510), a perspective view (7520) and cross section view (7540) is generally illustrated in detail in FIG. 75. The first composition (7501) may surround the resistive heating insert (7502). According to a preferred exemplary embodiment, a resistive heating element in the resistive heating insert produces heat so that the first composition changes a physical property to deform or collapse the restriction plug element. The RPEs of the present invention are designed for strength, rigidity and hardness sufficient to withstand the high pressure differentials required during well stimulation, which typically range from about 1,000 pounds per square inch (psi) to about 10,000 psi. According to certain embodiments, the first composition is formed of a material or combination of materials having sufficient strength, rigidity and hardness at a temperature of from about 150° F. to about 350° F., from about 150° F. to about 220° F. or from about 150° F. to about 200° F. to seat in the restriction sleeve member and then withstand deformation under the high pressure ranging from about 1,000 psi to about 10,000 psi associated with hydraulic fracturing processes. The materials selected for first composition deform or change property when the resistive heating element produces heat upon exposure to wellbore temperature or fracturing fluids.

One class of useful materials for the first composition is elastomers. "Elastomer" as used herein is a generic term for substances emulating natural rubber in that they stretch under tension, have a high tensile strength, retract rapidly, and substantially recover their original dimensions. The term includes natural and man-made elastomers, and the elastomer may be a thermoplastic elastomer or a non-thermoplastic elastomer. The term includes blends (physical mixtures) of elastomers, as well as copolymers, terpolymers, and multi-polymers. Useful elastomers may also include one or more additives, fillers, plasticizers, and the like. Other materials may non-degradable group that includes G-10 (glass reinforced Epoxy Laminate), FR4, PEEK (Injection Molded), Nylon GF, Torlon, Steel, Aluminum, Stainless Steel, Nylon MF, Nylon GF, Magnesium Alloy (without HCL), Ceramic, Cast Iron, Thermoset Plastics, and Elastomers (rubber, nitrile, niton, silicone, etc.). The first composition may also include materials from a long term degradable group that includes PGA (polyglycolic acid) and Magnesium Alloy (with HCL).

The resistive heating insert (7502) in the restriction plug element may comprise a voltage source (7504), a resistive heating element (7505), a pressure switch (7503) and a sealed cap (7514). The resistance heating element (7505) may be wire or ribbon, straight or coiled. The resistive heating element (7505) material may be selected from a common classes of materials that include: Kanthal (FeCrAl) wires, Nichrome 80/20 and Cupronickel (CuNi) alloys for low temperature heating and combinations thereof. The resistive heating element (7505) may also be supported by ceramic insulators. Electric heating is any process in which electrical energy is converted to heat. The resistive heating element inside works on the principle of Joule heating wherein an electric current passing through a resistor will convert that electrical energy into heat energy. The material of the resistance heating element (7505) may be selected such that the rate of degradation of the first composition material (7501) is controlled. For example, material of the resistance element (7505) may be cupronickel alloy that has a low trigger for heating. The length of the resistance element material (7505) may also be selected to control the rate of degradation of the first composition material (7501).

The resistive heating insert is designed to withstand the temperatures during fracturing process, but trigger the heating process during the subsequent exposure to wellbore fluids. The trigger conditions for the resistance heating element (7505) may be temperatures expected in the wellbore or a pressure condition as detected by a pressure switch (7503). The pressure switch (7503) may activate a voltage source (7504) that in turn enables the flow of current inside the resistive heating element (7505). A pressure activating device such as a reverse acting rupture disk may be part of the pressure switch. The pressure switch may be activated when the pressure in the wellbore exceeds a rated pressure of the pressure activating device. After a ball is seated in a restriction sleeve member, the fracturing pressure may be ramped up to exceed the rated pressure of the pressure activating device. The rated pressure may be in between a treatment pressure and a breakdown pressure. When the pressure switch (7503) is activated it may enable a connection of a through wire to an arming terminal in the voltage source (7504) completing the circuit for the voltage source. In one preferred exemplary embodiment, the voltage source is a battery. A sealed cap (7514) may seal the exposed end of the resistive heating insert (7502) to physically protect the resistive heating insert (7502) from undesired wellbore conditions.

The first composition further may comprise a plurality of parts. Alternatively, the first composition is a solitary integral part. The heating insert may further provide structural integrity to the restriction plug element. When the resistive heating insert generates heat, the first composition may collapse and the restriction plug element may break into smaller parts. The restriction plug element may have a shape that is selected from a group comprising: sphere, cylinder, or ovoid. When the resistive heating insert generates heat, the restriction plug element may deform to enable the restriction plug element to pass through a restriction sleeve member in the wellbore casing. Alternatively, when the resistive heating insert generates heat, the restriction plug element may reduce size to enable it to pass through a restriction sleeve member in the wellbore casing. The first composition may be selected from a group comprising plastics, non-degradable or long term degradable.

According to a preferred exemplary embodiment, the restriction plug element with the integrated resistive heating insert may further be surrounded by an insulating coating. The insulating coating (7608) may surround the first composition to further control the rate of degradation of the first composition (7501). In one preferred exemplary embodiment, the insulator may be a ceramic, elastomer or plastic that surrounds the first composition and slows the rate at which the first composition changes phase, strength or elasticity.

According to another preferred exemplary embodiment, the restriction plug element with the integrated resistive heating insert may be used in conjunction with a restriction sleeve member, such that when in production the restriction plug element degrades or deforms and passes through the restriction sleeve member or a plurality of restriction sleeve members.

Exemplary Restriction Plug Element with an Integrated Chemical Heater (7700-7800)

Figure 77:
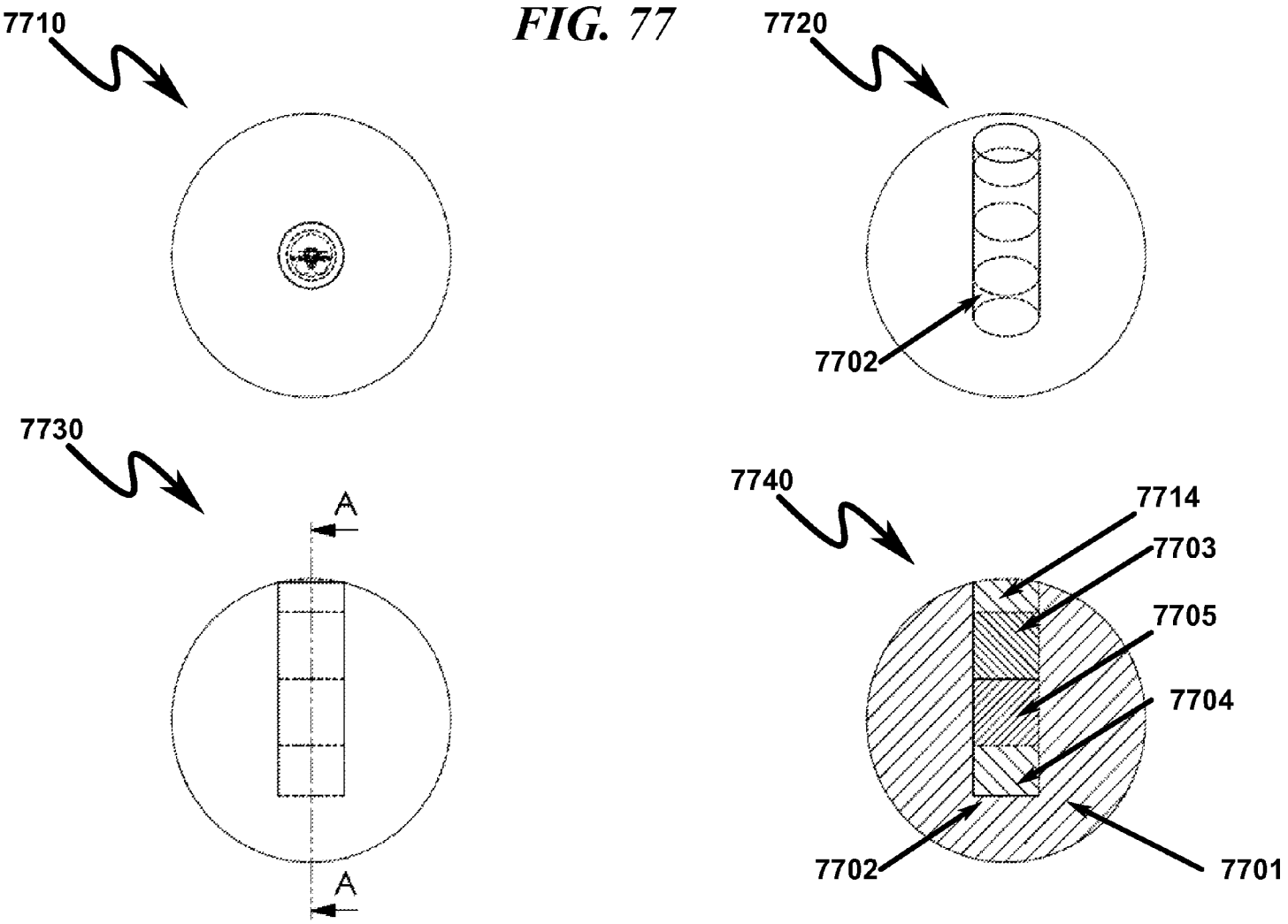
FIG. 77 illustrates a restrictive plug element with an integrated chemical heater according to a preferred exemplary system embodiment.

An exemplary restrictive plug element with an integrated chemical heater may be generally illustrated in more detail in FIG. 77, wherein a restriction plug element (RPE) comprises a first composition (7701) surrounding a chemical heating insert (7702). The RPE may be deployed into a wellbore casing for isolating pressure communication to toe end stages. A front view (7730), an end view (7710), a perspective view (7720) and cross section view (7740) is generally illustrated in detail in FIG. 75. The chemical heating insert (7702) may comprise a first chemical composition (7703) and a second chemical composition (7704) that are physically isolated by a pressure mixing chamber (7705). The first composition (7701) may completely or partially surround the chemical heating insert (7702). According to a preferred exemplary embodiment, a chemical reaction may take place between the first chemical composition and the second chemical composition in the pressure mixing chamber, the chemical reaction activated by pressure generates heat such that the first composition changes a physical property to deform or collapse the restriction plug element. The first composition of RPEs of the present invention are designed for strength, rigidity and hardness sufficient to withstand the high pressure differentials required during well stimulation, which typically range from about 1,000 pounds per square inch (psi) to about 10,000 psi. The first composition material (7701) may be selected from material as aforementioned.

The pressure mixing chamber (7705) may be activated by a pressure event in the wellbore such as a perforation or fracturing. The pressure event may enable the first chemical composition (7703) and the second chemical composition (7704) to mix and react in the pressure mixing chamber (7705). A pressure activating device such as a reverse acting rupture disk may be part of the pressure switch. The pressure switch may be activated when the pressure in the wellbore exceeds a rated pressure of the pressure activating device. After a ball is seated in a restriction sleeve member, the fracturing pressure may be ramped up to exceed the rated pressure of the pressure activating device. The rated pressure may be in between a treatment pressure and a breakdown pressure. The chemical reaction may be an exothermic reaction that gives off heat. The energy needed to initiate the chemical reaction is less than the energy that is subsequently released by the chemical reaction.

The rate of the chemical reaction may be accelerated or retarded based on factors such as nature of the reactants, particle size of the reactants, concentration of the reactants, pressure of gaseous reactants, temperature and catalysts. According to a preferred exemplary embodiment, a catalyst may be added to the pressure mixing chamber to alter the rate of the reaction. The first composition chemical may be selected from a group comprising: mixture of aluminum, copper sulfate, potassium chlorate, and calcium sulfate, magnesium, magnesium-iron alloy, particulate oxide of an alkali or alkaline earth metal and a solid, particulate acid or strongly acid salt, or mixtures thereof. Similarly, the second composition chemical may be selected from a group comprising: NaCl, acetic acid, and water. The catalyst may be selected from a group comprising salts.

Exothermic compositions have been provided which are comprised of a particulate oxide of an alkali or alkaline earth metal and a solid, particulate acid or strongly acid salt, or mixtures thereof. The proportion of the alkaline and acidic reactants is selected so that at least an amount of the alkaline oxide reactant is present in the composition which, when converted to the corresponding hydroxide, will neutralize the acidic reactant. Advantageously, an excess of the oxide is employed in order to obtain higher temperature.

The exothermic reactants for the first composition may also be selected from a group comprising: quicklime, sodium hydroxide, cobalt, chromium, iron, iron hydroxide, magnesium, manganese, molybdenum, tin oxide (II), titanium, sodium, calcium hydroxide, sulfuric acid, nitric acid, metallic sodium, etc. Among them, a powder of magnesium chloride is preferable. The reactants are those generating an oxide reacting with oxygen at room temperature in the form of a revived metal having an exothermic characteristic. It is preferable to mix two or more metal powders. The reaction of magnesium chloride with water, avoids the use of either a strong acid or base.

A sealed cap (7714) may seal the exposed end of the chemical heating insert (7702) to physically protect the chemical heating insert (7702) from undesired wellbore conditions.

Figure 78:
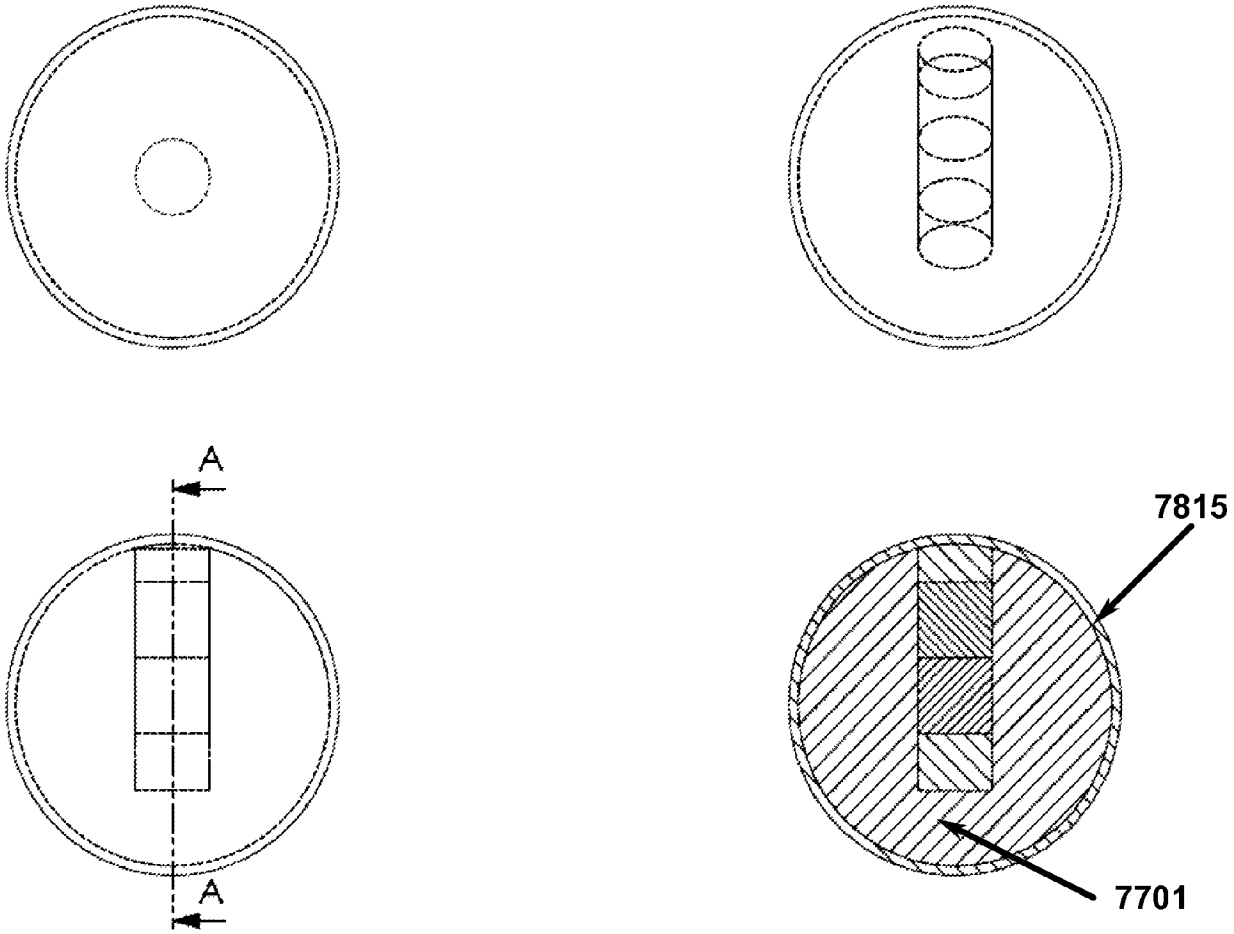
FIG. 78 illustrates a restrictive plug element surrounded by an insulating layer and integrated with a chemical heater according to a preferred exemplary system embodiment.

According to a preferred exemplary embodiment, the restriction plug element with the integrated chemical heating insert may further be surrounded by an insulating coating layer. As illustrated in FIG. 78, the insulating coating layer (7815) may surround the first composition to further control the rate of degradation of the first composition (7701). In one preferred exemplary embodiment, the insulator may be a ceramic, elastomer or plastic that surrounds the first composition and slows the rate at which the first composition changes phase, strength or elasticity.

According to another preferred exemplary embodiment, the restriction plug element with the integrated chemical heating insert may be used in conjunction with a restriction sleeve member, such that when in production the restriction plug element degrades or deforms and passes through the restriction sleeve member or a plurality of restriction sleeve members.

The first composition further may comprise a plurality of parts. Alternatively, the first composition is a solitary integral part. The heating insert may further provide structural integrity to the restriction plug element. When the chemical heating insert generates heat, the first composition may collapse and the restriction plug element may break into smaller parts. The restriction plug element may be have a shape that is selected from a group comprising: sphere, cylinder, or ovoid. When the chemical heating insert generates heat, the restriction plug element may deforms to enable the restriction plug element to pass through a restriction sleeve member in the wellbore casing. Alternatively, when the chemical heating insert generates heat, the restriction plug element reduces size to enable it to pass through a restriction sleeve member in the wellbore casing. The first composition may be selected from a group comprising plastics, non-degradable or long term degradable.

Exemplary Restriction Plug Element with an Integrated Cartridge (7900-8000)

Figure 79:
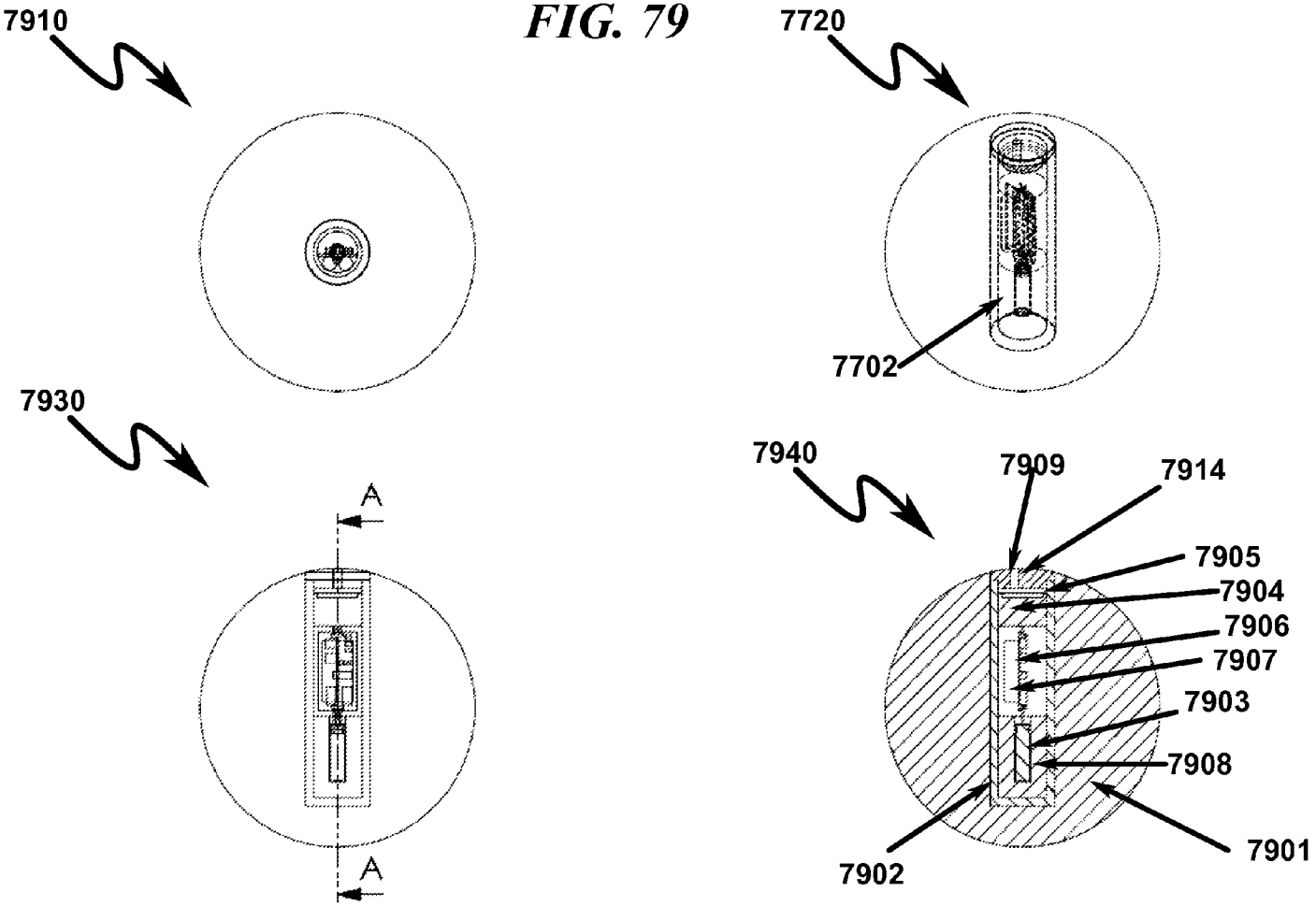
FIG. 79 illustrates a restrictive plug element with an integrated cartridge heater according to a preferred exemplary system embodiment.
Figure 80:
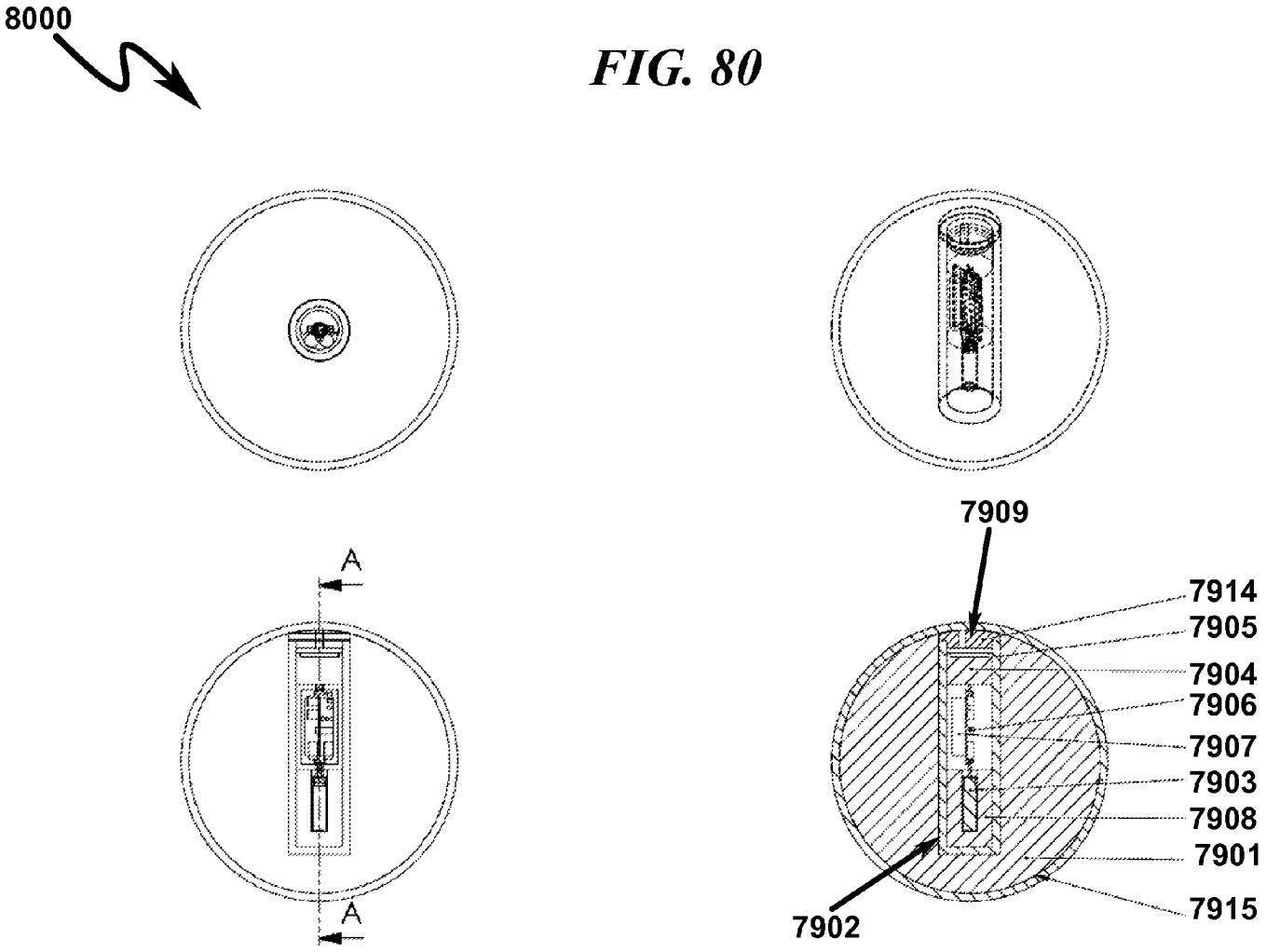
FIG. 80 illustrates a restrictive plug element surrounded by an insulating layer and integrated with a cartridge heater according to a preferred exemplary system embodiment.

An exemplary restrictive plug element with an integrated chemical heater may be generally illustrated in more detail in FIG. 79, wherein a restriction plug element (RPE) comprises a first composition (7901) surrounding a cartridge insert (7902). The RPE may be deployed into a wellbore casing for isolating pressure communication to toe end stages. A front view (7930), an end view (7910), a perspective view (7920) and cross section view (7940) is generally illustrated in detail in FIG. 75. The cartridge insert (7902) may comprise a combustible material (7908) housed in a cartridge housing (7905). The cartridge insert (7902) may be in pressure communication with the wellbore through a pressure switch (7904). The cartridge housing may be sealed by vented cap (7914) that has a vent (7909) used to communicate with the wellbore pressure. A circuit board (7906) with a power supply (7907) may be connected to the pressure switch (7904). The first composition (7901) may completely or partially surround the cartridge insert (7902). The first composition of RPEs of the present invention are designed for strength, rigidity and hardness sufficient to withstand the high pressure differentials required during well stimulation, which typically range from about 1,000 pounds per square inch (psi) to about 10,000 psi. The first composition material (7901) may be selected from material as aforementioned.

The cartridge insert (7902) is designed to withstand the temperatures during fracturing process, but trigger a heating process during the subsequent exposure to wellbore fluids. The trigger condition for the circuit board (7512) may be a pressure condition as detected by a pressure switch (7904). The pressure switch (7904) may activate a timer in the circuit board (7906) that enables a circuit to activate an energetic device (7903). The timer could be programmed prior to deploying the RPE into the wellbore casing. The energetic device (7903) may be an ignitor. A pressure activating device such as a reverse acting rupture disk may be part of the pressure switch (7904). The pressure switch (7904) may be activated when the pressure in the wellbore exceeds a rated pressure of the pressure activating device. After a ball is seated in a restriction sleeve member, the fracturing pressure may be ramped up to exceed the rated pressure of the pressure activating device. The rated pressure may be in between a treatment pressure and a breakdown pressure.

According to a preferred exemplary embodiment, an energetic device may initiate combustion of a combustible material that generates heat such that the first composition changes a physical property to deform or collapse the restriction plug element. The combustible material may be selected from a group comprising thermite, solid rocket propellant.

A sealed cap (7914) may seal the exposed end of the cartridge insert (7902) to physically protect the chemical heating insert (7902) from undesired wellbore conditions.

According to a preferred exemplary embodiment, the restriction plug element with the integrated cartridge insert may further be surrounded by an insulating coating layer. The insulating coating layer (8015) may surround the first composition to further control the rate of degradation of the first composition (7901). In one preferred exemplary embodiment, the insulator may be a ceramic, elastomer or plastic that surrounds the first composition and slows the rate at which the first composition changes phase, strength or elasticity.

According to another preferred exemplary embodiment, the restriction plug element with the integrated cartridge heating insert may be used in conjunction with a restriction sleeve member, such that when in production the restriction plug element degrades or deforms and passes through the restriction sleeve member or a plurality of restriction sleeve members.

The first composition further may comprise a plurality of parts. Alternatively, the first composition is a solitary integral part. The cartridge insert may further provide structural integrity to the restriction plug element. When the heating insert generates heat, the first composition may collapse and the restriction plug element may break into smaller parts. The restriction plug element may have a shape that is selected from a group comprising: sphere, cylinder, or ovoid. When the cartridge insert generates heat, the restriction plug element may deform to enable the restriction plug element to pass through a restriction sleeve member in the wellbore casing. Alternatively, when the cartridge insert generates heat, the restriction plug element reduces size to enable it to pass through a restriction sleeve member in the wellbore casing. The first composition may be selected from a group comprising plastics, non-degradable or long term degradable.

System Summary

The present invention system anticipates a wide variety of variations in the basic theme of extracting gas utilizing wellbore casings, but can be generalized as a wellbore isolation plug system comprising:

(a) restriction sleeve member (RSM); and (b) restriction plug element (RPE);

wherein the RSM is configured to fit within a wellbore casing;

the RSM is configured to be positioned at a desired wellbore location by a wellbore setting tool (WST);

the WST is configured to set and form a seal between the RSM and an inner surface of the wellbore casing to prevent substantial movement of the RSM; and the RPE is configured to position to seat in the RSM.

This general system summary may be augmented by the various elements described herein to produce a wide variety of invention embodiments consistent with this overall design description.

Method Summary

The present invention method anticipates a wide variety of variations in the basic theme of implementation, but can be generalized as a wellbore plug isolation method wherein the method is performed on a wellbore plug isolation system comprising:

(a) restriction sleeve member (RSM); and (b) restriction plug element (RPE);

wherein the RSM is configured to fit within a wellbore casing;

the RSM is configured to be positioned at a desired wellbore location by a wellbore setting tool (WST);

the WST is configured to set and form a seal between the RSM and an inner surface of the wellbore casing to prevent substantial movement of the RSM; and the RPE is configured to position to seat in the RSM;

wherein the method comprises the steps of:

(1) installing the wellbore casing;

(2) deploying the WST along with the RSM and a perforating gun string assembly (GSA) to a desired wellbore location in the wellbore casing;

(3) setting the RSM at the desired wellbore location with the WST and forming a seal;

(4) perforating the hydrocarbon formation with the perforating GSA;

(5) removing the WST and perforating GSA from the wellbore casing;

(6) deploying the RPE into the wellbore casing to seat in the RSM and creating a hydraulic fracturing stage;

(7) fracturing the stage with fracturing fluids;

(8) checking if all hydraulic fracturing stages in the wellbore casing have been completed, if not so, proceeding to the step (2);

(9) enabling fluid flow in production direction; and

(10) commencing oil and gas production from the hydraulic fracturing stages.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein said WST is further configured to form a conforming seating surface (CSS) in said RSM; and said RPE is configured in complementary shape to said CSS shape to seat to seat in said CSS.

An embodiment wherein a conforming seating surface (CSS) is machined in said RSM; and said RPE is configured in complementary shape to said CSS shape to seat to seat in said CSS.

An embodiment wherein the WST grips the RSM to the inside of the casing with gripping elements selected from a group consisting of: elastomers, carbide buttons, and wicker forms.

An embodiment wherein said RSM is degradable.

An embodiment wherein said RPE is degradable.

An embodiment wherein said RSM material is selected from a group consisting of: aluminum, iron, steel, titanium, tungsten, copper, bronze, brass, plastic, and carbide.

An embodiment wherein said RPE material is selected from a group consisting of: a metal, a non-metal, and a ceramic.

An embodiment wherein said RPE shape is selected from a group consisting of: a sphere, a cylinder, and a dart.

An embodiment wherein said wellbore casing comprises an inner casing surface (ICS) associated with an inner casing diameter (ICD);

said RSM comprises an inner sleeve surface (ISS) associated with an inner sleeve diameter (ISD); and ratio of said ISD to said ICD ranges from 0.5 to 0.99.

An embodiment wherein said plural RPEs are configured to create unevenly spaced hydraulic fracturing stages.

An embodiment wherein said RPE is not degradable;

said RPE remains in between RSMs; and fluid flow is enabled through flow channels the RSMs in production direction.

An embodiment wherein said RPE is not degradable; and said RPE is configured to pass through said RSMs in the production direction.

An embodiment wherein the WST sets the RSM to the inside surface of the wellbore casing at multiple points of the RSM.

An embodiment wherein said inner sleeve surface of said RSM comprises polished bore receptacle (PBR).

One skilled in the art will recognize that other embodiments are possible based on combinations of elements taught within the above invention description.

Restriction Plug Element System Summary

The present invention system anticipates a wide variety of variations in the basic theme of extracting gas utilizing wellbore casings, but can be generalized a restriction plug element (RPE) for use in a wellbore casing comprising a first composition and a heating insert wherein the heating insert is configured with heating source; the heating source is configured to generate heat; and when the heating source generates the heat, the first composition changes physical property such that the restriction plug element changes shape to enable substantially unrestricted fluid flow fluid flow in the wellbore casing during production.

This general system summary may be augmented by the various elements described herein to produce a wide variety of invention embodiments consistent with this overall design description.

Alternate Restriction Plug Element System Summary

The present invention system anticipates a wide variety of variations in the basic theme of extracting gas utilizing wellbore casings, but can be generalized as a restriction plug element in a wellbore isolation plug system comprising:

(a) restriction sleeve member (RSM); and (b) restriction plug element (RPE)

wherein the restriction sleeve member is configured to fit within a wellbore casing;

the restriction sleeve member is configured to be positioned at a wellbore location by a wellbore setting tool (WST);

the restriction plug element is configured to position to seat in the restriction sleeve member;

the restriction plug element comprises a first composition and a heating insert wherein the heating insert is configured with heating source; the heating source is configured to generate heat; and when the heating source generates the heat, the first composition changes physical property such that the restriction plug element changes shape to enable substantially unrestricted fluid flow fluid flow in the wellbore casing during production.

This general system summary may be augmented by the various elements described herein to produce a wide variety of invention embodiments consistent with this overall design description.

Restriction Plug Element Method Summary

The present invention method anticipates a wide variety of variations in the basic theme of implementation, but can be generalized as a wellbore plug isolation method wherein the method is performed on a wellbore plug isolation system with a restriction plug element comprises a first composition and a heating insert wherein the first composition is non-dissolvable at temperatures expected in the wellbore casing; the heating insert is configured with heating source; the heating source is configured to generate heat; and when the heating source generates the heat, the first composition changes physical property such that the restriction plug element changes shape to enable substantially unrestricted fluid flow fluid flow in the wellbore casing during production;

wherein the method comprises the steps of:

(1) checking if a restriction sleeve member (RSM) is present, if so, proceeding to step (3);

(2) setting a restriction sleeve member at a wellbore location in a wellbore casing;

(3) perforating a hydrocarbon formation with a perforating gun string assembly;

(4) deploying the restriction plug element into the wellbore casing to isolate toe end fluid communication and create a hydraulic fracturing stage;

(5) controlling a contact temperature of the restriction plug element to maintain physical property of the first composition;

(6) fracturing the fracturing stage with fracturing fluids;

(7) activating the heating element to generate heat so that the first composition undergoes a change in physical property and deforms;

(8) checking if all hydraulic fracturing stages in the wellbore casing have been completed, if not so, repeating steps (1) to (7); and (9) enabling fluid flow in production direction.

This general method summary may be augmented by the various elements described herein to produce a wide variety of invention embodiments consistent with this overall design description.

Restriction Plug Element System/Method Variations

The present invention anticipates a wide variety of variations in the basic theme of oil and gas extraction. The examples presented previously do not represent the entire scope of possible usages. They are meant to cite a few of the almost limitless possibilities. This basic system and method may be augmented with a variety of ancillary embodiments, including but not limited to:

An embodiment wherein the physical property is a phase of material of the first composition.

An embodiment wherein the physical property is strength of material of the first composition.

An embodiment wherein the physical property is elasticity of material of the first composition.

An embodiment wherein the heating insert is a resistive heating insert; the resistive heating insert comprises a resistive heating element and a voltage source; and the resistive heating element is configured to generate heat when the voltage source conducts current through the resistive heating element.

An embodiment wherein the heating insert is a chemical heating insert; the chemical heating insert comprises a first chemical composition, a second chemical composition and a mixing chamber; the first chemical composition and the second chemical composition are configured to react in the mixing chamber to generate heat.

An embodiment wherein the heating insert is a cartridge insert; the cartridge insert comprises an energetic device and a combustible material; the combustible material is configured to combust to generate heat.

An embodiment wherein the first composition further comprises a plurality of parts.

An embodiment wherein the first composition is a solitary integral part.

An embodiment wherein the heating insert is configured to provide structural integrity to the restriction plug element.

An embodiment wherein when the heating insert generates heat, the first composition collapses the restriction plug element into smaller parts.

An embodiment wherein a shape of the restriction plug element is selected from a group comprising: sphere, cylinder, or ovoid.

An embodiment wherein when the heating insert generates heat, the restriction plug element deforms to enable to pass through a restriction sleeve member in the wellbore casing.

An embodiment wherein when the heating insert generates heat, the restriction plug element reduces size to enable to pass through a restriction sleeve member in the wellbore casing.

An embodiment wherein the first composition is selected from a group comprising plastics, non-degradable or long term degradable.

CONCLUSION

A wellbore plug isolation system and method for positioning plugs to isolate fracture zones in a horizontal, vertical, or deviated wellbore has been disclosed. The system/method includes a wellbore casing laterally drilled into a hydrocarbon formation, a wellbore setting tool (WST) that sets a large inner diameter (ID) restriction sleeve member (RSM), and a restriction plug element (RPE). The RPE includes a first composition and a second composition that changes phase or strength under wellbore conditions. After a stage is perforated, RPEs are deployed to isolate toe ward pressure communication. The second composition changes phase to create flow channels in the RPE during production. In an alternate system/method, the second composition changes phase or strength thereby deforming the RPE to reduce size and pass through the RSM's. The RPEs are removed or left behind prior to initiating well production without the need for a milling procedure.

What is claimed is:

1. An apparatus for use in a wellbore casing, said apparatus comprising a restriction plug element (RPE), a heating insert and a seal cap; said heating insert contained within said restriction plug element and sealed with said seal cap; said apparatus substantially shaped as a sphere to enable said apparatus to be pumped into said wellbore casing; wherein said heating insert is configured with a heating source; said heating source configured to generate heat at a trigger condition expected in said wellbore casing; said heating insert is a resistive heating insert; said resistive heating insert comprises a resistive heating element and a voltage source; and said resistive heating element is configured to generate heat when said voltage source conducts current through said resistive heating element; whereby when said heating source generates said heat, a first composition in said restriction plug element changes physical property such that said restriction plug element changes shape to enable substantially unrestricted fluid flow in said wellbore casing during production; and said physical property selected from a group comprising: phase, strength, or elasticity.

2. The restriction plug element of claim 1 wherein said physical property is rate of degradation of material of said first composition.

3. The restriction plug element of claim 1 wherein said first composition further comprises a plurality of parts.

4. The restriction plug element of claim 1 wherein said first composition is a solitary integral part.

5. The restriction plug element of claim 1 wherein when said heating insert generates heat, said first composition collapses said restriction plug element into smaller parts.

6. The restriction plug element of claim 1 wherein when said heating insert generates heat, said restriction plug element deforms to enable to pass through a restriction sleeve member in said wellbore casing.

7. The restriction plug element of claim 1 wherein when said heating insert generates heat, said restriction plug element reduces size to enable to pass through a restriction sleeve member in said wellbore casing.

8. The restriction plug element of claim 1 wherein said first composition is selected from a group comprising plastics, non-degradable or long term degradable.

9. The restriction plug element of claim 1 wherein said trigger condition is a wellbore temperature expected in said wellbore casing.

10. The restriction plug element of claim 1 wherein said trigger condition is a wellbore pressure expected in said wellbore casing.

11. A wellbore plug isolation system comprising:

(a) restriction sleeve member (RSM); and (b) restriction apparatus wherein said restriction sleeve member is configured to fit within a wellbore casing;

said restriction sleeve member is configured to be positioned at a wellbore location by a wellbore setting tool (WST);

said restriction apparatus is configured to position to seat in said restriction sleeve member;

said restriction apparatus comprising a restriction plug element (RPE), a heating insert and a seal cap; said heating insert contained within said restriction plug element and sealed with said seal cap; said apparatus substantially shaped as a sphere to enable said apparatus to be pumped into said wellbore casing; wherein said heating insert is configured with a heating source; said heating source configured to generate heat at a trigger condition expected in said wellbore casing; said heating insert selected from a group consisting of: a cartridge insert, a chemical heating insert and a resistive heating insert; whereby when said heating source generates said heat, a first composition in said restriction plug element changes physical property such that said restriction plug element changes shape to enable substantially unrestricted fluid flow in said wellbore casing during production; and said physical property selected from a group comprising: phase, strength, or elasticity.

12. The wellbore plug isolation system of claim 11 wherein said trigger condition is a wellbore temperature expected in said wellbore casing.

13. A wellbore plug isolation method, said method operating in conjunction with an apparatus for use in a wellbore casing, said apparatus comprising a restriction plug element (RPE) a heating insert and a seal cap; said heating insert contained within said restriction plug element and sealed with said seal cap; said apparatus substantially shaped as a sphere to enable said apparatus to be pumped into said wellbore casing; wherein said heating insert is configured with a heating source; said heating source configured to generate heat at a trigger condition expected in said wellbore casing; said heating insert selected from a group consisting of: a cartridge insert, a chemical heating insert and a resistive heating insert;

wherein said method comprises the steps of:

(1) checking if a restriction sleeve member (RSM) is present, if so, proceeding to step (3);
(2) setting a restriction sleeve member at a wellbore location in a wellbore casing;
(3) perforating a hydrocarbon formation with a perforating gun string assembly;
(4) pumping said restriction plug element together with said heating insert into said wellbore casing to isolate toe end fluid communication and create a hydraulic fracturing stage;
(5) controlling a contact temperature of said restriction plug element to maintain physical property of said first composition;
(6) fracturing said fracturing stage with fracturing fluids;
(7) activating said heating element to generate heat so that said first composition undergoes a change in physical property and deforms;
(8) checking if all hydraulic fracturing stages in said wellbore casing have been completed, if not so, repeating steps (1) to (7); and
(9) enabling fluid flow in production direction.

14. The wellbore plug isolation method of claim 13 wherein said resistive heating insert comprises a resistive heating element and a voltage source; and said resistive heating element is configured to generate heat when said voltage source conducts current through said resistive heating element.

15. The wellbore plug isolation method of claim 13 wherein said chemical heating insert comprises a first chemical composition, a second chemical composition and a mixing chamber; said first chemical composition and said second chemical composition are configured to react in said mixing chamber to generate heat.

16. The wellbore plug isolation method of claim 13 wherein said cartridge insert comprises an energetic device and a combustible material; said combustible material is configured to combust to generate heat.

17. The wellbore plug isolation method of claim 13 wherein said first composition further comprises a plurality of parts.

18. The wellbore plug isolation method of claim 13 wherein said first composition is a solitary integral part.

19. The wellbore plug isolation method of claim 13 wherein when said heating insert generates heat, said first composition collapses said restriction plug element into smaller parts.

20. The wellbore plug isolation method of claim 13 wherein when said heating insert generates heat, said restriction plug element deforms to enable to pass through a restriction sleeve member in said wellbore casing.

21. The wellbore plug isolation method of claim 13 wherein said first composition is selected from a group comprising plastics, non-degradable or long term degradable.

22. The wellbore plug isolation method of claim 13 wherein said trigger condition is a wellbore temperature expected in said wellbore casing.

23. A wellbore isolation method, said method operating in conjunction with a restriction plug element (RPE), said restriction plug element comprises a first composition and a heating insert wherein said heating insert is configured with a heating source; said heating source configured to generate heat at a trigger condition expected in said wellbore casing; said heating insert selected from a group consisting of: a cartridge insert, a chemical heating insert and a resistive heating insert;

wherein said method comprises the steps of:

(1) pumping down said RPE together with said heating insert to a desired location and creating a hydraulic fracturing stage;
(2) generating heat in said heating source with said trigger condition;
(3) undergoing said physical property change in said first composition due to said heat and changing shape; and
(4) enabling substantially unrestricted fluid flow in a production direction.

24. The wellbore isolation method of claim 23 wherein said trigger condition is a wellbore temperature expected in said wellbore casing.

25. The wellbore plug isolation method of claim 23 wherein said resistive heating insert comprises a resistive heating element and a voltage source; and said resistive heating element is configured to generate heat when said voltage source conducts current through said resistive heating element.

26. The wellbore plug isolation method of claim 23 wherein said chemical heating insert comprises a first chemical composition, a second chemical composition and a mixing chamber; said first chemical composition and said second chemical composition are configured to react in said mixing chamber to generate heat.

27. The wellbore plug isolation method of claim 23 wherein said cartridge insert comprises an energetic device and a combustible material; said combustible material is configured to combust to generate heat.

28. An apparatus for use in a wellbore casing, said apparatus comprising a restriction plug element (RPE), a heating insert and a seal cap; said heating insert contained within said restriction plug element and sealed with said seal cap; said apparatus substantially shaped as a sphere to enable said apparatus to be pumped into said wellbore casing; wherein said heating insert is configured with a heating source; said heating source configured to generate heat at a trigger condition expected in said wellbore casing; said heating insert is a chemical heating insert; said chemical heating insert comprises a first chemical composition, a second chemical composition and a mixing chamber; said first chemical composition and said second chemical composition are configured to react in said mixing chamber to generate heat; whereby when said heating source generates said heat, a first composition in said restriction plug element changes physical property such that said restriction plug element changes shape to enable substantially unrestricted fluid flow in said wellbore casing during production; and said physical property selected from a group comprising: phase, strength, or elasticity.

29. An apparatus for use in a wellbore casing, said apparatus comprising a restriction plug element (RPE), a heating insert and a seal cap; said heating insert contained within said restriction plug element and sealed with said seal cap; said apparatus substantially shaped as a sphere to enable said apparatus to be pumped into said wellbore casing; wherein said heating insert is configured with a heating source; said heating source configured to generate heat at a trigger condition expected in said wellbore casing; said heating insert is a cartridge insert; said cartridge insert comprises an energetic device and a combustible material; said combustible material is configured to combust to generate heat; whereby when said heating source generates said heat, a first composition in said restriction plug element changes physical property such that said restriction plug element changes shape to enable substantially unrestricted fluid flow in said wellbore casing during production; and said physical property selected from a group comprising: phase, strength, or elasticity.

* * * * *